US009894732B2

(12) United States Patent
Xiong et al.

(10) Patent No.: US 9,894,732 B2
(45) Date of Patent: Feb. 13, 2018

(54) LED TUBE LAMP COMPATIBLE WITH DIFFERENT SOURCES OF EXTERNAL DRIVING SIGNAL

(71) Applicant: JIAXING SUPER LIGHTING ELECTRIC APPLIANCE CO., LTD, Jiaxing (CN)

(72) Inventors: Aiming Xiong, Jiaxing (CN); Xintong Liu, Jiaxing (CN); Xiaojia Wu, Jiaxing (CN); Hechen Hu, Jiaxing (CN)

(73) Assignee: Jiaxing Super Lighting Electric Appliance Co., Ltd., Jiaxing, Zhejiang (CN)

( * ) Notice: Subject to any disclaimer, the term of this patent is extended or adjusted under 35 U.S.C. 154(b) by 0 days.

(21) Appl. No.: 15/383,160

(22) Filed: Dec. 19, 2016

(65) Prior Publication Data

US 2017/0164434 A1 Jun. 8, 2017

Related U.S. Application Data

(63) Continuation of application No. 15/065,892, filed on Mar. 10, 2016, now Pat. No. 9,526,145, which is a (Continued)

(30) Foreign Application Priority Data

Oct. 17, 2014 (CN) ..... 2014 2 0602526
Feb. 15, 2015 (CN) ..... 2016 1 0085895
(Continued)

(51) Int. Cl.
*H05B 37/00* (2006.01)
*H05B 41/00* (2006.01)
(Continued)

(52) U.S. Cl.
CPC ..... *H05B 33/089* (2013.01); *F21K 9/278* (2016.08); *H05B 33/0815* (2013.01);
(Continued)

(58) Field of Classification Search
None
See application file for complete search history.

(56) References Cited

U.S. PATENT DOCUMENTS 5,936,599 A 8/1999 Reymond
7,380,961 B2 6/2008 Moriyama et al.
(Continued)

FOREIGN PATENT DOCUMENTS

CN 200965185 10/2007
CN 101715265 5/2010
(Continued)

*Primary Examiner* — Anh Tran
(74) *Attorney, Agent, or Firm* — Muir Patent Law, PLLC

(57) ABSTRACT

An LED tube lamp is provided. The LED tube lamp includes a lamp tube having at least two external connection terminals, for receiving an external driving signal; a rectifying circuit for rectifying the external driving signal to produce a rectified signal; an LED lighting module comprising an LED module, for emitting light; and a ballast interface circuit coupled between the external connection terminals and the LED lighting module, and comprising a detection circuit configured to determine whether the external driving signal is a high frequency or high voltage signal according to the frequency or voltage level of the rectified signal, wherein the ballast interface circuit is configured such that when the external driving signal is determined to be a high frequency or high voltage signal, the ballast interface circuit causes current conduction in the LED module for emitting light.

42 Claims, 43 Drawing Sheets

Related U.S. Application Data continuation-in-part of application No. 14/865,387, filed on Sep. 25, 2015, now Pat. No. 9,609,711, application No. 15/383,160, which is a continuation-in-part of application No. 15/211,813, filed on Jul. 15, 2016, now Pat. No. 9,756,698, which is a continuation-in-part of application No. 14/865,387, filed on Sep. 25, 2015, now Pat. No. 9,609,711, and a continuation-in-part of application No. 15/150,458, filed on May 10, 2016, now Pat. No. 9,794,990, application No. 15/383,160, which is a continuation-in-part of application No. 15/150,458, filed on May 10, 2016, now Pat. No. 9,794,990, which is a continuation-in-part of application No. 14/699,138, filed on Apr. 29, 2015, now Pat. No. 9,480,109.

(30) Foreign Application Priority Data

| | | |
|---|---|---|
| Mar. 10, 2015 | (CN) | 2015 1 0104823 |
| Mar. 25, 2015 | (CN) | 2015 1 0133689 |
| Mar. 26, 2015 | (CN) | 2015 1 0134586 |
| Apr. 3, 2015 | (CN) | 2015 1 0155807 |
| Apr. 14, 2015 | (CN) | 2015 1 0173861 |
| Apr. 22, 2015 | (CN) | 2015 1 0193980 |
| May 19, 2015 | (CN) | 2015 1 0259151 |
| May 22, 2015 | (CN) | 2015 1 0268927 |
| May 29, 2015 | (CN) | 2015 1 0284720 |
| Jun. 10, 2015 | (CN) | 2015 1 0315636 |
| Jun. 12, 2015 | (CN) | 2015 1 0324394 |
| Jun. 17, 2015 | (CN) | 2015 1 0338027 |
| Jun. 26, 2015 | (CN) | 2015 1 0364735 |
| Jun. 26, 2015 | (CN) | 2015 1 0372375 |
| Jun. 26, 2015 | (CN) | 2015 1 0373492 |
| Jun. 29, 2015 | (CN) | 2015 1 0378322 |
| Jul. 2, 2015 | (CN) | 2015 1 0391910 |
| Jul. 10, 2015 | (CN) | 2015 1 0406595 |
| Jul. 20, 2015 | (CN) | 2015 1 0428680 |
| Aug. 7, 2015 | (CN) | 2015 1 0482944 |
| Aug. 8, 2015 | (CN) | 2015 1 0483475 |
| Aug. 8, 2015 | (CN) | 2015 1 0486115 |
| Aug. 26, 2015 | (CN) | 2015 1 0530110 |
| Sep. 2, 2015 | (CN) | 2015 1 0555543 |
| Sep. 6, 2015 | (CN) | 2015 1 0557717 |
| Sep. 18, 2015 | (CN) | 2015 1 0595173 |
| Oct. 29, 2015 | (CN) | 2015 1 0724135 |
| Jan. 22, 2016 | (CN) | 2016 1 0043864 |
| May 27, 2016 | (CN) | 2016 1 0363805 |
| Oct. 28, 2016 | (CN) | 2016 1 0969680 |

(51) Int. Cl.

| | |
|---|---|
| ***H05B 33/08*** | (2006.01) |
| ***F21K 9/278*** | (2016.01) |
| *F21Y 115/10* | (2016.01) |
| *F21Y 103/10* | (2016.01) |
| *F21K 9/272* | (2016.01) |
| *F21K 9/275* | (2016.01) |
| *F21V 29/83* | (2015.01) |
| *F21V 15/015* | (2006.01) |
| *F21V 7/22* | (2018.01) |
| *F21V 3/02* | (2006.01) |

(52) U.S. Cl.

CPC ..... *H05B 33/0845* (2013.01); *F21K 9/272* (2016.08); *F21K 9/275* (2016.08); *F21V 3/02* (2013.01); *F21V 7/22* (2013.01); *F21V 15/015* (2013.01); *F21V 29/83* (2015.01); *F21Y 2103/10* (2016.08); *F21Y 2115/10* (2016.08)

(56) References Cited

U.S. PATENT DOCUMENTS

| | | | | |
|---|---|---|---|---|
| 8,525,427 | B2 | 9/2013 | Samoilenko et al. | |
| 8,648,542 | B2 | 2/2014 | Kim et al. | |
| 8,796,943 | B2 | 2/2014 | Miyamichi | |
| 8,749,167 | B2 | 6/2014 | Hsia et al. | |
| 9,210,744 | B2 | 12/2015 | Carmen et al. | |
| 9,480,109 | B2 | 10/2016 | Ye et al. | |
| 9,497,821 | B2 | 11/2016 | Liu | |
| 9,521,718 | B2 | 12/2016 | Xiong et al. | |
| 9,526,145 | B2 | 12/2016 | Xiong et al. | |
| 9,587,817 | B2 | 3/2017 | Liu et al. | |
| 9,609,711 | B2 | 3/2017 | Jiang et al. | |
| 9,629,211 | B2 | 4/2017 | Xiong et al. | |
| 9,629,215 | B2 | 4/2017 | Xiong et al. | |
| 9,629,216 | B2 | 4/2017 | Jiang et al. | |
| 9,689,536 | B2 | 6/2017 | Xiong et al. | |
| 2002/0176262 | A1 | 11/2002 | Tripathi | |
| 2003/0102819 | A1 | 6/2003 | Min | |
| 2007/0127242 | A1 | 6/2007 | Allen et al. | |
| 2010/0096976 | A1 | 4/2010 | Park | |
| 2010/0102729 | A1 | 4/2010 | Katzir | |
| 2010/0181925 | A1 | 7/2010 | Ivey et al. | |
| 2010/0220469 | A1 | 9/2010 | Ivey et al. | |
| 2011/0043127 | A1 | 2/2011 | Yamasaki | |
| 2011/0057572 | A1 | 3/2011 | Kit et al. | |
| 2011/0121756 | A1 | 5/2011 | Thomas et al. | |
| 2011/0148313 | A1 | 6/2011 | Ramaker | |
| 2011/0149563 | A1 | 6/2011 | Hsia et al. | |
| 2011/0176297 | A1 | 7/2011 | Hsia et al. | |
| 2011/0181190 | A1 | 7/2011 | Lin et al. | |
| 2011/0228526 | A1 | 9/2011 | Hartikka et al. | |
| 2011/0260614 | A1 | 10/2011 | Hartikka et al. | |
| 2012/0181952 | A1 | 7/2012 | Rooer | |
| 2012/0299501 | A1 | 11/2012 | Kost et al. | |
| 2012/0300445 | A1 | 11/2012 | Chu et al. | |
| 2012/0313540 | A1 | 12/2012 | Lin | |
| 2013/0127327 | A1 | 5/2013 | Heil et al. | |
| 2013/0147350 | A1 | 6/2013 | Yang | |
| 2013/0313983 | A1 | 11/2013 | Radermacher | |
| 2013/0320869 | A1 | 12/2013 | Jans | |
| 2013/0335959 | A1 | 12/2013 | Hsia et al. | |
| 2014/0035463 | A1 | 2/2014 | Miyamichi | |
| 2014/0055029 | A1 | 2/2014 | Jans | |
| 2014/0062320 | A1* | 3/2014 | Urano | H05B 33/0815 315/186 |
| 2014/0117853 | A1* | 5/2014 | Miyamichi | H05B 33/0815 315/119 |
| 2014/0239827 | A1 | 8/2014 | Park | |
| 2014/0239834 | A1 | 8/2014 | Choi et al. | |
| 2014/0265900 | A1 | 9/2014 | Sadwick et al. | |
| 2015/0077001 | A1 | 3/2015 | Takahashi | |
| 2015/0173138 | A1 | 6/2015 | Roberts | |
| 2015/0176770 | A1 | 6/2015 | Wilcox et al. | |
| 2015/0351171 | A1 | 12/2015 | Tao et al. | |
| 2015/0366008 | A1 | 12/2015 | Barnetson et al. | |
| 2016/0081147 | A1 | 3/2016 | Guang | |
| 2016/0198535 | A1 | 7/2016 | Ye et al. | |
| 2016/0219658 | A1 | 7/2016 | Xiong et al. | |
| 2016/0255699 | A1 | 9/2016 | Ye et al. | |
| 2016/0270163 | A1 | 9/2016 | Hu et al. | |
| 2016/0270164 | A1 | 9/2016 | Xiong et al. | |
| 2016/0270165 | A1 | 9/2016 | Xiong et al. | |
| 2016/0270166 | A1 | 9/2016 | Xiong et al. | |
| 2016/0270173 | A1 | 9/2016 | Xiong | |
| 2016/0270184 | A1 | 9/2016 | Xiong et al. | |
| 2016/0286621 | A1* | 9/2016 | Tao | H05B 33/0887 |
| 2016/0309550 | A1 | 10/2016 | Xiong et al. | |
| 2016/0381746 | A1 | 12/2016 | Ye et al. | |
| 2016/0381760 | A1 | 12/2016 | Xiong et al. | |
| 2017/0067627 | A1 | 3/2017 | Liu et al. | |
| 2017/0094736 | A1 | 3/2017 | Xiong et al. | |
| 2017/0094746 | A1 | 3/2017 | Xiong et al. | |

(56) References Cited

U.S. PATENT DOCUMENTS

| | | | |
|---|---|---|---|
| 2017/0102114 | A1 | 4/2017 | Xiong et al. |
| 2017/0105263 | A1 | 4/2017 | Xiong et al. |
| 2017/0159923 | A1 | 6/2017 | Liu et al. |
| 2017/0164434 | A1 | 6/2017 | Xiong et al. |
| 2017/0181239 | A1 | 6/2017 | Xiong et al. |

FOREIGN PATENT DOCUMENTS

| | | | |
|---|---|---|---|
| CN | 102155642 | | 8/2011 |
| CN | 102355780 | | 2/2012 |
| CN | 102932997 | | 2/2013 |
| CN | 104735873 | | 6/2015 |
| CN | 106015996 | A | 10/2016 |
| EP | 2914065 | | 9/2015 |
| GB | 2533683 | | 6/2016 |
| WO | WO2012139691 | | 10/2012 |
| WO | WO2013150417 | A1 | 10/2013 |
| WO | WO2014206785 | A1 | 12/2014 |
| WO | WO2015028329 | A1 | 3/2015 |
| WO | WO2015028639 | A1 | 3/2015 |
| WO | WO2015/066566 | A1 | 5/2015 |
| WO | WO2015074917 | | 5/2015 |
| WO | WO2017012514 | A1 | 1/2017 |

* cited by examiner

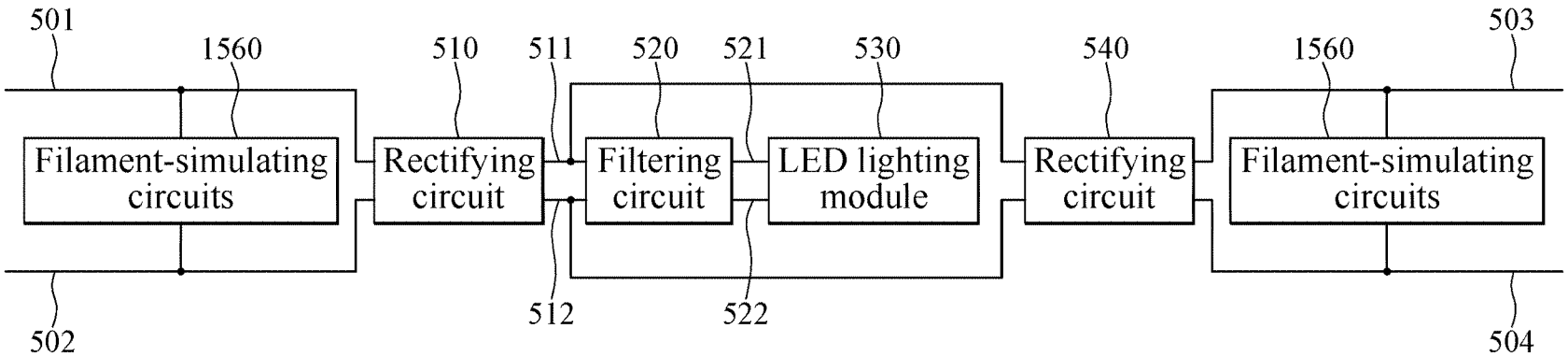
FIG.59A
FIG.59B
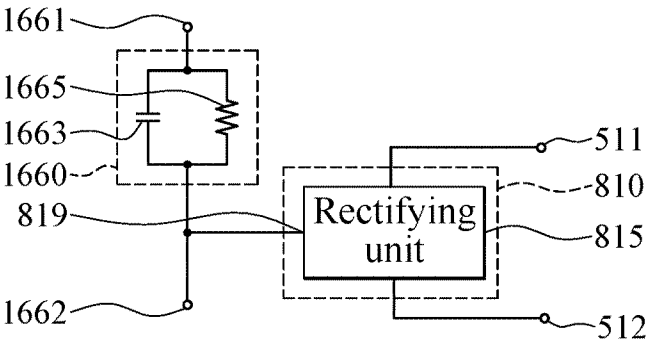
FIG.59C

LED TUBE LAMP COMPATIBLE WITH DIFFERENT SOURCES OF EXTERNAL DRIVING SIGNAL

CROSS-REFERENCE TO RELATED APPLICATIONS

The present application is a Continuation-In-Part application of U.S. patent application Ser. No. 15/065,892, filed Mar. 10, 2016, the contents of which are incorporated herein by reference in their entirety, and which is a Continuation-In-Part application of U.S. patent application Ser. No. 14/865,387, filed Sep. 25, 2015, the contents of which are incorporated herein by reference in their entirety, and which claims the benefit of priority under 35 U.S.C. § 119 to the following Chinese Patent Applications, filed with the State Intellectual Property Office (SIPO), the contents of each of which are incorporated herein by reference in their entirety: CN201510104823.3 filed Mar. 10, 2015; CN201510133689.x filed Mar. 25, 2015; CN201510134586.5 filed Mar. 26, 2015; CN201510155807.7 filed Apr. 3, 2015; CN201510173861.4 filed Apr. 14, 2015; CN201510193980.6 filed Apr. 22, 2015; CN 201510259151.3 filed on May 19, 2015; CN 201510268927.8 filed on May 22, 2015; CN201510284720.x filed May 29, 2015; CN 201510315636.x filed on Jun. 10, 2015; CN201510338027.6 filed Jun. 17, 2015; CN 201510364735.7 filed on Jun. 26, 2015; CN 201510372375.5 filed on Jun. 26, 2015; CN201510373492.3 filed Jun. 26, 2015; CN 201510378322.4 filed on Jun. 29, 2015; CN 201510391910.1 filed on Jul. 2, 2015; CN 201510406595.5 filed on Jul. 10, 2015; CN 201510428680.1 filed on Jul. 20, 2015; CN201510482944.1 filed Aug. 7, 2015; CN201510486115.0 filed Aug. 8, 2015; CN201510483475.5 filed Aug. 8, 2015; CN201510555543.4 filed Sep. 2, 2015; CN201510557717.0 filed Sep. 6, 2015; CN201510595173.7 filed Sep. 18, 2015.

U.S. patent application Ser. No. 15/065,892 further claims the benefit of priority under 35 U.S.C. § 119 to the following Chinese Patent Applications, filed with the State Intellectual Property Office (SIPO), the contents of each of which are incorporated herein by reference in their entirety: CN201510324394.0 filed Jun. 12, 2015; CN201510530110.3 filed Aug. 26, 2015; CN201510724135.7 filed Oct. 29, 2015; and CN201610085895.2 filed Feb. 15, 2016.

The present application is also a Continuation-In-Part application of U.S. patent application Ser. No. 15/211,813, filed Jul. 15, 2016, the contents of which are incorporated herein by reference in their entirety, and which is a Continuation-In-Part application of U.S. patent application Ser. No. 14/865,387, filed Sep. 25, 2015 and is a Continuation-In-Part application of U.S. patent application Ser. No. 15/150,458, filed May 10, 2016, the contents of each of which are incorporated herein by reference in their entirety. U.S. patent application Ser. No. 15/211,813, filed Jul. 15, 2016 also claims priority under 35 U.S.C. § 119 to the following Chinese Patent Applications, filed with the State Intellectual Property Office (SIPO), the contents of each of which are incorporated herein by reference in their entirety: CN201510724135.7, filed Oct. 29, 2015, and 201610043864.0, filed Jan. 22, 2016.

This application is also a Continuation-In-Part application of U.S. patent application Ser. No. 15/150,458, filed May 10, 2016, which is a Continuation-In-Part application of U.S. patent application Ser. No. 14/699,138, filed Apr. 29, 2015, which claims priority to Chinese Patent Application No.: CN 201420602526.2, filed Oct. 17, 2014, the contents of each of which are incorporated by reference herein in their entirety.

The present application also claims the benefit of priority under 35 U.S.C. § 119 to the following Chinese Patent Applications, filed with the State Intellectual Property Office (SIPO), the contents of each of which are incorporated herein by reference in their entirety: CN 201610969680.7, filed on Oct. 28, 2016 and CN 201610363805.1, filed on May 27, 2016.

If any terms in this application conflict with terms used in any application(s) to which this application claims priority, or terms incorporated by reference into this application or the application(s) to which this application claims priority, a construction based on the terms as used or defined in this application should be applied.

BACKGROUND

Technical Field

The embodiments of the present disclosure relate to illumination devices, and more particularly to an LED tube lamp compatible with different power sources, and its components including light sources, electronic components, and end caps.

Related Art

LED ("light emitting diode") lighting technology is rapidly developing to replace traditional incandescent and fluorescent lighting. LED tube lamps are mercury-free in comparison with fluorescent tube lamps that need to be filled with inert gas and mercury. Thus, it is not surprising that LED tube lamps are becoming a highly desired illumination option among different available lighting systems used in homes and workplaces, which used to be dominated by traditional lighting options such as compact fluorescent light bulbs (CFLs) and fluorescent tube lamps. Benefits of LED tube lamps include improved durability and longevity and far less energy consumption; therefore, when considering all factors, they would typically be considered as a cost-effective lighting option.

Electrical ballast is a broader category of ballast that can encompass for example electronic ballast, inductive ballast, and/or emergency ballast. More specifically, common main types of electronic ballast include instant-start ballast and programmed-start ballast. Electrical ballast typically includes a resonant circuit and is designed to match the loading characteristics of a fluorescent lamp in driving the fluorescent lamp. For example, for properly starting a fluorescent lamp, the electrical ballast provides driving methods respectively corresponding to the fluorescent lamp working as a capacitive device before emitting light, and working as a resistive device upon emitting light. But an LED is a nonlinear component with significantly different characteristics from a fluorescent lamp. Therefore, using an LED tube lamp with an electrical ballast impacts the resonant circuit design of the electronic ballast, which may cause a compatibility problem. Generally, a programmed-start ballast detects the presence of a filament in a fluorescent lamp, but traditional LED driving circuits cannot support such detection and may cause a failure of a filament detection and thus may fail to start the LED tube lamp. Further, electrical ballast is in effect a current source, and when it acts as a power supply of a DC-to-DC converter circuit in an LED tube lamp, problems of overvoltage and overcurrent or undervoltage and undercurrent are likely to occur, resulting in damaging of electronic components in the LED tube lamp or unstable provision of lighting by the LED tube lamp.

Further, the driving of an LED uses a DC driving signal, but the driving signal for a fluorescent lamp is a low-frequency, low-voltage AC signal as provided by an AC power line or an inductive ballast, a high-frequency, high-voltage AC signal provided by an electronic ballast, or even a DC signal provided by a battery for emergency lighting applications. Since the voltages and frequency spectrums of these types of signals differ significantly, simply performing a rectification to produce the required DC driving signal in an LED tube lamp is typically not competent at achieving the LED tube lamp's compatibility with traditional driving systems of a fluorescent lamp.

In addition, conventional fluorescent lamps and LED lamps are not equipped with advanced abilities both to regulate their electrical currents for better qualities or functions and to be compatible with various types of ballasts avoiding typical needs to find a suitable lamp when the fluorescent or LED lamp is not compatible with a present type of ballast. So, there are needs for an improved LED tube lamp which is compatible or can be used with, or can be supplied by, any of different power sources of external driving signal, including, e.g., an AC power line, an electrical ballast, and a DC power source.

Accordingly, the prevent disclosure and its embodiments are herein provided.

SUMMARY

The present disclosure may actually include one or more inventions claimed currently or not yet claimed, and for avoiding confusion due to unnecessarily distinguishing between those possible inventions at the stage of preparing the specification, the possible plurality of inventions herein may be collectively referred to as "the (present) invention" herein.

Various embodiments are summarized in this section, and are described with respect to the "present invention," which terminology is used to describe certain presently disclosed embodiments, whether claimed or not, and is not necessarily an exhaustive description of all possible embodiments, but rather is merely a summary of certain embodiments. Certain of the embodiments described below as various aspects of the "present invention" can be combined in different manners to form an LED tube lamp or a portion thereof.

The present disclosure provides a novel LED tube lamp, and aspects thereof.

An aspect of the present disclosure provides an LED tube lamp, comprising a lamp tube having at least two external connection terminals for the lamp tube, for receiving an external driving signal; a rectifying circuit for rectifying the external driving signal to produce a rectified signal; an LED lighting module comprising an LED module, for emitting light; and a ballast interface circuit coupled between the external connection terminals and the LED lighting module, and comprising a detection circuit configured to determine whether the external driving signal is a high frequency or high voltage signal according to the frequency or voltage level of the rectified signal, wherein the ballast interface circuit is configured such that when the external driving signal is determined to be a high frequency or high voltage signal, the ballast interface circuit causes current conduction in the LED module for emitting light.

In various embodiments, the external driving signal is from an electronic ballast, an inductive ballast, an AC power line, or a DC power source.

In an embodiment, the ballast interface circuit further comprises an electronic switch coupled to the detection circuit, and the detection circuit comprises a voltage detection circuit coupled to the electronic switch; and the voltage detection circuit is configured to determine whether the external driving signal is a high frequency or high voltage signal according to the voltage level of the rectified signal, in order to control current conduction or cutoff of the electronic switch, wherein the current conduction causes current conduction in the LED module and the cutoff causes an open circuit for the LED module.

In another embodiment, the ballast interface circuit further comprises an electronic switch coupled to the detection circuit, and the detection circuit comprises a frequency determination circuit coupled to the electronic switch; and the frequency determination circuit is configured to determine whether the external driving signal is a high frequency or high voltage signal according to the frequency of the rectified signal, in order to control current conduction or cutoff of the electronic switch, wherein the current conduction causes current conduction in the LED module and the cutoff causes an open circuit in the LED module.

In still another embodiment, the ballast interface circuit further comprises a circuit branch coupled to the detection circuit, and the detection circuit comprises a control circuit and an electronic switch; the circuit branch is configured to detect the voltage level of the rectified signal and then generate a detection signal; and the control circuit is configured to determine whether the external driving signal is a high frequency or high voltage signal according to the detection signal, and to control current conduction or cutoff of the electronic switch, wherein the current conduction causes current conduction in the LED module and the cutoff causes an open circuit in the LED module.

In one embodiment, the detection circuit comprises a thyristor, which is configured to conduct current or be cutoff depending on the voltage level of the rectified signal; and when the external driving signal is determined to be a high frequency or high voltage signal, the thyristor is configured to conduct current after a predefined delay of time upon the external driving signal being input to the LED tube lamp.

In some embodiments, the detection circuit determines that the external driving signal is a high frequency or high voltage signal when determining that the voltage level of the rectified signal is higher than a predefined first threshold level; the ballast interface circuit causes an open circuit in the LED module when the detection circuit determines that the voltage level of the rectified signal is higher than a predefined second level but lower than the predefined first threshold level, wherein the predefined first threshold level is higher than the predefined second threshold level; and the ballast interface circuit causes current conduction in the LED module when the detection circuit determines that the voltage level of the rectified signal is lower than the second predefined threshold level.

In one embodiment, the detection circuit comprises a thyristor device coupled between the rectifying circuit and the LED module; and when the external driving signal is determined to be a high frequency or high voltage signal, the thyristor device is configured to conduct current after a predefined delay of time upon the external driving signal being input to the LED tube lamp.

Another aspect of the present disclosure provides an LED tube lamp, comprising a lamp tube having at least two external connection terminals, for receiving an external driving signal; a rectifying circuit for rectifying the external driving signal to produce a rectified signal; an LED lighting module comprising an LED module, for emitting light; and a ballast detection circuit coupled to the rectifying circuit and comprising a detection circuit configured to determine whether the external driving signal is a high frequency signal according to the frequency of the external driving signal, wherein the ballast detection circuit is configured such that when the external driving signal is determined to be a high frequency signal, the ballast detection circuit allows transmission of the external driving signal to the LED lighting module through the detection circuit or circuit external to the ballast detection circuit; and when the external driving signal is determined to be a low frequency signal the ballast detection circuit allows transmission of the external driving signal to the LED lighting module by bypassing the detection circuit.

In various embodiments, the external driving signal is from or provided by an electronic ballast, an inductive ballast, an AC power line, or a DC power source.

In one embodiment, the ballast detection circuit further comprises a switch circuit connected to the detection circuit and controlled by the detection circuit; when the external driving signal is determined to be a high frequency signal, the switch circuit is cutoff to allow transmission of the external driving signal through a circuit connected in parallel with the switch circuit, or a circuit external to the ballast detection circuit; and when the external driving signal is determined to be a low frequency signal the switch circuit conducts current for transmission of the external driving signal bypassing the circuit connected in parallel with the switch circuit.

In another embodiment, the LED lighting module further comprises a driving circuit for driving the LED module, the ballast detection circuit further comprises a mode switching circuit, and the detection circuit is configured to produce a control signal, according to the frequency of the external driving signal, to control the mode switching circuit on whether to perform a first mode of lighting operation or a second mode of lighting operation. When the mode switching circuit performs the first mode of lighting operation, the driving circuit receives the rectified signal and drives the LED module. And when the mode switching circuit performs the second mode of lighting operation, transmission of the rectified signal bypasses at least some components of the driving circuit in order to drive the LED module.

In still another embodiment, the detection circuit comprises a frequency determination circuit, the ballast detection circuit further comprises a switch circuit connected to the detection circuit, and the frequency determination circuit is configured to control current conduction or cutoff of the switch circuit according to the frequency of the external driving signal. When the external driving signal is determined to be a high frequency signal, the switch circuit is cutoff, and when the external driving signal is determined to be a low frequency signal the switch circuit conducts current.

In some embodiments, the frequency determination circuit comprises a capacitor coupled between an input and an output terminals of the ballast detection circuit. When the external driving signal is determined to be a high frequency signal, a low voltage produced by the capacitor causes the switch circuit to be cutoff. And when the external driving signal is determined to be a low frequency or DC signal, a high voltage produced by the capacitor causes the switch circuit to conduct current.

In some embodiments, the frequency determination circuit comprises a first inductor and a second inductor; and the first inductor is coupled to the at least two external connection terminals, and is configured to induce a detection voltage in the second inductor by mutual induction based on a current through the first inductor upon the external driving signal being input to the LED tube lamp. When the external driving signal is determined to be a high frequency signal, a high level detection voltage produced by the second inductor causes the switch circuit to be cutoff. And when the external driving signal is determined to be a low frequency or DC signal, a low detection voltage produced by the second inductor causes the switch circuit to conduct current.

Still another aspect of the present disclosure provides an LED tube lamp, comprising a lamp tube having at least two external connection terminals, for receiving an external driving signal; a rectifying circuit for rectifying the external driving signal to produce a rectified signal; an LED lighting module comprising a driving circuit and an LED module for emitting light, the driving circuit for driving the LED module; and a mode determination circuit coupled to the driving circuit and configured to determine whether the external driving signal is a high frequency or high voltage signal according to the frequency or voltage level of the rectified signal, wherein the mode determination circuit is configured such that when the external driving signal is determined to be a high frequency or high voltage signal, the mode determination circuit allows transmission of the rectified signal to the LED module by bypassing at least some components of the driving circuit; and when the external driving signal is determined to be a low frequency or low voltage signal the mode determination circuit allows the driving circuit to receive the rectified signal and drive the LED module.

In various embodiments, the external driving signal is from or provided by an electronic ballast, an inductive ballast, an AC power line, or a DC power source.

In some embodiments, the LED tube lamp further comprises a mode switching circuit coupled to the mode determination circuit and the driving circuit, and the mode determination circuit comprises a voltage determination circuit configured to control, according to the voltage level of the external driving signal, the mode switching circuit on whether to perform a first mode of lighting operation or a second mode of lighting operation. When the mode switching circuit performs the first mode of lighting operation, the driving circuit receives the rectified signal and drives the LED module. And when the mode switching circuit performs the second mode of lighting operation, transmission of the rectified signal bypasses at least some components of the driving circuit in order to drive the LED module.

In an embodiment, the voltage determination circuit comprises a symmetrical trigger diode coupled to a resistor, and the symmetrical trigger diode is configured to receive the rectified signal to generate a determination result signal at a connection node between the symmetrical trigger diode and the resistor.

In some embodiments, the LED tube lamp further comprises a mode switching circuit coupled to the mode determination circuit and the driving circuit, and the mode determination circuit comprises a frequency determination circuit configured to control, according to the frequency of the external driving signal, the mode switching circuit on whether to perform a first mode of lighting operation or a second mode of lighting operation. When the mode switching circuit performs the first mode of lighting operation, the driving circuit receives the rectified signal and drives the LED module. And when the mode switching circuit performs the second mode of lighting operation, transmission of the rectified signal bypasses at least some components of the driving circuit in order to drive the LED module.

In at least the three aspects of the present disclosure, further features and limitations in the elements of the claimed invention and/or in addition to the recited features and limitations above may be present in various embodiments, according to and consistent with the terms of the claims of the present disclosure.

BRIEF DESCRIPTION OF THE DRAWINGS

FIG. 59A is a block diagram of an LED tube lamp according to some embodiments;

FIG. 59B is a schematic diagram of a filament-simulating circuit according to some embodiments;

FIG. 59C is a schematic block diagram including a filament-simulating circuit according to some embodiments;

FIG. 60C is a schematic diagram of an OVP circuit according to an embodiment;

FIG. 61A is a block diagram of a power supply module in an LED tube lamp according to some embodiments;

FIG. 61B is a block diagram of an LED tube lamp according to some embodiments;

FIG. 61C is a block diagram of a ballast detection circuit according to some embodiments;

FIG. 61D is a schematic diagram of a ballast detection circuit according to some embodiments;

FIG. 61E is a schematic diagram of a ballast detection circuit according to some embodiments;

FIG. 62 is a block diagram of a power supply module in an LED tube lamp according to some embodiments;

FIG. 63A is a plan view of a circuit substrate for disposing a chip capacitor in an LED tube lamp according to some embodiments;

FIG. 63B is a plan view of a circuit substrate for disposing a chip capacitor in LED tube lamp according to an embodiment; and FIG. 63C is a plan view of a circuit substrate for disposing a chip capacitor in LED tube lamp according to an embodiment.

DETAILED DESCRIPTION

Figure 1:
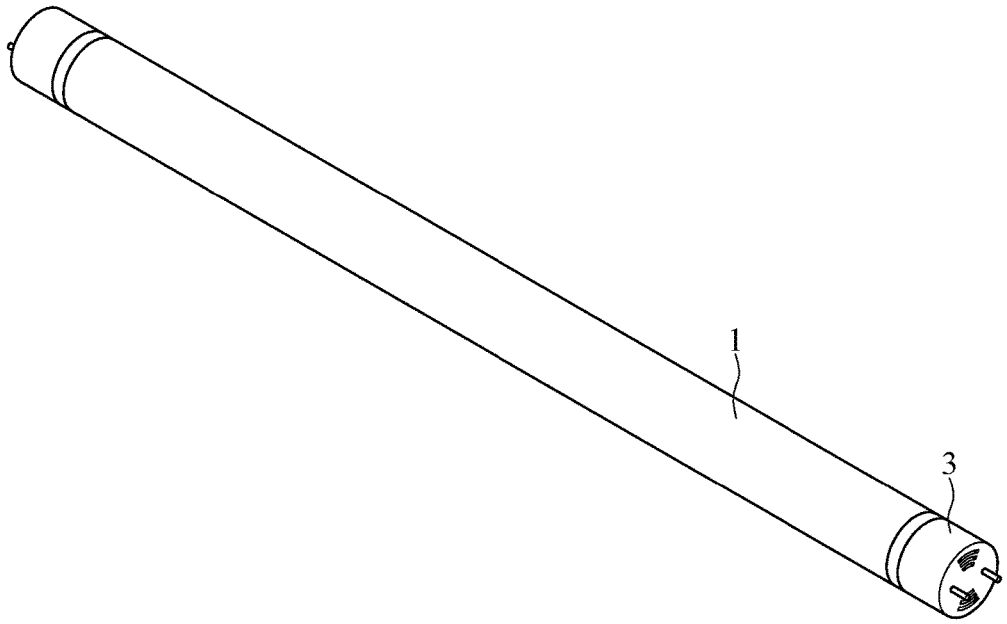
FIG. 1 is a perspective view schematically illustrating an LED tube lamp according to one embodiment.

The present disclosure now will be described more fully hereinafter with reference to the accompanying drawings, in which various embodiments are shown. The disclosure may, however, be embodied in many different forms and should not be construed as limited to the example embodiments set forth herein. These example embodiments are just that—examples—and many implementations and variations are possible that do not require the details provided herein. It should also be emphasized that the disclosure provides details of alternative examples, but such listing of alternatives is not exhaustive. Furthermore, any consistency of detail between various examples should not be interpreted as requiring such detail—it is impracticable to list every possible variation for every feature described herein. The language of the claims should be referenced in determining the requirements of the invention.

In the drawings, the size and relative sizes of layers and regions may be exaggerated for clarity. Like numbers refer to like elements throughout. Though the different figures show variations of exemplary embodiments, these figures are not necessarily intended to be mutually exclusive from each other. Rather, as will be seen from the context of the detailed description below, certain features depicted and described in different figures can be combined with other features from other figures to result in various embodiments, when taking the figures and their description as a whole.

The terminology used herein is for the purpose of describing particular embodiments only and is not intended to be limiting of the invention. As used herein, the singular forms "a", "an" and "the" are intended to include the plural forms as well, unless the context clearly indicates otherwise. As used herein, the term "and/or" includes any and all combinations of one or more of the associated listed items and may be abbreviated as "/". As used herein, the term "and/or" includes any and all combinations of one or more of the associated listed items. Also, the term "exemplary" is intended to refer to an example or illustration.

Although the figures described herein may be referred to using language such as "one embodiment," or "certain embodiments," these figures, and their corresponding descriptions are not intended to be mutually exclusive from other figures or descriptions, unless the context so indicates. Therefore, certain aspects from certain figures may be the same as certain features in other figures, and/or certain figures may be different representations or different portions of a particular exemplary embodiment.

It will be understood that, although the terms first, second, third etc. may be used herein to describe various elements, components, regions, layers and/or sections, these elements, components, regions, layers and/or sections should not be limited by these terms. Unless the context indicates otherwise, these terms are only used to distinguish one element, component, region, layer or section from another element, component, region, layer or section, for example as a naming convention. Thus, a first element, component, region, layer or section discussed below in one section of the specification could be termed a second element, component, region, layer or section in another section of the specification or in the claims without departing from the teachings of the present disclosure. In addition, in certain cases, even if a term is not described using "first," "second," etc., in the specification, it may still be referred to as "first" or "second" in a claim in order to distinguish different claimed elements from each other.

It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

It will be understood that when an element is referred to as being "connected" or "coupled" to, or "on" another element, it can be directly connected or coupled to, or on the other element or intervening elements may be present. In contrast, when an element is referred to as being "directly connected," "directly coupled," or "directly on" to another element, there are no intervening elements present. Other words used to describe the relationship between elements should be interpreted in a like fashion (e.g., "between" versus "directly between," "adjacent" versus "directly adjacent," etc.). However, the term "contact," as used herein refers to direct connection (e.g., touching) unless the context indicates otherwise.

Embodiments described herein will be described referring to plan views and/or cross-sectional views by way of ideal schematic views. Accordingly, the exemplary views may be modified depending on manufacturing technologies and/or tolerances. Therefore, the disclosed embodiments are not limited to those shown in the views, but include modifications in configuration formed on the basis of manufacturing processes. Therefore, regions exemplified in figures may have schematic properties, and shapes of regions shown in figures may exemplify specific shapes of regions of elements to which aspects of the embodiments are not limited.

Although corresponding plan views and/or perspective views of some cross-sectional view(s) may not be shown, the cross-sectional view(s) of device structures illustrated herein provide support for a plurality of device structures that extend along two different directions as would be illustrated in a plan view, and/or in three different directions as would be illustrated in a perspective view. The two different directions may or may not be orthogonal to each other. The three different directions may include a third direction that may be orthogonal to the two different directions. The plurality of device structures may be integrated in a same electronic device. For example, when a device structure (e.g., a memory cell structure or a transistor structure) is illustrated in a cross-sectional view, an electronic device may include a plurality of the device structures (e.g., memory cell structures or transistor structures), as would be illustrated by a plan view of the electronic device. The plurality of device structures may be arranged in an array and/or in a two-dimensional pattern.

Spatially relative terms, such as "beneath," "below," "lower," "above," "upper" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

Terms such as "same," "planar," or "coplanar," as used herein when referring to orientation, layout, location, shapes, sizes, amounts, or other measures do not necessarily mean an exactly identical orientation, layout, location, shape, size, amount, or other measure, but are intended to encompass nearly identical orientation, layout, location, shapes, sizes, amounts, or other measures within acceptable variations that may occur, for example, due to manufacturing processes. The term "substantially" may be used herein to reflect this meaning.

As used herein, items described as being "electrically connected" are configured such that an electrical signal can be passed from one item to the other. Therefore, a passive electrically conductive component (e.g., a wire, pad, internal electrical line, etc.) physically connected to a passive electrically insulative component (e.g., a prepreg layer of a printed circuit board, an electrically insulative adhesive connecting two device, an electrically insulative underfill or mold layer, etc.) is not electrically connected to that component. Moreover, items that are "directly electrically connected," to each other are electrically connected through one or more passive elements, such as, for example, wires, pads, internal electrical lines, through vias, etc. As such, directly electrically connected components do not include components electrically connected through active elements, such as transistors or diodes.

Components described as thermally connected or in thermal communication are arranged such that heat will follow a path between the components to allow the heat to transfer from the first component to the second component. Simply because two components are part of the same device or package does not make them thermally connected. In general, components which are heat-conductive and directly connected to other heat-conductive or heat-generating components (or connected to those components through intermediate heat-conductive components or in such close proximity as to permit a substantial transfer of heat) will be described as thermally connected to those components, or in thermal communication with those components. On the contrary, two components with heat-insulative materials therebetween, which materials significantly prevent heat transfer between the two components, or only allow for incidental heat transfer, are not described as thermally connected or in thermal communication with each other. The terms "heat-conductive" or "thermally-conductive" do not apply to a particular material simply because it provides incidental heat conduction, but are intended to refer to materials that are typically known as good heat conductors or known to have utility for transferring heat, or components having similar heat conducting properties as those materials.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein. In addition, unless the context indicates otherwise, steps described in a particular order need not occur in that order.

In particular, terms "high frequency" and "high voltage" described herein are relative terms which respectively refer to a higher frequency and a higher voltage than or as compared to a lower frequency and a lower voltage (mentioned in connection with the terms), respectively, which are respectively referred to as relative terms "low frequency" and "low voltage". And the terms "high frequency" and "high voltage" may respectively refer to a higher frequency and a higher voltage to which a lower frequency and a lower voltage have risen respectively.

The present disclosure provides a novel LED tube lamp.

Terms such as "about" or "approximately" may reflect sizes, orientations, or layouts that vary only in a small relative manner, and/or in a way that does not significantly alter the operation, functionality, or structure of certain elements. For example, a range from "about 0.1 to about 1" may encompass a range such as a 0%-5% deviation around 0.1 and a 0% to 5% deviation around 1, especially if such deviation maintains the same effect as the listed range.

Figure 1A:
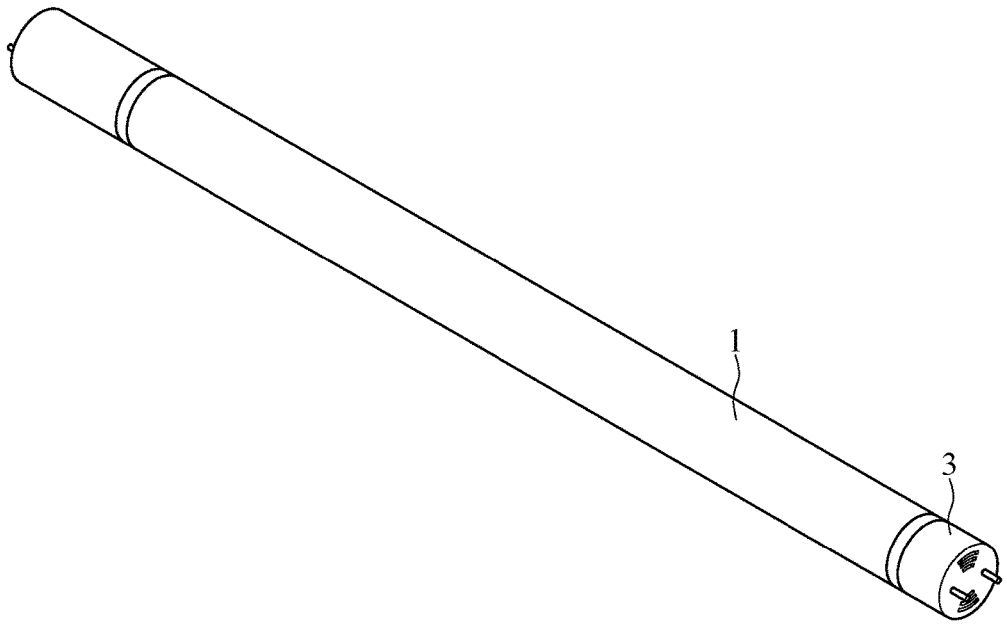
FIG. 1A is a perspective view schematically illustrating the different sized end caps of an LED tube lamp according to another embodiment.
Figure 2:
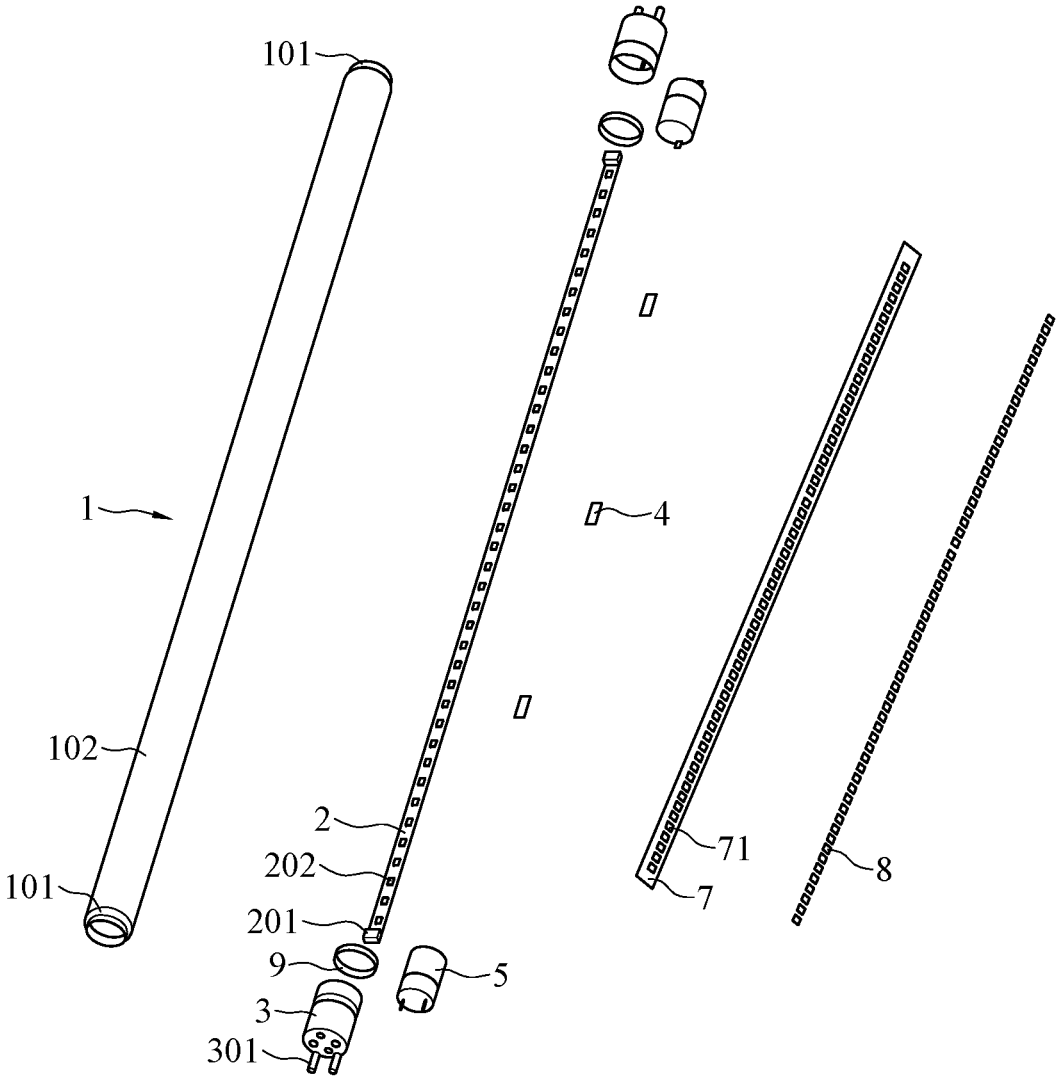
FIG. 2 is an exemplary exploded view schematically illustrating the LED tube lamp shown in FIG. 1.

Referring to FIGS. 1 and 2, an LED tube lamp of one embodiment includes a lamp tube 1, an LED light strip 2 disposed inside the lamp tube 1, and two end caps 3 respectively disposed at two ends of the lamp tube 1. The lamp tube 1 may be made of plastic or glass. The sizes of the two end caps 3 may be the same or different. Referring to FIG. 1A, the size of one end cap may in some embodiments be about 30% to about 80% times the size of the other end cap.

In one embodiment, the lamp tube 1 is made of glass with strengthened or tempered structure to avoid being easily broken and incurring electrical shock that may occur in conventional glass made tube lamps, and to avoid the fast aging process that often occurs in plastic made tube lamps. The glass made lamp tube 1 may be additionally strengthened or tempered by a chemical tempering method or a physical tempering method in various embodiments.

An exemplary chemical tempering method is accomplished by exchanging the Na ions or K ions on the glass surface with other alkali metal ions and therefore changes composition of the glass surface. The sodium (Na) ions or potassium (K) ions and other alkali metal ions on the glass surface are exchanged to form an ion exchange layer on the glass surface. The glass is then under tension on the inside while under compression on the outside when cooled to room temperature, so as to achieve the purpose of increased strength. The chemical tempering method includes but is not limited to the following glass tempering methods: high temperature type ion exchange method, the low temperature type ion exchange method, dealkalization, surface crystallization, and/or sodium silicate strengthening methods, further explained as follows.

An exemplary embodiment of the high temperature type ion exchange method includes the following steps: Inserting glass containing sodium oxide ($Na_2O$) or potassium oxide ($K_2O$) in the temperature range of the softening point and glass transition point into molten salt of lithium, so that the Na ions in the glass are exchanged for Li ions in the molten salt. Later, the glass is then cooled to room temperature, since the surface layer containing Li ions has a different expansion coefficient with respect to the inner layer containing Na ions or K ions, thus the surface produces residual stress and is reinforced. Meanwhile, the glass containing $Al_2O_3$, $TiO_2$ and other components, by performing ion exchange, can produce glass crystals having an extremely low coefficient of expansion. The crystallized glass surface after cooling produces a significant amount of pressure, up to 700 MPa, which can enhance the strength of glass.

An exemplary embodiment of the low-temperature ion exchange method includes the following steps: First, a monovalent cation (e.g., K ions) undergoes ion exchange with the alkali ions (e.g. Na ion) on the surface layer at a temperature range that is lower than the strain point temperature, so as to allow the K ions to penetrate the surface. For example, for manufacturing a $Na_2O+CaO+SiO_2$ system glass, the glass can be impregnated for ten hours at more than four hundred degrees in the molten salt. The low temperature ion exchange method can easily obtain glass of higher strength, and the processing method is simple, does not damage the transparent nature of the glass surface, and does not undergo shape distortion.

An exemplary embodiment of dealkalization includes treating glass using platinum (Pt) catalyst along with sulfurous acid gas and water in a high temperature atmosphere. The $Na^+$ ions are migrated out and bleed from the glass surface to be reacted with the Pt catalyst, so that the surface layer becomes a $SiO_2$ enriched layer, which results in a low expansion glass and produces compressive stress upon cooling.

The surface crystallization method and the high temperature type ion exchange method are different, but only the surface layer is treated by heat treatment to form low expansion coefficient microcrystals on the glass surface, thus reinforcing the glass.

An exemplary embodiment of the sodium silicate glass strengthening method is a tempering method using sodium silicate (water glass) in water solution at 100 degrees Celsius and several atmospheres of pressure treatment, where a stronger/higher strength glass surface that is harder to scratch is thereby produced.

An exemplary embodiment of the physical tempering method includes but is not limited to applying a coating to or changing the structure of an object such as to strengthen the easily broken position. The applied coating can be, for example, a ceramic coating, an acrylic coating, or a glass coating depending on the material used. The coating can be performed in a liquid phase or gaseous phase.

The above glass tempering methods described including physical tempering methods and chemical tempering methods can be accomplished singly or combined together in any fashion.

Figure 15:
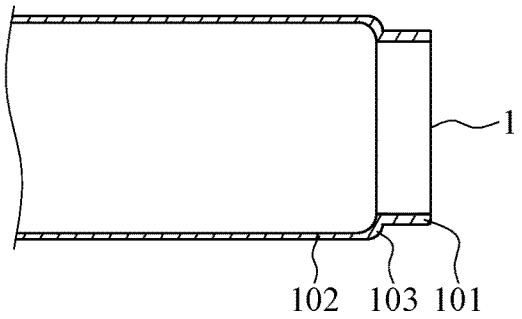
FIG. 15 is a plan cross-sectional view schematically illustrating an end structure of a lamp tube of the LED tube lamp according to one embodiment.

Referring to FIG. 2 and FIG. 15, a glass made lamp tube of an LED tube lamp according to one embodiment has structure-strengthened end regions described as follows. The glass made lamp tube 1 includes a main body region 102, two rear end regions 101 (or just end regions 101) respectively formed at two ends of the main body region 102, and end caps 3 that respectively sleeve the rear end regions 101. The outer diameter of at least one of the rear end regions 101 is less than the outer diameter of the main body region 102. In the embodiment of FIGS. 2 and 15, the outer diameters of the two rear end regions 101 are less than the outer diameter of the main body region 102. In addition, the surface of the rear end region 101 is in parallel with the surface of the main body region 102 in a cross-sectional view. Specifically, the glass made lamp tube 1 is strengthened at both ends, such that the rear end regions 101 are formed to be strengthened structures. In certain embodiments, the rear end regions 101 with strengthened structure are respectively sleeved with the end caps 3, and the outer diameters of the end caps 3 and the main body region 102 have little or no differences. For example, the end caps 3 may have the same or substantially the same outer diameters as that of the main body region 102 such that there is no gap between the end caps 3 and the main body region 102. In this way, a supporting seat in a packing box for transportation of the LED tube lamp contacts not only the end caps 3 but also the lamp tube 1 and makes uniform the loadings on the entire LED tube lamp to avoid situations where only the end caps 3 are forced, therefore preventing breakage at the connecting portion between the end caps 3 and the rear end regions 101 due to stress concentration. The quality and the appearance of the product are therefore improved.

In one embodiment, the end caps 3 and the main body region 102 have substantially the same outer diameters. These diameters may have a tolerance for example within +/−0.2 millimeter (mm), or in some cases up to +/−1.0 millimeter (mm). Depending on the thickness of the end caps 3, the difference between an outer diameter of the rear end regions 101 and an outer diameter of the main body region 102 can be about 1 mm to about 10 mm for typical product applications. In some embodiments, the difference between the outer diameter of the rear end regions 101 and the outer diameter of the main body region 102 can be about 2 mm to about 7 mm.

Referring to FIG. 15, the lamp tube 1 is further formed with a transition region 103 between the main body region 102 and the rear end regions 101. In one embodiment, the transition region 103 is a curved region formed to have cambers at two ends to smoothly connect the main body region 102 and the rear end regions 101, respectively. For example, the two ends of the transition region 103 may be arc-shaped in a cross-section view along the axial direction of the lamp tube 1. Furthermore, one of the cambers connects the main body region 102 while the other one of the cambers connects the rear end region 101. In some embodiments, the arc angle of the cambers is greater than 90 degrees while the outer surface of the rear end region 101 is a continuous surface in parallel with the outer surface of the main body region 102 when viewed from the cross-section along the axial direction of the lamp tube. In other embodiments, the transition region 103 can be without curve or arc in shape. In certain embodiments, the length of the transition region 103 along the axial direction of the lamp tube 1 is between about 1 mm to about 4 mm. Upon experimentation, it was found that when the length of the transition region 103 along the axial direction of the lamp tube 1 is less than 1 mm, the strength of the transition region would be insufficient; when the length of the transition region 103 along the axial direction of the lamp tube 1 is more than 4 mm, the main body region 102 would be shorter and the desired illumination surface would be reduced, and the end caps 3 would be longer and the more materials for the end caps 3 would be needed.

Figure 5:
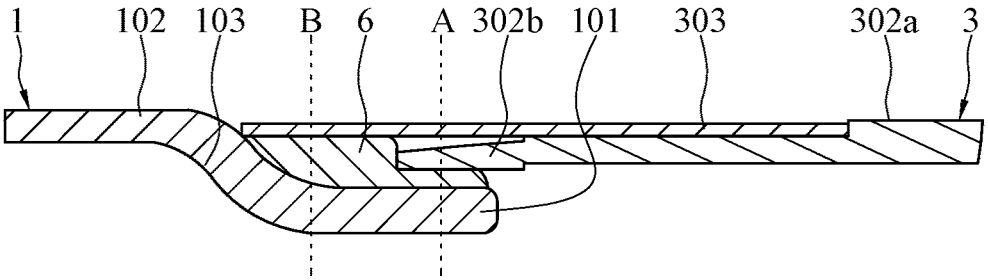
FIG. 5 is a plan cross-sectional partial view schematically illustrating a connecting region of the end cap and the lamp tube of the LED tube lamp according to one embodiment.
Figure 16:
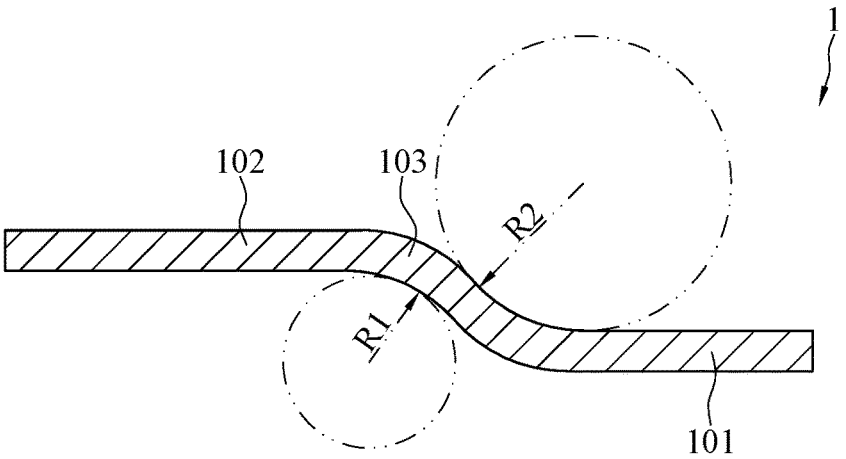
FIG. 16 is an exemplary plan cross-sectional view schematically illustrating the local structure of the transition region of the end of the lamp tube of FIG. 15.

Referring to FIG. 5 and FIG. 16, in certain embodiments, the lamp tube 1 is made of glass, and has a rear end region 101, a main body region 102, and a transition region 103. The transition region 103 has two arc-shaped cambers at both ends to from an S shape; one camber positioned near the main body region 102 is convex outwardly, while the other camber positioned near the rear end region 101 is concaved inwardly. For example, the radius of curvature, R1, of the camber/arc between the transition region 103 and the main body region 102 is smaller than the radius of curvature, R2, of the camber/arc between the transition region 103 and the rear end region 101. The ratio R1:R2 may range, for example, from about 1:1.5 to about 1:10, and in some embodiments is more effective from about 1:2.5 to about 1:5, and in some embodiments is even more effective from about 1:3 to about 1:4. In this way, the camber/arc of the transition region 103 positioned near the rear end region 101 is in compression at outer surfaces and in tension at inner surfaces, and the camber/arc of the transition region 103 positioned near the main body region 102 is in tension at outer surfaces and in compression at inner surfaces. Therefore, the goal of strengthening the transition region 103 of the lamp tube 1 is achieved.

Taking the standard specification for T8 lamp as an example, the outer diameter of the rear end region 101 may be configured between 20.9 mm to 23 mm. An outer diameter of the rear end region 101 being less than 20.9 mm may be too small to fittingly insert the power supply into the lamp tube 1. The outer diameter of the main body region 102 is in some embodiments configured to be between about 25 mm to about 28 mm. An outer diameter of the main body region 102 being less than 25 mm may be inconvenient to strengthen the ends of the main body region 102 as far as the current manufacturing skills are concerned, while an outer diameter of the main body region 102 being greater than 28 mm is not compliant to the industrial standard.

Figure 3:
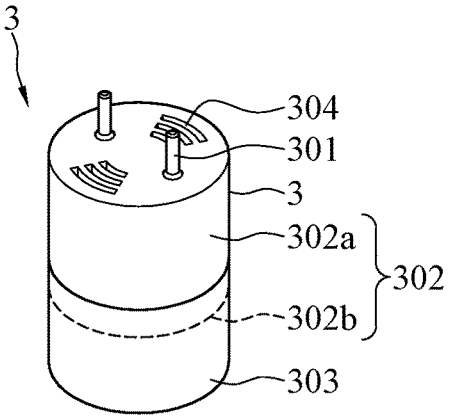
FIG. 3 is a perspective view schematically illustrating a front and top of an end cap of the LED tube lamp according to one embodiment.
Figure 4:
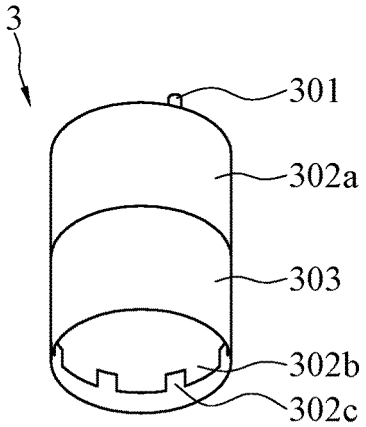
FIG. 4 is an exemplary perspective view schematically illustrating a bottom of the end cap as shown in FIG. 3.

Referring to FIGS. 3 and 4, in one embodiment, each end cap 3 includes an electrically insulating tube 302, a thermal conductive member 303 sleeving over the electrically insulating tube 302, and two hollow conductive pins 301 disposed on the electrically insulating tube 302. The thermal conductive member 303 can be a metal ring that is tubular in shape.

Referring FIG. 5, in one embodiment, one end of the thermal conductive member 303 extends away from the electrically insulating tube 302 of the end cap 3 and towards one end of the lamp tube 1, and is bonded and adhered to the end of the lamp tube 1 using a hot melt adhesive 6. In this way, the end cap 3 by way of the thermal conductive member 303 extends to the transition region 103 of the lamp tube 1. In one embodiment, the thermal conductive member 303 and the transition region 103 are closely connected such that the hot melt adhesive 6 would not overflow out of the end cap 3 and remain on the main body region 102 when using the hot melt adhesive 6 to join the thermal conductive member 303 and the lamp tube 1. In addition, the electrically insulating tube 302 facing toward the lamp tube 1 does not have an end extending to the transition region 103, and that there is a gap between the electrically insulating tube 302 and the transition region 103. In one embodiment, the electrically insulating tube 302 is not limited to being made of plastic or ceramic, any material that is not a good electrical conductor can be used.

In some embodiments, the hot melt adhesive 6 is a composite including a so-called commonly known as "welding mud powder", and in some embodiments, includes one or more of phenolic resin 2127#, shellac, rosin, calcium carbonate powder, zinc oxide, and ethanol. Rosin is a thickening agent with a feature of being dissolved in ethanol but not dissolved in water. In one embodiment, a hot melt adhesive 6 having rosin could be expanded to change its physical status to become solidified when being heated to high temperature in addition to the intrinsic viscosity. Therefore, the end cap 3 and the lamp tube 1 can be adhered closely by using the hot melt adhesive to accomplish automatic manufacture for the LED tube lamps. In one embodiment, the hot melt adhesive 6 may be expansive and flowing and finally solidified after cooling. In this embodiment, the volume of the hot melt adhesive 6 expands to about 1.3 times the original size when heated from room temperature to about 200 to 250 degrees Celsius. The hot melt adhesive 6 is not limited to the materials recited herein. Alternatively, a material for the hot melt adhesive 6 to be solidified immediately when heated to a predetermined temperature can be used. The hot melt adhesive 6 provided in various embodiments is durable with respect to high temperature inside the end caps 3 due to the heat resulting from the power supply. Therefore, the lamp tube 1 and the end caps 3 could be secured to each other without decreasing the reliability of the LED tube lamp.

Furthermore, there is formed an accommodation space between the inner surface of the thermal conductive member 303 and the outer surface of the lamp tube 1 to accommodate the hot melt adhesive 6, as indicated by the dotted line B in FIG. 5. For example, the hot melt adhesive 6 can be filled into the accommodation space at a location where a first hypothetical plane (as indicated by the dotted line B in FIG. 5) being perpendicular to the axial direction of the lamp tube 1 would pass through the thermal conductive member, the hot melt adhesive 6, and the outer surface of the lamp tube 1. The hot melt adhesive 6 may have a thickness, for example, of about 0.2 mm to about 0.5 mm. In one embodiment, the hot melt adhesive 6 will be expansive to solidify in and connect with the lamp tube 1 and the end cap 3 to secure both. The transition region 103 brings a height difference between the rear end region 101 and the main body region 102 to avoid the hot melt adhesives 6 being overflowed onto the main body region 102, and thereby saves manpower to remove the overflowed adhesive and increase the LED tube lamp productivity. The hot melt adhesive 6 is heated by receiving heat from the thermal conductive member 303 to which an electricity from an external heating equipment is applied, and then expands and finally solidifies after cooling, such that the end caps 3 are adhered to the lamp tube 1.

Referring to FIG. 5, in one embodiment, the electrically insulating tube 302 of the end cap 3 includes a first tubular part 302*a* and a second tubular part 302*b* connected along an axial direction of the lamp tube 1. The outer diameter of the second tubular part 302*b* is less than the outer diameter of the first tubular part 302*a*. In some embodiments, the outer diameter difference between the first tubular part 302*a* and the second tubular part 302*b* is between about 0.15 mm and about 0.30 mm. The thermal conductive member 303 sleeves over the outer circumferential surface of the second tubular part 302*b*. The outer surface of the thermal conductive member 303 is coplanar or substantially flush with respect to the outer circumferential surface of the first tubular part 302*a*. For example, the thermal conductive member 303 and the first tubular part 302*a* have substantially uniform exterior diameters from end to end. Thus, the entire end cap 3 and thus the entire LED tube lamp may be smooth with respect to the outer appearance and may have a substantially uniform tubular outer surface, such that the loading during transportation on the entire LED tube lamp is also uniform. In one embodiment, a ratio of the length of the thermal conductive member 303 along the axial direction of the end cap 3 to the axial length of the electrically insulating tube 302 ranges from about 1:2.5 to about 1:5.

In one embodiment, for sake of secure adhesion between the end cap 3 and the lamp tube 1, the second tubular part 302*b* is at least partially disposed around the lamp tube 1, and the accommodation space further includes a space encompassed by the inner surface of the second tubular part 302*b* and the outer surface of the rear end region 101 of the lamp tube 1. The hot melt adhesive 6 is at least partially filled in an overlapped region (shown by a dotted line "A" in FIG. 5) between the inner surface of the second tubular part 302*b* and the outer surface of the rear end region 101 of the lamp tube 1. For example, the hot melt adhesive 6 may be filled into the accommodation space at a location where a second hypothetical plane (shown by the dotted line A in FIG. 5) being perpendicular to the axial direction of the lamp tube 1 would pass through the thermal conductive member 303, the second tubular part 302*b*, the hot melt adhesive 6, and the rear end region 101.

The hot melt adhesive 6 is not required to completely fill the entire accommodation space as shown in FIG. 5, especially where a gap is reserved or formed between the thermal conductive member 303 and the second tubular part 302*b*. For example, in some embodiments, the hot melt adhesive 6 can be only partially filled into the accommodation space. During manufacturing of the LED tube lamp, the amount of the hot melt adhesive 6 coated and applied between the thermal conductive member 303 and the rear end region 101 may be appropriately increased, such that in the subsequent heating process, the hot melt adhesive 6 can be caused to expand and flow in between the second tubular part 302*b* and the rear end region 101, and thereby solidify after cooling to join the second tubular part 302*b* and the rear end region 101.

During fabrication of the LED tube lamp, the rear end region 101 of the lamp tube 1 is inserted into one of the end caps 3. In some embodiments, the axial length of the inserted portion of the rear end region 101 of the lamp tube 1 accounts for approximately one-third (⅓) to two-thirds (⅔) of the total axial length of the thermal conductive member 303. One benefit is that, there will be sufficient creepage distance between the hollow conductive pins 301 and the thermal conductive member 303, and thus it is not easy to form a short circuit leading to dangerous electric shock to individuals. On the other hand, the creepage distance between the hollow conductive pin 301 and the thermal conductive member 303 is increased due to the electrically insulating effect of the electrically insulating tube 302, and thus a high voltage test is more likely to pass without causing electrical shocks to people.

Furthermore, the presence of the second tubular part 302*b* interposed between the hot melt adhesive 6 and the thermal conductive member 303 may reduce the heat from the thermal conductive member 303 to the hot melt adhesive 6. To help prevent or minimize this problem, referring to FIG. 4 in one embodiment, the end of the second tubular part 302*b* facing the lamp tube 1 (i.e., away from the first tubular part 302*a*) is circumferentially provided with a plurality of notches 302*c*. These notches 302*c* help to increase the contact areas between the thermal conductive member 303 and the hot melt adhesive 6 and therefore provide rapid heat conduction from the thermal conductive member 303 to the hot melt adhesive 6 so as to accelerate the solidification of the hot melt adhesive 6. Moreover, the hot melt adhesive 6 electrically insulates the thermal conductive member 303 and the lamp tube 1 so that a user would not be electrically shocked when he touches the thermal conductive member 303 connected to a broken lamp tube 1.

The thermal conductive member 303 can be made of various heat conducting materials. The thermal conductive member 303 can be a metal sheet such as an aluminum alloy. The thermal conductive member 303 sleeves the second tubular part 302*b* and can be tubular or ring-shaped. The electrically insulating tube 302 may be made of electrically insulating material, but in some embodiments, have low thermal conductivity to prevent the heat from reaching the power supply module located inside the end cap 3 and therefore negatively affecting performance of the power supply module. In one embodiment, the electrically insulating tube 302 is a plastic tube.

Alternatively, the thermal conductive member 303 may be formed by a plurality of metal plates circumferentially arranged on the tubular part 302*b* with either an equidistant space or a non-equidistant space.

Figure 6:
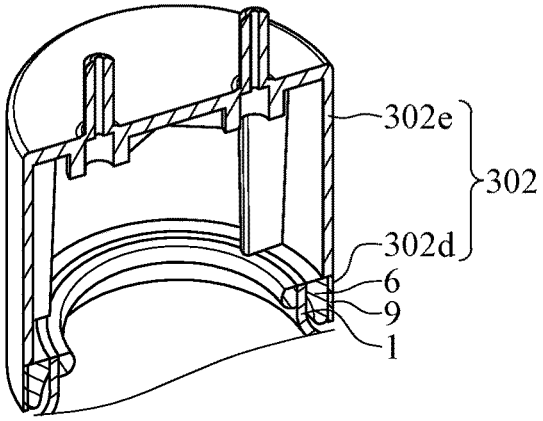
FIG. 6 is a perspective cross-sectional view schematically illustrating an inner structure of an all-plastic end cap (having a magnetic metal member and hot melt adhesive inside) according to another embodiment.

The end cap 3 may be designed to have other kinds of structures or include other elements. Referring to FIG. 6, the end cap 3 according to another embodiment further includes a magnetic metal member 9 within the electrically insulating tube 302 but excludes the thermal conductive member 3. The magnetic metal member 9 is fixedly arranged on the inner circumferential surface of the electrically insulating tube 302 and therefore interposed between the electrically insulating tube 302 and the lamp tube 1 such that the magnetic metal member 9 is partially overlapped with the lamp tube 1 in the radial direction. In this embodiment, the whole magnetic metal member 9 is inside the electrically insulating tube 302, and the hot melt adhesive 6 is coated on the inner surface of the magnetic metal member 9 (the surface of the magnetic metal tube member 9 facing the lamp tube 1) and adhered to the outer peripheral surface of the lamp tube 1. In some embodiments, the hot melt adhesive 6 covers the entire inner surface of the magnetic metal member 9 in order to increase the adhesion area and to improve the stability of the adhesion.

Figure 7:
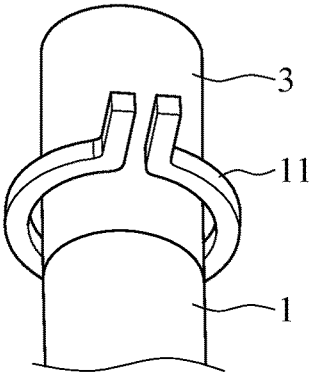
FIG. 7 is a perspective view schematically illustrating the all-plastic end cap and the lamp tube being bonded together by utilizing an induction coil according to certain embodiments.

Referring to FIG. 7, when manufacturing the LED tube lamp of this embodiment, the electrically insulating tube 302 is inserted in an external heating equipment which is in some embodiments an induction coil 11, so that the induction coil 11 and the magnetic metal member 9 are disposed opposite (or adjacent) to one another along the radially extending direction of the electrically insulating tube 302. The induction coil 11 is energized and forms an electromagnetic field, and the electromagnetic field induces the magnetic metal member 9 to create an electrical current and become heated. The heat from the magnetic metal member 9 is transferred to the hot melt adhesive 6 to make the hot melt adhesive 6 expansive and flowing and then solidified after cooling, and the bonding for the end cap 3 and the lamp tube 1 can be accomplished. The induction coil 11 may be made, for example, of red copper and composed of metal wires having width of, for example, about 5 mm to about 6 mm to be a circular coil with a diameter, for example, of about 30 mm to about 35 mm, which is a bit greater than the outer diameter of the end cap 3. Since the end cap 3 and the lamp tube 1 may have the same outer diameters, the outer diameter may change depending on the outer diameter of the lamp tube 1, and therefore the diameter of the induction coil 11 used can be changed depending on the type of the lamp tube 1 used. As examples, the outer diameters of the lamp tube for T12, T10, T8, T5, T4, and T2 are 38.1 mm, 31.8 mm, 25.4 mm, 16 mm, 12.7 mm, and 6.4 mm, respectively.

Furthermore, the induction coil 11 may be provided with a power amplifying unit to increase the alternating current power to about 1 to 2 times the original. In some embodiments, it is better that the induction coil 11 and the electrically insulating tube 302 are coaxially aligned to make energy transfer more uniform. In some embodiments, a deviation value between the axes of the induction coil 11 and the electrically insulating tube 302 is not greater than about 0.05 mm. When the bonding process is complete, the end cap 3 and the lamp tube 1 are moved away from the induction coil. Then, the hot melt adhesive 6 absorbs the energy to be expansive and flowing and solidified after cooling. In one embodiment, the magnetic metal member 9 can be heated to a temperature of about 250 to about 300 degrees Celsius; the hot melt adhesive 6 can be heated to a temperature of about 200 to about 250 degrees Celsius. The material of the hot melt adhesive is not limited here, and a material of allowing the hot melt adhesive to immediately solidify when absorbing heat energy can also be used.

In one embodiment, the induction coil 11 may be fixed in position to allow the end cap 3 and the lamp tube 1 to be moved into the induction coil 11 such that the hot melt adhesive 6 is heated to expand and flow and then solidify after cooling when the end cap 3 is again moved away from the induction coil 11. Alternatively, the end cap 3 and the lamp tube 1 may be fixed in position to allow the induction coil 11 to be moved to encompass the end cap 3 such that the hot melt adhesive 6 is heated to expand and flow and then solidify after cooling when the induction coil 11 is again moved away from the end cap 3. In one embodiment, the external heating equipment for heating the magnetic metal member 9 is provided with a plurality of devices the same as the induction coils 11, and the external heating equipment moves relative to the end cap 3 and the lamp tube 1 during the heating process. In this way, the external heating equipment moves away from the end cap 3 when the heating process is completed. However, the length of the lamp tube 1 is far greater than the length of the end cap 3 and may be up to above 240 cm in some special appliances, and this may cause bad connection between the end cap 3 and the lamp tube 1 during the process that the lamp tube 1 accompany with the end cap 3 to relatively enter or leave the induction coil 11 in the back and for the direction as mentioned above when a position error exists.

Figure 44:
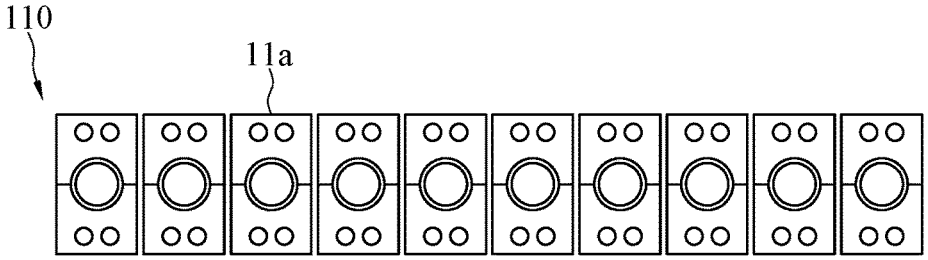
FIG. 44 is a plan view schematically illustrating an external equipment for heating the hot melt adhesive according to another embodiment.

Referring to FIG. 44, an external heating equipment 110 having a plurality sets of upper and lower semicircular fixtures 11*a* is provided to achieve the same heating effect as that brought by the induction coils 11. In this way, the above-mentioned damage risk due to the relative movement in a back-and-forth direction can be reduced. The upper and lower semicircular fixtures 11*a* each has a semicircular coil made by winding a metal wire of, for example, about 5 mm to about 6 mm wide. The combination of the upper and lower semicircular fixtures form a ring with a diameter, for example, of about 30 mm to about 35 mm, and the inside semicircular coils form a closed loop to become the induction coil 11 as mentioned. In this embodiment, the end cap 3 and the lamp tube 1 do not relatively move in the back-and-forth manner, but roll into the notch of the lower semicircular fixture. Specifically, an end cap 3 accompanied with a lamp tube 1 initially roll on a production line, and then the end cap 3 rolls into the notch of a lower semicircular fixture, and then the upper and the lower semicircular fixtures are combined to form a closed loop, and the fixtures are detached when heating is completed. This method may reduce the need for high position precision and reduce yield problems in production.

Referring to FIG. 6, the electrically insulating tube 302 is further divided into two parts, namely a first tubular part 302*d* and a second tubular part 302*e*, i.e. the remaining part. In order to provide better support of the magnetic metal member 9, an inner diameter of the first tubular part 302*d* for supporting the magnetic metal member 9 is larger than the inner diameter of the second tubular part 302*e* which does not have the magnetic metal member 9, and a stepped structure is formed at the connection of the first tubular part 302*d* and the second tubular part 302*e*. In this way, an end of the magnetic metal member 9 as viewed in an axial direction is abutted against the stepped structure such that the entire inner surface of the end cap is smooth and plain. Additionally, the magnetic metal member 9 may be of various shapes, e.g., a sheet-like or tubular-like structure being circumferentially arranged or the like, where the magnetic metal member 9 is coaxially arranged with the electrically insulating tube 302.

Figure 8:
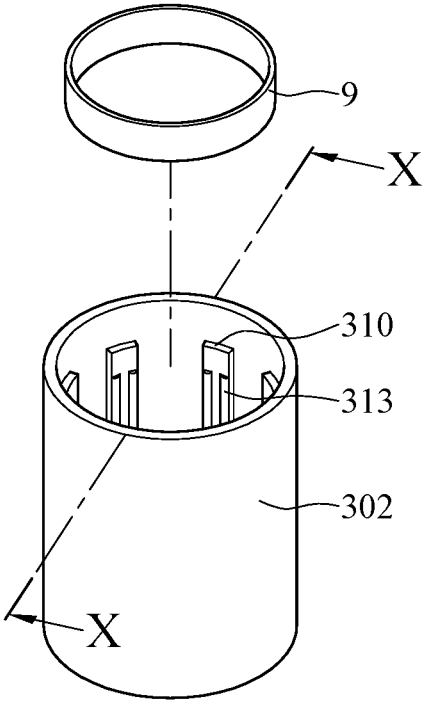
FIG. 8 is a perspective view schematically illustrating a supporting portion and a protruding portion of the electrically insulating tube of the end cap of the LED tube lamp according to another embodiment.
Figure 9:
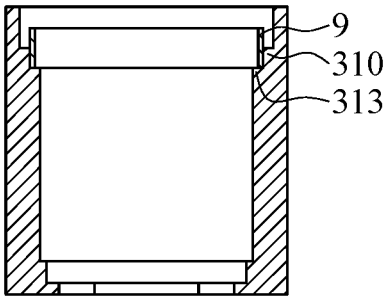
FIG. 9 is an exemplary plan cross-sectional view schematically illustrating the inner structure of the electrically insulating tube and the magnetic metal member of the end cap of FIG. 8 taken along a line X-X.

Referring to FIGS. 8 and 9, the electrically insulating tube may be further formed with a supporting portion 313 on the inner surface of the electrically insulating tube 302 to be extending inwardly such that the magnetic metal member 9 is axially abutted against the upper edge of the supporting portion 313. In some embodiments, the thickness of the supporting portion 313 along the radial direction of the electrically insulating tube 302 is between 1 mm to 2 mm. The electrically insulating tube 302 may be further formed with a protruding portion 310 on the inner surface of the electrically insulating tube 302 to be extending inwardly such that the magnetic metal member 9 is radially abutted against the side edge of the protruding portion 310 and that the outer surface of the magnetic metal member 9 and the inner surface of the electrically insulating tube 302 is spaced apart with a gap. In some embodiments, the thickness of the protruding portion 310 along the radial direction of the electrically insulating tube 302 is less than the thickness of the supporting portion 313 along the radial direction of the electrically insulating tube 302 (e.g., 0.2 mm to 1 mm smaller in some embodiments).

Referring to FIG. 9, the protruding portion 310 and the supporting portion are connected along the axial direction, and the magnetic metal member 9 is axially abutted against the upper edge of the supporting portion 313 while radially abutted against the side edge of the protruding portion 310 such that at least part of the protruding portion 310 intervenes between the magnetic metal member 9 and the electrically insulating tube 302. The protruding portion 310 may be arranged along the circumferential direction of the electrically insulating tube 302 to have a circular configuration. Alternatively, the protruding portion 310 may be in the form of a plurality of bumps arranged on the inner surface of the electrically insulating tube 302. The bumps may be equidistantly or non-equidistantly arranged along the inner circumferential surface of the electrically insulating tube 302 as long as the outer surface of the magnetic metal member 9 and the inner surface of the electrically insulating tube 302 are in a minimum contact and simultaneously hold the hot melt adhesive 6. In other embodiments, an entirely metal made end cap 3 could be used with an insulator disposed under the hollow conductive pin to endure the high voltage.

Figure 10:
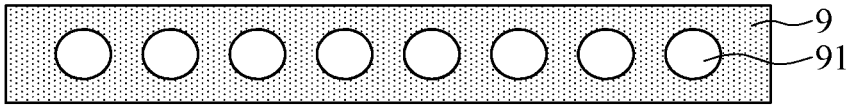
FIG. 10 is a plan view schematically illustrating the configuration of the openings on surface of the magnetic metal member of the end cap of the LED tube lamp according to another embodiment.

Referring to FIG. 10, in one embodiment, the magnetic metal member 9 can have one or more openings 91 that are circular. However, the openings 91 may instead be, for example, oval, square, star shaped, etc., as long as the contact area between the magnetic metal member 9 and the inner peripheral surface of the electrically insulating tube 302 can be reduced and the function of the magnetic metal member 9 to heat the hot melt adhesive 6 can be performed. In some embodiments, the openings 91 occupy about 10% to about 50% of the surface area of the magnetic metal member 9. The opening 91 can be arranged circumferentially on the magnetic metal member 9 in an equidistantly spaced or non-equidistantly spaced manner.

Figure 11:
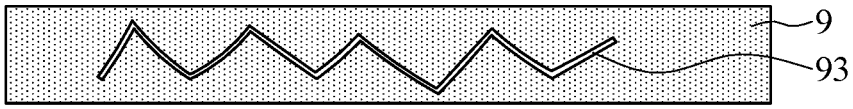
FIG. 11 is a plan view schematically illustrating the indentation/embossment on a surface of the magnetic metal member of the end cap of the LED tube lamp according to certain embodiments.

Referring to FIG. 11, in other embodiments, the magnetic metal member 9 has an indentation/embossment 93 on surface facing the electrically insulating tube 302. The embossment is raised from the inner surface of the magnetic metal member 9, while the indentation is depressed under the inner surface of the magnetic metal member 9. The indentation/embossment reduces the contact area between the inner peripheral surface of the electrically insulating tube 302 and the outer surface of the magnetic metal member 9 while maintaining the function of melting and curing the hot melt adhesive 6. In sum, the surface of the magnetic metal member 9 can be configured to have openings, indentations, or embossments or any combination thereof to achieve the goal of reducing the contact area between the inner peripheral surface of the electrically insulating tube 302 and the outer surface of the magnetic metal member 9. At the same time, the firm adhesion between the magnetic metal member 9 and the lamp tube 1 should be secured to accomplish the heating and solidification of the hot melt adhesive 6.

Figure 12:
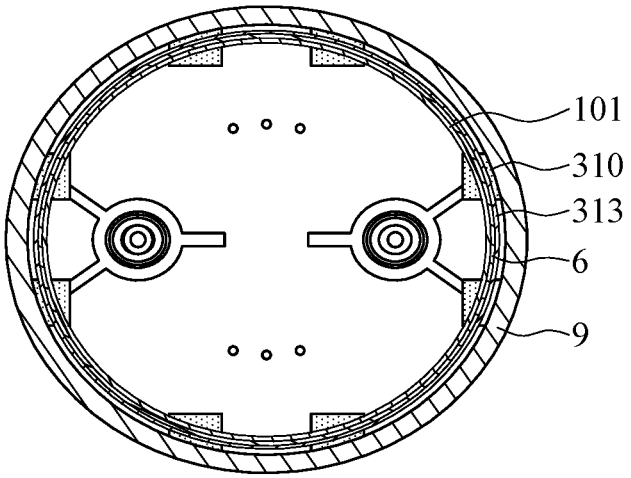
FIG. 12 is an exemplary plan cross-sectional view schematically illustrating the structure of the connection of the end cap of FIG. 8 and the lamp tube along a radial axis of the lamp tube, where the electrically insulating tube is in shape of a circular ring.
Figure 13:
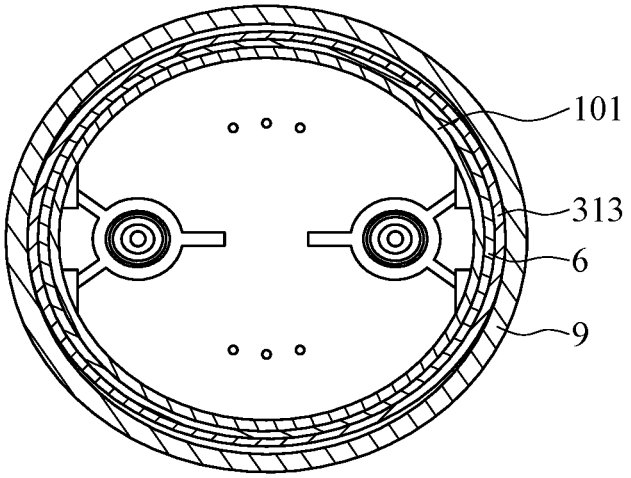
FIG. 13 is an exemplary plan cross-sectional view schematically illustrating the structure of the connection of the end cap of FIG. 8 and the lamp tube along a radial axis of the lamp tube, where the electrically insulating tube is in shape of an elliptical or oval ring.

Referring to FIG. 12, in one embodiment, the magnetic metal member 9 is a circular ring. Referring to FIG. 13, in another embodiment, the magnetic metal member 9 is a non-circular ring such as but not limited to an oval ring. When the magnetic metal member 9 is an oval ring, the minor axis of the oval ring is slightly larger than the outer diameter of the end region of the lamp tube 1 such that the contact area of the inner peripheral surface of the electrically insulating tube 302 and the outer surface of the magnetic metal member 9 is reduced and the function of melting and curing the hot melt adhesive 6 still performs properly. For example, the inner surface of the electrically insulating tube 302 may be formed with supporting portion 313 and the magnetic metal member 9 in a non-circular ring shape is seated on the supporting portion 313. Thus, the contact area of the outer surface of the magnetic metal member 9 and the inner surface of the electrically insulating tube 302 could be reduced while the function of solidifying the hot melt adhesive 6 could be performed. In other embodiments, the magnetic metal member 9 can be disposed on the outer surface of the end cap 3 to replace the thermal conductive member 303 as shown in FIG. 5 and to perform the function of heating and solidifying the hot melt adhesive 6 via electromagnetic induction.

Figure 45:
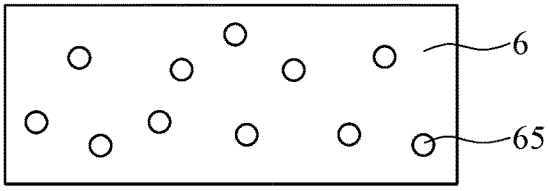
FIG. 45 is a cross-sectional view schematically illustrating the hot melt adhesive having uniformly distributed high permeability powder particles with small particle size according to one embodiment.
Figure 46:
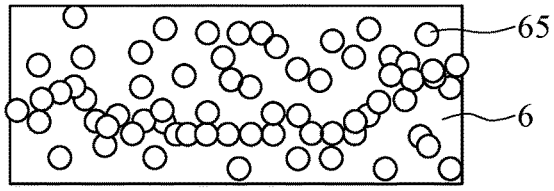
FIG. 46 is a cross-sectional view schematically illustrating the hot melt adhesive having non-uniformly distributed high permeability powder particles with small particle size according to another embodiment, wherein the powder particles form a closed electric loop.
Figure 47:
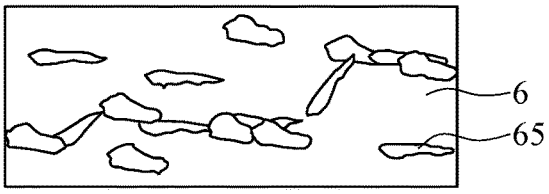
FIG. 47 is a cross-sectional view schematically illustrating the hot melt adhesive having non-uniformly distributed high permeability powder particles with large particle size according to yet another embodiment, wherein the powder particles form a closed electric loop.

Referring to FIGS. 45 to 47, in other embodiments, the magnetic metal member 9 may be omitted. Instead, in some embodiments, the hot melt adhesive 6 has a predetermined proportion of high permeability powders 65 having relative permeability ranging, for example, from about $10^2$ to about $10^6$. The powders can be used to replace the calcite powders originally included in the hot melt adhesive 6, and in certain embodiments, a volume ratio of the high permeability powders 65 to the calcite powders may be about 1:3~1:1. In some embodiments, the material of the high permeability powders 65 is one of iron, nickel, cobalt, alloy thereof, or any combination thereof; the weight percentage of the high permeability powders 65 with respect to the hot melt adhesive is about 10% to about 50%; and/or the powders may have mean particle size of about 1 to about 30 micrometers. Such a hot melt adhesive 6 allows the end cap 3 and the lamp tube 1 to adhere together and be qualified in a destruction test, a torque test, and a bending test. For example, the bending test standard for the end cap of the LED tube lamp is greater than 5 newton-meters (Nt-m), while the torque test standard is greater than 1.5 newton-meters (Nt-m). In one embodiment, upon the ratio of the high permeability powders 65 to the hot melt adhesive 6 and the magnetic flux applied, the end cap 3 and the end of the lamp tube 1 secured by using the hot melt adhesive 6 are qualified in a torque test of 1.5 to 5 newton-meters (Nt-m) and a bending test of 5 to 10 newton-meters (Nt-m). The induction coil 11 is first switched on and allow the high permeability powders uniformly distributed in the hot melt adhesive 6 to be charged, and therefore allow the hot melt adhesive 6 to be heated to be expansive and flowing and then solidified after cooling. Thereby, the goal of adhering the end cap 3 onto the lamp tube 1 is achieved.

Referring to FIGS. 45 to 47, the high permeability powders 65 may have different distribution manners in the hot melt adhesive 6. As shown in FIG. 45, the high permeability powders 65 have mean particle size of about 1 to about 5 micrometers, and are distributed uniformly in the hot melt adhesive 6. When such a hot melt adhesive 6 is coated on the inner surface of the end cap 3, though the high permeability powders 65 cannot form a closed loop due to the uniform distribution, they can still be heated due to magnetic hysteresis in the electromagnetic field, so as to heat the hot melt adhesive 6. As shown in FIG. 46, the high permeability powders 65 have mean particle size of about 1 to about 5 micrometers, and are distributed randomly in the hot melt adhesive 6. When such a hot melt adhesive 6 is coated on the inner surface of the end cap 3, the high permeability powders 65 form a closed loop due to the random distribution; they can be heated due to magnetic hysteresis or the closed loop in the electromagnetic field, so as to heat the hot melt adhesive 6. As shown in FIG. 47, the high permeability powders 65 have mean particle size of about 5 to about 30 micrometers, and are distributed randomly in the hot melt adhesive 6. When such a hot melt adhesive 6 is coated on the inner surface of the end cap 3, the high permeability powders 65 form a closed loop due to the random distribution; they can be heated due to magnetic hysteresis or the closed loop in the electromagnetic field, so as to heat the hot melt adhesive 6. Accordingly, depending on the adjustment of the particle size, the distribution density and the distribution manner of the high permeability powders 65, and the electromagnetic flux applied to the end cap 3, the heating temperature of the hot melt adhesive 6 can be controlled. In one embodiment, the hot melt adhesive 6 is flowing and solidified after cooling from a temperature of about 200 to about 250 degrees Celsius. In another embodiment, the hot melt adhesive 6 is immediately solidified at a temperature of about 200 to about 250 degrees Celsius.

Figure 14:
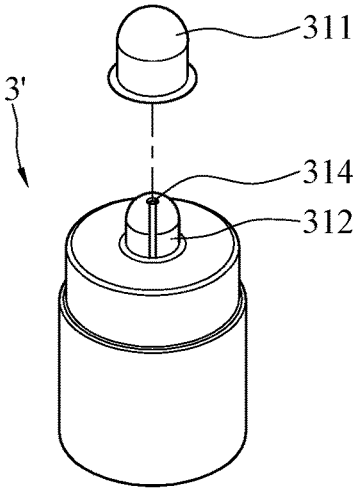
FIG. 14 is a perspective view schematically illustrating still another end cap of an LED tube lamp according to still another embodiment.
Figure 39:
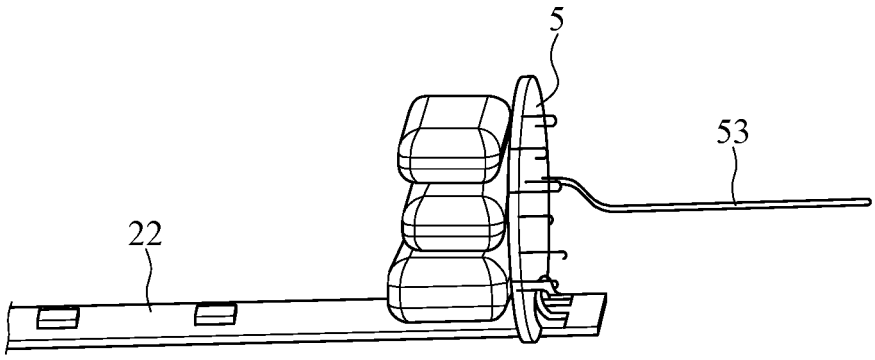
FIG. 39 is a perspective view schematically illustrating the printed circuit board of the power supply, which is perpendicularly adhered to a hard circuit board made of aluminum via soldering according to another embodiment.

Referring to FIGS. 14 and 39, in one embodiment, an end cap 3' has a pillar 312 at one end, the top end of the pillar 312 is provided with an opening having a groove 314 of, for example 0.1±1% mm depth at the periphery thereof for positioning a conductive lead 53 as shown in FIG. 39. The conductive lead 53 passes through the opening on top of the pillar 312 and has its end bent to be disposed in the groove 314. After that, a conductive metallic cap 311 covers the pillar 312 such that the conductive lead 53 is fixed between the pillar 312 and the conductive metallic cap 311. In some embodiments, the inner diameter of the conductive metallic cap 311 is 7.56±5% mm, the outer diameter of the pillar 312 is 7.23±5% mm, and the outer diameter of the conductive lead 53 is 0.5±1% mm. Nevertheless, the mentioned sizes are not limited here once that the conductive metallic cap 311 closely covers the pillar 312 without using extra adhesives and therefore completes the electrical connection between the power supply 5 and the conductive metallic cap 311.

Referring to FIGS. 2, 3, 12, and 13, in one embodiment, the end cap 3 may have openings 304 to dissipate heat generated by the power supply modules inside the end cap 3 so as to prevent a high temperature condition inside the end cap 3 that might reduce reliability. In some embodiments, the openings are in a shape of an arc; especially in a shape of three arcs with different size. In one embodiment, the openings are in a shape of three arcs with gradually varying size. The openings on the end cap 3 can be in any one of the above-mentioned shape or any combination thereof.

In other embodiments, the end cap 3 is provided with a socket (not shown) for installing the power supply module.

Figure 17:
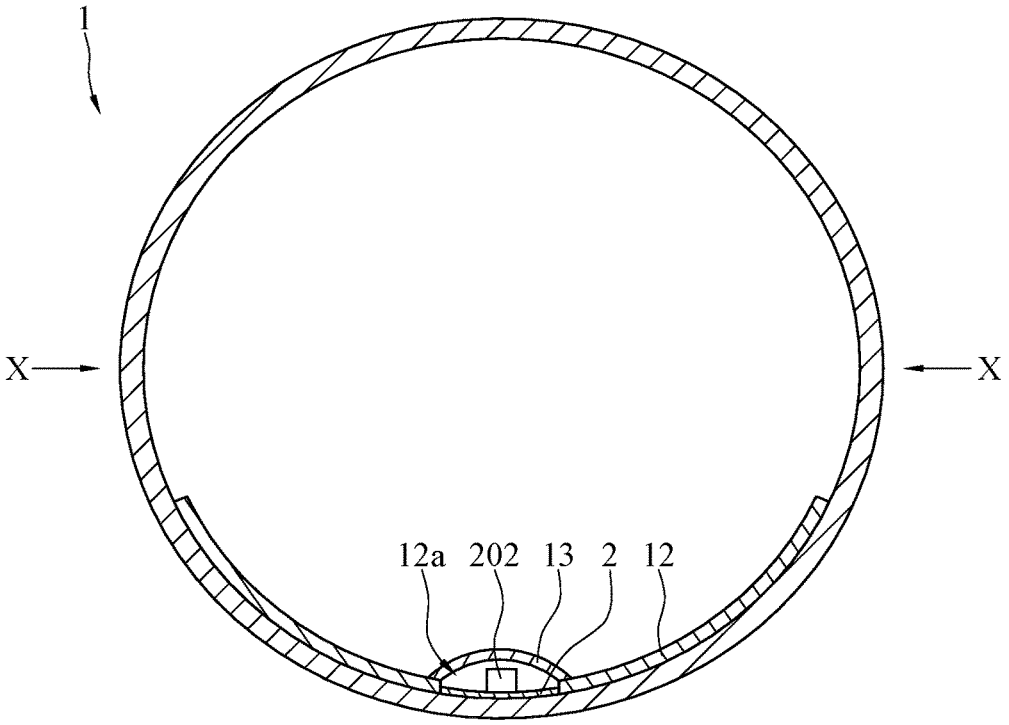
FIG. 17 is a plan cross-sectional view schematically illustrating an inside structure of the lamp tube of the LED tube lamp according to one embodiment, wherein two reflective films are respectively adjacent to two sides of the LED light strip along the circumferential direction of the lamp tube.

Referring to FIG. 17, in one embodiment, the lamp tube 1 further has a diffusion film 13 coated and bonded to the inner surface thereof so that the light outputted or emitted from the LED light sources 202 is diffused by the diffusion film 13 and then pass through the lamp tube 1. The diffusion film 13 can be in form of various types, such as a coating onto the inner surface or outer wall of the lamp tube 1, or a diffusion coating layer (not shown) coated at the surface of each LED light source 202, or a separate membrane covering the LED light source 202.

Referring again to FIG. 17, in one embodiment, when the diffusion film 13 is in the form of a sheet, it covers but is not in contact with the LED light sources 202. The diffusion film 13 in the form of a sheet is usually called an optical diffusion sheet or board, usually a composite made of mixing diffusion particles into polystyrene (PS), polymethyl methacrylate (PMMA), polyethylene terephthalate (PET), and/or polycarbonate (PC), and/or any combination thereof. The light passing through such composite is diffused to expand in a wide range of space such as a light emitted from a plane source, and therefore makes the brightness of the LED tube lamp uniform.

In alternative embodiments, the diffusion film 13 is in form of an optical diffusion coating, which is composed of any one of calcium carbonate, halogen calcium phosphate and aluminum oxide, or any combination thereof. When the optical diffusion coating is made from a calcium carbonate with suitable solution, an excellent light diffusion effect and transmittance to exceed 90% can be obtained. Furthermore, the diffusion film 13 in form of an optical diffusion coating may be applied to an outer surface of the rear end region 101 having the hot melt adhesive 6 to produce increased friction resistance between the end cap 3 and the rear end region 101. Compared with an example without any optical diffusion coating, the rear end region 101 having the diffusion film 13 is beneficial, for example for preventing accidental detachment of the end cap 3 from the lamp tube 1.

In one embodiment, the composition of the diffusion film 13 in form of the optical diffusion coating includes calcium carbonate, strontium phosphate (e.g., CMS-5000, white powder), thickener, and a ceramic activated carbon (e.g., ceramic activated carbon SW-C, which is a colorless liquid). Specifically, in one example, such an optical diffusion coating on the inner circumferential surface of the glass tube has an average thickness ranging between about 20 and about 30 μm. A light transmittance of the diffusion film 13 using this optical diffusion coating is about 90%. For example, the light transmittance of the diffusion film 13 ranges from 85% to 96%. In addition, this diffusion film 13 can also provide electrical isolation for reducing risk of electric shock to a user upon breakage of the lamp tube 1. Furthermore, the diffusion film 13 provides an improved illumination distribution uniformity of the light outputted by the LED light sources 202 such that the light can illuminate the back of the light sources 202 and the side edges of the bendable circuit sheet so as to avoid the formation of dark regions inside the lamp tube 1 and improve the illumination comfort. In another possible embodiment, the light transmittance of the diffusion film can be 92% to 94% while the thickness ranges from about 200 to about 300 μm.

In another embodiment, the optical diffusion coating can also be made of a mixture including a calcium carbonate-based substance, some reflective substances like strontium phosphate or barium sulfate, a thickening agent, ceramic activated carbon, and deionized water. The mixture is coated on the inner circumferential surface of the glass tube and has an average thickness ranging between about 20 and about 30 μm. In view of the diffusion phenomena in microscopic terms, light is reflected by particles. The particle size of the reflective substance such as strontium phosphate or barium sulfate will be much larger than the particle size of the calcium carbonate. Therefore, adding a small amount of reflective substance in the optical diffusion coating can effectively increase the diffusion effect of light.

In other embodiments, halogen calcium phosphate or aluminum oxide can also serve as the main material for forming the diffusion film 13. The particle size of the calcium carbonate is, for example, about 2 to 4 μm, while the particle size of the halogen calcium phosphate and aluminum oxide are about 4 to 6 μm and 1 to 2 μm, respectively. When the light transmittance is required to be 85% to 92%, the average thickness for the optical diffusion coating mainly having the calcium carbonate may be about 20 to about 30 μm, while the average thickness for the optical diffusion coating mainly having the halogen calcium phosphate may be about 25 to about 35 μm, and/or the average thickness for the optical diffusion coating mainly having the aluminum oxide may be about 10 to about 15 μm. However, when the required light transmittance is up to 92% and even higher, the optical diffusion coating mainly having the calcium carbonate, the halogen calcium phosphate, or the aluminum oxide should be even thinner.

The main material and the corresponding thickness of the optical diffusion coating can be decided according to the place for which the lamp tube 1 is used and the light transmittance desired or required. It is noted that the higher the light transmittance of the diffusion film is desired or required, the grainier the visual appearance of the light sources will be.

Referring to FIG. 17, the inner circumferential surface of the lamp tube 1 may also be provided or bonded with a reflective film 12. The reflective film 12 is provided around the LED light sources 202, and occupies a portion of an area of the inner circumferential surface of the lamp tube 1 arranged along the circumferential direction thereof. As shown in FIG. 17, the reflective film 12 is disposed at two sides of the LED light strip 2 extending along a circumferential direction of the lamp tube 1. The LED light strip 2 is basically in a middle position of the lamp tube 1 and between the two reflective films 12. The reflective film 12, when viewed by a person looking at the lamp tube from the side (in the X-direction shown in FIG. 17), serves to block the LED light sources 202, so that the person does not directly see the LED light sources 202, thereby reducing the visual graininess effect. On the other hand, that the light emitted from the LED light sources 202 is reflected by the reflective film 12 facilitates the divergence angle control of the LED tube lamp, so that more light illuminates toward directions without the reflective film 12, such that the LED tube lamp has higher energy efficiency when providing the same level of illumination performance.

Specifically, the reflection film 12 is provided on the inner peripheral surface of the lamp tube 1, and has an opening 12*a* configured to accommodate the LED light strip 2. The size of the opening 12*a* is the same or slightly larger than the size of the LED light strip 2. During assembly, the LED light sources 202 are mounted on the LED light strip 2 (a bendable circuit sheet) provided on the inner surface of the lamp tube 1, and then the reflective film 12 is adhered to the inner surface of the lamp tube 1, so that the opening 12*a* of the reflective film 12 correspondingly matches the LED light strip 2 in a one-to-one relationship, and the LED light strip 2 is exposed to the outside of the reflective film 12.

Figure 18:
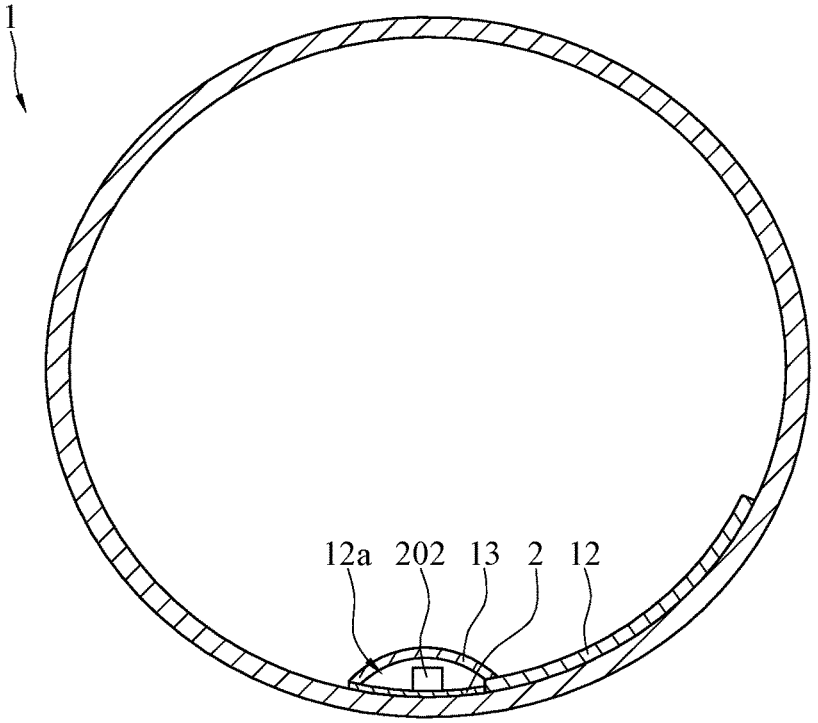
FIG. 18 is a plan cross-sectional view schematically illustrating an inside structure of the lamp tube of the LED tube lamp according to another embodiment, wherein only a reflective film is disposed on one side of the LED light strip along the circumferential direction of the lamp tube.
Figure 19:
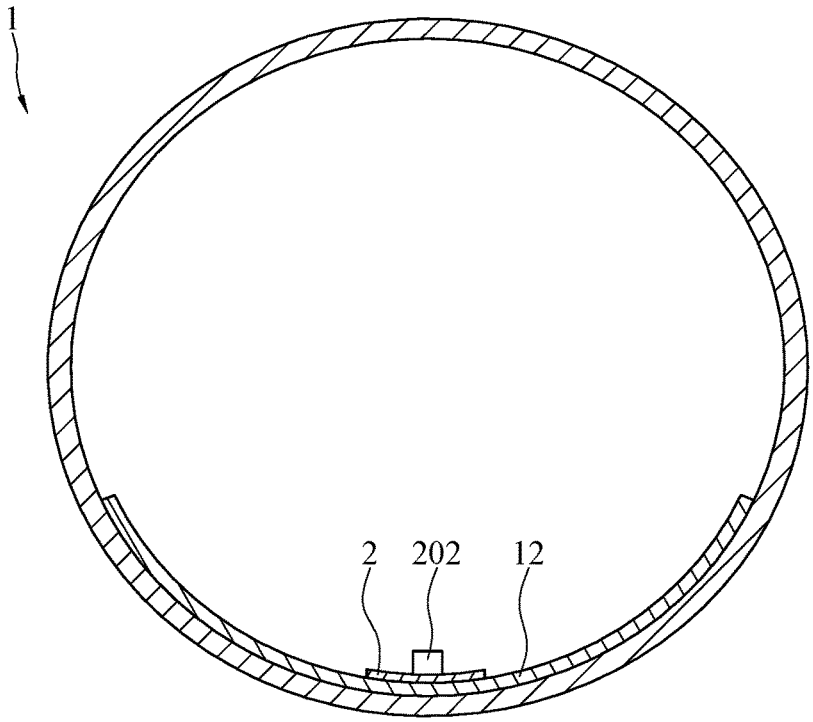
FIG. 19 is a plan cross-sectional view schematically illustrating an inside structure of the lamp tube of the LED tube lamp according to still another embodiment, wherein the reflective film is under the LED light strip and extends at both sides along the circumferential direction of the lamp tube.
Figure 20:
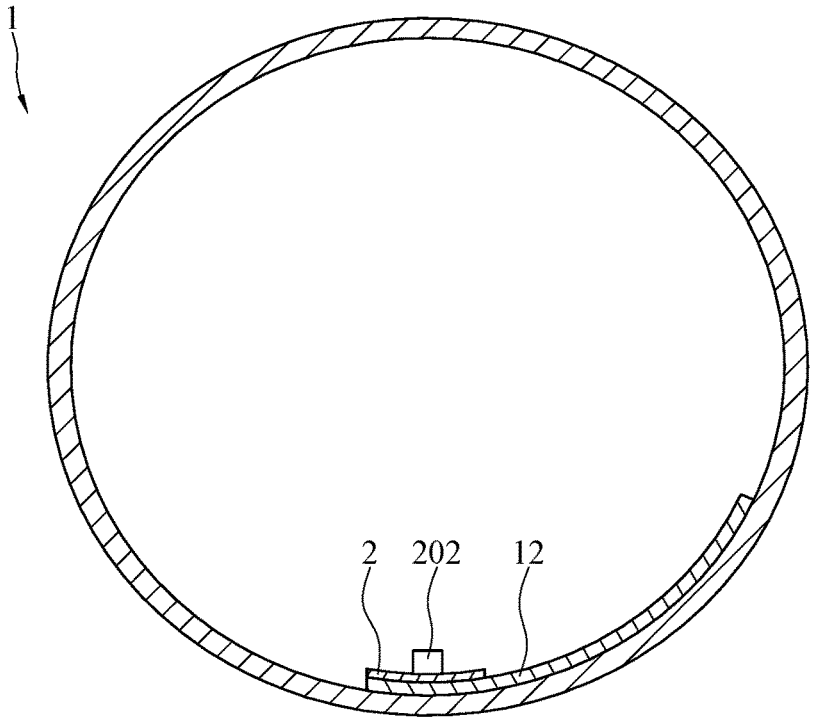
FIG. 20 is a plan cross-sectional view schematically illustrating an inside structure of the lamp tube of the LED tube lamp according to yet another embodiment, wherein the reflective film is under the LED light strip and extends at only one side along the circumferential direction of the lamp tube.

In one embodiment, the reflectance of the reflective film 12 is generally at least greater than 85%, in some embodiments greater than 90%, and in some embodiments, greater than 95%, to be most effective. In one embodiment, the reflective film 12 extends circumferentially along the length of the lamp tube 1 occupying about 30% to 50% of the inner surface area of the lamp tube 1. In some embodiments, a ratio of a circumferential length of the reflective film 12 along the inner circumferential surface of the lamp tube 1 to a circumferential length of the lamp tube 1 is about 0.3 to 0.5. In the illustrated embodiment of FIG. 17, the reflective film 12 is disposed substantially in the middle along a circumferential direction of the lamp tube 1, so that the two distinct portions or sections of the reflective film 12 disposed on the two sides of the LED light strip 2 are substantially equal in area. The reflective film 12 may be made of PET with some reflective materials such as strontium phosphate or barium sulfate or any combination thereof, with a thickness between about 140 μm and about 350 μm or between about 150 μm and about 220 μm for a more preferred effect in some embodiments. As shown in FIG. 18, in other embodiments, the reflective film 12 may be provided along the circumferential direction of the lamp tube 1 on only one side of the LED light strip 2 while occupying the same percentage of the inner surface area of the lamp tube 1 (e.g., 15% to 25% for the one side). Alternatively, as shown in FIGS. 19 and 20, the reflective film 12 may be provided without any opening, and the reflective film 12 is directly adhered or mounted to the inner surface of the lamp tube 1 and followed by mounting or fixing the LED light strip 2 on the reflective film 12 such that the reflective film 12 positioned on one side or two sides of the LED light strip 2.

Figure 21:
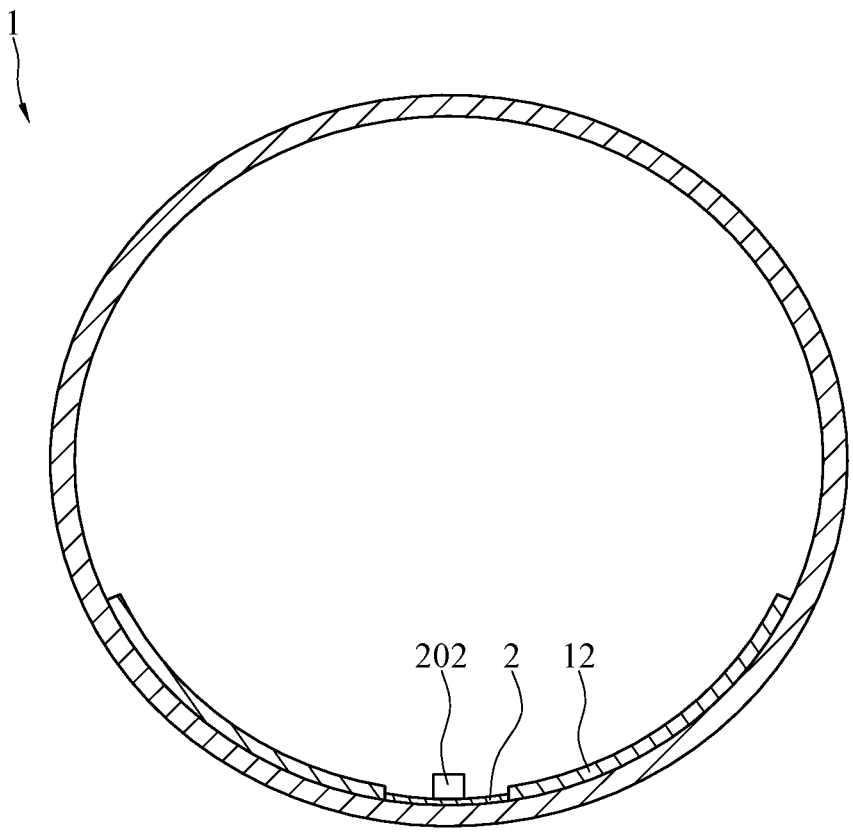
FIG. 21 is a plan cross-sectional view schematically illustrating an inside structure of the lamp tube of the LED tube lamp according to still yet another embodiment, wherein two reflective films are respectively adjacent to two sides of the LED light strip and extending along the circumferential direction of the lamp tube.

In the above-mentioned embodiments, various types of the reflective film 12 and the diffusion film 13 can be adopted to accomplish optical effects including single reflection, single diffusion, and/or combined reflection-diffusion. For example, the lamp tube 1 may be provided with only the reflective film 12, and no diffusion film 13 is disposed inside the lamp tube 1, such as shown in FIGS. 19, 20, and 21.

In other embodiments, the width of the LED light strip 2 (along the circumferential direction of the lamp tube) can be widened to occupy a circumference area of the inner circumferential surface of the lamp tube 1. Since the LED light strip 2 has on its surface a circuit protective layer made of an ink which can reflect lights, the widen part of the LED light strip 2 functions like the reflective film 12 as mentioned above. In some embodiments, a ratio of the length of the LED light strip 2 along the circumferential direction to the circumferential length of the lamp tube 1 is about 0.3 to 0.5. The light emitted from the light sources could be concentrated by the reflection of the widen part of the LED light strip 2.

In other embodiments, the inner surface of the glass made lamp tube may be coated totally with the optical diffusion coating, or partially with the optical diffusion coating (e.g., where the reflective film 12 is coated there may be no optical diffusion coating). No matter in what coating manner, in some embodiments, it is more desirable that the optical diffusion coating be coated on the outer surface of the rear end region of the lamp tube 1 so as to firmly secure the end cap 3 with the lamp tube 1.

In various embodiments, the light emitted from the light sources may be processed with the abovementioned diffusion film, reflective film, other kinds of diffusion layer sheets, adhesive film, or any combination thereof.

Referring again to FIG. 2, the LED tube lamp according to some embodiments also includes an adhesive sheet 4, an insulation adhesive sheet 7, and an optical adhesive sheet 8. The LED light strip 2 is fixed by the adhesive sheet 4 to an inner circumferential surface of the lamp tube 1. The adhesive sheet 4 may be but is not limited to a silicone adhesive. The adhesive sheet 4 may be in form of several short pieces or a long piece. Various kinds of the adhesive sheet 4, the insulation adhesive sheet 7, and the optical adhesive sheet 8 can be combined to constitute various embodiments.

The insulation adhesive sheet 7 is coated on the surface of the LED light strip 2 that faces the LED light sources 202 so that the LED light strip 2 is not exposed and thus is electrically insulated from the outside environment. In application of the insulation adhesive sheet 7, a plurality of through holes 71 on the insulation adhesive sheet 7 are reserved to correspondingly accommodate the LED light sources 202 such that the LED light sources 202 are mounted in the through holes 101. The material composition of the insulation adhesive sheet 7 may include, for example vinyl silicone, hydrogen polysiloxane and aluminum oxide. The insulation adhesive sheet 7 has a thickness, for example, ranging from about 100 μm to about 140 μm (micrometers). The insulation adhesive sheet 7 having a thickness less than 100 μm typically does not produce sufficient insulating effect, while the insulation adhesive sheet 7 having a thickness more than 140 μm may result in material waste.

Figure 37:
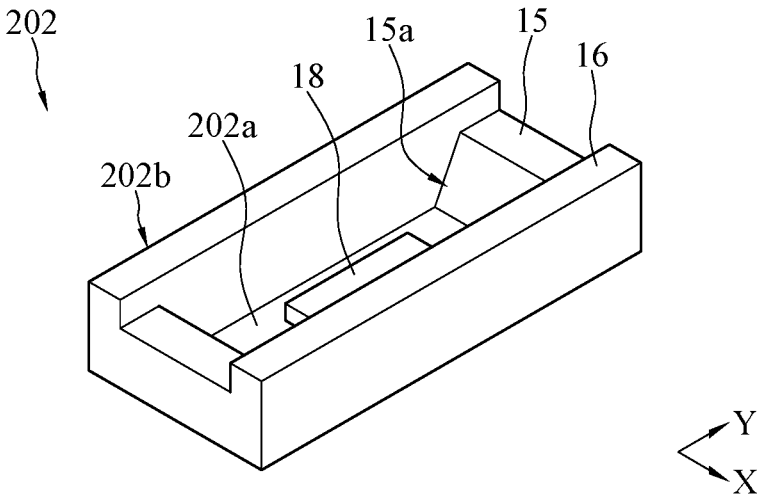
FIG. 37 is a perspective view schematically illustrating an LED lead frame for the LED light sources of the LED tube lamp according to one embodiment.

The optical adhesive sheet 8, which in some embodiments is a clear or transparent material, is applied or coated on the surface of the LED light source 202 in order to ensure optimal light transmittance. After being applied to the LED light sources 202, the optical adhesive sheet 8 may have a granular, strip-like or sheet-like shape. The performance of the optical adhesive sheet 8 depends on its refractive index and thickness. The refractive index of the optical adhesive sheet 8 is in some embodiments between 1.22 and 1.6. In some embodiments, it is better for the optical adhesive sheet 8 to have a refractive index being a square root of the refractive index of the housing or casing of the LED light source 202, or the square root of the refractive index of the housing or casing of the LED light source 202 plus or minus 15%, to contribute better light transmittance. The housing/casing of the LED light sources 202 is a structure to accommodate and carry the LED dies (or chips) such as an LED lead frame 202*b* as shown in FIG. 37. The refractive index of the optical adhesive sheet 8 may range from 1.225 to 1.253 in some embodiments. In some embodiments, the thickness of the optical adhesive sheet 8 may range from 1.1 mm to 1.3 mm. The optical adhesive sheet 8 having a thickness less than 1.1 mm may not be able to cover the LED light sources 202, while the optical adhesive sheet 8 having a thickness more than 1.3 mm may reduce light transmittance and increases material cost.

Figure 22:
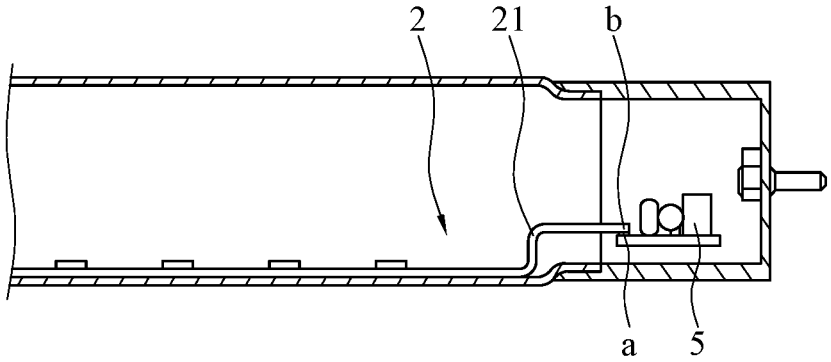
FIG. 22 is a plan sectional view schematically illustrating the LED light strip is a bendable circuit sheet with ends thereof passing across the transition region of the lamp tube of the LED tube lamp to be solder bonded to the output terminals of the power supply according to one embodiment.

In some embodiments, in the process of assembling the LED light sources to the LED light strip, the optical adhesive sheet 8 is first applied on the LED light sources 202; then the insulation adhesive sheet 7 is coated on one side of the LED light strip 2; then the LED light sources 202 are fixed or mounted on the LED light strip 2; the other side of the LED light strip 2 being opposite to the side of mounting the LED light sources 202 is bonded and affixed to the inner surface of the lamp tube 1 by the adhesive sheet 4; finally, the end cap 3 is fixed to the end portion of the lamp tube 1, and the LED light sources 202 and the power supply 5 are electrically connected by the LED light strip 2. As shown in the embodiment of FIG. 22, the bendable circuit sheet 2 passes the transition region 103 to be soldered or traditionally wire-bonded with the power supply 5, and then the end cap 3 having the structure as shown in FIG. 3 or 4 or FIG. 6 is adhered to the strengthened transition region 103 via methods as shown in FIG. 5 or FIG. 7, respectively to form a complete LED tube lamp.

In this embodiment, the LED light strip 2 is fixed by the adhesive sheet 4 to an inner circumferential surface of the lamp tube 1, so as to increase the light illumination angle of the LED tube lamp and broaden the viewing angle to be greater than 330 degrees. By means of applying the insulation adhesive sheet 7 and the optical adhesive sheet 8, electrical insulation of the entire light strip 2 is accomplished such that electrical shock would not occur even when the lamp tube 1 is broken and therefore safety could be improved.

Furthermore, the inner peripheral surface or the outer circumferential surface of the glass made lamp tube 1 may be covered or coated with an adhesive film (not shown) to isolate the inside from the outside of the glass made lamp tube 1 when the glass made lamp tube 1 is broken. In this embodiment, the adhesive film is coated on the inner peripheral surface of the lamp tube 1. The material for the coated adhesive film includes, for example, methyl vinyl silicone oil, hydro silicone oil, xylene, and calcium carbonate, wherein xylene is used as an auxiliary material. The xylene will be volatilized and removed when the coated adhesive film on the inner surface of the lamp tube 1 solidifies or hardens. The xylene is mainly used to adjust the capability of adhesion and therefore to control the thickness of the coated adhesive film.

In one embodiment, the thickness of the coated adhesive film is preferably between about 100 and about 140 micrometers (μm). The adhesive film having a thickness being less than 100 micrometers may not have sufficient shatterproof capability for the glass tube, and the glass tube is thus prone to crack or shatter. The adhesive film having a thickness being larger than 140 micrometers may reduce the light transmittance and may increase material cost. The thickness of the coated adhesive film may be between about 10 and about 800 micrometers (μm) when the shatterproof capability and the light transmittance are not strictly demanded.

In one embodiment, the inner peripheral surface or the outer circumferential surface of the glass made lamp tube 1 is coated with an adhesive film such that the broken pieces are adhered to the adhesive film when the glass made lamp tube is broken. Therefore, the lamp tube 1 would not be penetrated to form a through hole connecting the inside and outside of the lamp tube 1 and thus prevents a user from touching any charged object inside the lamp tube 1 to avoid electrical shock. In addition, the adhesive film may diffuse light and may allow the light to transmit such that the light uniformity and the light transmittance of the entire LED tube lamp increases. The adhesive film can be used in combination with the adhesive sheet 4, the insulation adhesive sheet 7 and the optical adhesive sheet 8 to constitute various embodiments. As the LED light strip 2 is configured to be a bendable circuit sheet, no coated adhesive film is thereby required.

Furthermore, the light strip 2 may be an elongated aluminum plate, FR 4 board, or a bendable circuit sheet. When the lamp tube 1 is made of glass, adopting a rigid aluminum plate or FR4 board would make a broken lamp tube, e.g., broken into two parts, remain a straight shape so that a user may be under a false impression that the LED tube lamp is still usable and fully functional, and it is easy for him to incur electric shock upon handling or installation of the LED tube lamp. Because of added flexibility and bendability of the flexible substrate for the LED light strip 2, the problem faced by the aluminum plate, FR4 board, or conventional 3-layered flexible board having inadequate flexibility and bendability, are thereby addressed. In certain embodiments, a bendable circuit sheet is adopted as the LED light strip 2 for that such an LED light strip 2 would not allow a ruptured or broken lamp tube to maintain a straight shape and therefore instantly inform the user of the disability of the LED tube lamp and avoid possibly incurred electrical shock. The following are further descriptions of the bendable circuit sheet used as the LED light strip 2.

Figure 23:
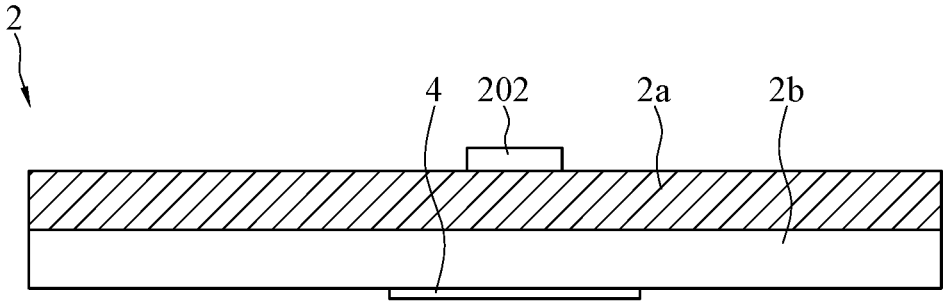
FIG. 23 is a plan cross-sectional view schematically illustrating a bi-layered structure of the bendable circuit sheet of the LED light strip of the LED tube lamp according to an embodiment.

Referring to FIG. 23, in one embodiment, the LED light strip 2 includes a bendable circuit sheet having a conductive wiring layer 2*a* and a dielectric layer 2*b* that are arranged in a stacked manner, wherein the wiring layer 2*a* and the dielectric layer 2*b* have same areas. The LED light source 202 is disposed on one surface of the wiring layer 2*a*, the dielectric layer 2*b* is disposed on the other surface of the wiring layer 2*a* that is away from the LED light sources 202. The wiring layer 2*a* is electrically connected to the power supply 5 to carry direct current (DC) signals. Meanwhile, the surface of the dielectric layer 2*b* away from the wiring layer 2*a* is fixed to the inner circumferential surface of the lamp tube 1 by means of the adhesive sheet 4. The wiring layer 2*a* can be a metal layer or a power supply layer including wires such as copper wires.

In another embodiment, the outer surface of the wiring layer 2*a* or the dielectric layer 2*b* may be covered with a circuit protective layer made of an ink with function of resisting soldering and increasing reflectivity. Alternatively, the dielectric layer can be omitted and the wiring layer can be directly bonded to the inner circumferential surface of the lamp tube, and the outer surface of the wiring layer 2*a* is coated with the circuit protective layer. Whether the wiring layer 2*a* has a one-layered, or two-layered structure, the circuit protective layer can be adopted. In some embodiments, the circuit protective layer is disposed only on one side/surface of the LED light strip 2, such as the surface having the LED light source 202. In some embodiments, the bendable circuit sheet is a one-layered structure made of just one wiring layer 2*a*, or a two-layered structure made of one wiring layer 2*a* and one dielectric layer 2*b*, and thus is more bendable or flexible to curl when compared with the conventional three-layered flexible substrate (one dielectric layer sandwiched with two wiring layers). Thus, the bendable circuit sheet of the LED light strip 2 can be installed in a lamp tube with a customized shape or non-tubular shape, and fitly mounted to the inner surface of the lamp tube. The bendable circuit sheet closely mounted to the inner surface of the lamp tube is preferable in some cases. In addition, using fewer layers of the bendable circuit sheet improves the heat dissipation and lowers the material cost.

Nevertheless, the bendable circuit sheet is not limited to being one-layered or two-layered; in other embodiments, the bendable circuit sheet may include multiple layers of the wiring layers 2*a* and multiple layers of the dielectric layers 2*b*, in which the dielectric layers 2*b* and the wiring layers 2*a* are sequentially stacked in a staggered manner, respectively. These stacked layers are away from the surface of the outermost wiring layer 2*a*, which has the LED light source 202 disposed thereon and is electrically connected to the power supply 5. Moreover, the length of the bendable circuit sheet is greater than the length of the lamp tube.

Figure 48:
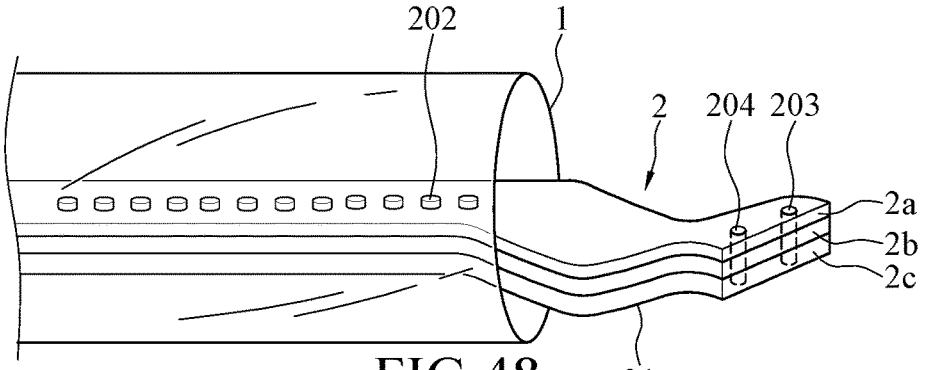
FIG. 48 is a perspective view schematically illustrating the bendable circuit sheet of the LED light strip is formed with two conductive wiring layers according to another embodiment.

Referring to FIG. 48, in one embodiment, the LED light strip 2 includes a bendable circuit sheet having in sequence a first wiring layer 2*a*, a dielectric layer 2*b*, and a second wiring layer 2*c*. The thickness of the second wiring layer 2*c* is greater than that of the first wiring layer 2*a*, and the length of the LED light strip 2 is greater than that of the lamp tube 1. The end region of the light strip 2 extending beyond the end portion of the lamp tube 1 without disposition of the light source 202 is formed with two separate through holes 203 and 204 to respectively electrically communicate the first wiring layer 2*a* and the second wiring layer 2*c*. The through holes 203 and 204 are not connected to (e.g., not in communication with) each other to avoid short.

In this way, the greater thickness of the second wiring layer 2*c* allows the second wiring layer 2*c* to support the first wiring layer 2*a* and the dielectric layer 2*b*, and meanwhile allow the LED light strip 2 to be mounted onto the inner circumferential surface without being liable to shift or deform, and thus the yield rate of product can be improved. In addition, the first wiring layer 2*a* and the second wiring layer 2*c* are in electrical communication such that the circuit layout of the first wiring later 2*a* can be extended downward to the second wiring layer 2*c* to reach the circuit layout of the entire LED light strip 2. Moreover, since the land for the circuit layout becomes two-layered, the area of each single layer and therefore the width of the LED light strip 2 can be reduced such that more LED light strips 2 can be put on a production line to increase productivity.

Furthermore, the first wiring layer 2*a* and the second wiring layer 2*c* of the end region of the LED light strip 2 that extends beyond the end portion of the lamp tube 1 without disposition of the light source 202 can be used to accomplish the circuit layout of a power supply module so that the power supply module can be directly disposed on the bendable circuit sheet of the LED light strip 2.

Referring to FIG. 2, in one embodiment, the LED light strip 2 has a plurality of LED light sources 202 mounted thereon, and the end cap 3 has a power supply 5 installed therein. The LED light sources 202 and the power supply 5 are electrically connected by the LED light strip 2. The power supply 5 may be a single integrated unit (i.e., all of the power supply components are integrated into one module unit) installed in one end cap 3. Alternatively, the power supply 5 may be divided into two separate units (i.e. the power supply components are divided into two parts) installed in two end caps 3, respectively. When only one end of the lamp tube 1 is strengthened by a glass tempering process, it may be preferable that the power supply 5 is a single integrated unit and installed in the end cap 3 corresponding to the strengthened end of the lamp tube 1.

The power supply 5 can be fabricated by various ways. For example, the power supply 5 may be an encapsulation body formed by injection molding a silica gel with high thermal conductivity such as being greater than 0.7 w/m·k. This kind of power supply has advantages of high electrical insulation, high heat dissipation, and regular shape to match other components in an assembly. Alternatively, the power supply 5 in the end caps may be a printed circuit board having components that are directly exposed or packaged by a conventional heat shrink sleeve. The power supply 5 according to some embodiments can be a single printed circuit board provided with a power supply module as shown in FIG. 23 or a single integrated unit as shown in FIG. 38.

Figure 38:
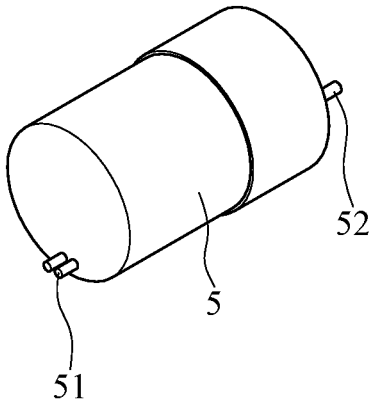
FIG. 38 is a perspective view schematically illustrating a power supply of the LED tube lamp according to one embodiment.

Referring to FIGS. 2 and 38, in one embodiment, the power supply 5 is provided with a male plug 51 at one end and a metal pin 52 at the other end, one end of the LED light strip 2 is correspondingly provided with a female plug 201, and the end cap 3 is provided with a hollow conductive pin 301 to be connected with an outer electrical power source. Specifically, the male plug 51 is fittingly inserted into the female plug 201 of the LED light strip 2, while the metal pins 52 are fittingly inserted into the hollow conductive pins 301 of the end cap 3. The male plug 51 and the female plug 201 function as a connector between the power supply 5 and the LED light strip 2. Upon insertion of the metal pin 502, the hollow conductive pin 301 is punched with an external punching tool to slightly deform such that the metal pin 502 of the power supply 5 is secured and electrically connected to the hollow conductive pin 301. Upon turning on the electrical power, the electrical current passes in sequence through the hollow conductive pin 301, the metal pin 502, the male plug 501, and the female plug 201 to reach the LED light strip 2 and go to the LED light sources 202. However, the power supply 5 of the embodiment is not limited to the modular type as shown in FIG. 38. The power supply 5 may be a printed circuit board provided with a power supply module and electrically connected to the LED light strip 2 via the abovementioned the male plug 51 and female plug 52 combination.

In another embodiment, a traditional wire bonding technique can be used instead of the male plug 51 and the female plug 52 for connecting any kind of the power supply 5 and the light strip 2. Furthermore, the wires may be wrapped with an electrically insulating tube to protect a user from being electrically shocked. However, the bonded wires tend to be easily broken during transportation and can therefore cause quality issues.

In still another embodiment, the connection between the power supply 5 and the LED light strip 2 may be accomplished via tin soldering, rivet bonding, or welding. One way to secure the LED light strip 2 is to provide the adhesive sheet 4 at one side thereof and adhere the LED light strip 2 to the inner surface of the lamp tube 1 via the adhesive sheet 4. Two ends of the LED light strip 2 can be either fixed to or detached from the inner surface of the lamp tube 1.

In case that two ends of the LED light strip 2 are fixed to the inner surface of the lamp tube 1, it may be preferable that the bendable circuit sheet of the LED light strip 2 is provided with the female plug 201 and the power supply is provided with the male plug 51 to accomplish the connection between the LED light strip 2 and the power supply 5. In this case, the male plug 51 of the power supply 5 is inserted into the female plug 201 to establish electrical connection.

In case that two ends of the LED light strip 2 are detached from the inner surface of the lamp tube and that the LED light strip 2 is connected to the power supply 5 via wire-bonding, any movement in subsequent transportation is likely to cause the bonded wires to break. Therefore, an exemplary option for the connection between the light strip 2 and the power supply 5 could be soldering. Specifically, referring to FIG. 22, the ends of the LED light strip 2 including the bendable circuit sheet are arranged to pass over the strengthened transition region 103 and directly soldering bonded to an output terminal of the power supply 5 such that the product quality is improved without using wires. In this way, the female plug 201 and the male plug 51 respectively provided for the LED light strip 2 and the power supply 5 are no longer needed.

Figure 24:
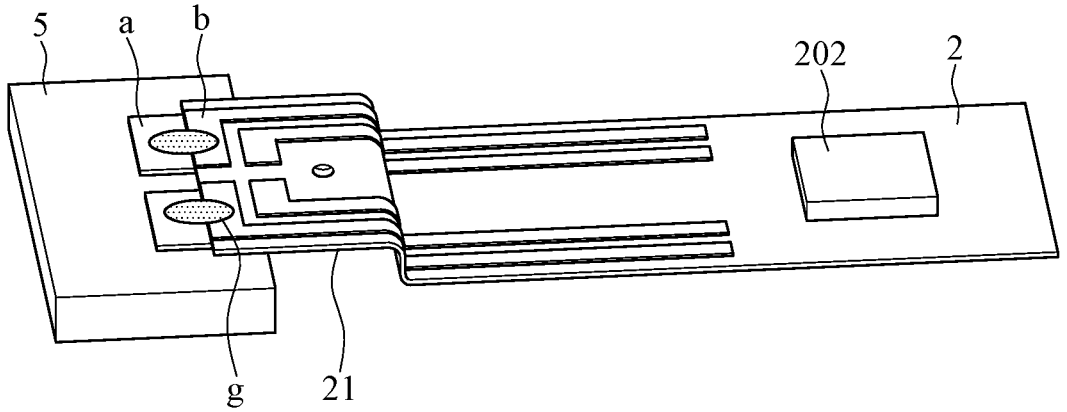
FIG. 24 is a perspective view schematically illustrating the soldering pad of the bendable circuit sheet of the LED light strip for soldering connection with the printed circuit board of the power supply of the LED tube lamp according to one embodiment.
Figure 30:
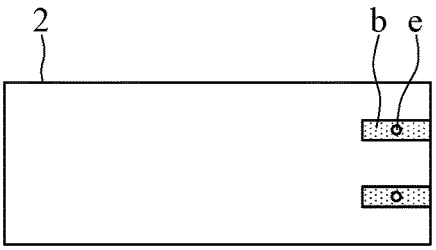
FIG. 30 is a plan view schematically illustrating through holes are formed on the soldering pads of the bendable circuit sheet of the LED light strip of the LED tube lamp according to one embodiment.

Referring to FIG. 24, an output terminal of the printed circuit board of the power supply 5 may have soldering pads "a" provided with an amount of solder (e.g., tin solder) with a thickness sufficient to later form a solder joint. Correspondingly, the ends of the LED light strip 2 may have soldering pads "b". The soldering pads "a" on the output terminal of the printed circuit board of the power supply 5 are soldered to the soldering pads "b" on the LED light strip 2 via the tin solder on the soldering pads "a". The soldering pads "a" and the soldering pads "b" may be face to face during soldering such that the connection between the LED light strip 2 and the printed circuit board of the power supply 5 is the firmest. However, this kind of soldering typically includes that a thermo-compression head presses on the rear surface of the LED light strip 2 and heats the tin solder, i.e. the LED light strip 2 intervenes between the thermo-compression head and the tin solder, and therefore may easily cause reliability problems. Referring to FIG. 30, a through hole may be formed in each of the soldering pads "b" on the LED light strip 2 to allow the soldering pads "b" overlay the soldering pads "b" without being face-to-face (e.g., both soldering pads "a" and soldering pads "b" can have surfaces that face the same direction) and the thermo-compression head directly presses tin solders on the soldering pads "a" on surface of the printed circuit board of the power supply 5 when the soldering pads "a" and the soldering pads "b" are vertically aligned. This is an easy way to accomplish in practice.

Referring again to FIG. 24, two ends of the LED light strip 2 detached from the inner surface of the lamp tube 1 are formed as freely extending portions 21, while most of the LED light strip 2 is attached and secured to the inner surface of the lamp tube 1. One of the freely extending portions 21 has the soldering pads "b" as mentioned above. Upon assembling of the LED tube lamp, the freely extending end portions 21 along with the soldered connection of the printed circuit board of the power supply 5 and the LED light strip 2 would be coiled, curled up or deformed to be fittingly accommodated inside the lamp tube 1. When the bendable circuit sheet of the LED light strip 2 includes in sequence the first wiring layer 2*a*, the dielectric layer 2*b*, and the second wiring layer 2*c* as shown in FIG. 48, the freely extending end portions 21 can be used to accomplish the connection between the first wiring layer 2*a* and the second wiring layer 2*c* and arrange the circuit layout of the power supply 5.

In this embodiment, during the connection of the LED light strip 2 and the power supply 5, the soldering pads "b" and the soldering pads "a" and the LED light sources 202 are on surfaces facing toward the same direction and the soldering pads "b" on the LED light strip 2 are each formed with a through hole "e" as shown in FIG. 30 such that the soldering pads "b" and the soldering pads "a" communicate with each other via the through holes "e". When the freely extending end portions 21 are deformed due to contraction or curling up, the soldered connection of the printed circuit board of the power supply 5 and the LED light strip 2 exerts a lateral tension on the power supply 5. Furthermore, the soldered connection of the printed circuit board of the power supply 5 and the LED light strip 2 also exerts a downward tension on the power supply 5 when compared with the situation where the soldering pads "a" of the power supply 5 and the soldering pads "b" of the LED light strip 2 are face to face. This downward tension on the power supply 5 comes from the tin solders inside the through holes "e" and forms a stronger and more secure electrical connection between the LED light strip 2 and the power supply 5. As described above, the freely extending portions 21 may be different from a fixed portion of the LED light strip 2 in that they fixed portion may conform to the shape of the inner surface of the lamp tube 1 and may be fixed thereto, while the freely extending portion 21 may have a shape that does not conform to the shape of the lamp tube 1. For example, there may be a space between an inner surface of the lamp tube 1 and the freely extending portion 21. As shown in FIG. 8, the freely extending portion 21 may be bent away from the lamp tube 1.

Figure 25:
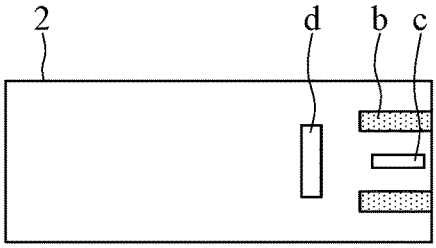
FIG. 25 is a plan view schematically illustrating the arrangement of the soldering pads of the bendable circuit sheet of the LED light strip of the LED tube lamp according to one embodiment.

Referring to FIG. 25, in one embodiment, the soldering pads "b" of the LED light strip 2 are two separate pads to electrically connect the positive and negative electrodes of the bendable circuit sheet of the LED light strip 2, respectively. The size of the soldering pads "b" may be, for example, about 3.5×2 $mm^2$. In certain embodiments, the printed circuit board of the power supply 5 is correspondingly provided with soldering pads "a" having reserved tin solders, and the height of the tin solders suitable for subsequent automatic soldering bonding process is generally, for example, about 0.1 to 0.7 mm, in some preferable embodiments about 0.3 to about 0.5 mm, and in some even more preferable embodiments about 0.4 mm. An electrically insulating through hole "c" may be formed between the two soldering pads "b" to isolate and prevent the two soldering pads from electrically shorting during soldering. Furthermore, an extra positioning opening "d" may also be provided behind the electrically insulating through hole "c" to allow an automatic soldering machine to quickly recognize the position of the soldering pads "b".

Figure 26:
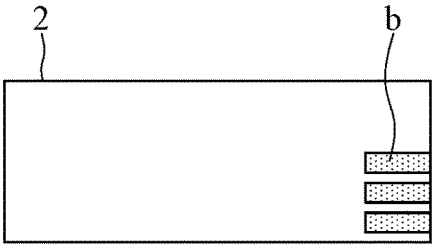
FIG. 26 is a plan view schematically illustrating a row of three soldering pads of the bendable circuit sheet of the LED light strip of the LED tube lamp according to another embodiment.
Figure 27:
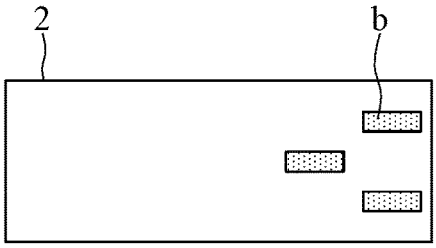
FIG. 27 is a plan view schematically illustrating two rows of soldering pads of the bendable circuit sheet of the LED light strip of the LED tube lamp according to still another embodiment.
Figure 28:
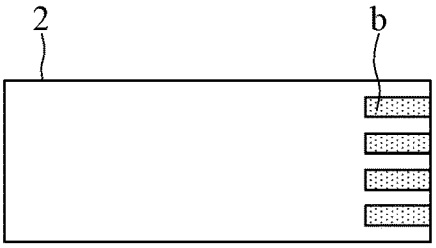
FIG. 28 is a plan view schematically illustrating a row of four soldering pads of the bendable circuit sheet of the LED light strip of the LED tube lamp according to yet another embodiment.
Figure 29:
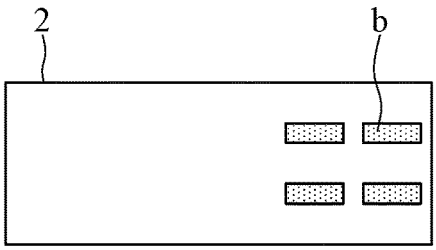
FIG. 29 is a plan view schematically illustrating two rows of two soldering pads of the bendable circuit sheet of the LED light strip of the LED tube lamp according to yet still another embodiment.

For the sake of achieving scalability and compatibility, the amount of the soldering pads "b" on each end of the LED light strip 2 may be more than one such as two, three, four, or more than four. When there is only one soldering pad "b" provided at each end of the LED light strip 2, the two ends of the LED light strip 2 are electrically connected to the power supply 5 to form a loop, and various electrical components can be used. For example, a capacitance may be replaced by an inductance to perform current regulation. Referring to FIGS. 26 to 28, when each end of the LED light strip 2 has three soldering pads, the third soldering pad can be grounded; when each end of the LED light strip 2 has four soldering pads, the fourth soldering pad can be used as a signal input terminal. Correspondingly, in some embodiments, the power supply 5 should have same number of soldering pads "a" as that of the soldering pads "b" on the LED light strip 2. In some embodiments, as long as electrical short between the soldering pads "b" can be prevented, the soldering pads "b" should be arranged according to the dimension of the actual area for disposition, for example, three soldering pads can be arranged in a row or two rows. In other embodiments, the amount of the soldering pads "b" on the bendable circuit sheet of the LED light strip 2 may be reduced by rearranging the circuits on the bendable circuit sheet of the LED light strip 2. The lesser the amount of the soldering pads, the easier the fabrication process becomes. On the other hand, a greater number of soldering pads may improve and secure the electrical connection between the LED light strip 2 and the output terminal of the power supply 5.

Referring to FIG. 30, in another embodiment, each of the soldering pads "b" is formed with a through hole "e" having a diameter generally of about 1 to 2 mm, in some preferred embodiments of about 1.2 to 1.8 mm, and in yet further preferred embodiments of about 1.5 mm. The through hole "e" communicates the soldering pad "a" with the soldering pad "b" so that the tin solder on the soldering pads "a" passes through the through holes "e" and finally reach the soldering pads "b". A smaller through hole "e" would make it difficult for the tin solder to pass. The tin solder accumulates around the through holes "e" upon exiting the through holes "e" and condense to form a solder ball "g" with a larger diameter than that of the through holes "e" upon condensing. Such a solder ball "g" functions as a rivet to further increase the stability of the electrical connection between the soldering pads "a" on the power supply 5 and the soldering pads "b" on the LED light strip 2.

Figure 31:
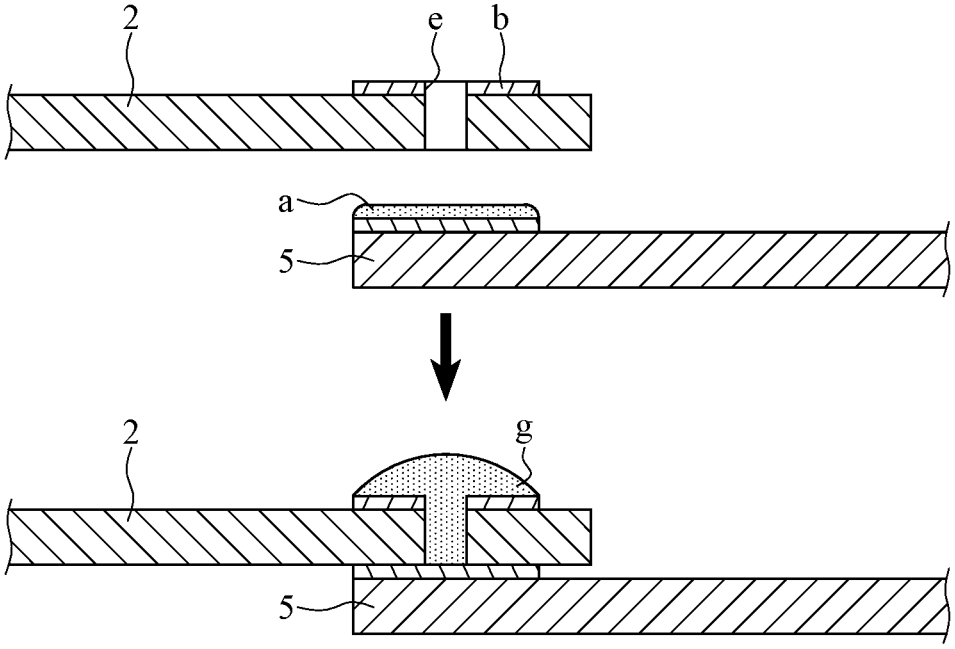
FIG. 31 is a plan cross-sectional view schematically illustrating a soldering bonding process utilizing the soldering pads of the bendable circuit sheet of the LED light strip of FIG. 30 taken from side view and the printed circuit board of the power supply according to one embodiment.
Figure 32:
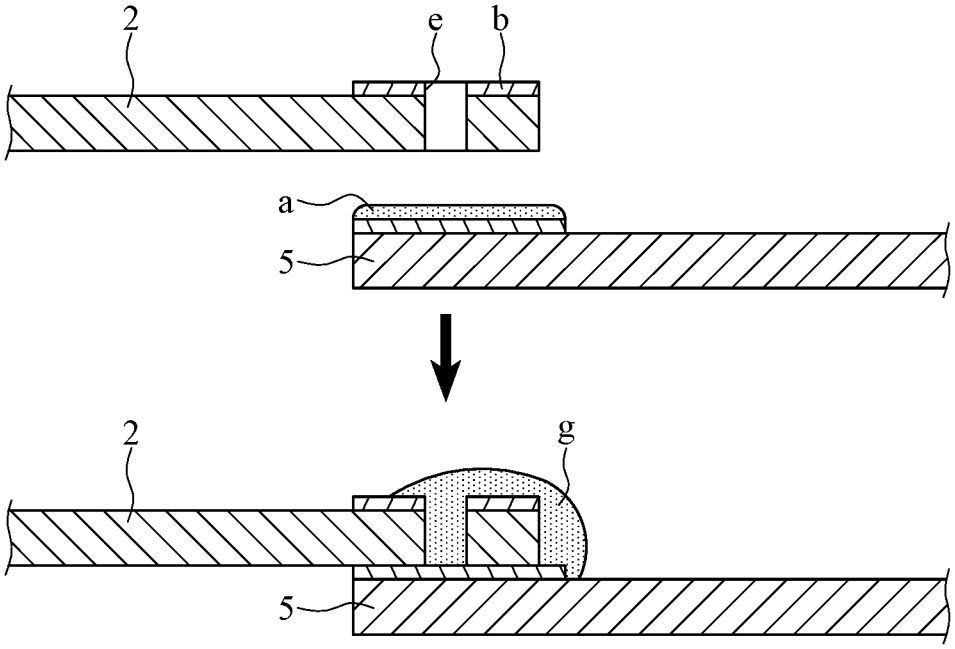
FIG. 32 is a plan cross-sectional view schematically illustrating a soldering bonding process utilizing the soldering pads of the bendable circuit sheet of the LED light strip of FIG. 30 taken from side view and the printed circuit board of the power supply according to another embodiment, wherein the through hole of the soldering pads is near the edge of the bendable circuit sheet.
Figure 33:
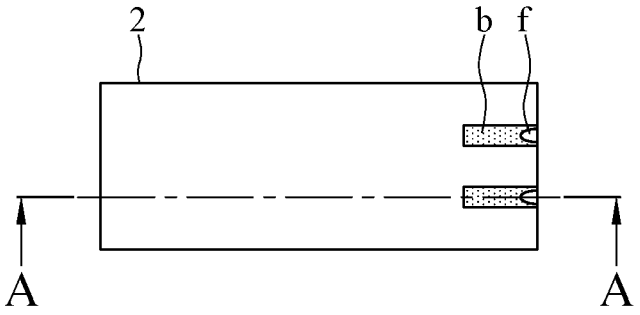
FIG. 33 is a plan view schematically illustrating notches formed on the soldering pads of the bendable circuit sheet of the LED light strip of the LED tube lamp according to one embodiment.
Figure 34:
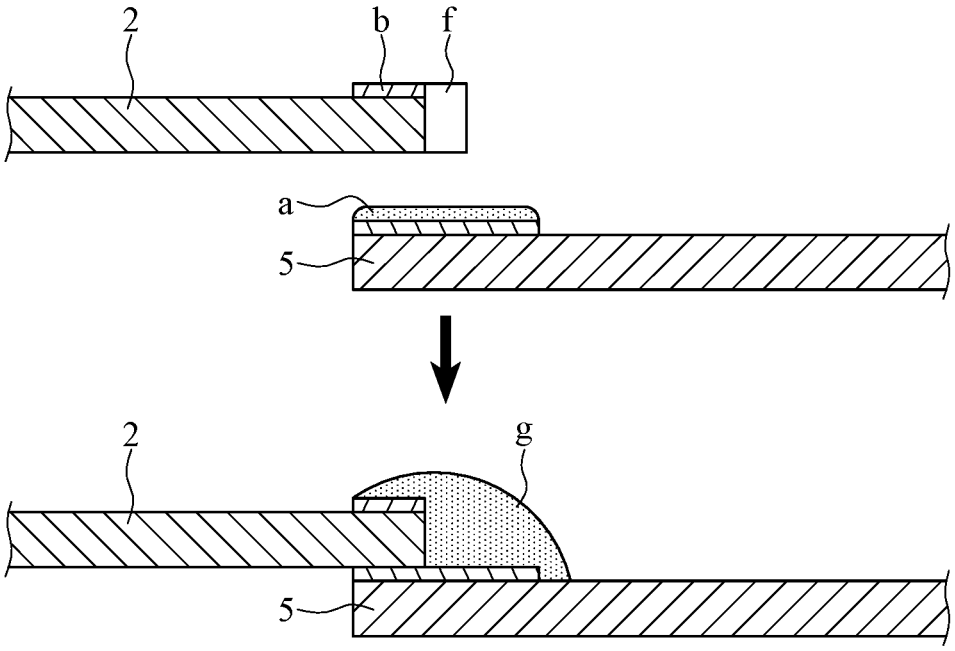
FIG. 34 is an exemplary plan cross-sectional view of FIG. 33 taken along a line A-A'.

Referring to FIGS. 31 to 32, in other embodiments, when a distance from the through hole "e" to the side edge of the LED light strip 2 is less than a particular distance (e.g., 1 mm), the tin solder may pass through the through hole "e" to accumulate on the periphery of the through hole "e", and extra tin solder may spill over the soldering pads "b" to reflow along the side edge of the LED light strip 2 and join the tin solder on the soldering pads "a" of the power supply 5. The tin solder then condenses to form a structure like a rivet to firmly secure the LED light strip 2 onto the printed circuit board of the power supply 5 such that reliable electric connection is achieved. Referring to FIGS. 33 and 34, in another embodiment, the through hole "e" can be replaced by a notch "f" formed at the side edge of the soldering pads "b" for the tin solder to easily pass through the notch "f" and accumulate on the periphery of the notch "f" and to form a solder ball with a larger diameter than that of the notch "e" upon condensing. Such a solder ball may be formed like a C-shape rivet to enhance the secure capability of the electrically connecting structure.

Figure 40:
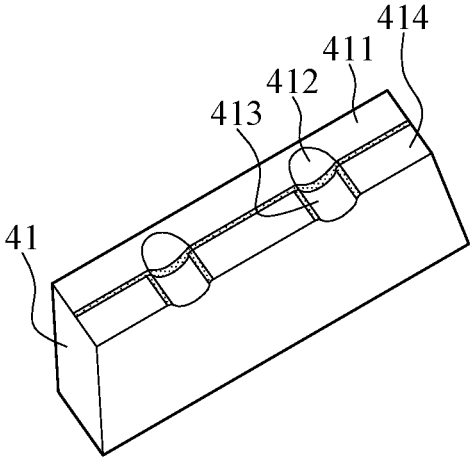
FIG. 40 is a perspective view illustrating a thermos-compression head used in soldering the bendable circuit sheet of the LED light strip and the printed circuit board of the power supply according to one embodiment.

The abovementioned through hole "e" or notch "f" might be formed in advance of soldering or formed by direct punching with a thermo-compression head, as shown in FIG. 40, during soldering. The portion of the thermo-compression head for touching the tin solder may be flat, concave, or convex, or any combination thereof. The portion of the thermo-compression head for restraining the object to be soldered such as the LED light strip 2 may be strip-like or grid-like. The portion of the thermo-compression head for touching the tin solder does not completely cover the through hole "e" or the notch "f" to make sure that the tin solder is able to pass through the through hole "e" or the notch "f". The portion of the thermo-compression head being concave may function as a room to receive the solder ball.

Referring to FIG. 40, a thermo-compression head 41 used for bonding the soldering pads "a" on the power supply 5 and the soldering pads "b" on the light strip 2 is mainly composed of four sections: a bonding plane 411, a plurality of concave guiding tanks 412, a plurality of concave molding tanks 413, and a restraining plane 414. The bonding plane 411 is a portion actually touching, pressing and heating the tin solder to perform soldering bonding. The bonding plane 411 may be flat, concave, convex or any combination thereof. The concave guiding tanks 412 are formed on the bonding plane 411 and opened near an edge of the bonding plane 411 to guide the heated and melted tin solder to flow into the through holes or notches formed on the soldering pads. For example, the guiding tanks 412 may function to guide and stop the melted tin solders. The concave molding tanks 413 are positioned beside the guiding tanks 412 and have a concave portion more depressed than that of the guiding tanks 412 such that the concave molding tanks 413 each form a housing to receive the solder ball. The restraining plane 414 is a portion next to the bonding plane 411 and formed with the concave molding tanks 413. The restraining plane 414 is lower than the bonding plane 411 such that the restraining plane 414 firmly presses the LED light strip 2 on the printed circuit board of the power supply 5 while the bonding plane 411 presses against the soldering pads "b" during the soldering bonding. The restraining plane 414 may be strip-like or grid-like on surface. The difference of height of the bonding plane 411 and the restraining plane 414 is the thickness of the LED light strip 2.

Figure 41:
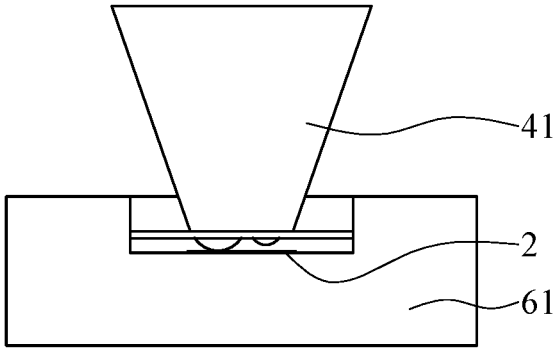
FIG. 41 is a plan view schematically illustrating the thickness difference between two solders on the pads of the bendable circuit sheet of the LED light strip or the printed circuit board of the power supply according to one embodiment.

Referring to FIGS. 41, 25, and 40, soldering pads corresponding to the soldering pads of the LED light strip are formed on the printed circuit board of the power supply 5 and tin solder is reserved on the soldering pads on the printed circuit board of the power supply 5 for subsequent soldering bonding performed by an automatic soldering bonding machine. The tin solder in some embodiments has a thickness of about 0.3 mm to about 0.5 mm such that the LED light strip 2 can be firmly soldered to the printed circuit board of the power supply 5. As shown in FIG. 41, in case of having height difference between two tin solders respectively reserved on two soldering pads on the printed circuit board of the power supply 5, the higher one will be touched first and melted by the thermo-compression head 41 while the other one will be touched and start to melt until the higher one is melted to a height the same as the height of the other one. This usually incurs unsecured soldering bonding for the reserved tin solder with smaller height, and therefore affects the electrical connection between the LED light strip 2 and the printed circuit board of the power supply 5. To alleviate these effects, in one embodiment, the kinetic equilibrium principal is applied and a linkage mechanism is installed on the thermo-compression head 41 to allow rotation of the thermo-compression head 41 during a soldering bonding such that the thermo-compression head 41 starts to heat and melt the two reserved tin solders only when the thermo-compression head 41 detects that the pressure on the two reserved tin solders are the same.

Figure 42:
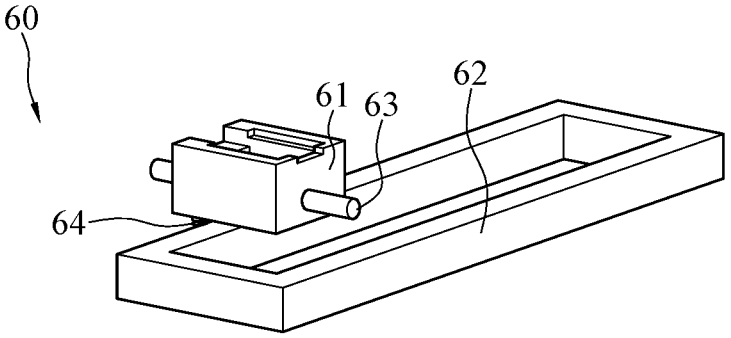
FIG. 42 is a perspective view schematically illustrating the soldering vehicle for soldering the bendable circuit sheet of the LED light strip and the printed circuit board of the power supply according to one embodiment.
Figure 43:
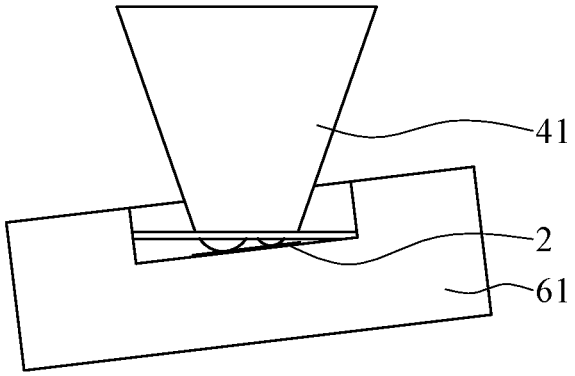
FIG. 43 is an exemplary plan view schematically illustrating a rotation status of the rotary platform of the soldering vehicle in FIG. 41.

In the abovementioned embodiment, the thermo-compression head 41 is rotatable while the LED light strip 2 and the printed circuit board of the power supply 5 remain unmoved. Referring to FIG. 42, in another embodiment, the thermo-compression head 41 is unmoved while the LED light strip is allowed to rotate. In this embodiment, the LED light strip 2 and the printed circuit board of the power supply 5 are loaded on a soldering vehicle 60 including a rotary platform 61, a vehicle holder 62, a rotating shaft 63, and two elastic members 64. The rotary platform 61 functions to carry the LED light strip 2 and the printed circuit board of the power supply 5. The rotary platform 61 is movably mounted to the vehicle holder 62 via the rotating shaft 63 so that the rotary platform 61 is able to rotate with respect to the vehicle holder 62 while the vehicle holder 62 bears and holds the rotary platform 61. The two elastic members 64 are disposed on two sides of the rotating shaft 63, respectively, such that the rotary platform 61 in connection with the rotating shaft 63 always remains at the horizontal level when the rotary platform 61 is not loaded. In this embodiment, the elastic members 64 are springs for example, and the ends thereof are disposed corresponding to two sides of the rotating shaft 63 so as to function as two pivots on the vehicle holder 62. As shown in FIG. 42, when two tin solders reserved on the LED light strip 2 pressed by the thermo-compression head 41 are not at the same height level, the rotary platform 61 carrying the LED light strip 2 and the printed circuit board of the power supply 5 will be driven by a rotating shaft 63 to rotate until the thermo-compression head 41 detects the same pressure on the two reserved tin solders, and then starts a soldering bonding. Referring to FIG. 43, when the rotary platform 61 rotates, the elastic members 64 at two sides of the rotating shaft 63 are compressed or pulled; and the driving force of the rotating shaft 63 releases and the rotary platform 61 returns to the original height level by the resilience of the elastic members 64 when the soldering bonding is completed.

In other embodiments, the rotary platform 61 may be designed to have mechanisms without using the rotating shaft 63 and the elastic members 64. For example, the rotary platform 61 may be designed to have driving motors and active rotary mechanisms, and therefore the vehicle holder 62 is saved. Accordingly, other embodiments utilizing the kinetic equilibrium principle to drive the LED light strip 2 and the printed circuit board of the power supply 5 to move in order to complete the soldering bonding process are within the spirit of the embodiment.

Figure 35:
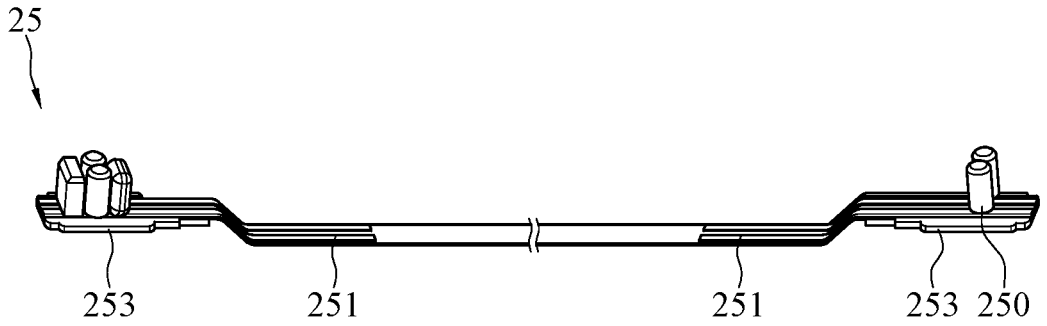
FIG. 35 is a perspective view schematically illustrating a circuit board assembly composed of the bendable circuit sheet of the LED light strip and the printed circuit board of the power supply according to another embodiment.
Figure 36:
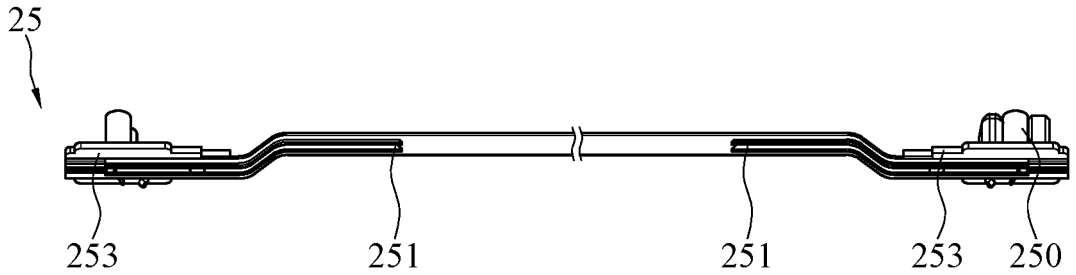
FIG. 36 is a perspective view schematically illustrating another arrangement of the circuit board assembly of FIG. 35.

Referring to FIGS. 35 and 36, in another embodiment, the LED light strip 2 and the power supply 5 may be connected by utilizing a circuit board assembly 25 instead of solder bonding. The circuit board assembly 25 has a long circuit sheet 251 and a short circuit board 253 that are adhered to each other with the short circuit board 253 being adjacent to the side edge of the long circuit sheet 251. The short circuit board 253 may be provided with power supply module 250 to form the power supply 5. The short circuit board 253 is stiffer or more rigid than the long circuit sheet 251 to be able to support the power supply module 250.

The long circuit sheet 251 may be the bendable circuit sheet of the LED light strip including a wiring layer **2*a* as shown in FIG. 23. The wiring layer 2*a* of the long circuit sheet 251 and the power supply module 250 may be electrically connected in various manners depending on the demand in practice. As shown in FIG. 35, the power supply module 250 and the long circuit sheet 251 having the wiring layer 2***a* on a surface are on the same side of the short circuit board 253 such that the power supply module 250 is directly connected to the long circuit sheet 251. As shown in FIG. 36, alternatively, the power supply module 250 and the long circuit sheet 251 including the wiring layer 2*a* on a surface are on opposite sides of the short circuit board 253 such that the power supply module 250 is directly connected to the short circuit board 253 and indirectly connected to the wiring layer 2*a* of the LED light strip 2 by way of the short circuit board 253.

As shown in FIG. 35, in one embodiment, the long circuit sheet 251 and the short circuit board 253 are adhered together first, and the power supply module 250 is subsequently mounted on the wiring layer 2*a* of the long circuit sheet 251 serving as the LED light strip 2. The long circuit sheet 251 of the LED light strip 2 herein is not limited to include only one wiring layer 2*a* and may further include another wiring layer such as the wiring layer 2*c* shown in FIG. 48. The light sources 202 are disposed on the wiring layer 2*a* of the LED light strip 2 and electrically connected to the power supply 5 by way of the wiring layer 2*a*. As shown in FIG. 36, in another embodiment, the long circuit sheet 251 of the LED light strip 2 may include a wiring layer 2*a* and a dielectric layer 2*b*. The dielectric layer 2*b* may be adhered to the short circuit board 253 first and the wiring layer 2*a* is subsequently adhered to the dielectric layer 2*b* and extends to the short circuit board 253. All these embodiments are within the scope of applying the circuit board assembly concept of the embodiment.

In the above-mentioned embodiments, the short circuit board 253 may have a length generally of about 15 mm to about 40 mm and in some embodiments about 19 mm to about 36 mm, while the long circuit sheet 251 may have a length generally of about 800 mm to about 2800 mm and in some embodiments of about 1200 mm to about 2400 mm. A ratio of the length of the short circuit board 253 to the length of the long circuit sheet 251 ranges from, for example, about 1:20 to about 1:200.

When the ends of the LED light strip 2 are not fixed on the inner surface of the lamp tube 1, the connection between the LED light strip 2 and the power supply 5 via soldering bonding could not firmly support the power supply 5, and it may be necessary to dispose the power supply 5 inside the end cap 3. For example, a longer end cap to have enough space for receiving the power supply 5 would be needed. However, this will reduce the length of the lamp tube under the prerequisite that the total length of the LED tube lamp is fixed according to the product standard, and may therefore decrease the effective illuminating areas.

Referring to FIG. 39, in one embodiment, a hard circuit board 22 made of aluminum is used instead of the bendable circuit sheet, such that the ends or terminals of the hard circuit board 22 can be mounted at ends of the lamp tube 1, and the power supply 5 is solder bonded to one of the ends or terminals of the hard circuit board 22 in a manner such that the printed circuit board of the power supply 5 is not parallel but may be perpendicular to the hard circuit board 22 to save space in the longitudinal direction used for the end cap. This solder bonding technique may be more convenient to accomplish and the effective illuminating areas of the LED tube lamp could also remain. Moreover, a conductive lead 53 for electrical connection with the end cap 3 could be formed directly on the power supply 5 without soldering other metal wires between the power supply 5 and the hollow conductive pin 301 as shown in FIG. 3, and which facilitates the manufacturing of the LED tube lamp.

Next, examples of the circuit design and using of the power supply module 250 are described as follows.

Figure 49A:
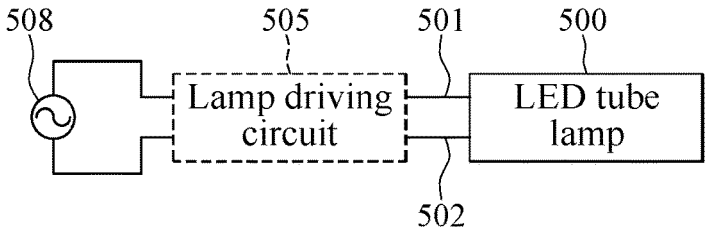
FIG. 49A is a block diagram of an exemplary power supply system for an LED tube lamp according to some embodiments.

FIG. 49A is a block diagram of an exemplary power supply system for an LED tube lamp according to some embodiments. Referring to FIG. 49A, an AC power supply 508 is used to supply an AC supply signal, and may be an AC power line with a voltage rating, for example, of 100-277 volts and a frequency rating, for example, of 50 or 60 Hz. A lamp driving circuit 505 receives and then converts the AC supply signal into an AC driving signal as an external driving signal (external, in that it is external to the LED tube lamp). Lamp driving circuit 505 may be for example an electronic ballast used to convert the AC power line into a high-frequency high-voltage AC driving signal. Common types of electronic ballast include instant-start ballast, programmed-start or rapid-start ballast, etc., which may all be applicable to the LED tube lamp of the present disclosure. The voltage of the AC driving signal is, in some embodiments, higher than 300 volts, and is in some embodiments in the range of about 400-700 volts. The frequency of the AC driving signal is in some embodiments higher than 10 k Hz, and is in some embodiments in the range of about 20 k-50 k Hz. The LED tube lamp 500 receives an external driving signal and is thus driven to emit light via the LED light sources 202. In one embodiment, the external driving signal comprises the AC driving signal from lamp driving circuit 505. In one embodiment, LED tube lamp 500 is in a driving environment in which it is power-supplied at only one end cap having two conductive pins 501 and 502, which are coupled to the lamp driving circuit 505 to receive the AC driving signal. The two conductive pins 501 and 502 may be electrically and physically connected to, either directly or indirectly, the lamp driving circuit 505. The two conductive pins 501 and 502 may be formed, for example, of a conductive material such as a metal. The conductive pins may have, for example, a protruding rod-shape, or a ball shape. Conductive pins such as 501 and 502 may be generally referred to as external connection terminals, for connecting the LED tube lamp 500 to an external socket. According to this exemplary embodiment, conductive pin 501 may be referred to as the first external connection terminal, and conductive pin 502 may be referred to as the second external connection terminal. The external connection terminals (e.g., the first and second external connection terminals) may have an elongated shape, a ball shape, or in some embodiments, may even be flat or may have a female-type connection for connecting to protruding male connectors in a lamp socket. In various embodiments, the number of the conductive pins may be more than two. And the number of the conductive pins can vary depending on the needs of different applications.

In some embodiments, lamp driving circuit 505 may be omitted and is therefore depicted by a dotted line. In one embodiment, if lamp driving circuit 505 is omitted, AC power supply 508 is directly connected to pins 501 and 502, which then receive the AC supply signal as an external driving signal.

Figure 49B:
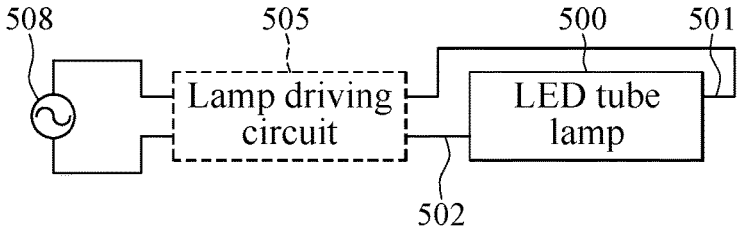
FIG. 49B is a block diagram of an exemplary power supply system for an LED tube lamp according to some embodiments.

In addition to the above use with a single-end power supply, LED tube lamp 500 may instead be used with a dual-end power supply to have one pin at each of the two ends of an LED lamp tube. FIG. 49B is a block diagram of an exemplary power supply system for an LED tube lamp according to some embodiments. Referring to FIG. 49B, compared to that shown in FIG. 49A, pins 501 and 502 are respectively disposed at the two opposite end caps of LED tube lamp 500, forming a single pin at each end of LED tube lamp 500, with other components and their functions being the same as those illustrated in FIG. 49A.

Figure 49C:
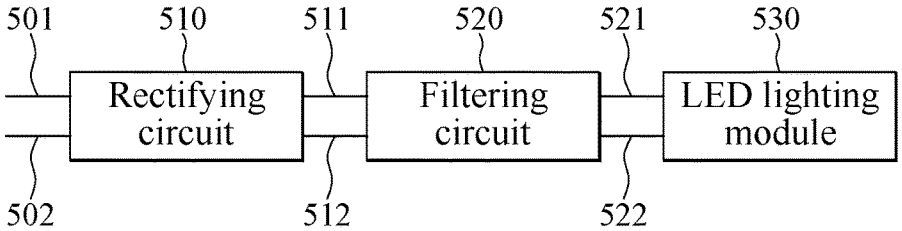
FIG. 49C is a block diagram showing elements of an exemplary LED lamp according to some embodiments.

FIG. 49C is a block diagram showing elements of an exemplary LED lamp according to some embodiments. Referring to FIG. 49C, the power supply module 250 of the LED lamp may include a rectifying circuit 510 and a filtering circuit 520, and may also include some components of an LED lighting module 530. Rectifying circuit 510 is coupled to pins 501 and 502 to receive and then rectify an external driving signal, so as to output a rectified signal at output terminals 511 and 512. The external driving signal may be the AC driving signal or the AC supply signal described with reference to FIGS. 49A and 49B, or may even be a DC signal, which in some embodiments does not alter the LED lamp of the present disclosure. Filtering circuit 520 is coupled to the first rectifying circuit for filtering the rectified signal to produce a filtered signal. For instance, filtering circuit 520 is coupled to terminals 511 and 512 to receive and then filter the rectified signal, so as to output a filtered signal at output terminals 521 and 522. LED lighting module 530 is coupled to filtering circuit 520, to receive the filtered signal for emitting light. For instance, LED lighting module 530 may include a circuit coupled to terminals 521 and 522 to receive the filtered signal and thereby to drive an LED unit (e.g., LED light sources 202 on an LED light strip 2, as discussed above, and not shown in FIG. 49C). For example, as described in more detail below, LED lighting module 530 may include a driving circuit coupled to an LED module to emit light. Details of these operations are described in below descriptions of certain embodiments.

In some embodiments, although there are two output terminals 511 and 512 and two output terminals 521 and 522 in embodiments of these Figs., in practice the number of ports or terminals for coupling between rectifying circuit 510, filtering circuit 520, and LED lighting module 530 may be one or more depending on the needs of signal transmission between the circuits or devices.

In addition, the power supply module of the LED lamp described in FIG. 49B, and embodiments of the power supply module of an LED lamp described below, may each be used in the LED tube lamp 500 in FIGS. 49A and 49B, and may instead be used in any other type of LED lighting structure having two conductive pins used to conduct power, such as LED light bulbs, personal area lights (PAL), plug-in LED lamps with different types of bases (such as types of PL-S, PL-D, PL-T, PL-L, etc.), etc.

Figure 49D:
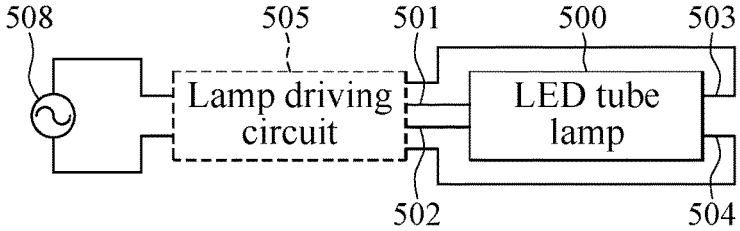
FIG. 49D is a block diagram of an exemplary power supply system for an LED tube lamp according to some embodiments.

FIG. 49D is a block diagram of an exemplary power supply system for an LED tube lamp according to some embodiments. Referring to FIG. 49D, an AC power supply 508 is used to supply an AC supply signal. A lamp driving circuit 505 receives and then converts the AC supply signal into an AC driving signal. An LED tube lamp 500 receives an AC driving signal from lamp driving circuit 505 and is thus driven to emit light. In this embodiment, LED tube lamp 500 is power-supplied at its both end caps respectively having two pins 501 and 502 and two pins 503 and 504, which are coupled to lamp driving circuit 505 to concurrently receive the AC driving signal to drive an LED unit (not shown) in LED tube lamp 500 to emit light. AC power supply 508 may be, e.g., the AC power line, and lamp driving circuit 505 may be a stabilizer or an electrical ballast. It should be noted that different pins or external connection terminals described throughout this specification may be referred to as first pin/external connection terminal, second pin/external connection terminal, third pin/external connection terminal, etc., for discussion/description purposes. Therefore, in some situations, for example, external connection terminal 501 may be referred to as a first external connection terminal, and external connection terminal 503 may be referred to as a second external connection terminal. Also, the lamp tube may include two end caps respectively coupled to two ends thereof, and the pins may be coupled to the end caps, such that the pins are coupled to the lamp tube.

Figure 49E:
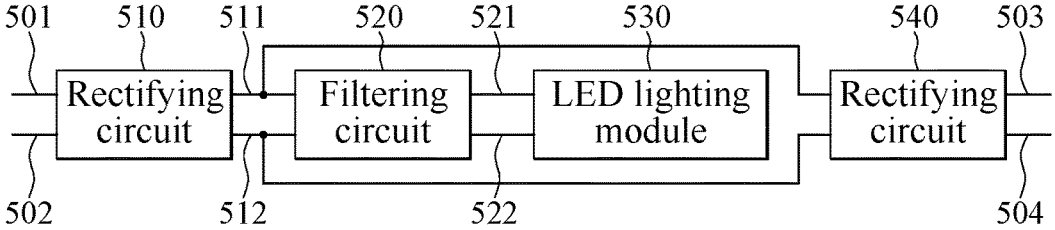
FIG. 49E is a block diagram showing elements of an LED lamp according to some embodiments.

FIG. 49E is a block diagram showing elements of an LED lamp according to some embodiments. Referring to FIG. 49E, the power supply module of the LED lamp includes a rectifying circuit 510, a filtering circuit 520, and a rectifying circuit 540, and may also include some components of an LED lighting module 530. Rectifying circuit 510 is coupled to pins 501 and 502 to receive and then rectify an external driving signal conducted by pins 501 and 502. Rectifying circuit 540 is coupled to pins 503 and 504 to receive and then rectify an external driving signal conducted by pins 503 and 504. Therefore, the power supply module of the LED lamp may include two rectifying circuits 510 and 540 configured to output a rectified signal at output terminals 511 and 512. Filtering circuit 520 is coupled to terminals 511 and 512 to receive and then filter the rectified signal, so as to output a filtered signal at output terminals 521 and 522. LED lighting module 530 is coupled to terminals 521 and 522 to receive the filtered signal and thereby to drive an LED unit (not shown) of LED lighting module 530 to emit light.

The power supply module of the LED lamp in this embodiment of FIG. 49E may be used in LED tube lamp 500 with a dual-end power supply in FIG. 49D. In some embodiments, since the power supply module of the LED lamp comprises rectifying circuits 510 and 540, the power supply module of the LED lamp may be used in LED tube lamps 500 with a single-end power supply in FIGS. 49A and 49B, to receive an external driving signal (such as the AC supply signal or the AC driving signal described above). The power supply module of an LED lamp in this embodiment and other embodiments herein may also be used with a DC driving signal.

Figure 50A:
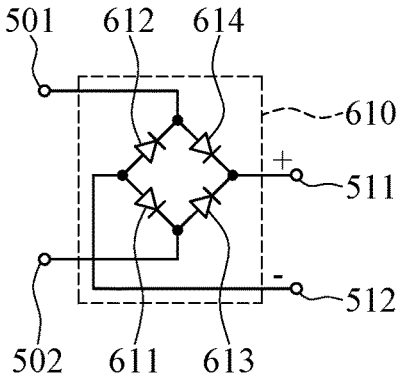
FIG. 50A is a schematic diagram of a rectifying circuit according to some embodiments.

FIG. 50A is a schematic diagram of a rectifying circuit according to some embodiments. Referring to FIG. 50A, rectifying circuit 610 includes rectifying diodes 611, 612, 613, and 614, configured to full-wave rectify a received signal. Diode 611 has an anode connected to output terminal 512, and a cathode connected to pin 502. Diode 612 has an anode connected to output terminal 512, and a cathode connected to pin 501. Diode 613 has an anode connected to pin 502, and a cathode connected to output terminal 511. Diode 614 has an anode connected to pin 501, and a cathode connected to output terminal 511.

When pins 501 and 502 (generally referred to as (external connection) terminals) receive an AC signal, rectifying circuit 610 operates as follows. During the connected AC signal's positive half cycle, the AC signal is input through pin 501, diode 614, and output terminal 511 in sequence, and later output through output terminal 512, diode 611, and pin 502 in sequence. During the connected AC signal's negative half cycle, the AC signal is input through pin 502, diode 613, and output terminal 511 in sequence, and later output through output terminal 512, diode 612, and pin 501 in sequence. Therefore, during the connected AC signal's full cycle, the positive pole of the rectified signal produced by rectifying circuit 610 remains at output terminal 511, and the negative pole of the rectified signal remains at output terminal 512. Accordingly, the rectified signal produced or output by rectifying circuit 610 is a full-wave rectified signal.

When pins 501 and 502 are coupled to a DC power supply to receive a DC signal, rectifying circuit 610 operates as follows. When pin 501 is coupled to the anode of the DC supply and pin 502 to the cathode of the DC supply, the DC signal is input through pin 501, diode 614, and output terminal 511 in sequence, and later output through output terminal 512, diode 611, and pin 502 in sequence. When pin 501 is coupled to the cathode of the DC supply and pin 502 to the anode of the DC supply, the DC signal is input through pin 502, diode 613, and output terminal 511 in sequence, and later output through output terminal 512, diode 612, and pin 501 in sequence. Therefore, no matter what the electrical polarity of the DC signal is between pins 501 and 502, the positive pole of the rectified signal produced by rectifying circuit 610 remains at output terminal 511, and the negative pole of the rectified signal remains at output terminal 512.

Therefore, rectifying circuit 610 in this embodiment can output or produce a proper rectified signal regardless of whether the received input signal is an AC or DC signal.

Figure 50B:
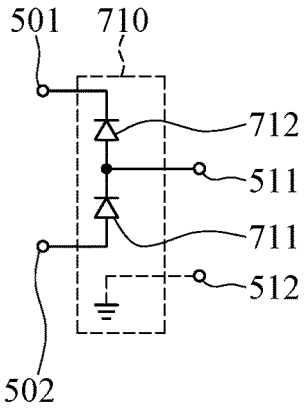
FIG. 50B is a schematic diagram of a rectifying circuit according to some embodiments.

FIG. 50B is a schematic diagram of a rectifying circuit according to some embodiments. Referring to FIG. 50B, rectifying circuit 710 includes rectifying diodes 711 and 712, configured to half-wave rectify a received signal. Diode 711 has an anode connected to pin 502, and a cathode connected to output terminal 511. Diode 712 has an anode connected to output terminal 511, and a cathode connected to pin 501. Output terminal 512 may be omitted or grounded depending on actual applications.

Next, exemplary operation(s) of rectifying circuit 710 is described as follows.

In one embodiment, during a received AC signal's positive half cycle, the electrical potential at pin 501 is higher than that at pin 502, so diodes 711 and 712 are both in a cutoff state as being reverse-biased, making rectifying circuit 710 not outputting a rectified signal. During a received AC signal's negative half cycle, the electrical potential at pin 501 is lower than that at pin 502, so diodes 711 and 712 are both in a conducting state as being forward-biased, allowing the AC signal to be input through diode 711 and output terminal 511, and later output through output terminal 512, a ground terminal, or another end of the LED tube lamp not directly connected to rectifying circuit 710. Accordingly, the rectified signal produced or output by rectifying circuit 710 is a half-wave rectified signal.

Figure 50C:
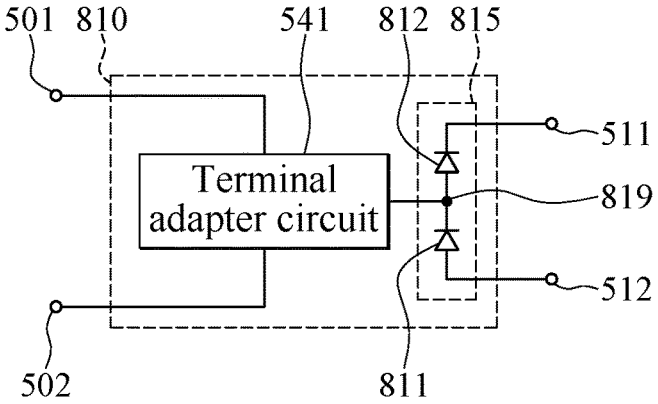
FIG. 50C is a schematic diagram of a rectifying circuit according to some embodiments.

FIG. 50C is a schematic diagram of a rectifying circuit according to some embodiments. Referring to FIG. 50C, rectifying circuit 810 includes a rectifying unit 815 and a terminal adapter circuit 541. In this embodiment, rectifying unit 815 comprises a half-wave rectifier circuit including diodes 811 and 812 and configured to half-wave rectify. Diode 811 has an anode connected to an output terminal 512, and a cathode connected to a half-wave node 819. Diode 812 has an anode connected to half-wave node 819, and a cathode connected to an output terminal 511. Terminal adapter circuit 541 is coupled to half-wave node 819 and pins 501 and 502, to transmit a signal received at pin 501 and/or pin 502 to half-wave node 819. By means of the terminal adapting function of terminal adapter circuit 541, rectifying circuit 810 includes two input terminals (connected to pins 501 and 502) and two output terminals 511 and 512.

Next, in certain embodiments, rectifying circuit 810 operates as follows.

During a received AC signal's positive half cycle, the AC signal may be input through pin 501 or 502, terminal adapter circuit 541, half-wave node 819, diode 812, and output terminal 511 in sequence, and later output through another end or circuit of the LED tube lamp. During a received AC signal's negative half cycle, the AC signal may be input through another end or circuit of the LED tube lamp, and later output through output terminal 512, diode 811, half-wave node 819, terminal adapter circuit 541, and pin 501 or 502 in sequence.

Terminal adapter circuit 541 may comprise a resistor, a capacitor, an inductor, or any combination thereof, for performing functions of voltage/current regulation or limiting, types of protection, current/voltage regulation, etc. Descriptions of these functions are presented below.

Figure 50D:
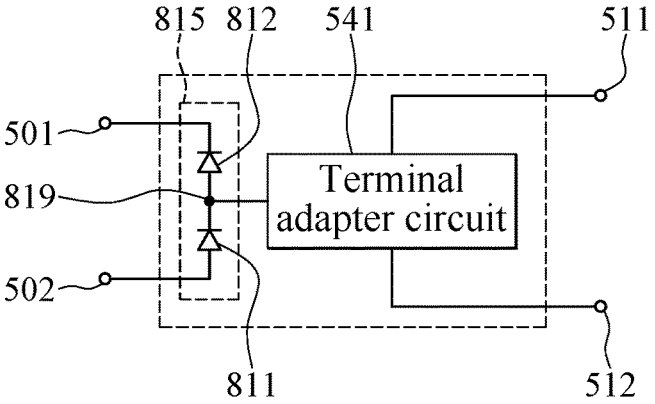
FIG. 50D is a schematic diagram of a rectifying circuit according to some embodiments.

In practice, rectifying unit 815 and terminal adapter circuit 541 may be interchanged in position (as shown in FIG. 50D), without altering the function of half-wave rectification. FIG. 50D is a schematic diagram of a rectifying circuit according to some embodiments. Referring to FIG. 50D, diode 811 has an anode connected to pin 502 and diode 812 has a cathode connected to pin 501. A cathode of diode 811 and an anode of diode 812 are connected to half-wave node 819. Terminal adapter circuit 541 is coupled to half-wave node 819 and output terminals 511 and 512. During a received AC signal's positive half cycle, the AC signal may be input through another end or circuit of the LED tube lamp, and later output through output terminal 511 or 512, terminal adapter circuit 541, half-wave node 819, diode 812, and pin 501 in sequence. During a received AC signal's negative half cycle, the AC signal may be input through pin 502, diode 811, half-wave node 819, terminal adapter circuit 541, and output node 511 or 512 in sequence, and later output through another end or circuit of the LED tube lamp.

Terminal adapter circuit 541 in embodiments shown in FIGS. 50C and 50D may be omitted and is therefore depicted by a dotted line. If terminal adapter circuit 541 of FIG. 50C is omitted, pins 501 and 502 will be coupled to half-wave node 819. If terminal adapter circuit 541 of FIG. 50D is omitted, output terminals 511 and 512 will be coupled to half-wave node 819.

Rectifying circuit 510 as shown and explained in FIGS. 50A-D can constitute or be the rectifying circuit 540 shown in FIG. 49E, as having pins 503 and 504 for conducting instead of pins 501 and 502.

Next, an explanation follows as to choosing embodiments and their combinations of rectifying circuits 510 and 540, with reference to FIGS. 49C and 49E.

Rectifying circuit 510 in embodiments shown in FIG. 49C may comprise the rectifying circuit 610 in FIG. 50A.

Rectifying circuits 510 and 540 in embodiments shown in FIG. 49E may each comprise, for example, any one of the rectifying circuits in FIGS. 50A-D, and terminal adapter circuit 541 in FIGS. 50C-D may be omitted without altering the rectification function used in an LED tube lamp. When rectifying circuits 510 and 540 each comprise a half-wave rectifier circuit described in FIGS. 50B-D, during a received AC signal's positive or negative half cycle, the AC signal may be input from one of rectifying circuits 510 and 540, and later output from the other rectifying circuit 510 or 540. Further, when rectifying circuits 510 and 540 each comprise the rectifying circuit described in FIG. 50C or 50D, or when they comprise the rectifying circuits in FIGS. 50C and 50D respectively, only one terminal adapter circuit 541 may be needed for functions of voltage/current regulation or limiting, types of protection, current/voltage regulation, etc. within rectifying circuits 510 and 540, omitting another terminal adapter circuit 541 within rectifying circuit 510 or 540.

Figure 51A:
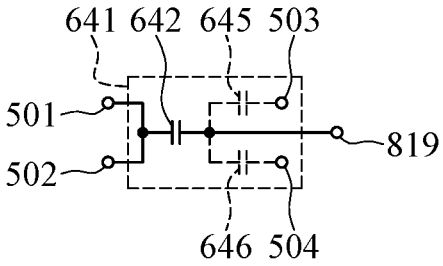
FIG. 51A is a schematic diagram of a terminal adapter circuit according to some embodiments.

FIG. 51A is a schematic diagram of a terminal adapter circuit according to some embodiments. Referring to FIG.

51A, terminal adapter circuit 641 comprises a capacitor 642 having an end connected to pins 501 and 502, and another end connected to half-wave node 819. In one embodiment, capacitor 642 has an equivalent impedance to an AC signal, which impedance increases as the frequency of the AC signal decreases, and decreases as the frequency increases. Therefore, capacitor 642 in terminal adapter circuit 641 in this embodiment works as a high-pass filter. Further, terminal adapter circuit 641 is connected in series to an LED unit in the LED tube lamp, producing an equivalent impedance of terminal adapter circuit 641 to perform a current/voltage limiting function on the LED unit, thereby preventing damaging of the LED unit by an excessive voltage across and/or current in the LED unit. In addition, choosing the value of capacitor 642 according to the frequency of the AC signal can further enhance voltage/current regulation.

Terminal adapter circuit 641 may further include a capacitor 645 and/or capacitor 646. Capacitor 645 has an end connected to half-wave node 819, and another end connected to pin 503. Capacitor 646 has an end connected to half-wave node 819, and another end connected to pin 504. For example, half-wave node 819 may be a common connective node between capacitors 645 and 646. And capacitor 642 acting as a current regulating capacitor is coupled to the common connective node and pins 501 and 502. In such a structure, series-connected capacitors 642 and 645 exist between one of pins 501 and 502 and pin 503, and/or series-connected capacitors 642 and 646 exist between one of pins 501 and 502 and pin 504. Through equivalent impedances of series-connected capacitors, voltages from the AC signal are divided. Referring to FIGS. 49E and 51A, according to ratios between equivalent impedances of the series-connected capacitors, the voltages respectively across capacitor 642 in rectifying circuit 510, filtering circuit 520, and LED lighting module 530 can be controlled, making the current flowing through an LED module in LED lighting module 530 being limited within a current rating, and then protecting/preventing filtering circuit 520 and LED module from being damaged by excessive voltages.

Figure 51B:
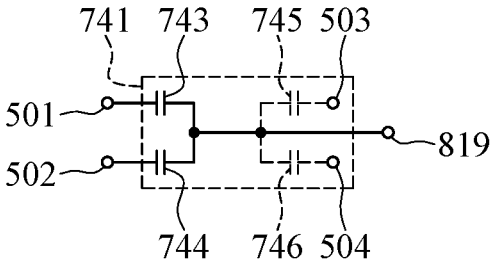
FIG. 51B is a schematic diagram of a terminal adapter circuit according to some embodiments.

FIG. 51B is a schematic diagram of a terminal adapter circuit according to some embodiments. Referring to FIG. 51B, terminal adapter circuit 741 comprises capacitors 743 and 744. Capacitor 743 has an end connected to pin 501, and another end connected to half-wave node 819. Capacitor 744 has an end connected to pin 502, and another end connected to half-wave node 819. Compared to terminal adapter circuit 641 in FIG. 51A, terminal adapter circuit 741 has capacitors 743 and 744 in place of capacitor 642. Capacitance values of capacitors 743 and 744 may be the same as each other, or may differ from each other depending on the magnitudes of signals to be received at pins 501 and 502.

Similarly, terminal adapter circuit 741 may further comprise a capacitor 745 and/or a capacitor 746, respectively connected to pins 503 and 504. Thus, each of pins 501 and 502 and each of pins 503 and 504 may be connected in series to a capacitor, to achieve the functions of voltage division and other protections.

Figure 51C:
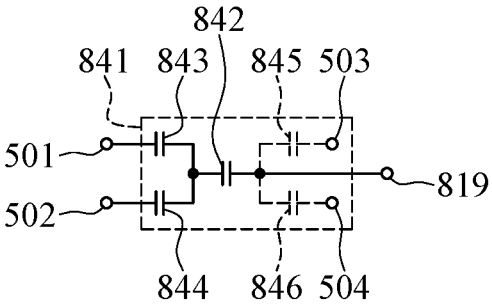
FIG. 51C is a schematic diagram of a terminal adapter circuit according to some embodiments.

FIG. 51C is a schematic diagram of a terminal adapter circuit according to some embodiments. Referring to FIG. 51C, terminal adapter circuit 841 comprises capacitors 842, 843, and 844. Capacitors 842 and 843 are connected in series between pin 501 and half-wave node 819. Capacitors 842 and 844 are connected in series between pin 502 and half-wave node 819. In such a circuit structure, if any one of capacitors 842, 843, and 844 is shorted, there is still at least one capacitor (of the other two capacitors) between pin 501 and half-wave node 819 and between pin 502 and half-wave node 819, which performs a current-limiting function. Therefore, in the event that a user accidentally gets an electric shock, this circuit structure will prevent an excessive current flowing through and then seriously hurting the body of the user.

Similarly, terminal adapter circuit 841 may further comprise a capacitor 845 and/or a capacitor 846, respectively connected to pins 503 and 504. Thus, each of pins 501 and 502 and each of pins 503 and 504 may be connected in series to a capacitor, to achieve the functions of voltage division and other protections.

Figure 51D:
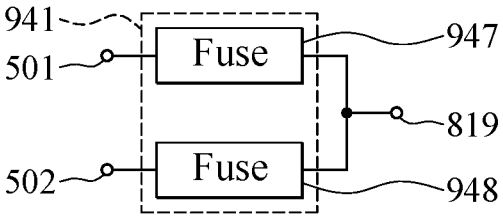
FIG. 51D is a schematic diagram of a terminal adapter circuit according to some embodiments.

FIG. 51D is a schematic diagram of a terminal adapter circuit according to some embodiments. Referring to FIG. 51D, terminal adapter circuit 941 comprises fuses 947 and 948. Fuse 947 has an end connected to pin 501, and another end connected to half-wave node 819. Fuse 948 has an end connected to pin 502, and another end connected to half-wave node 819. With the fuses 947 and 948, when the current through each of pins 501 and 502 exceeds a current rating of a corresponding connected fuse 947 or 948, the corresponding fuse 947 or 948 will accordingly melt and then break the circuit to achieve overcurrent protection. The terminal adapter circuits described above may be described as current limiting circuits, and/or voltage limiting circuits.

Each of the embodiments of the terminal adapter circuits as described in rectifying circuits 510 and 810 coupled to pins 501 and 502 and shown and explained above can be used or included in the rectifying circuit 540 shown in FIG. 49E, to be connected to conductive pins 503 and 504 in a similar manner as described above in connection with conductive pins 501 and 502.

Capacitance values of the capacitors in the embodiments of the terminal adapter circuits shown and described above are in some embodiments in the range, for example, of about 100 pF-100 nF. Also, a capacitor used in embodiments may be equivalently replaced by two or more capacitors connected in series or parallel. For example, each of capacitors 642 and 842 may be replaced by two series-connected capacitors, one having a capacitance value chosen from the range, for example of about 1.0 nF to about 2.5 nF and which may be in some embodiments preferably 1.5 nF, and the other having a capacitance value chosen from the range, for example of about 1.5 nF to about 3.0 nF, and which is in some embodiments about 2.2 nF.

In some embodiments, the LED tube lamp may include a current-limiting element. The current-limiting element can be coupled between at least one of the external connection terminals disposed at one end of the lamp tube and at least one of the external connection terminals disposed at the other end of the lamp tube. For example, the current-limiting element can be coupled between pins 501 and 503 or coupled between pins 502 and 504. The current-limiting element is coupled to at least one of the rectifying circuits 510 and 540. The current-limiting element is configured to receive the external driving signal input at one or more of the pins and limit the current level or the voltage level of the input external driving signal to protect the LED lamp from overcurrent or overvoltage damage. After receiving the external driving signal, the current-limiting element may then output the external driving signal in or to the rectifying circuit 510 or 540 for rectifying.

Like terminal adapter circuit 541, the current-limiting element may comprise a resistor, a capacitor, an inductor, or any combination thereof. For example, the current-limiting element may comprise or include capacitors 642 and 645, or capacitors 642 and 646, shown in FIG. 51A. For example, the current-limiting element may include capacitors 743 and 745, capacitors 743 and 746, capacitors 744 and 745, or capacitors 744 and 746, shown in FIG. 51B.

Figure 52A:
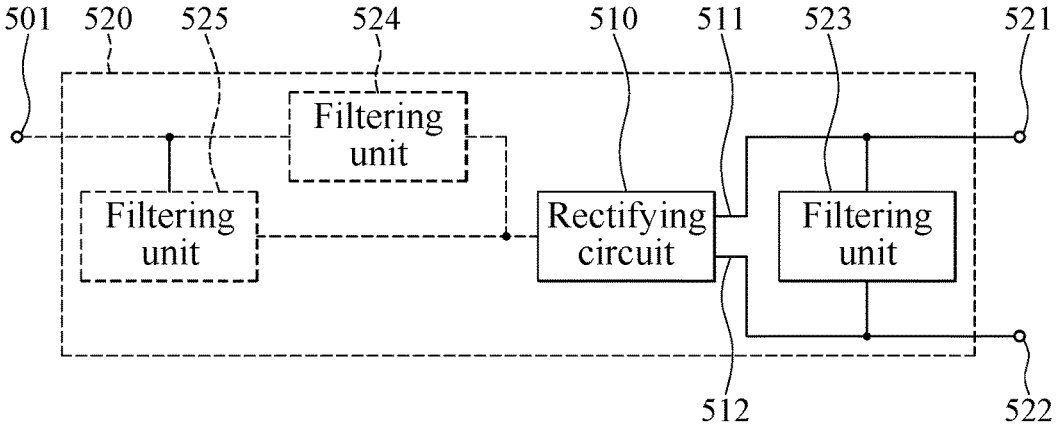
FIG. 52A is a block diagram of a filtering circuit according to some embodiments.
Figure 52B:
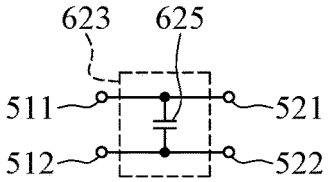
FIG. 52B is a schematic diagram of a filtering unit according to some embodiments.

FIG. 52A is a block diagram of a filtering circuit according to some embodiments. Rectifying circuit 510 is shown in FIG. 52A for illustrating its connection with other components, without intending filtering circuit 520 to include rectifying circuit 510. Referring to FIG. 52A, filtering circuit 520 includes a filtering unit 523 coupled to rectifying output terminals 511 and 512 to receive, and to filter out ripples of, a rectified signal from rectifying circuit 510, thereby outputting a filtered signal whose waveform is smoother than the rectified signal. Filtering circuit 520 may further comprise another filtering unit 524 coupled between a rectifying circuit and a pin, which are for example rectifying circuit 510 and pin 501, rectifying circuit 510 and pin 502, rectifying circuit 540 and pin 503, or rectifying circuit 540 and pin 504. Filtering unit 524 is for filtering of a specific frequency, in order to filter out a specific frequency component of an external driving signal. In this embodiment of FIG. 52A, filtering unit 524 is coupled between rectifying circuit 510 and pin 501. Filtering circuit 520 may further comprise another filtering unit 525 coupled between one of pins 501 and 502 and a diode of rectifying circuit 510, or between one of pins 503 and 504 and a diode of rectifying circuit 540, for reducing or filtering out electromagnetic interference (EMI). In this embodiment, filtering unit 525 is coupled between pin 501 and a diode (not shown in FIG. 52A) of rectifying circuit 510. Since filtering units 524 and 525 may be present or omitted depending on actual circumstances of their uses, they are depicted by a dotted line in FIG. 52A. Filtering units 523, 524, and 525 may be referred to herein as filtering sub-circuits of filtering circuit 520, or may be generally referred to as a filtering circuit FIG. 52B is a schematic diagram of a filtering unit according to some embodiments. Referring to FIG. 52B, filtering unit 623 includes a capacitor 625 having an end coupled to output terminal 511 and a filtering output terminal 521 and another end coupled to output terminal 512 and a filtering output terminal 522, and is configured to low-pass filter a rectified signal from output terminals 511 and 512, so as to filter out high-frequency components of the rectified signal and thereby output a filtered signal at output terminals 521 and 522.

Figure 52C:
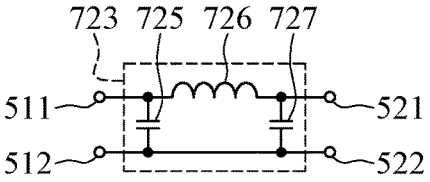
FIG. 52C is a schematic diagram of a filtering unit according to some embodiments.

FIG. 52C is a schematic diagram of a filtering unit according to some embodiments. Referring to FIG. 52C, filtering unit 723 comprises a pi filter circuit including a capacitor 725, an inductor 726, and a capacitor 727. As is well known, a pi filter circuit looks like the symbol 7C in its shape or structure. Capacitor 725 has an end connected to output terminal 511 and coupled to output terminal 521 through inductor 726, and has another end connected to output terminals 512 and 522. Inductor 726 is coupled between output terminals 511 and 521. Capacitor 727 has an end connected to output terminal 521 and coupled to output terminal 511 through inductor 726, and has another end connected to output terminals 512 and 522.

As seen between output terminals 511 and 512 and output terminals 521 and 522, filtering unit 723 compared to filtering unit 623 in FIG. 52B additionally has inductor 726 and capacitor 727, which are like capacitor 725 in performing low-pass filtering. Therefore, filtering unit 723 in this embodiment compared to filtering unit 623 in FIG. 52B has a better ability to filter out high-frequency components to output a filtered signal with a smoother waveform.

Inductance values of inductor 726 in the embodiment described above are chosen in some embodiments in the range of about 10 nH to about 10 mH. And capacitance values of capacitors 625, 725, and 727 in the embodiments described above are chosen in some embodiments in the range, for example, of about 100 pF to about 1 uF.

Figure 52D:
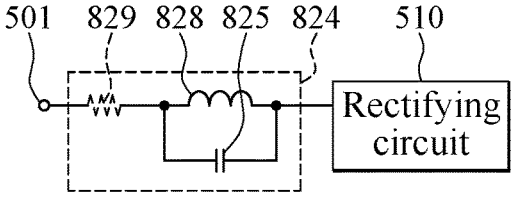
FIG. 52D is a schematic diagram of a filtering unit according to some embodiments.

FIG. 52D is a schematic diagram of a filtering unit according to some embodiments. Referring to FIG. 52D, filtering unit 824 includes a capacitor 825 and an inductor 828 connected in parallel. Capacitor 825 has an end coupled to pin 501, and another end coupled to rectifying output terminal 511 (not shown), and is configured to high-pass filter an external driving signal input at pin 501, so as to filter out low-frequency components of the external driving signal. Inductor 828 has an end coupled to pin 501 and another end coupled to rectifying output terminal 511, and is configured to low-pass filter an external driving signal input at pin 501, so as to filter out high-frequency components of the external driving signal. Therefore, the combination of capacitor 825 and inductor 828 works to present high impedance to an external driving signal at one or more specific frequencies. Thus, the parallel-connected capacitor and inductor work to present a peak equivalent impedance to the external driving signal at a specific frequency.

Through appropriately choosing a capacitance value of capacitor 825 and an inductance value of inductor 828, a center frequency f on the high-impedance band may be set at a specific value given by $$f = \frac{1}{2\pi\sqrt{LC}},$$

where L denotes inductance of inductor 828 and C denotes capacitance of capacitor 825. The center frequency is in some embodiments in the range of about 20~30 kHz, and may be in some embodiments about 25 kHz. In one embodiment, an LED lamp with filtering unit 824 is able to be certified under safety standards, for a specific center frequency, as provided by Underwriters Laboratories (UL).

In some embodiments, filtering unit 824 may further comprise a resistor 829, coupled between pin 501 and filtering output terminal 511. In FIG. 52D, resistor 829 is connected in series to the parallel-connected capacitor 825 and inductor 828. For example, resistor 829 may be coupled between pin 501 and parallel-connected capacitor 825 and inductor 828, or may be coupled between filtering output terminal 511 and parallel-connected capacitor 825 and inductor 828. In this embodiment, resistor 829 is coupled between pin 501 and parallel-connected capacitor 825 and inductor 828. Further, resistor 829 is configured for adjusting the quality factor (Q) of the LC circuit comprising capacitor 825 and inductor 828, to better adapt filtering unit 824 to application environments with different quality factor requirements. Since resistor 829 is an optional component, it is depicted in a dotted line in FIG. 52D.

Capacitance values of capacitor 825 are in some embodiments in the range of about 10 nF-2 uF. Inductance values of inductor 828 are in some embodiments smaller than 2 mH, and may be in some embodiments smaller than 1 mH. Resistance values of resistor 829 are in some embodiments larger than 50 ohms, and may be in some embodiments larger than 500 ohms.

Besides the filtering circuits shown and described in the above embodiments, traditional low-pass or band-pass filters can be used as the filtering unit in the filtering circuit described in the various embodiments.

Figure 52E:
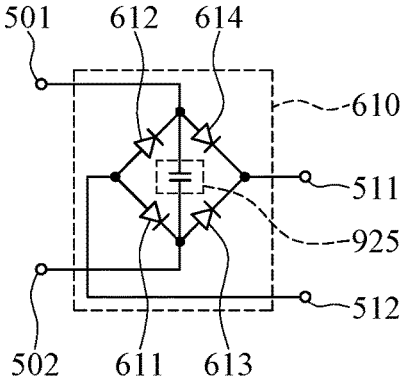
FIG. 52E is a schematic diagram of a filtering unit according to some embodiments.

FIG. 52E is a schematic diagram of a filtering unit according to some embodiments. Referring to FIG. 52E, in this embodiment filtering unit 925 is disposed in rectifying circuit 610 as shown in FIG. 50A, and is configured for reducing the EMI (Electromagnetic interference) caused by rectifying circuit 610 and/or other circuits. In this embodiment, filtering unit 925 includes an EMI-reducing capacitor coupled between pin 501 and the anode of rectifying diode 613, and also between pin 502 and the anode of rectifying diode 614, to reduce the EMI associated with the positive half cycle of the AC driving signal received at pins 501 and 502. The EMI-reducing capacitor of filtering unit 925 is also coupled between pin 501 and the cathode of rectifying diode 611, and between pin 502 and the cathode of rectifying diode 612, to reduce the EMI associated with the negative half cycle of the AC driving signal received at pins 501 and 502. In some embodiments, rectifying circuit 610 comprises a full-wave bridge rectifier circuit including four rectifying diodes 611, 612, 613, and 614. The full-wave bridge rectifier circuit has a first filtering node connecting an anode and a cathode respectively of two diodes 613 and 611 of the four rectifying diodes 611, 612, 613, and 614, and a second filtering node connecting an anode and a cathode respectively of the other two diodes 614 and 612 of the four rectifying diodes 611, 612, 613, and 614. And the EMI-reducing capacitor of the filtering unit 925 is coupled between the first filtering node and the second filtering node.

Similarly, with reference to FIGS. 50C, and 51A-51C, each capacitor in each of the circuits in FIGS. 51A-51C may be coupled between pins 501 and 502 (or pins 503 and 504) and any diode in FIG. 50C, so any or each capacitor in FIGS. 51A-51C can work as an EMI-reducing capacitor to achieve the function of reducing EMI. For example, rectifying circuit 510 in FIGS. 49C and 49E may comprise a half-wave rectifier circuit including two rectifying diodes and having a half-wave node connecting an anode and a cathode respectively of the two rectifying diodes, and any or each capacitor in FIGS. 51A-51C may be coupled between the half-wave node and at least one of the first pin and the second pin. And rectifying circuit 540 in FIG. 49E may comprise a half-wave rectifier circuit including two rectifying diodes and having a half-wave node connecting an anode and a cathode respectively of the two rectifying diodes, and any or each capacitor in FIGS. 51A-51C may be coupled between the half-wave node and at least one of the third pin and the fourth pin.

In some embodiments, the EMI-reducing capacitor of FIG. 52E may also act as capacitor 825 in filtering unit 824, so that in combination with inductor 828 the capacitor 825 performs the functions of reducing EMI and presenting high impedance to an external driving signal at specific frequencies. For example, when the rectifying circuit comprises a full-wave bridge rectifier circuit, capacitor 825 of filtering unit 824 may be coupled between the first filtering node and the second filtering node of the full-wave bridge rectifier circuit. When the rectifying circuit comprises a half-wave rectifier circuit, capacitor 825 of filtering unit 824 may be coupled between the half-wave node of the half-wave rectifier circuit and at least one of the first pin and the second pin.

Figure 53A:
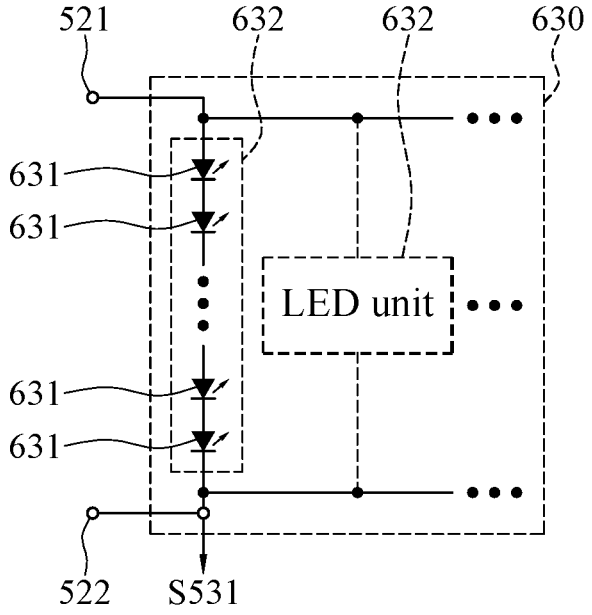
FIG. 53A is a schematic diagram of an LED module according to some embodiments.

FIG. 53A is a schematic diagram of an LED module according to some embodiments. Referring to FIG. 53A, LED module 630 has an anode connected to the filtering output terminal 521, has a cathode connected to the filtering output terminal 522, and comprises at least one LED unit 632. When two or more LED units are included, they are connected in parallel. An anode of each LED unit 632 forms the anode of LED module 630 and is connected to output terminal 521, and a cathode of each LED unit 632 forms the cathode of LED module 630 and is connected to output terminal 522. Each LED unit 632 includes at least one LED 631. When multiple LEDs 631 are included in an LED unit 632, they are connected in series, with the anode of the first LED 631 forming the anode of the LED unit 632 that is a part of, and the cathode of the first LED 631 connected to the next or second LED 631. And the anode of the last LED 631 in this LED unit 632 is connected to the cathode of a previous LED 631, with the cathode of the last LED 631 forming the cathode of the LED unit 632 that it is a part of.

In some embodiments, the LED module 630 may produce a current detection signal S531 reflecting a magnitude of current through LED module 630 and used for controlling or detecting current on the LED module 630. As described herein, an LED unit may refer to a single string of LEDs arranged in series, and an LED module may refer to a single LED unit, or a plurality of LED units connected to a same two nodes (e.g., arranged in parallel). For example, the LED light strip 2 described above may be an LED module and/or LED unit.

Figure 53B:
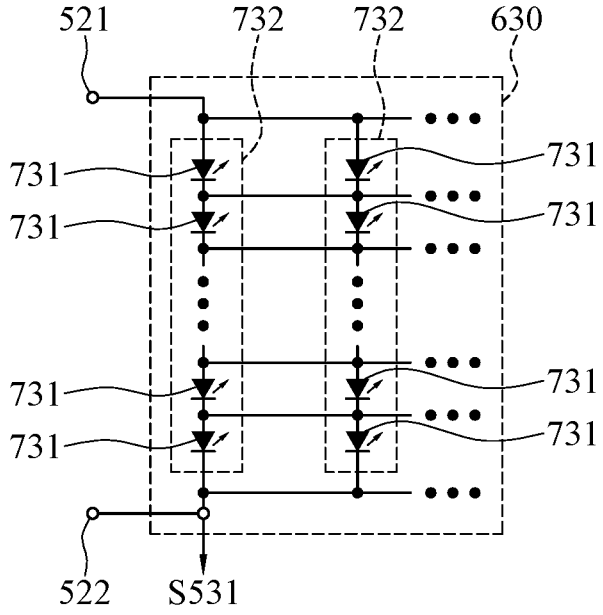
FIG. 53B is a schematic diagram of an LED module according to some embodiments.

FIG. 53B is a schematic diagram of an LED module according to some embodiments. Referring to FIG. 53B, LED module 630 has an anode connected to the filtering output terminal 521, has a cathode connected to the filtering output terminal 522, and comprises at least two LED units 732, with an anode of each LED unit 732 forming the anode of LED module 630, and a cathode of each LED unit 732 forming the cathode of LED module 630. Each LED unit 732 includes at least two LEDs 731 connected in the same way as described in FIG. 53A. For example, the anode of the first LED 731 in an LED unit 732 forms the anode of the LED unit 732 that it is a part of, the cathode of the first LED 731 is connected to the anode of the next or second LED 731, and the cathode of the last LED 731 forms the cathode of the LED unit 732 that it is a part of. Further, LED units 732 in an LED module 630 are connected to each other in this embodiment. All of the n-th LEDs 731 respectively of the LED units 732 are connected by every anode of every n-th LED 731 in the LED units 732, and by every cathode of every n-th LED 731, where n is a positive integer. In this way, the LEDs in LED module 630 in this embodiment are connected in the form of a mesh.

In some embodiments, compared to the embodiments of FIGS. 54A-54G LED lighting module 530 of the above embodiments includes LED module 630, but doesn't include a driving circuit for the LED module 630 (e.g., does not include an LED driving unit for the LED module or LED unit).

Similarly, LED module 630 in this embodiment may produce a current detection signal S531 reflecting a magnitude of current through LED module 630 and used for controlling or detecting current on the LED module 630.

In actual practice, the number of LEDs 731 included by an LED unit 732 is in some embodiments in the range of 15-25, and may be preferably in the range of 18-22.

Figure 53C:
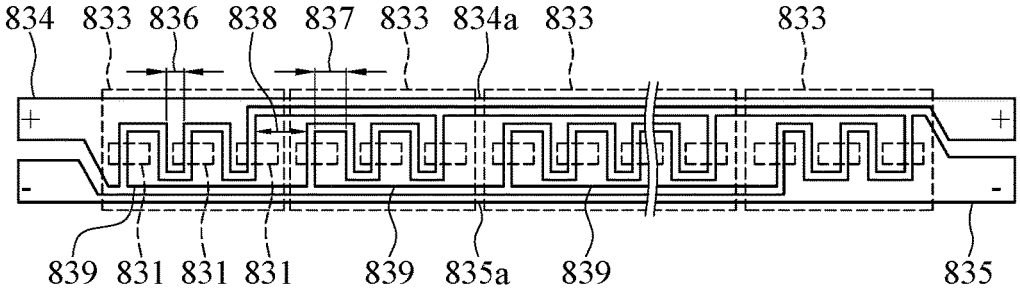
FIG. 53C is a plan view of a circuit layout of the LED module according to some embodiments.

FIG. 53C is an exemplary plan view of a circuit layout of an LED module according to some embodiments. Referring to FIG. 53C, in this embodiment LEDs 831 are connected in the same way as described in FIG. 53B, and three LED units are assumed in LED module 630 and described as follows for illustration. A positive conductive line 834 and a negative conductive line 835 are to receive a driving signal, for supplying power to the LEDs 831. For example, positive conductive line 834 may be coupled to the filtering output terminal 521 of the filtering circuit 520 described above, and negative conductive line 835 coupled to the filtering output terminal 522 of the filtering circuit 520, to receive a filtered signal. For the convenience of illustration, all three of the n-th LEDs 831 respectively of the three LED units are grouped as an LED set 833 in FIG. 53C.

Positive conductive line 834 connects the three first LEDs 831 respectively of the leftmost three LED units, at the anodes on the left sides of the three first LEDs 831 as shown in the leftmost LED set 833 of FIG. 53C. The three first LEDs 831 may be the leftmost LEDs for each LED unit respectively. Negative conductive line 835 connects the three last LEDs 831 respectively of the leftmost three LED units, at the cathodes on the right sides of the three last LEDs 831 as shown in the rightmost LED set 833 of FIG. 53C. The three last LEDs 831 may be the rightmost LEDs for each LED unit respectively. For the three LED units, the cathodes of the three first LEDs 831, the anodes of the three last LEDs 831, and the anodes and cathodes of all the remaining LEDs 831 are connected by conductive lines or parts 839, also referred to as internal conductive connectors.

For example, the anodes of the three LEDs 831 in the leftmost LED set 833 may be connected together by positive conductive line 834, and their cathodes may be connected together by a leftmost conductive part 839. The anodes of the three LEDs 831 in the second leftmost LED set 833 are also connected together by the leftmost conductive part 839, whereas their cathodes are connected together by a second, next-leftmost conductive part 839. Since the cathodes of the three LEDs 831 in the leftmost LED set 833 and the anodes of the three LEDs 831 in the second next-leftmost LED set 833 are connected together by the same leftmost conductive part 839, in each of the three LED units the cathode of the first LED 831 is connected to the anode of the next or second LED 831, with the remaining LEDs 831 also being connected in the same way. Accordingly, all the LEDs 831 of the three LED units are connected to form the mesh as shown in FIG. 53B. The LED module shown in FIG. 53C may form an LED light strip 2 such as described above.

According to the exemplary embodiment shown in FIG. 53C, the length 836 (e.g., length along a first direction that is a length direction of the LED light strip 2 and lamp tube 1) of a portion of each conductive part 839 that immediately connects to the anode of an LED 831 is smaller than the length 837 of another portion of each conductive part 839 that immediately connects to the cathode of an LED 831, making the area of the latter portion immediately connecting to the cathode larger than that of the former portion immediately connecting to the anode. The length 837 may be smaller than a length 838 of a portion of each conductive part 839 that immediately connects the cathode of an LED 831 and the anode of the next LED 831, making the area of the portion of each conductive part 839 that immediately connects a cathode and an anode larger than the area of any other portion of each conductive part 839 that immediately connects to only a cathode or an anode of an LED 831. Due to the length differences and area differences, this layout structure improves heat dissipation of the LEDs 831.

In some embodiments, positive conductive line 834 includes a lengthwise portion 834*a*, and negative conductive line 835 includes a lengthwise portion 835*a*, which are conducive to making the LED module have a positive "+" connective portion and a negative "−" connective portion at each of the two ends of the LED module, as shown in FIG. 53C. Such a layout structure allows for coupling certain of the various circuits of the power supply module of the LED lamp, including e.g. filtering circuit 520 and rectifying circuits 510 and 540, to the LED module through the positive connective portion and/or the negative connective portion at each or both ends of the LED lamp. Thus, the layout structure increases the flexibility in arranging actual circuits in the LED lamp.

Figure 53D:
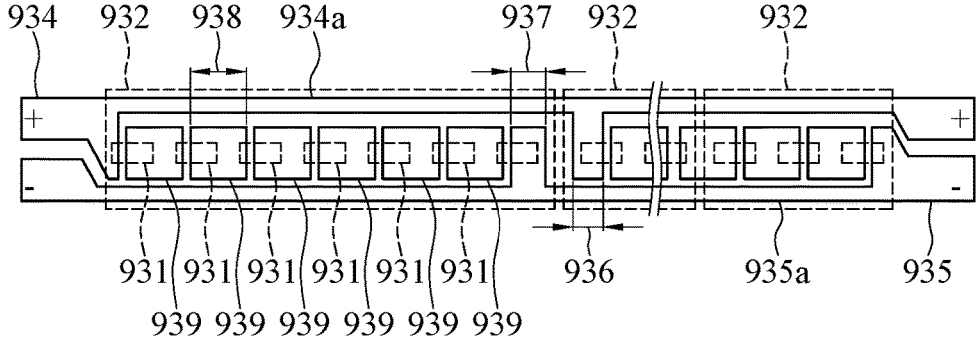
FIG. 53D is a plan view of a circuit layout of the LED module according to some embodiments.

FIG. 53D is a plan view of a circuit layout of the LED module according to some embodiments. Referring to FIG. 53D, in this embodiment LEDs 931 are connected in the same way as described in FIG. 53A, and three LED units each including 7 LEDs 931 are assumed in LED module 630 and described as follows for illustration. A positive conductive line 934 and a negative conductive line 935 are to receive a driving signal, for supplying power to the LEDs 931. For example, positive conductive line 934 may be coupled to the filtering output terminal 521 of the filtering circuit 520 described above, and negative conductive line 935 coupled to the filtering output terminal 522 of the filtering circuit 520, to receive a filtered signal. For the convenience of illustration, all seven LEDs 931 of each of the three LED units are grouped as an LED set 932 in FIG. 53D. Thus, there are three LED sets 932 corresponding to the three LED units.

Positive conductive line 934 connects to the anode on the left side of the first or leftmost LED 931 of each of the three LED sets 932. Negative conductive line 935 connects to the cathode on the right side of the last or rightmost LED 931 of each of the three LED sets 932. In each LED set 932, of two consecutive LEDs 931 the LED 931 on the left has a cathode connected by a conductive part 939 to an anode of the LED 931 on the right. By such a layout, the LEDs 931 of each LED set 932 are connected in series.

In some embodiments, the conductive part 939 may be used to connect an anode and a cathode respectively of two consecutive LEDs 931. Negative conductive line 935 connects to the cathode of the last or rightmost LED 931 of each of the three LED sets 932. And positive conductive line 934 connects to the anode of the first or leftmost LED 931 of each of the three LED sets 932. Therefore, as shown in FIG. 53D, the length (and thus area) of the conductive part 939 is larger than that of the portion of negative conductive line 935 immediately connecting to a cathode, which length (and thus area) is then larger than that of the portion of positive conductive line 934 immediately connecting to an anode. For example, the length 938 of the conductive part 939 may be larger than the length 937 of the portion of negative conductive line 935 immediately connecting to a cathode of an LED 931, which length 937 is then larger than the length 936 of the portion of positive conductive line 934 immediately connecting to an anode of an LED 931. Such a layout structure improves heat dissipation of the LEDs 931 in LED module 630.

Positive conductive line 934 may include a lengthwise portion 934*a*, and negative conductive line 935 may include a lengthwise portion 935*a*, which are conducive to making the LED module have a positive "+" connective portion and a negative "−" connective portion at each of the two ends of the LED module, as shown in FIG. 53D. Such a layout structure allows for coupling certain of the various circuits of the power supply module of the LED lamp, including e.g. filtering circuit 520 and rectifying circuits 510 and 540, to the LED module through the positive connective portion 934*a* and/or the negative connective portion 935*a* at each or both ends of the LED lamp. Thus, the layout structure increases the flexibility in arranging actual circuits in the LED lamp.

The positive conductive lines (834 or 934) may be characterized as including two end terminals at opposite ends, a plurality of pads between the two end terminals and for contacting and/or supplying power to LEDs (e.g., anodes of LEDs), and a wire portion, which may be an elongated conducive line extending along a length of an LED light strip and electrically connecting the two end terminals to the plurality of pads. Similarly, the negative conductive lines (835 or 935) may be characterized as including two end terminals at opposite ends, a plurality of pads between the two end terminals and for contacting and/or supplying power to LEDs (e.g., cathodes of LEDs), and a wire portion, which may be an elongated conducive line extending along a length of an LED light strip and electrically connecting the two end terminals to the plurality of pads. Thus, the layout structures shown above increase the flexibility in arranging actual circuits in the LED lamp.

Further, the circuit layouts as shown in FIG. 53C and FIG. 53D may be implemented with a bendable circuit sheet or substrate, which may be a flexible circuit board. The circuit layouts may be implemented for one of the exemplary LED light strips described previously, for example, to serve as a circuit board or sheet for the LED light strip on which the LED light sources are disposed. For example, the bendable circuit sheet may comprise one conductive layer where positive conductive line 834, including positive lengthwise portion 834*a*, negative conductive line 835, including negative lengthwise portion 835*a*, and conductive parts 839 shown in FIG. 53C, and positive conductive line 934, including positive lengthwise portion 934*a*, negative conductive line 935, including negative lengthwise portion 935*a*, and conductive parts 939 shown in FIG. 53D are formed. For example, the different conductive patterns may be formed by an etching method.

Figure 53E:
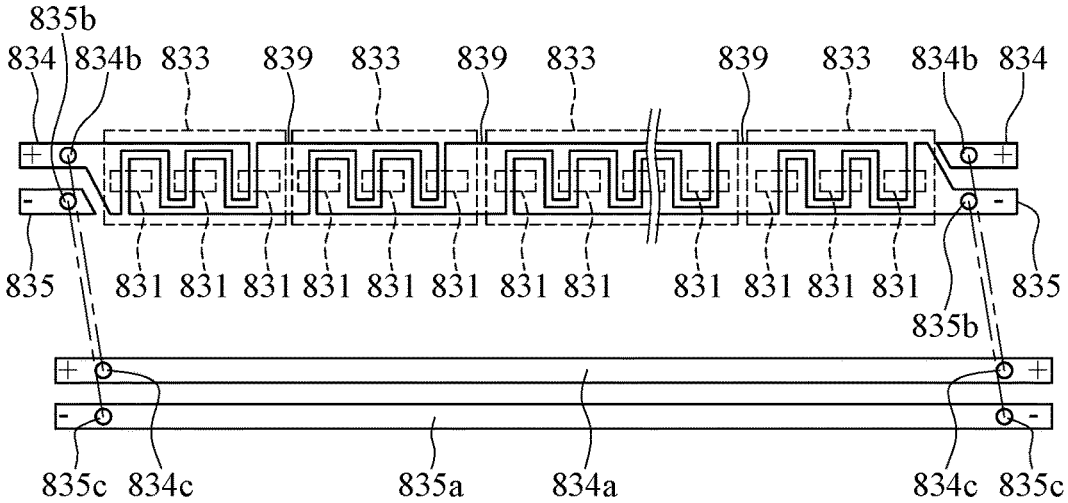
FIG. 53E is a plan view of a circuit layout of the LED module according to some embodiments.

FIG. 53E is a plan view of a circuit layout of an LED module according to some embodiments. The layout structures of the LED module in FIG. 53E and FIG. 53C each correspond to the same way of connecting LEDs 831 as that shown in FIG. 53B, but the layout structure in FIG. 53E comprises two conductive layers, instead of only one conductive layer for forming the circuit layout as shown in FIG. 53C. Referring to FIG. 53E, the main difference from the layout in FIG. 53C is that positive conductive line 834 and negative conductive line 835 have a lengthwise portion 834*a* and a lengthwise portion 835*a*, respectively, that are formed in a second conductive layer instead. This type of structure may be used to implement the embodiments that include two conductive layers such as discussed previously (e.g., as described in connection with FIG. 48). The difference is elaborated as follows.

Referring to FIG. 53E, the bendable circuit sheet of the LED module comprises a first conductive layer 2*a* and a second conductive layer 2*c* electrically insulated from each other by a dielectric layer 2*b* (not shown). Of the two conductive layers, positive conductive line 834, negative conductive line 835, and conductive parts 839 in FIG. 53E are formed in first conductive layer 2*a* by the method of etching for electrically connecting the plurality of LED components 831 e.g. in a form of a mesh, whereas positive lengthwise portion 834*a* and negative lengthwise portion 835*a* are formed in second conductive layer 2*c* (e.g., by etching) for electrically connecting to (e.g., the filtering output terminal of) the filtering circuit. Further, positive conductive line 834 and negative conductive line 835 in first conductive layer 2*a* have via points 834*b* and via points 835*b*, respectively, for connecting to second conductive layer 2*c*. And positive lengthwise portion 834*a* and negative lengthwise portion 835*a* in second conductive layer 2*c* have via points 834*c* and via points 835*c*, respectively. Via points 834*b* are positioned corresponding to via points 834*c*, for connecting positive conductive line 834 and positive lengthwise portion 834*a*. Via points 835*b* are positioned corresponding to via points 835*c*, for connecting negative conductive line 835 and negative lengthwise portion 835*a*. One exemplary way of connecting the two conductive layers is to form a hole connecting each via point 834*b* and a corresponding via point 834*c*, and to form a hole connecting each via point 835*b* and a corresponding via point 835*c*, with the holes extending through the two conductive layers and the dielectric layer in-between. Positive conductive line 834 and positive lengthwise portion 834*a* can be electrically connected, for example, by welding metallic part(s) through the connecting hole(s), and negative conductive line 835 and negative lengthwise portion 835*a* can be electrically connected, for example, by welding metallic part(s) through the connecting hole(s).

Similarly, the layout structure of the LED module in FIG. 53D may alternatively have positive lengthwise portion 934*a* and negative lengthwise portion 935*a* disposed in a second conductive layer, to constitute a two-layer layout structure.

In some embodiments, the thickness of the second conductive layer of a two-layer bendable circuit sheet is in some embodiments larger than that of the first conductive layer, in order to reduce the voltage drop or loss along each of the positive lengthwise portion and the negative lengthwise portion disposed in the second conductive layer. Compared to a one-layer bendable circuit sheet, since a positive lengthwise portion and a negative lengthwise portion are disposed in a second conductive layer in a two-layer bendable circuit sheet, the width (between two lengthwise sides) of the two-layer bendable circuit sheet is or can be reduced. On the same fixture or plate in a production process, the maximum number of bendable circuit sheets each with a shorter width that can be laid together is larger than the maximum number of bendable circuit sheets each with a longer width that can be laid together. Thus adopting a bendable circuit sheet with a shorter width can increase the efficiency of production of the LED module. And reliability in the production process, such as the accuracy of welding position when welding (materials on) the LED components, can also be improved, because a two-layer bendable circuit sheet can better maintain its shape.

As a variant of the above embodiments, an exemplary LED tube lamp may have at least some of the electronic components of its power supply module disposed on an LED light strip of the LED tube lamp. For example, the technique of printed electronic circuit (PEC) can be used to print, insert, or embed at least some of the electronic components onto the LED light strip (e.g., as opposed to being on a separate circuit board connected to the LED light strip).

In one embodiment, all electronic components of the power supply module are disposed directly on the LED light strip. For example, the production process may include or proceed with the following steps: preparation of the circuit substrate (e.g. preparation of a flexible printed circuit board); ink jet printing of metallic nano-ink; ink jet printing of active and passive components (as of the power supply module); drying/sintering; ink jet printing of interlayer bumps; spraying of insulating ink; ink jet printing of metallic nano-ink; ink jet printing of active and passive components (to sequentially form the included layers); spraying of surface bond pad(s); and spraying of solder resist against LED components. The production process may be different, however, and still result in some or all electronic components of the power supply module being disposed directly on the LED light strip.

In certain embodiments, if all electronic components of the power supply module are disposed on the light strip, electrical connection between terminal pins of the LED tube lamp and the light strip may be achieved by connecting the pins to conductive lines which are welded with ends of the light strip. In this case, another substrate for supporting the power supply module is not required, thereby allowing of an improved design or arrangement in the end cap(s) of the LED tube lamp. In some embodiments, the power supply module is disposed at two ends of the light strip, in order to significantly reduce the impact of heat generated from the power supply module's operations on the LED components. For example, components of the power supply module may be disposed at two ends of the light strip, in order to significantly reduce the impact of heat generated from the power supply module's operations on the LED components. Since no substrate other than the light strip is used to support the power supply module in this case, the total amount of welding or soldering can be significantly reduced, improving the general reliability of the power supply module. If no additional substrate is used, the electronic components of the power supply module disposed on the light strip may still be positioned in the end caps of the LED tube lamp, or they may be positioned partly or wholly inside the lamp tube but not in the end caps.

Another case is that some of all electronic components of the power supply module, such as some resistors and/or smaller size capacitors, are printed onto the light strip, and some bigger size components, such as some inductors and/or electrolytic capacitors, are disposed on another substrate, for example in the end cap(s). The production process of the light strip in this case may be the same as that described above. And in this case disposing some of all electronic components on the light strip is conducive to achieving a reasonable layout of the power supply module in the LED tube lamp, which may allow of an improved design in the end cap(s).

As a variant embodiment of the above, electronic components of the power supply module may be disposed on the light strip by a method of embedding or inserting, e.g. by embedding the components onto a bendable or flexible light strip. In some embodiments, this embedding may be realized by a method using copper-clad laminates (CCL) for forming a resistor or capacitor; a method using ink related to silk-screen printing; or a method of ink jet printing to embed passive components, wherein an ink jet printer is used to directly print inks to constitute passive components and related functionalities to intended positions on the light strip. Then through treatment by ultraviolet (UV) light or drying/sintering, the light strip is formed where passive components are embedded. The electronic components embedded onto the light strip include for example resistors, capacitors, and inductors. In other embodiments, active components also may be embedded. Through embedding some components onto the light strip, a reasonable layout of the power supply module can be achieved to allow of an improved design in the end cap(s), because the surface area on a printed circuit board used for carrying components of the power supply module is reduced or smaller, and therefore, the size, weight, and thickness of the resulting printed circuit board for carrying components of the power supply module is also smaller or reduced. Also in this situation since welding points on the printed circuit board for welding resistors and/or capacitors if they were not to be disposed on the light strip are no longer used, the reliability of the power supply module is improved, in view of the fact that these welding points are very liable to (cause or incur) faults, malfunctions, or failures. Further, the length of conductive lines needed for connecting components on the printed circuit board is therefore also reduced, which allows of a more compact layout of components on the printed circuit board and thus improving the functionalities of these components.

In some embodiments, luminous efficacy of the LED or LED component is 80 lm/W or above, and in some embodiments, it may be preferably 120 lm/W or above. Certain more optimal embodiments may include a luminous efficacy of the LED or LED component of 160 lm/W or above. White light emitted by an LED component may be produced by mixing fluorescent powder with the monochromatic light emitted by a monochromatic LED chip. The white light in its spectrum has major wavelength ranges of 430-460 nm and 550-560 nm, or major wavelength ranges of 430-460 nm, 540-560 nm, and 620-640 nm.

Figure 54A:
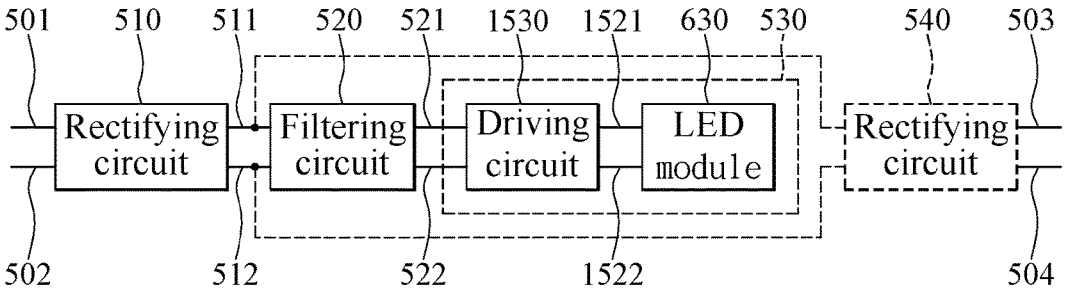
FIG. 54A is a block diagram showing components of an LED lamp (e.g., an LED tube lamp) according to some embodiments.

FIG. 54A is a block diagram showing components of an LED lamp (e.g., an LED tube lamp) according to some embodiments. As shown in FIG. 54A, the power supply module of the LED lamp includes rectifying circuits 510 and 540, a filtering circuit 520, and an LED driving circuit 1530, wherein an LED lighting module 530 includes the driving circuit 1530 and an LED module 630. According to the above description in FIG. 49E, driving circuit 1530 in FIG. 54A comprises a DC-to-DC converter circuit, and is coupled to filtering output terminals 521 and 522 to receive a filtered signal and then perform power conversion for converting the filtered signal into a driving signal at driving output terminals 1521 and 1522. The LED module 630 is coupled to driving output terminals 1521 and 1522 to receive the driving signal for emitting light. In some embodiments, the current of LED module 630 is stabilized at an objective current value. Exemplary descriptions of this LED module 630 are the same as those provided above with reference to FIG. 53A to FIG. 53D.

In some embodiments, the rectifying circuit 540 may be an optional element and therefore may be omitted. Thus, in the embodiment of FIG. 54A, the rectifying circuit 540 is depicted in a dotted line. Therefore, the power supply module of the LED lamp in this embodiment can be used with a single-end power supply coupled to one end of the LED lamp, and can be used with a dual-end power supply coupled to two ends of the LED lamp. With a single-end power supply, examples of the LED lamp include an LED light bulb, a personal area light (PAL), etc.

Figure 54B:
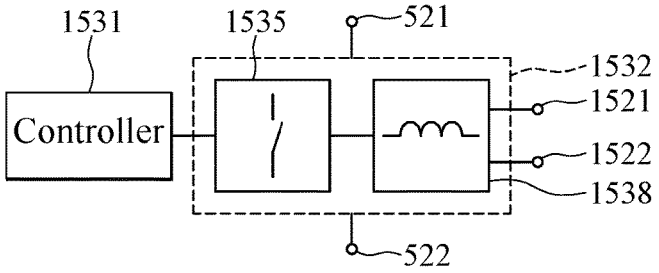
FIG. 54B is a block diagram of a driving circuit according to some embodiments.

FIG. 54B is a block diagram of an exemplary driving circuit according to some embodiments. Referring to FIG. 54B, the driving circuit includes a controller 1531, and a conversion circuit 1532 for power conversion based on a current source, for driving the LED module to emit light. Conversion circuit 1532 includes a switching circuit 1535 and an energy storage circuit 1538. Conversion circuit 1532 is coupled to filtering output terminals 521 and 522 to receive and then convert a filtered signal, under the control by controller 1531, into a driving signal at driving output terminals 1521 and 1522 for driving the LED module. Under the control by controller 1531, the driving signal output by conversion circuit 1532 comprises a steady current, making the LED module emitting steady light.

Figure 54C:
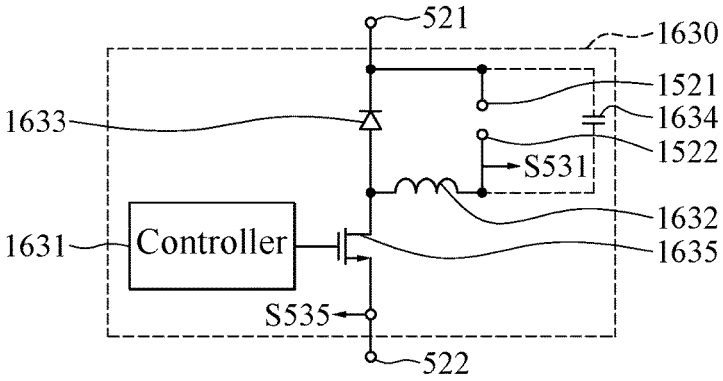
FIG. 54C is a schematic diagram of a driving circuit according to some embodiments.

FIG. 54C is a schematic diagram of a driving circuit according to some embodiments. Referring to FIG. 54C, a driving circuit 1630 in this embodiment comprises a buck DC-to-DC converter circuit having a controller 1631 and a converter circuit. The converter circuit includes an inductor 1632, a diode 1633 for "freewheeling" of current, a capacitor 1634, and a switch 1635. Driving circuit 1630 is coupled to filtering output terminals 521 and 522 to receive and then convert a filtered signal into a driving signal for driving an LED module connected between driving output terminals 1521 and 1522.

In this embodiment, switch 1635 comprises a metal-oxide-semiconductor field-effect transistor (MOSFET) and has a first terminal coupled to the anode of freewheeling diode 1633, a second terminal coupled to filtering output terminal 522, and a control terminal coupled to controller 1631 used for controlling current conduction or cutoff between the first and second terminals of switch 1635. To clarify, the term "control/controlling current conduction or cutoff of a device or between two terminals" refers to causing the device to conduct current or be cutoff/turned off, or determining that the device conduct current or be cutoff/turned off; or causing/determining current conduction or cutoff between the two terminals. Driving output terminal 1521 is connected to filtering output terminal 521, and driving output terminal 1522 is connected to an end of inductor 1632, which has another end connected to the first terminal of switch 1635. Capacitor 1634 is coupled between driving output terminals 1521 and 1522, to stabilize the voltage between driving output terminals 1521 and 1522. Freewheeling diode 1633 has a cathode connected to driving output terminal 1521.

Next, a description follows as to an exemplary operation of driving circuit 1630.

Controller 1631 is configured for determining when to turn switch 1635 on (in a conducting state) or off (in a cutoff state), according to a current detection signal S535 and/or a current detection signal S531. For example, in some embodiments, controller 1631 is configured to control the duty cycle of switch 1635 being on and switch 1635 being off, in order to adjust the size or magnitude of the driving signal. Current detection signal S535 represents the magnitude of current through switch 1635. Current detection signal S531 represents the magnitude of current through the LED module coupled between driving output terminals 1521 and 1522. The controller 1631 may control the duty cycle of the switch 1635 being on and off, based on, for example, a magnitude of a current detected based on current detection signal S531 or S535. As such, when the magnitude is above a threshold, the switch may be off (cutoff state) for more time, and when magnitude goes below the threshold, the switch may be on (conducting state) for more time. According to any of current detection signal S535 and current detection signal S531, controller 1631 can obtain information on the magnitude of power converted by the converter circuit. When switch 1635 is switched on, a current of a filtered signal is input through filtering output terminal 521, and then flows through capacitor 1634, driving output terminal 1521, the LED module, inductor 1632, and switch 1635, and then flows out from filtering output terminal 522. During this flowing of current, capacitor 1634 and inductor 1632 are performing storing of energy. On the other hand, when switch 1635 is switched off, capacitor 1634 and inductor 1632 perform releasing of stored energy by a current flowing from freewheeling capacitor 1633 to driving output terminal 1521 to make the LED module continuing to emit light.

In some embodiments, capacitor 1634 is an optional element, so it can be omitted and is thus depicted in a dotted line in FIG. 54C. In some application environments, the natural characteristic of an inductor to oppose instantaneous change in electric current passing through the inductor may be used to achieve the effect of stabilizing the current through the LED module, thus omitting capacitor 1634.

Figure 54D:
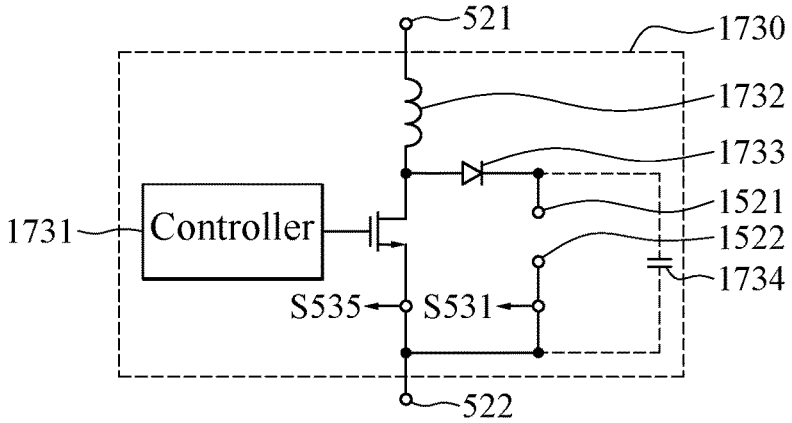
FIG. 54D is a schematic diagram of a driving circuit according to some embodiments.

FIG. 54D is a schematic diagram of an exemplary driving circuit according to some embodiments. Referring to FIG. 54D, a driving circuit 1730 in this embodiment comprises a boost DC-to-DC converter circuit having a controller 1731 and a converter circuit. The converter circuit includes an inductor 1732, a diode 1733 for "freewheeling" of current, a capacitor 1734, and a switch 1735. Driving circuit 1730 is configured to receive and then convert a filtered signal from filtering output terminals 521 and 522 into a driving signal for driving an LED module coupled between driving output terminals 1521 and 1522.

Inductor 1732 has an end connected to filtering output terminal 521, and another end connected to the anode of freewheeling diode 1733 and a first terminal of switch 1735, which has a second terminal connected to filtering output terminal 522 and driving output terminal 1522. Freewheeling diode 1733 has a cathode connected to driving output terminal 1521. And capacitor 1734 is coupled between driving output terminals 1521 and 1522.

Controller 1731 is coupled to a control terminal of switch 1735, and is configured for determining when to turn switch 1735 on (in a conducting state) or off (in a cutoff state), according to a current detection signal S535 and/or a current detection signal S531. When switch 1735 is switched on, a current of a filtered signal is input through filtering output terminal 521, and then flows through inductor 1732 and switch 1735, and then flows out from filtering output terminal 522. During this flowing of current, the current through inductor 1732 increases with time, with inductor 1732 being in a state of storing energy, while capacitor 1734 enters a state of releasing energy, making the LED module continuing to emit light. On the other hand, when switch 1735 is switched off, inductor 1732 enters a state of releasing energy as the current through inductor 1732 decreases with time. In this state, the current through inductor 1732 then flows through freewheeling diode 1733, capacitor 1734, and the LED module, while capacitor 1734 enters a state of storing energy.

In some embodiments, capacitor 1734 is an optional element, so it can be omitted and is thus depicted in a dotted line in FIG. 54D. When capacitor 1734 is omitted and switch 1735 is switched on, the current of inductor 1732 does not flow through the LED module, making the LED module not emit light; but when switch 1735 is switched off, the current of inductor 1732 flows through freewheeling diode 1733 to reach the LED module, making the LED module emit light. Therefore, by controlling the time that the LED module emits light, and the magnitude of current through the LED module, the average luminance of the LED module can be stabilized to be above a defined value, thus also achieving the effect of emitting a steady light.

Figure 54E:
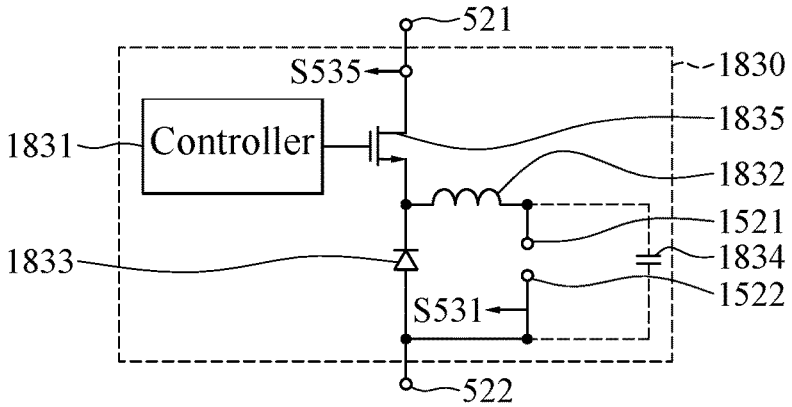
FIG. 54E is a schematic diagram of a driving circuit according to some embodiments.

FIG. 54E is a schematic diagram of an exemplary driving circuit according to some embodiments. Referring to FIG. 54E, a driving circuit 1830 in this embodiment comprises a buck DC-to-DC converter circuit having a controller 1831 and a converter circuit. The converter circuit includes an inductor 1832, a diode 1833 for "freewheeling" of current, a capacitor 1834, and a switch 1835. Driving circuit 1830 is coupled to filtering output terminals 521 and 522 to receive and then convert a filtered signal into a driving signal for driving an LED module connected between driving output terminals 1521 and 1522.

Switch 1835 has a first terminal coupled to filtering output terminal 521, a second terminal coupled to the cathode of freewheeling diode 1833, and a control terminal coupled to controller 1831 to receive a control signal from controller 1831 for controlling current conduction or cutoff between the first and second terminals of switch 1835. The anode of freewheeling diode 1833 is connected to filtering output terminal 522 and driving output terminal 1522. Inductor 1832 has an end connected to the second terminal of switch 1835, and another end connected to driving output terminal 1521. Capacitor 1834 is coupled between driving output terminals 1521 and 1522, to stabilize the voltage between driving output terminals 1521 and 1522.

Controller 1831 is configured for controlling when to turn switch 1835 on (in a conducting state) or off (in a cutoff state), according to a current detection signal S535 and/or a current detection signal S531. When switch 1835 is switched on, a current of a filtered signal is input through filtering output terminal 521, and then flows through switch 1835, inductor 1832, and driving output terminals 1521 and 1522, and then flows out from filtering output terminal 522. During this flowing of current, the current through inductor 1832 and the voltage of capacitor 1834 both increase with time, so inductor 1832 and capacitor 1834 are in a state of storing energy. On the other hand, when switch 1835 is switched off, inductor 1832 is in a state of releasing energy and thus the current through it decreases with time. In this case, the current through inductor 1832 circulates through driving output terminals 1521 and 1522, freewheeling diode 1833, and back to inductor 1832.

In some embodiments, capacitor 1834 is an optional element, so it can be omitted and is thus depicted in a dotted line in FIG. 54E. When capacitor 1834 is omitted, no matter whether switch 1835 is turned on or off, the current through inductor 1832 will flow through driving output terminals 1521 and 1522 to drive the LED module to continue emitting light.

Figure 54F:
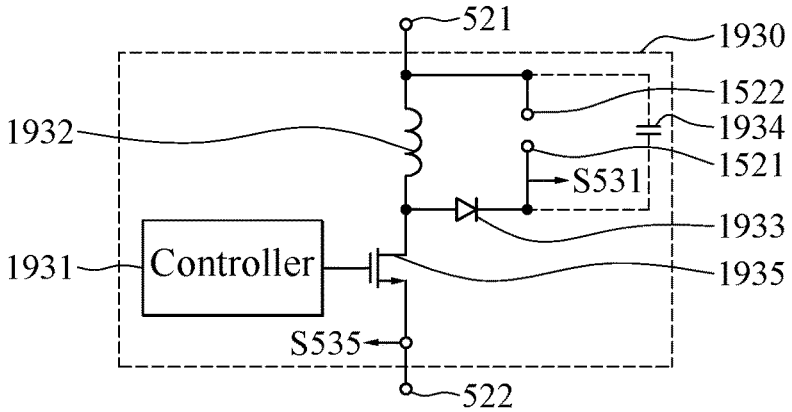
FIG. 54F is a schematic diagram of a driving circuit according to some embodiments.

FIG. 54F is a schematic diagram of an exemplary driving circuit according to some embodiments. Referring to FIG. 54F, a driving circuit 1930 in this embodiment comprises a buck DC-to-DC converter circuit having a controller 1931 and a converter circuit. The converter circuit includes an inductor 1932, a diode 1933 for "freewheeling" of current, a capacitor 1934, and a switch 1935. Driving circuit 1930 is coupled to filtering output terminals 521 and 522 to receive and then convert a filtered signal into a driving signal for driving an LED module connected between driving output terminals 1521 and 1522.

Inductor 1932 has an end connected to filtering output terminal 521 and driving output terminal 1522, and another end connected to a first end of switch 1935. Switch 1935 has a second end connected to filtering output terminal 522, and a control terminal connected to controller 1931 to receive a control signal from controller 1931 for controlling current conduction or cutoff of switch 1935. Freewheeling diode 1933 has an anode coupled to a node connecting inductor 1932 and switch 1935, and a cathode coupled to driving output terminal 1521. Capacitor 1934 is coupled to driving output terminals 1521 and 1522, to stabilize the driving of the LED module coupled between driving output terminals 1521 and 1522.

Controller 1931 is configured for controlling when to turn switch 1935 on (in a conducting state) or off (in a cutoff state), according to a current detection signal S531 and/or a current detection signal S535. When switch 1935 is turned on, a current is input through filtering output terminal 521, and then flows through inductor 1932 and switch 1935, and then flows out from filtering output terminal 522. During this flowing of current, the current through inductor 1932 increases with time, so inductor 1932 is in a state of storing energy; but the voltage of capacitor 1934 decreases with time, so capacitor 1934 is in a state of releasing energy to keep the LED module continuing to emit light. On the other hand, when switch 1935 is turned off, inductor 1932 is in a state of releasing energy and its current decreases with time. In this case, the current through inductor 1932 circulates through freewheeling diode 1933, driving output terminals 1521 and 1522, and back to inductor 1932. During this circulation, capacitor 1934 is in a state of storing energy and its voltage increases with time.

In some embodiments, the capacitor 1934 is an optional element, so it may be omitted. Thus, in the embodiment of FIG. 54F, the capacitor 1934 is depicted in a dotted line. When capacitor 1934 is omitted and switch 1935 is turned on, the current through inductor 1932 doesn't flow through driving output terminals 1521 and 1522, thereby making the LED module not emit light. On the other hand, when switch 1935 is turned off, the current through inductor 1932 flows through freewheeling diode 1933 and then the LED module to make the LED module emit light. Therefore, by controlling the time that the LED module emits light, and the magnitude of current through the LED module, the average luminance of the LED module can be stabilized to be above a defined value, thus also achieving the effect of emitting a steady light.

Figure 54G:
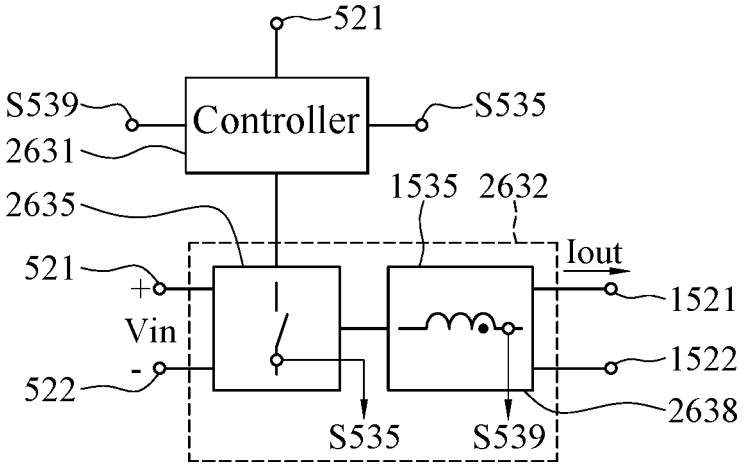
FIG. 54G is a block diagram of a driving circuit according to some embodiments.

FIG. 54G is a block diagram of an exemplary driving circuit according to some embodiments. Referring to FIG. 54G, the driving circuit includes a controller 2631, and a conversion circuit 2632 for power conversion based on an adjustable current source, for driving the LED module to emit light. Conversion circuit 2632 includes a switching circuit 2635 and an energy storage circuit 2638. And conversion circuit 2632 is coupled to filtering output terminals 521 and 522 to receive and then convert a filtered signal, under the control by controller 2631, into a driving signal at driving output terminals 1521 and 1522 for driving the LED module. Controller 2631 is configured to receive a current detection signal S535 and/or a current detection signal S539, for controlling or stabilizing the driving signal output by conversion circuit 2632 to be above an objective current value. Current detection signal S535 represents the magnitude of current through switching circuit 2635. Current detection signal S539 represents the magnitude of current through energy storage circuit 2638, which current may be e.g. an inductor current in energy storage circuit 2638 or a current output at driving output terminal 1521. Any of current detection signal S535 and current detection signal S539 can represent the magnitude of current Tout provided by the driving circuit from driving output terminals 1521 and 1522 to the LED module. Controller 2631 is coupled to filtering output terminal 521 for setting the objective current value according to the voltage Vin at filtering output terminal 521. Therefore, the current Tout provided by the driving circuit or the objective current value can be adjusted corresponding to the magnitude of the voltage Vin of a filtered signal output by a filtering circuit.

In some embodiments, current detection signals S535 and S539 can be generated by measuring current through a resistor or induced by an inductor. For example, a current can be measured according to a voltage drop across a resistor in conversion circuit 2632 the current flows through, or which arises from a mutual induction between an inductor in conversion circuit 2632 and another inductor in its energy storage circuit 2638.

The above driving circuit structures are especially suitable for an application environment in which the external driving circuit for the LED tube lamp includes electronic ballast. An electronic ballast is equivalent to a current source whose output power is not constant. In an internal driving circuit as shown in each of FIG. 54C to FIG. 54F, power consumed by the internal driving circuit relates to or depends on the number of LEDs in the LED module, and could be regarded as constant. When the output power of the electronic ballast is higher than power consumed by the LED module driven by the driving circuit, the output voltage of the ballast will increase continually, causing the level of an AC driving signal received by the power supply module of the LED lamp to continually increase, so as to risk damaging the ballast and/or components of the power supply module due to their voltage ratings being exceeded. On the other hand, when the output power of the electronic ballast is lower than power consumed by the LED module driven by the driving circuit, the output voltage of the ballast and the level of the AC driving signal will decrease continually so that the LED tube lamp fails to normally operate.

In general, the power needed for an LED lamp to work is typically already lower than that needed for a fluorescent lamp to work. If a conventional control mechanism of e.g. using a backlight module to control the LED luminance is used with a conventional driving system of e.g. a ballast, a problem will probably arise of mismatch or incompatibility between the output power of the external driving system and the power needed by the LED lamp. This problem may even cause damaging of the driving system and/or the LED lamp. To prevent and/or protect against this problem, using e.g. the power/current adjustment method described above in FIG. 54G enables the LED (tube) lamp to be better compatible with traditional fluorescent lighting systems.

With reference back to FIGS. 35 and 36, a short circuit board 253 includes a first short circuit substrate and a second short circuit substrate respectively connected to two terminal portions of a long circuit sheet 251, and electronic components of the power supply module are respectively disposed on the first short circuit substrate and the second short circuit substrate. The first short circuit substrate may be referred to as a first power supply substrate, or first end cap substrate. The second short circuit substrate may be referred to as a second power supply substrate, or second end cap substrate. The first power supply substrate and second power substrate may be separate substrates at different ends of an LED tube lamp.

The first short circuit substrate and the second short circuit substrate may have roughly the same length, or different lengths. In some embodiments, a first short circuit substrate (e.g. the right circuit substrate of short circuit board 253 in FIG. 35 and the left circuit substrate of short circuit board 253 in FIG. 36) has a length that is about 30%-80% of the length of the second short circuit substrate (i.e. the left circuit substrate of short circuit board 253 in FIG. 35 and the right circuit substrate of short circuit board 253 in FIG. 36). In some embodiments the length of the first short circuit substrate is about ⅓ ~⅔ of the length of the second short circuit substrate. For example, in one embodiment, the length of the first short circuit substrate may be about half the length of the second short circuit substrate. The length of the second short circuit substrate may be, for example in the range of about 15 mm to about 65 mm, depending on actual application occasions. In certain embodiments, the first short circuit substrate is disposed in an end cap at an end of the LED tube lamp, and the second short circuit substrate is disposed in another end cap at the opposite end of the LED tube lamp.

In some embodiments, capacitors of the driving circuit, such as capacitors 1634, 1734, 1834, and 1934 in FIG. 54C to FIG. 54F, in practical use may include two or more capacitors connected in parallel. Some or all capacitors of the driving circuit in the power supply module may be arranged on the first short circuit substrate of short circuit board 253, while other components such as the rectifying circuit, filtering circuit, inductor(s) of the driving circuit, controller(s), switch(es), diodes, etc. are arranged on the second short circuit substrate of short circuit board 253. Since inductors, controllers, switches, etc. are electronic components with higher temperature, arranging some or all capacitors on a circuit substrate separate or away from the circuit substrate(s) of high-temperature components helps prevent the working life of capacitors (especially electrolytic capacitors) from being negatively affected by the high-temperature components, thus improving the reliability of the capacitors. Further, the physical separation between the capacitors and both the rectifying circuit and filtering circuit described in this disclosure also contributes to reducing the problem associated with EMI.

In some embodiments, the driving circuit has power conversion efficiency of 80% or above, which may in some embodiments be 90% or above, and may in some embodiments be 92% or above. Therefore, without the driving circuit, luminous efficacy of the LED lamp according to some embodiments may preferably be 120 lm/W or above, and may even more preferably be 160 lm/W or above. On the other hand, with the driving circuit in combination with the LED component(s), luminous efficacy of the LED lamp may preferably be, in some embodiments, 120 lm/W*90%=108 lm/W or above, and may even more preferably be, in some embodiments 160 lm/W*92%=147.2 lm/W or above.

In view of the fact that the diffusion film or layer in an LED tube lamp generally has light transmittance of 85% or above, luminous efficacy of the LED tube lamp in some embodiments is 108 lm/W*85%=91.8 lm/W or above, and may be, in some more effective embodiments, 147.2 lm/W*85%=125.12 lm/W.

Figure 55B:
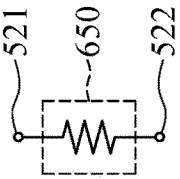
FIG. 55B is a schematic diagram of an anti-flickering circuit according to some embodiments.
Figure 55A:
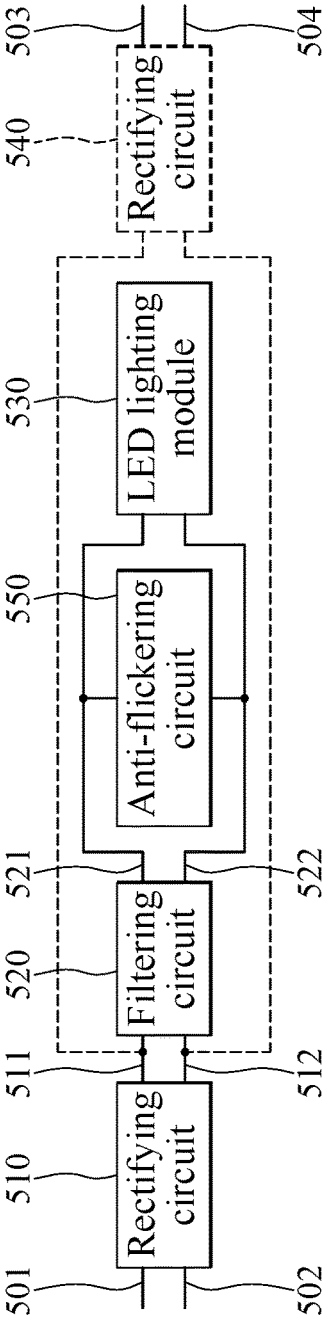
FIG. 55A is a block diagram of an LED lamp according to some embodiments.

FIG. 55A is a block diagram of an LED lamp according to some exemplary embodiments. Its operation will be described as well. Compared to FIG. 54A, the embodiment of FIG. 55A includes rectifying circuits 510 and 540, a filtering circuit 520, and a driving circuit 1530, and further includes an anti-flickering circuit 550; wherein the power supply module may also include some components of an LED lighting module 530. The anti-flickering circuit 550 is coupled between filtering circuit 520 and LED lighting module 530. In some embodiments, the rectifying circuit 540 may be omitted, as is depicted by the dotted line in FIG. 55A.

Anti-flickering circuit 550 is coupled to filtering output terminals 521 and 522, to receive a filtered signal, and under specific circumstances to consume partial energy of the filtered signal so as to reduce (the incidence of) ripples of the filtered signal disrupting or interrupting the light emission of the LED lighting module 530. In general, filtering circuit 520 has such filtering components as resistor(s) and/or inductor(s), and/or parasitic capacitors and inductors, which may form resonant circuits. Upon breakoff or stop of an AC power signal, as when the power supply of the LED lamp is turned off by a user, the amplitude(s) of resonant signals in the resonant circuits will decrease with time. But LEDs in the LED module of the LED lamp are unidirectional conduction devices and require a minimum conduction voltage for the LED module. When a resonant signal's trough value is lower than the minimum conduction voltage of the LED module, but its peak value is still higher than the minimum conduction voltage, the flickering phenomenon will occur in light emission of the LED module. In this case anti-flickering circuit 550 works by allowing a current matching a defined flickering current value of the LED component to flow through, consuming partial energy of the filtered signal which should be higher than the energy difference of the resonant signal between its peak and trough values, so as to reduce the flickering phenomenon. In certain embodiments, a preferred occasion for anti-flickering circuit 550 may operate when the filtered signal's voltage approaches (and is still higher than) the minimum conduction voltage.

In some embodiments, the anti-flickering circuit 550 may be more suitable for the situation in which LED lighting module 530 doesn't include driving circuit 1530, for example, when LED module 630 of LED lighting module 530 is (directly) driven to emit light by a filtered signal from a filtering circuit. In this case, the light emission of LED module 630 will directly reflect variation in the filtered signal due to its ripples. In this situation, the introduction of anti-flickering circuit 550 will prevent the flickering phenomenon from occurring in the LED lamp upon the breakoff of power supply to the LED lamp.

FIG. 55B is a schematic diagram of an anti-flickering circuit according to some embodiments. Referring to FIG. 55B, anti-flickering circuit 650 includes at least a resistor, such as two resistors connected in series between filtering output terminals 521 and 522. In this embodiment, anti-flickering circuit 650 in use consumes partial energy of a filtered signal continually. When in normal operation of the LED lamp, this partial energy is far lower than the energy consumed by LED lighting module 530. But upon a break off or stop of the power supply, when the voltage level of the filtered signal decreases to approach the minimum conduction voltage of LED module 630, this partial energy is still consumed by anti-flickering circuit 650 in order to offset the impact of the resonant signals which may cause the flickering of light emission of LED module 630. In some embodiments, a current equal to or larger than an anti-flickering current level may be set to flow through anti-flickering circuit 650 when LED module 630 is supplied by the minimum conduction voltage, and then an equivalent anti-flickering resistance of anti-flickering circuit 650 can be determined based on the set current.

Figure 56A:
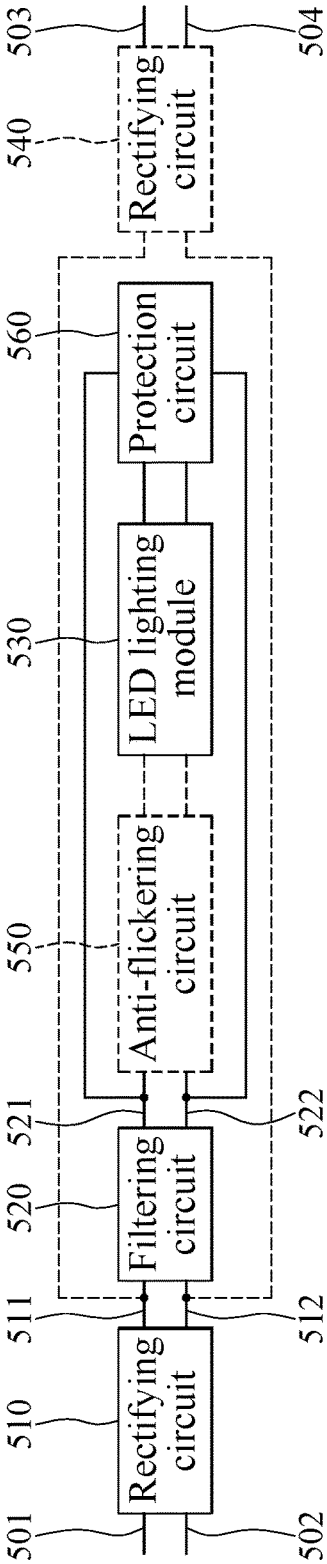
FIG. 56A is a block diagram of an exemplary power supply module for an LED lamp according to some embodiments.

FIG. 56A is a block diagram of an exemplary power supply module for an LED lamp according to some embodiments. Compared to FIG. 55A, the embodiment of FIG. 56A includes rectifying circuits 510 and 540, a filtering circuit 520, a driving circuit 1530, and an anti-flickering circuit 550, and further includes a protection circuit 560. In this embodiment, a driving circuit 1530 and an LED module 630 compose the LED lighting module 530. Protection circuit 560 is coupled to filtering output terminals 521 and 522, to detect the filtered signal from filtering circuit 520 for determining whether to enter a protection state. Upon entering a protection state, protection circuit 560 works to limit, restrain, or clamp down on the level of the filtered signal, preventing damaging of components in LED lighting module 530. And anti-flickering circuit 550 may be omitted and are thus depicted in a dotted line in FIG. 56A.

Figure 56B:
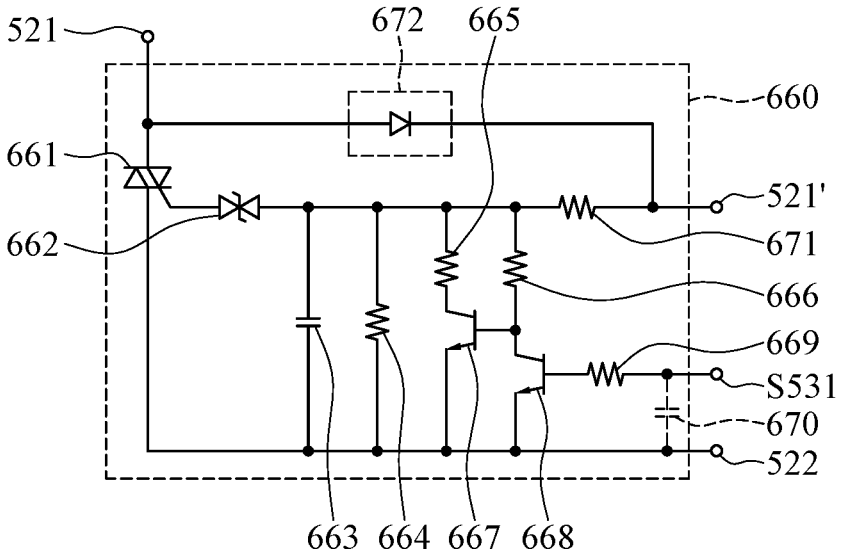
FIG. 56B is a schematic diagram of a protection circuit according to some embodiments.

FIG. 56B is a schematic diagram of the protection circuit according to some embodiments. Referring to FIG. 56B, a protection circuit 660 includes a voltage clamping circuit, a voltage division circuit, capacitors 663 and 670, resistor 669, and a diode 672, for entering a protection state when a current and/or voltage of the LED module is/are or might be excessively high, thus preventing damaging of the LED module. The voltage clamping circuit includes a bidirectional triode thyristor (TRIAC) 661 and a diode for alternating current (DIAC), or symmetrical trigger diode 662. The voltage division circuit includes bipolar junction transistors (BJT) 667 and 668, which respectively serve as first and second switches and resistors 664, 665, 666, and 671.

Bidirectional triode thyristor 661 has a first terminal connected to filtering output terminal 521, a second terminal connected to filtering output terminal 522, and a control terminal connected to a first terminal of symmetrical trigger diode 662, which has a second terminal connected to an end of capacitor 663, which has another end connected to filtering output terminal 522. Resistor 664 is in parallel to capacitor 663, and has an end connected to the second terminal of symmetrical trigger diode 662 and another end connected to filtering output terminal 522. Resistor 665 has an end connected to the second terminal of symmetrical trigger diode 662 and another end connected to the collector terminal of BJT 667, whose emitter terminal is connected to filtering output terminal 522. Resistor 666 has an end connected to the second terminal of symmetrical trigger diode 662 and another end connected to the collector terminal of BJT 668 and the base terminal of BJT 667. The emitter terminal of BJT 668 is connected to filtering output terminal 522. Resistor 669 has an end connected to the base terminal of BJT 668 and another end connected to an end of capacitor 670, which has another end connected to filtering output terminal 522. Resistor 671 has an end connected to the second terminal of symmetrical trigger diode 662 and another end connected to the cathode of diode 672, whose anode is connected to filtering output terminal 521.

According to some embodiments, the resistance of resistor 665 is smaller than that of resistor 666.

Next, an exemplary operation of protection circuit 660 in overcurrent protection is described as follows.

The node connecting resistor 669 and capacitor 670 is to receive a current detection signal S531, which represents and may indicate the magnitude of current through the LED module. One end of resistor 671 is a voltage terminal 521'. In certain embodiments concerning overcurrent protection, voltage terminal 521' may be coupled to a biasing voltage source, or be connected through diode 672 to filtering output terminal 521, as shown in FIG. 56B, to receive a filtered signal as a biasing voltage source. If voltage terminal 521' is coupled to an external biasing voltage source, diode 672 may be omitted, so it is depicted in a dotted line in FIG. 56B. The combination of resistor 669 and capacitor 670 can work to filter out high frequency components of the current detection signal S531, and then input the filtered current detection signal S531 to the base terminal of BJT 668 for controlling current conduction and cutoff of BJT 668. The filtering function of resistor 669 and capacitor 670 can prevent misoperation of BJT 668 due to noises. In practical use, resistor 669 and capacitor 670 may be omitted, so they are each depicted in a dotted line in FIG. 56B. When they are omitted, current detection signal S531 is input directly to the base terminal of BJT 668.

When the LED lamp is operating normally and the current of the LED module is within a normal range (e.g., current detection signal S531 has a value, such as a voltage level, below a particular threshold amount), BJT 668 is in a cutoff state, and resistor 66 works to pull up the base voltage of BJT 667, which therefore enters a conducting state. In this state, the electric potential at the second terminal of symmetrical trigger diode 662 is determined based on the voltage at voltage terminal 521' of the biasing voltage source and voltage division ratios between resistor 671 and parallel-connected resistors 664 and 665. Since the resistance of resistor 665 is relatively small, voltage share for resistor 665 is smaller and the electric potential at the second terminal of symmetrical trigger diode 662 is therefore pulled down. Then, the electric potential at the control terminal of bidirectional triode thyristor 661 is in turn pulled down by symmetrical trigger diode 662, causing bidirectional triode thyristor 661 to enter a cutoff state, which cutoff state makes protection circuit 660 not being in a protection state.

When the current of the LED module exceeds an overcurrent value, the level of current detection signal S531 will increase significantly (e.g., to have a higher value, such as a higher voltage level, above a particular threshold amount) to cause BJT 668 to enter a conducting state and then pull down the base voltage of BJT 667, which thereby enters a cutoff state. In this case, the electric potential at the second terminal of symmetrical trigger diode 662 is determined based on the voltage at voltage terminal 521' of the biasing voltage source and voltage division ratios between resistor 671 and parallel-connected resistors 664 and 666. Since the resistance of resistor 666 is relatively high, voltage share for resistor 666 is larger and the electric potential at the second terminal of symmetrical trigger diode 662 is therefore higher. Then the electric potential at the control terminal of bidirectional triode thyristor 661 is in turn pulled up by symmetrical trigger diode 662, causing bidirectional triode thyristor 661 to enter a conducting state, which conducting state works to restrain or clamp down on the voltage between filtering output terminals 521 and 522 and thus makes protection circuit 660 being in a protection state.

In this embodiment, the voltage at voltage terminal 521' of the biasing voltage source is determined based on the trigger voltage of bidirectional triode thyristor 661, and voltage division ratio between resistor 671 and parallel-connected resistors 664 and 665, or voltage division ratio between resistor 671 and parallel-connected resistors 664 and 666. In certain embodiments, through voltage division between resistor 671 and parallel-connected resistors 664 and 665, the voltage from voltage terminal 521' at symmetrical trigger diode 662 will be lower than the trigger voltage of bidirectional triode thyristor 661. Otherwise, through voltage division between resistor 671 and parallel-connected resistors 664 and 666, the voltage from voltage terminal 521' at symmetrical trigger diode 662 will be higher than the trigger voltage of bidirectional triode thyristor 661. For example, in some embodiments, when the current of the LED module exceeds an overcurrent value, the voltage division circuit is adjusted to the voltage division ratio between resistor 671 and parallel-connected resistors 664 and 666, causing a higher portion of the voltage at voltage terminal 521' to result at symmetrical trigger diode 662, achieving a hysteresis function. Specifically, BJTs 667 and 668 as switches are respectively connected in series to resistors 665 and 666 which determine the voltage division ratios. The voltage division circuit is configured to control turning on which one of BJTs 667 and 668 and leaving the other off for determining the relevant voltage division ratio, according to whether the current of the LED module exceeds an overcurrent value. And the clamping circuit determines whether to restrain or clamp down on the voltage of the LED module according to the applying voltage division ratio.

Next, an exemplary operation of protection circuit 660 in overvoltage protection is described as follows.

The node connecting resistor 669 and capacitor 670 may receive a current detection signal S531, which represents, for example, the magnitude of current through the LED module. As described above, protection circuit 660 is configured to provide overcurrent protection. One end of resistor 671 is connected to a voltage terminal 521'. In this embodiment concerning overvoltage protection, voltage terminal 521' is coupled to the positive terminal of the LED module to detect the voltage of the LED module. Taking previously described embodiments for example, in embodiments of FIG. 53A and FIG. 53B, in some embodiments, LED lighting module 530 doesn't include driving circuit 1530, and the voltage terminal 521' would be coupled to filtering output terminal 521. Whereas in embodiments of FIG. 54A to FIG. 54G, LED lighting module 530 includes driving circuit 1530, and the voltage terminal 521' would be coupled to driving output terminal 1521. In this embodiment, voltage division ratios between resistor 671 and parallel-connected resistors 664 and 665, and voltage division ratios between resistor 671 and parallel-connected resistors 664 and 666 will be adjusted according to the voltage at voltage terminal 521', for example, the voltage at driving output terminal 1521 or filtering output terminal 521. Therefore, normal overcurrent protection can still be provided by protection circuit 660.

In some embodiments, when the LED lamp is operating normally, assuming overcurrent condition doesn't occur, the electric potential at the second terminal of symmetrical trigger diode 662 is determined based on the voltage at voltage terminal 521' and voltage division ratios between resistor 671 and parallel-connected resistors 664 and 665, and is insufficient to trigger bidirectional triode thyristor 661. Then bidirectional triode thyristor 661 is in a cutoff state, making protection circuit 660 not being in a protection state. On the other hand, when the LED module is operating abnormally (e.g.: LED module is open-circuited) with the voltage at the positive terminal of the LED module exceeding an overvoltage value, the electric potential at the second terminal of symmetrical trigger diode 662 is sufficiently high to trigger bidirectional triode thyristor 661 when the voltage at the first terminal of symmetrical trigger diode 662 is larger than the trigger voltage of bidirectional triode thyristor 661. Then bidirectional triode thyristor 661 enters a conducting state, making protection circuit 660 being in a protection state to restrain or clamp down on the level of the filtered signal.

As described above, protection circuit 660 provides one or two of the functions of overcurrent protection and overvoltage protection.

In some embodiments, protection circuit 660 may further include a zener diode connected to resistor 664 in parallel, which zener diode is used to limit or restrain the voltage across resistor 664. The breakdown voltage of the zener diode is in some embodiments in the range of about 25~50 volts, and may preferably be about 36 volts.

Further, a silicon controlled rectifier may be substituted for bidirectional triode thyristor 661 and a surge protection device such as a thyristor surge suppressor may be substituted for symmetrical trigger diode 662, without negatively affecting the protection functions. Using a silicon controlled rectifier instead of a bidirectional triode thyristor 661 has a lower voltage drop across itself in conduction than that across bidirectional triode thyristor 661 in conduction.

In one embodiment, values of the parameters of protection circuit 660 may be set as follows. Resistance of resistor 669 may be about 10 ohms. Capacitance of capacitor 670 may be about 1 nF. Capacitance of capacitor 633 may be about 10 nF. The (breakover) voltage of symmetrical trigger diode 662 may be in the range of about 26~36 volts. Resistance of resistor 671 may be in the range of about 300 k~600 k ohms, and may preferably be, in some embodiments, about 540 k ohms. Resistance of resistor 666 is in some embodiments in the range of about 100 k~300 k ohms, and may preferably be, in some embodiments, about 220 k ohms. Thus, the resistance of the second resistor 666 may be lower, and in some embodiments, less than half of the resistance of the fourth resistor 671. Resistance of resistor 665 is in some embodiments in the range of about 30 k~100 k ohms, and may preferably be, in some embodiments about 40 k ohms. Thus, the resistance of the first resistor 665 may be lower, and in some embodiments, less than half of the resistance of the second resistor 666. Resistance of resistor 664 is in some embodiments in the range of about 100 k~300 k ohms, and may preferably be, in some embodiments about 220 k ohms. Thus, in some embodiments, resistance of third resistor 664 is the same as resistance of the second resistor 666.

In an aspect of the present disclosure, an LED tube lamp comprises a mode determination circuit coupled to the driving circuit 1530. The mode determination circuit is configured to determine whether the external driving signal is a high frequency or high voltage signal according to the frequency or voltage level of the rectified signal. When the external driving signal is a high frequency or high voltage signal, the mode determination circuit allows transmission of the rectified signal to the LED module 630 by bypassing at least some components of the driving circuit 1530; and when the external driving signal is a low frequency or low voltage signal the mode determination circuit allows the driving circuit 1530 to receive the rectified signal and drive the LED module 630. In various embodiments, the external driving signal may be from or provided by an electrical ballast (e.g., an electronic ballast), an inductive ballast, an AC powerline, or a DC power source. In some embodiments, an electronic ballast may use solid state electronic circuitry to provide the proper starting and operating electrical conditions to power the LED tube lamp.

In embodiments of the LED tube lamp (whether it comprises the mode determination circuit or not), the LED tube lamp may comprise a mode switching circuit coupled to the driving circuit 1530. The mode switching circuit is configured to determine, and may be controlled by the mode determination circuit on, whether to perform a first mode or a second mode of lighting operation of the LED tube lamp.

Figure 57A:
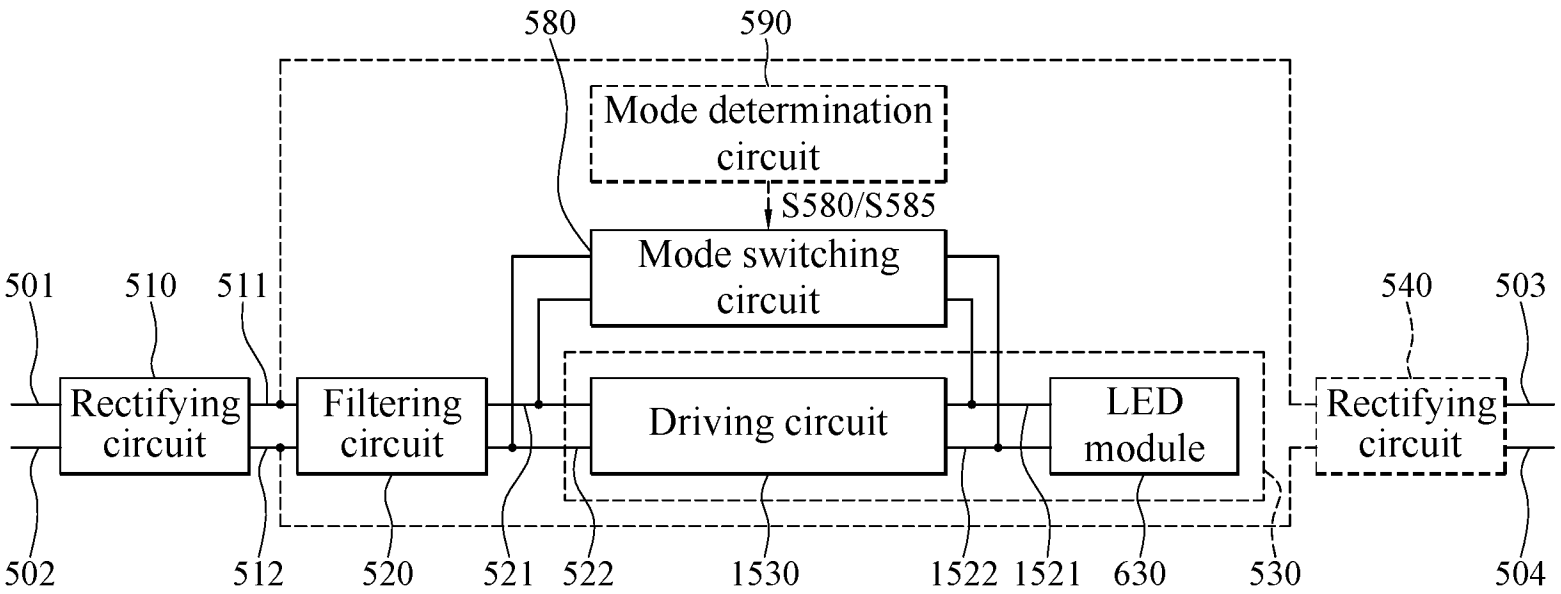
FIG. 57A is a block diagram of an LED lamp according to some embodiments.

FIG. 57A is a block diagram of an LED lamp according to some embodiments. Compared to FIG. 54A, the embodiment of FIG. 57A includes rectifying circuits 510 and 540, a filtering circuit 520, and a driving circuit 1530, and further includes a mode determination circuit 590, and a mode switching circuit 580. The mode determination circuit 590 is configured to determine whether the external driving signal is a high frequency or high voltage signal, and the mode switching circuit 580 is configured to determine whether to perform a first mode or a second mode of lighting operation of the LED tube lamp. The mode determination circuit 590 is coupled to mode switching circuit 580. In some embodiments, the first mode may also be referred to as a first driving mode and the second mode may also be referred to as a second driving mode.

In this embodiment, the driving circuit 1530 and an LED module 630 compose the LED lighting module 530. The mode switching circuit 580 is coupled to at least one of filtering output terminals 521 and 522 and at least one of driving output terminals 1521 and 1522, for determining whether to perform a first driving mode or a second driving mode, as according to a frequency of the external driving signal. In the first driving mode, a filtered signal from filtering circuit 520 is input into driving circuit 1530, while in the second driving mode the filtered signal bypasses at least a component of driving circuit 1530, making (the bypassed component(s) of) driving circuit 1530 stop working in conducting the filtered signal, allowing the filtered signal to (directly) reach and drive LED module 630. The bypassed component(s) of driving circuit 1530 may include an inductor or a switch, which when bypassed makes driving circuit 1530 unable to transfer and/or convert power, and then stop working in conducting the filtered signal. If driving circuit 1530 includes a capacitor, the capacitor can still be used to filter out ripples of the filtered signal in order to stabilize the voltage across the LED module. When mode switching circuit 580 determines on performing the first driving mode, allowing the filtered signal to be input to driving circuit 1530, driving circuit 1530 then transforms the filtered signal into a driving signal for driving LED module 630 to emit light. On the other hand, when mode switching circuit 580 determines on performing the second driving mode, allowing the filtered signal to bypass driving circuit 1530 to reach LED module 630, the filtering circuit 520 then becomes in effect a driving circuit for LED module 630. Then filtering circuit 520 provides the filtered signal as a driving signal for the LED module for driving the LED module 630 to emit light.

In some embodiments, the filtering circuit 520 may be removed to another position such as being coupled between the driving circuit 1530 and the LED module 630. Thus, the rectified signal at rectifying output terminals 511 and 512 may flow into driving circuit 1530 without passing through filtering circuit 520. And instead of being coupled to filtering output terminals 521 and 522 the mode switching circuit 580 may alternatively be connected to at least one of the rectifying output terminals 511 and 512 and at least one of the driving output terminals 1521 and 1522. In this case, when the mode switching circuit 580 determines on performing the first driving mode, allowing the rectified signal to be input to the driving circuit 1530, the driving circuit 1530 then transforms the rectified signal into a driving signal for driving the LED module 630 to emit light. On the other hand, when the mode switching circuit 580 determines on performing the second driving mode, allowing the rectified signal to bypass as least a component of the driving circuit 1530 to reach the LED module 630, the rectifying circuit 510 or 540 then becomes in effect a driving circuit for LED module 630.

In some embodiments, the mode determination circuit 590 may be coupled to at least one of the rectifying output terminals 511 and 512. In this case, the mode determination circuit 590 may determine whether the external driving signal is a high frequency or high voltage signal according to the frequency or voltage level of the rectified signal at one or both of the rectifying output terminals 511 and 512. When the external driving signal is a high frequency or high voltage signal, the mode determination circuit 590 determines on the second driving mode to allow transmission of the rectified signal to the LED module 630 by bypassing at least one component of the driving circuit 1530; and when the external driving signal is a low frequency or low voltage signal, the mode determination circuit 590 determines on the first driving mode to allow the driving circuit 1530 to receive the rectified signal and drive the LED module 630.

In some embodiments, the mode determination circuit 590 may alternatively be coupled to at least one of the filtering output terminals 521 and 522. According to this embodiment, the mode determination circuit 590 may determine whether the external driving signal is a high frequency or high voltage signal according to the frequency or voltage level of the rectified signal after being filtered by the filtering circuit 520 (i.e. the filtered signal).

In some embodiments, the mode switching circuit 580 can determine whether to perform the first driving mode or the second driving mode based on a user's instruction or a detected signal received by the LED lamp through pins 501, 502, 503, and 504. In some embodiments, the mode switching circuit 580 may be controlled by the mode determination circuit 590 to determine whether to perform the first mode or the second mode of lighting operation of the LED tube lamp. Based on the external driving signal received by the LED lamp, the mode determination circuit 590 may generate the determined result signal S580 or/and S585, and so the mode switching circuit 580 can determine whether to perform the first driving mode or the second driving mode based on the determined result signal S580 or/and S585. With the mode switching circuit 580, the power supply module of the LED lamp can adapt to or perform one of appropriate driving modes corresponding to different application environments or driving systems, thus improving the compatibility of the LED lamp. In some embodiments, the rectifying circuit 540 may be omitted, as is depicted by the dotted line in FIG. 57A.

Figure 57B:
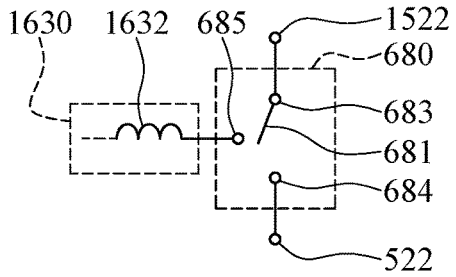
FIG. 57B is a schematic diagram of a mode switching circuit in an LED lamp according to some embodiments.

FIG. 57B is a schematic diagram of a mode switching circuit in an LED lamp according to some embodiments. Referring to FIG. 57B, a mode switching circuit 680 includes a mode switch 681 suitable for use with the driving circuit 1630 in FIG. 54C. Referring to FIG. 57B and FIG. 54C, mode switch 681 has three terminals 683, 684, and 685, wherein terminal 683 is coupled to driving output terminal 1522, terminal 684 is coupled to filtering output terminal 522, and terminal 685 is coupled to the inductor 1632 in driving circuit 1630.

When mode switching circuit 680 determines to perform a first driving mode, mode switch 681 conducts current in a first conductive path through terminals 683 and 685 and a second conductive path through terminals 683 and 684 is in a cutoff state. In this case, driving output terminal 1522 is coupled to inductor 1632, and therefore driving circuit 1630 is working normally, which working includes receiving a filtered signal from filtering output terminals 521 and 522 and then transforming the filtered signal into a driving signal, output at driving output terminals 1521 and 1522 for driving the LED module.

When mode switching circuit 680 determines to perform a second driving mode, mode switch 681 conducts current in the second conductive path through terminals 683 and 684 and the first conductive path through terminals 683 and 685 is in a cutoff state. In this case, driving output terminal 1522 is coupled to filtering output terminal 522, and therefore driving circuit 1630 stops working, and a filtered signal is input through filtering output terminals 521 and 522 to driving output terminals 1521 and 1522 for driving the LED module, while bypassing inductor 1632 and switch 1635 in driving circuit 1630.

Figure 57C:
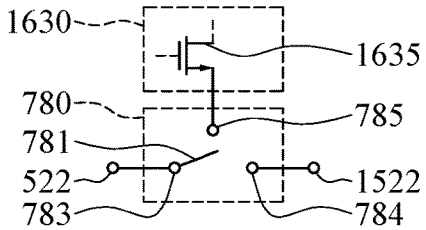
FIG. 57C is a schematic diagram of a mode switching circuit in an LED lamp according to some embodiments.

FIG. 57C is a schematic diagram of a mode switching circuit in an LED lamp according to some embodiments. Referring to FIG. 57C, a mode switching circuit 780 includes a mode switch 781 suitable for use with the driving circuit 1630 in FIG. 54C. Referring to FIG. 57C and FIG. 54C, mode switch 781 has three terminals 783, 784, and 785, wherein terminal 783 is coupled to filtering output terminal 522, terminal 784 is coupled to driving output terminal 1522, and terminal 785 is coupled to switch 1635 in driving circuit 1630.

When mode switching circuit 780 determines to perform a first driving mode, mode switch 781 conducts current in a first conductive path through terminals 783 and 785 and a second conductive path through terminals 783 and 784 is in a cutoff state. In this case, filtering output terminal 522 is coupled to switch 1635, and therefore driving circuit 1630 is working normally, which working includes receiving a filtered signal from filtering output terminals 521 and 522 and then transforming the filtered signal into a driving signal, output at driving output terminals 1521 and 1522 for driving the LED module.

When mode switching circuit 780 determines to perform a second driving mode, mode switch 781 conducts current in the second conductive path through terminals 783 and 784 and the first conductive path through terminals 783 and 785 is in a cutoff state. In this case, driving output terminal 1522 is coupled to filtering output terminal 522, and therefore driving circuit 1630 stops working, and a filtered signal is input through filtering output terminals 521 and 522 to driving output terminals 1521 and 1522 for driving the LED module, while bypassing inductor 1632 and switch 1635 in driving circuit 1630.

Figure 57D:
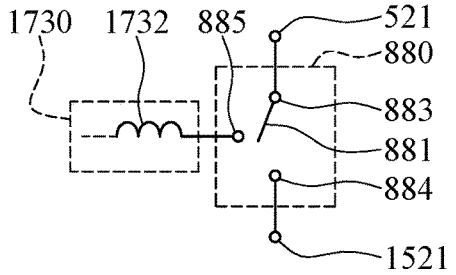
FIG. 57D is a schematic diagram of a mode switching circuit in an LED lamp according to some embodiments.

FIG. 57D is a schematic diagram of a mode switching circuit in an LED lamp according to some embodiments. Referring to FIG. 57D, a mode switching circuit 880 includes a mode switch 881 suitable for use with the driving circuit 1730 in FIG. 54D. Referring to FIG. 57D and FIG. 54D, mode switch 881 has three terminals 883, 884, and 885, wherein terminal 883 is coupled to filtering output terminal 521, terminal 884 is coupled to driving output terminal 1521, and terminal 885 is coupled to inductor 1732 in driving circuit 1730.

When mode switching circuit 880 determines on performing a first driving mode, mode switch 881 conducts current in a first conductive path through terminals 883 and 885 and a second conductive path through terminals 883 and 884 is in a cutoff state. In this case, filtering output terminal 521 is coupled to inductor 1732, and therefore driving circuit 1730 is working normally, which working includes receiving a filtered signal from filtering output terminals 521 and 522 and then transforming the filtered signal into a driving signal, output at driving output terminals 1521 and 1522 for driving the LED module.

When mode switching circuit 880 determines to perform a second driving mode, mode switch 881 conducts current in the second conductive path through terminals 883 and 884 and the first conductive path through terminals 883 and 885 is in a cutoff state. In this case, driving output terminal 1521 is coupled to filtering output terminal 521, and therefore driving circuit 1730 stops working, and a filtered signal is input through filtering output terminals 521 and 522 to driving output terminals 1521 and 1522 for driving the LED module, while bypassing inductor 1732 and freewheeling diode 1733 in driving circuit 1730.

Figure 57E:
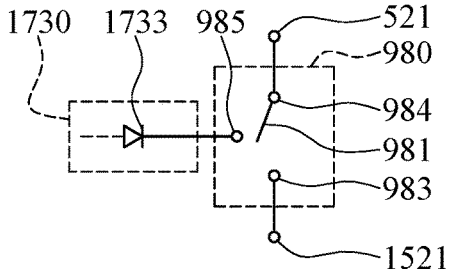
FIG. 57E is a schematic diagram of a mode switching circuit in an LED lamp according to some embodiments.

FIG. 57E is a schematic diagram of a mode switching circuit in an LED lamp according to some embodiments. Referring to FIG. 57E, a mode switching circuit 980 includes a mode switch 981 suitable for use with the driving circuit 1730 in FIG. 54D. Referring to FIG. 57E and FIG. 54D, mode switch 981 has three terminals 983, 984, and 985, wherein terminal 983 is coupled to driving output terminal 1521, terminal 984 is coupled to filtering output terminal 521, and terminal 985 is coupled to the cathode of diode 1733 in driving circuit 1730.

When mode switching circuit 980 determines to perform a first driving mode, mode switch 981 conducts current in a first conductive path through terminals 983 and 985 and a second conductive path through terminals 983 and 984 is in a cutoff state. In this case, filtering output terminal 521 is coupled to the cathode of diode 1733, and therefore driving circuit 1730 is working normally, which working includes receiving a filtered signal from filtering output terminals 521 and 522 and then transforming the filtered signal into a driving signal, output at driving output terminals 1521 and 1522 for driving the LED module.

When mode switching circuit 980 determines to perform a second driving mode, mode switch 981 conducts current in the second conductive path through terminals 983 and 984 and the first conductive path through terminals 983 and 985 is in a cutoff state. In this case, driving output terminal 1521 is coupled to filtering output terminal 521, and therefore driving circuit 1730 stops working, and a filtered signal is input through filtering output terminals 521 and 522 to driving output terminals 1521 and 1522 for driving the LED module, while bypassing inductor 1732 and freewheeling diode 1733 in driving circuit 1730.

Figure 57F:
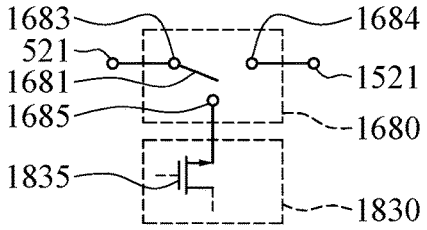
FIG. 57F is a schematic diagram of a mode switching circuit in an LED lamp according to some embodiments.

FIG. 57F is a schematic diagram of a mode switching circuit in an LED lamp according to some embodiments. Referring to FIG. 57F, a mode switching circuit 1680 includes a mode switch 1681 suitable for use with the driving circuit 1830 in FIG. 54E. Referring to FIG. 57F and FIG. 54E, mode switch 1681 has three terminals 1683, 1684, and 1685, wherein terminal 1683 is coupled to filtering output terminal 521, terminal 1684 is coupled to driving output terminal 1521, and terminal 1685 is coupled to switch 1835 in driving circuit 1830.

When mode switching circuit 1680 determines on performing a first driving mode, mode switch 1681 conducts current in a first conductive path through terminals 1683 and 1685 and a second conductive path through terminals 1683 and 1684 is in a cutoff state. In this case, filtering output terminal 521 is coupled to switch 1835, and therefore driving circuit 1830 is working normally, which working includes receiving a filtered signal from filtering output terminals 521 and 522 and then transforming the filtered signal into a driving signal, output at driving output terminals 1521 and 1522 for driving the LED module.

When mode switching circuit 1680 determines on performing a second driving mode, mode switch 1681 conducts current in the second conductive path through terminals 1683 and 1684 and the first conductive path through terminals 1683 and 1685 is in a cutoff state. In this case, driving output terminal 1521 is coupled to filtering output terminal 521, and therefore driving circuit 1830 stops working, and a filtered signal is input through filtering output terminals 521 and 522 to driving output terminals 1521 and 1522 for driving the LED module, while bypassing inductor 1832 and switch 1835 in driving circuit 1830.

Figure 57G:
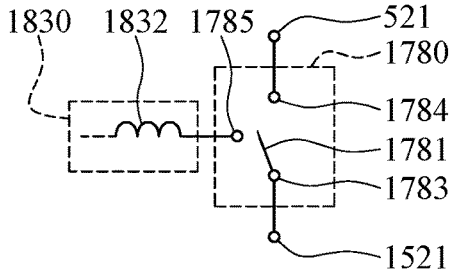
FIG. 57G is a schematic diagram of a mode switching circuit in an LED lamp according to some embodiments.

FIG. 57G is a schematic diagram of a mode switching circuit in an LED lamp according to some embodiments. Referring to FIG. 57G, a mode switching circuit 1780 includes a mode switch 1781 suitable for use with the driving circuit 1830 in FIG. 54E. Referring to FIG. 57G and FIG. 54E, mode switch 1781 has three terminals 1783, 1784, and 1785, wherein terminal 1783 is coupled to filtering output terminal 521, terminal 1784 is coupled to driving output terminal 1521, and terminal 1785 is coupled to inductor 1832 in driving circuit 1830.

When mode switching circuit 1780 determines on performing a first driving mode, mode switch 1781 conducts current in a first conductive path through terminals 1783 and 1785 and a second conductive path through terminals 1783 and 1784 is in a cutoff state. In this case, filtering output terminal 521 is coupled to inductor 1832, and therefore driving circuit 1830 is working normally, which working includes receiving a filtered signal from filtering output terminals 521 and 522 and then transforming the filtered signal into a driving signal, output at driving output terminals 1521 and 1522 for driving the LED module.

When mode switching circuit 1780 determines on performing a second driving mode, mode switch 1781 conducts current in the second conductive path through terminals 1783 and 1784 and the first conductive path through terminals 1783 and 1785 is in a cutoff state. In this case, driving output terminal 1521 is coupled to filtering output terminal 521, and therefore driving circuit 1830 stops working, and a filtered signal is input through filtering output terminals 521 and 522 to driving output terminals 1521 and 1522 for driving the LED module, while bypassing inductor 1832 and switch 1835 in driving circuit 1830.

Figure 57H:
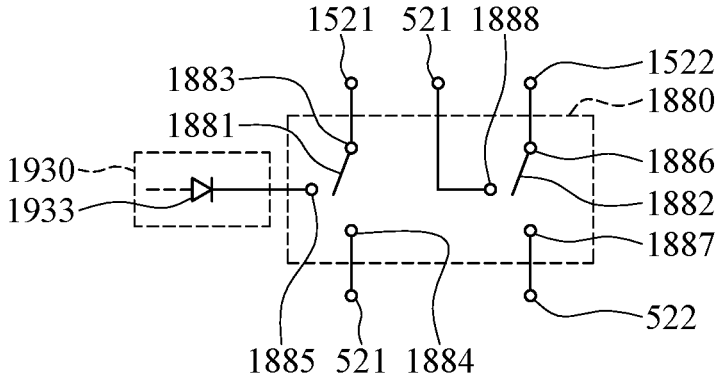
FIG. 57H is a schematic diagram of a mode switching circuit in an LED lamp according to some embodiments.

FIG. 57H is a schematic diagram of a mode switching circuit in an LED lamp according to some embodiments. Referring to FIG. 57H, a mode switching circuit 1880 includes mode switches 1881 and 1882 suitable for use with the driving circuit 1930 in FIG. 54F. Referring to FIG. 57H and FIG. 54F, mode switch 1881 has three terminals 1883, 1884, and 1885, wherein terminal 1883 is coupled to driving output terminal 1521, terminal 1884 is coupled to filtering output terminal 521, and terminal 1885 is coupled to freewheeling diode 1933 in driving circuit 1930. And mode switch 1882 has three terminals 1886, 1887, and 1888, wherein terminal 1886 is coupled to driving output terminal 1522, terminal 1887 is coupled to filtering output terminal 522, and terminal 1888 is coupled to filtering output terminal 521.

When mode switching circuit 1880 determines on performing a first driving mode, mode switch 1881 conducts current in a first conductive path through terminals 1883 and 1885 and a second conductive path through terminals 1883 and 1884 is in a cutoff state, and mode switch 1882 conducts current in a third conductive path through terminals 1886 and 1888 and a fourth conductive path through terminals 1886 and 1887 is in a cutoff state. In this case, driving output terminal 1521 is coupled to freewheeling diode 1933, and filtering output terminal 521 is coupled to driving output terminal 1522. Therefore driving circuit 1930 is working normally, which working includes receiving a filtered signal from filtering output terminals 521 and 522 and then transforming the filtered signal into a driving signal, output at driving output terminals 1521 and 1522 for driving the LED module.

When mode switching circuit 1880 determines on performing a second driving mode, mode switch 1881 conducts current in the second conductive path through terminals 1883 and 1884 and the first conductive path through terminals 1883 and 1885 is in a cutoff state, and mode switch 1882 conducts current in the fourth conductive path through terminals 1886 and 1887 and the third conductive path through terminals 1886 and 1888 is in a cutoff state. In this case, driving output terminal 1521 is coupled to filtering output terminal 521, and filtering output terminal 522 is coupled to driving output terminal 1522. Therefore driving circuit 1930 stops working, and a filtered signal is input through filtering output terminals 521 and 522 to driving output terminals 1521 and 1522 for driving the LED module, while bypassing freewheeling diode 1933 and switch 1935 in driving circuit 1930.

Figure 57I:
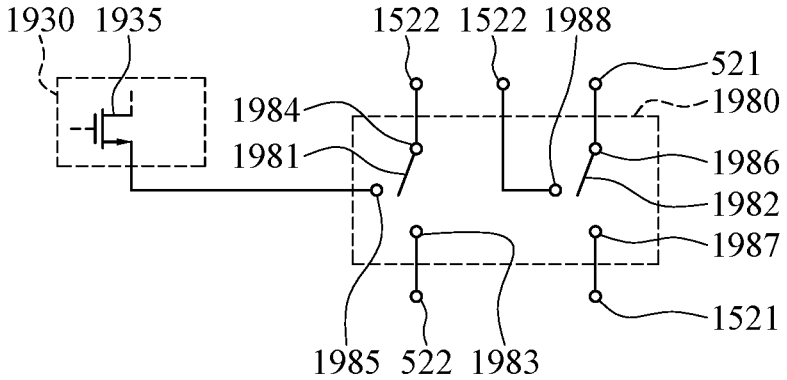
FIG. 57I is a schematic diagram of a mode switching circuit in an LED lamp according to some embodiments.

FIG. 57I is a schematic diagram of a mode switching circuit in an LED lamp according to some embodiments. Referring to FIG. 57I, a mode switching circuit 1980 includes mode switches 1981 and 1982 suitable for use with the driving circuit 1930 in FIG. 54F. Referring to FIG. 57I and FIG. 54F, mode switch 1981 has three terminals 1983, 1984, and 1985, wherein terminal 1983 is coupled to filtering output terminal 522, terminal 1984 is coupled to driving output terminal 1522, and terminal 1985 is coupled to switch 1935 in driving circuit 1930. And mode switch 1982 has three terminals 1986, 1987, and 1988, wherein terminal 1986 is coupled to filtering output terminal 521, terminal 1987 is coupled to driving output terminal 1521, and terminal 1988 is coupled to driving output terminal 1522.

When mode switching circuit 1980 determines to perform a first driving mode, mode switch 1981 conducts current in a first conductive path through terminals 1983 and 1985 and a second conductive path through terminals 1983 and 1984 is in a cutoff state, and mode switch 1982 conducts current in a third conductive path through terminals 1986 and 1988 and a fourth conductive path through terminals 1986 and 1987 is in a cutoff state. In this case, driving output terminal 1522 is coupled to filtering output terminal 521, and filtering output terminal 522 is coupled to switch 1935. Therefore driving circuit 1930 is working normally, which working includes receiving a filtered signal from filtering output terminals 521 and 522 and then transforming the filtered signal into a driving signal, output at driving output terminals 1521 and 1522 for driving the LED module.

When mode switching circuit 1980 determines to perform a second driving mode, mode switch 1981 conducts current in the second conductive path through terminals 1983 and 1984 and the first conductive path through terminals 1983 and 1985 is in a cutoff state, and mode switch 1982 conducts current in the fourth conductive path through terminals 1986 and 1987 and the third conductive path through terminals 1986 and 1988 is in a cutoff state. In this case, driving output terminal 1521 is coupled to filtering output terminal 521, and filtering output terminal 522 is coupled to driving output terminal 1522. Therefore driving circuit 1930 stops working, and a filtered signal is input through filtering output terminals 521 and 522 to driving output terminals 1521 and 1522 for driving the LED module, while bypassing freewheeling diode 1933 and switch 1935 in driving circuit 1930.

In some embodiments, the mode switching circuits 680 and 780 may be coupled to rectifying output terminal 512 instead of being coupled to the filtering output terminal 522. The mode switching circuits 880, 980, 1680, and 1780 may be coupled to the rectifying output terminal 511 instead of being coupled to the filtering output terminal 521. The mode switching circuits 1880 and 1980 may be coupled to the rectifying output terminals 511 and 512 instead of being coupled to the filtering output terminals 521 and 522. According to these embodiments, the driving output terminals 1521 and 1522 are coupled to the rectifying output terminals 511 and 512, respectively. When the mode switching circuit determines on performing the second driving mode, the rectified signal is transmitted to driving output terminals 1521 and 1522 for driving the LED module 630, by bypassing one or more components of the driving circuit 1530. And when the mode switching circuit determines on performing the first driving mode, the rectified signal is transformed into the driving signal by the driving circuit 1530 for driving the LED module 630.

The mode switches in the above embodiments may each comprise, for example, a single-pole double-throw switch, or comprise two semiconductor switches (such as metal oxide semiconductor transistors), for switching a conductive path on to conduct current while leaving the other conductive path cutoff. Each of the two conductive paths provides a path for conducting the filtered signal, allowing the current of the filtered signal to flow through one of the two paths, thereby achieving the function of mode switching or selection. For example, with reference to FIGS. 49A, and 49C in addition, when the lamp driving circuit 505 is not present and the LED tube lamp 500 is directly supplied by the AC power supply 508, the mode switching circuit may determine to perform a first driving mode in which the driving circuit (such as driving circuit 1530, 1630, 1730, 1830, or 1930) transforms the filtered signal into a driving signal of a level meeting a required level to properly drive the LED module to emit light. On the other hand, when the lamp driving circuit 505 is present, the mode switching circuit may determine to perform a second driving mode in which the filtered signal is (almost) directly used to drive the LED module to emit light; or alternatively the mode switching circuit may determine to perform the first driving mode to drive the LED module to emit light.

Figure 57J:
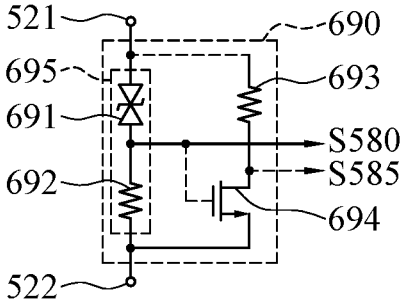
FIG. 57J is a schematic diagram of a mode determination circuit in an LED lamp according to some embodiments.

FIG. 57J is a schematic diagram of a mode determination circuit in an LED lamp according to some embodiments. Referring to FIG. 57J, the mode determination circuit 690 is an embodiment of mode determination circuit 590 (as shown in FIG. 57A). Mode determination circuit 690 is connected between filtering output terminals 521 and 522. The mode determination circuit 690 comprises a voltage determination circuit 695 configured to control, according to the voltage level of the external driving signal, the mode switching circuit 580 on whether to perform the first mode or the second mode of lighting operation. When the mode switching circuit 580 performs the first mode of lighting operation, the driving circuit 1530 receives the rectified signal (or the filtered signal) and drives the LED module 630. When the mode switching circuit 580 performs the second mode of lighting operation, transmission of the rectified signal (or the filtered signal) bypasses at least some components of the driving circuit 1530 in order to drive the LED module 630.

In some embodiments, the voltage determination circuit 695 comprises a symmetrical trigger diode 691 and a resistor 692 coupled to each other, and is configured for detecting a voltage level of the external driving signal by receiving the filtered signal at filtering output terminals 521 and 522 to generate the determination result signal S580. The symmetrical trigger diode 691 and the resistor 692 are connected in series; and namely, one end of the symmetrical trigger diode 691 is coupled to the first filtering output terminal 521, the other end thereof is coupled to one end of the resistor 692, and the other end of the resistor 692 is coupled to the second filtering output terminal 522. A connection node of the symmetrical trigger diode 691 and the resistor 692 generates the determined result signal S580 transmitted to the mode switching circuit 580. When the external driving signal is a signal with high frequency and high voltage, the determined result signal S580 is at a high voltage level to make the mode switching circuit 580 determine to operate at the second driving mode. For example, when the lamp driving circuit 505, as shown in FIG. 49A and FIG. 49C, exists, the lamp driving circuit 505 converts the AC power signal of the AC power supply 508 into an AC driving signal with high frequency and high voltage, transmitted into the LED tube lamp 500. At this time, the mode switching circuit 580 determines to operate at the second driving mode and so the filtered signal, outputted by the first filtering output terminal 521 and the second filtering output terminal 522, directly drive the LED module 630 to light. When the external driving signal is a signal with low frequency and low voltage, the determined result signal S580 is at a low voltage level to make the mode switching circuit 580 determine to operate at the first driving mode. For example, when the lamp driving circuit 505, as shown in FIG. 49A and FIG. 49C, does not exist, the AC power signal of the AC power supply 508 is directly transmitted into the LED tube lamp 500. At this time, the mode switching circuit 580 determines to operate at the first driving mode and so the filtered signal, outputted by the first filtering output terminal 521 and the second filtering output terminal 522, is converted into an appropriate voltage level to drive the LED module 630 to light.

In some embodiments, a breakover voltage of the symmetrical trigger diode 691 is in a range of 400V~1300V, in some embodiments more specifically in a range of 450V~700V, and in some embodiments, more specifically in a range of 500V~600V.

The mode determination circuit 690 may include a resistor 693 and a switch 694. The resistor 693 and the switch 694 could be omitted based on the practice application, thus the resistor 693 and the switch 694 and a connection line thereof are depicted in a dotted line in FIG. 57J. The resistor 693 and the switch 694 are connected in series; namely one end of the resistor 693 is coupled to the first filtering output terminal 521, the other end is coupled to one end of the switch 694, and another end of the switch 694 is coupled to second filtering output terminal 522. A control end of the switch 694 is coupled to the connection node of the symmetrical trigger diode 691 and the resistor 692 for receiving the determined result signal S580. Accordingly, a connection node of the resistor 693 and the switch 694 generates another determined result signal S585. The determined result signal S585 is an inverted signal of the determined result signal S580 and so they could be applied to a mode switching circuit 580 having two switches for switching between two modes, such as the mode switching circuit 1880 or 1980.

Figure 57K:
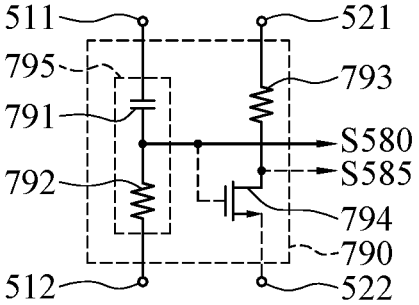
FIG. 57K is a schematic diagram of a mode determination circuit in an LED lamp according to some embodiments.

FIG. 57K is a schematic diagram of a mode determination circuit in an LED lamp according to some embodiments. Referring to FIG. 57K, the mode determination circuit 790 is an embodiment of mode determination circuit 590 (as shown in FIG. 57A). The mode determination circuit 790 comprises a frequency determination circuit 795 configured to control, according to the frequency of the external driving signal, the mode switching circuit 580 on whether to perform the first mode or the second mode of lighting operation. When the mode switching circuit 580 performs the first mode of lighting operation, the driving circuit 1530 receives the rectified signal (or the filtered signal) and drives the LED module 630. And when the mode switching circuit 580 performs the second mode of lighting operation, transmission of the rectified signal (or the filtered signal) bypasses at least some components of the driving circuit 1530 in order to drive the LED module 630.

In some embodiments, the mode determination circuit 790 includes a capacitor 791, resistors 791 and 793, and a switch 794. The capacitor 791 and the resistor 792 are connected in series as the frequency determination circuit 795 for detecting a frequency of an external driving signal. One end of the capacitor 791 is coupled to the first rectifying output terminal 511, the other end is coupled to one end of the resistor 792, and the other end of the resistor 792 is coupled to the second rectifying output terminal 512. The frequency determination circuit 795 generates the determined result signal S580 at a connection node of the resistor 792 and the capacitor 791. A voltage level of the determined result signal S580 is determined based on the frequency of the external driving signal. In some embodiment, the higher the frequency of the external driving signal is, the higher the voltage level of the determined result signal S580 is, and the lower the frequency of the external driving signal is, the lower the voltage level of the determined result signal S580 is. Hence, when the external driving signal is a higher frequency signal (e.g., more than 20 KHz) and high voltage, the determined result signal S580 is at high voltage level to make the mode switching circuit 580 determine to operate at the second driving mode. When the external driving signal is a lower frequency signal and low voltage signal, the determined result signal S580 is at a low voltage level to make the mode switching circuit 580 determine to operate at the first driving mode. Similarly, in some embodiments, the mode determination circuit 790 may include a resistor 793 and a switch 794. The resistor 793 and the switch 794 are connected in series between the first filtering output terminal 521 and the second filtering output terminal 522, and a control end of the switch 794 is coupled to the frequency determination circuit 795 to receive the determined result signal S580. Accordingly, another determined result signal S585 is generated at a connection node of the resistor 793 and the switch 794 and is an inverted signal of the determined result signal S580. The determined result signals S580 and S585 may be applied to a mode switching circuit 580 having two switches. The resistor 793 and the switch 794 could be omitted based on practice application and so are depicted in a dotted line.

Figure 58A:
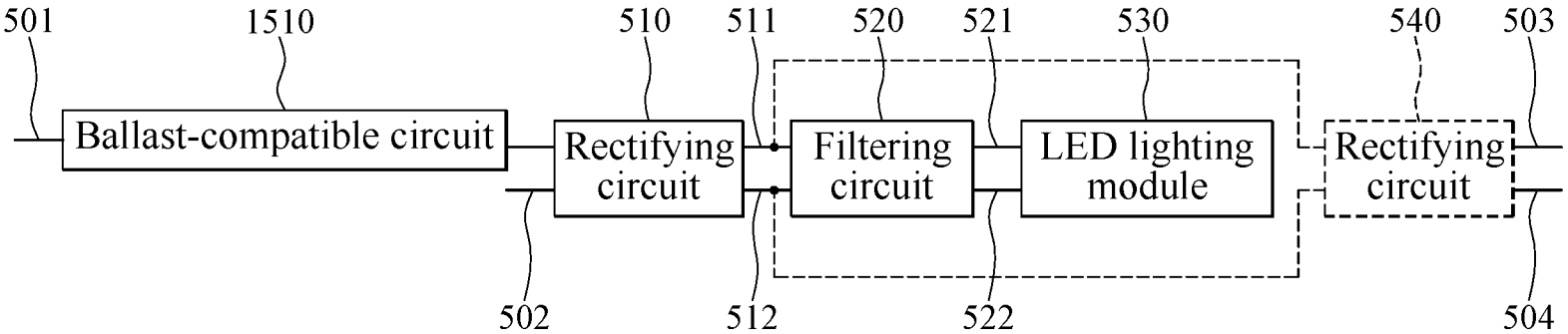
FIG. 58A is a block diagram of an LED lamp according to some embodiments.

FIG. 58A is a block diagram of an LED lamp according to some embodiments. Compared to FIG. 49E, the embodiment of FIG. 58A includes rectifying circuits 510 and 540, and a filtering circuit 520, and further includes a ballast-compatible circuit 1510; wherein the power supply module may also include some components of an LED lighting module 530. The ballast-compatible circuit 1510 is coupled to (the first) rectifying circuit 510, and may be coupled between pin 501 and/or pin 502 and rectifying circuit 510. This embodiment is explained assuming the ballast-compatible circuit 1510 to be coupled between pin 501 and rectifying circuit 510. With reference to FIGS. 49A, 49B, and 49D in addition to FIG. 58A, in one embodiment, lamp driving circuit 505 comprises a ballast configured to provide an AC driving signal to drive the LED lamp in this embodiment. In some embodiments, the ballast-compatible circuit herein may also be referred to as a ballast interface circuit.

In an initial stage upon the activation of the driving system of lamp driving circuit 505, lamp driving circuit 505's ability to output relevant signal(s) initially takes time to rise to a standard state, and at first has not risen to that state. However, in the initial stage the power supply module of the LED lamp instantly or rapidly receives or conducts the AC driving signal provided by lamp driving circuit 505, which initial conduction is likely to fail the starting of the LED lamp by lamp driving circuit 505 as lamp driving circuit 505 is initially loaded by the LED lamp in this stage. For example, internal components of lamp driving circuit 505 may retrieve power from a transformed output in lamp driving circuit 505, in order to maintain their operation upon the activation. In this case, the activation of lamp driving circuit 505 may end up failing as its output voltage could not normally rise to a required level in this initial stage; or the quality factor (Q) of a resonant circuit in lamp driving circuit 505 may vary as a result of the initial loading from the LED lamp, so as to cause the failure of the activation.

In one embodiment, in the initial stage upon activation, ballast-compatible circuit 1510 will be in an open-circuit state, preventing the energy of the AC driving signal from reaching the LED module. After a defined delay, which may be a specific delay period, after the AC driving signal as an external driving signal is first input to the LED tube lamp, ballast-compatible circuit 1510 switches, or changes, from a cutoff state during the delay to a conducting state, allowing the energy of the AC driving signal to start to reach the LED module. By means of the delayed conduction of ballast-compatible circuit 1510, operation of the LED lamp simulates the lamp-starting characteristics of a fluorescent lamp. For example during lamp starting of a fluorescent lamp, internal gases of the fluorescent lamp will normally discharge for light emission after a delay upon activation of a driving power supply. Therefore, ballast-compatible circuit 1510 further improves the compatibility of the LED lamp with lamp driving circuits 505 such as an electronic ballast. In this manner, ballast-compatible circuit 1510, which may be described as a delay circuit, or an external signal control circuit, is configured to control the timing for receiving an AC driving signal at a power supply module of an LED lamp (e.g., at a rectifier circuit and/or filter circuit of a power supply module).

In this embodiment, rectifying circuit 540 may be omitted and is therefore depicted by a dotted line in FIG. 58A.

In some embodiments, using the ballast-compatible circuit described with reference to FIG. 58F, and H-P in this disclosure, upon the external driving signal being initially input at the first pin and second pin (e.g., upon inserting or plugging an LED lamp into a socket), the ballast interface circuit may not enter a conduction state until a period of delay passes. In some embodiments, the period may be between about 10 milliseconds (ms) and about 1 second. More specifically, in some embodiments, the period may be between about 10 ms and about 300 ms.

Figure 58B:
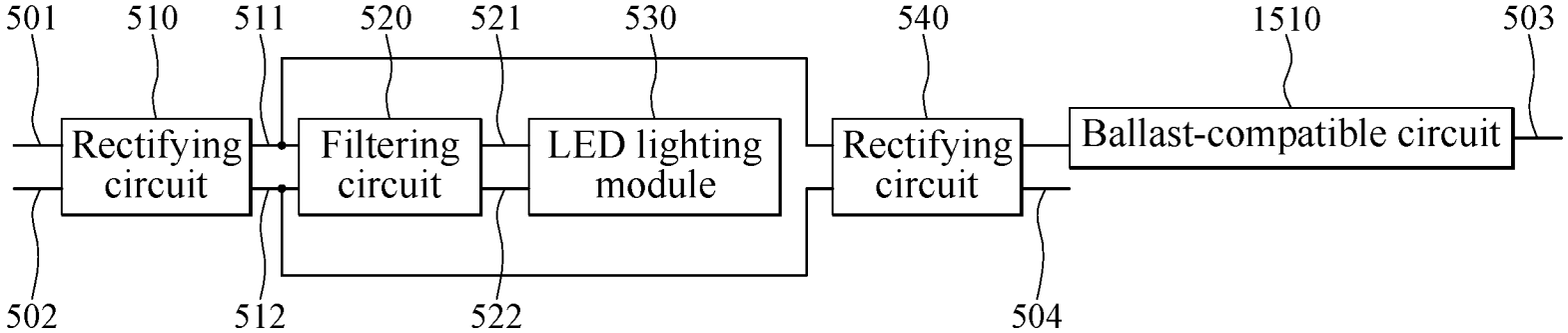
FIG. 58B is a block diagram of an LED lamp according to some embodiments.

FIG. 58B is a block diagram of an LED lamp according to some embodiments. Compared to FIG. 58A, ballast-compatible circuit 1510 in the embodiment of FIG. 58B is coupled between pin 503 and/or pin 504 and rectifying circuit 540. As explained regarding ballast-compatible circuit 1510 in FIG. 58A, ballast-compatible circuit 1510 in FIG. 58B performs the function of delaying the starting of the LED lamp, or causing the input of the AC driving signal to be delayed for a (predefined) period of time, in order to prevent the failure of starting by lamp driving circuits 505 such as an electrical ballast.

Figure 58C:
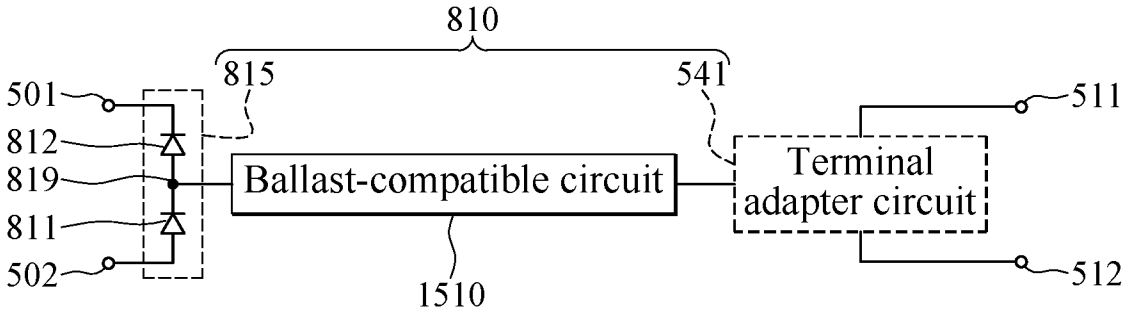
FIG. 58C illustrates an arrangement with a ballast-compatible circuit in an LED lamp according to some embodiments.

Apart from coupling ballast-compatible circuit 1510 between terminal pin(s) and rectifying circuit in the above embodiments, ballast-compatible circuit 1510 may alternatively be included within a rectifying circuit with a different structure. FIG. 58C illustrates an arrangement with a ballast-compatible circuit in an LED lamp according to some embodiments. Referring to FIG. 58C, the rectifying circuit has the circuit structure of rectifying circuit 810 in FIG. 50C. Rectifying circuit 810 includes rectifying unit 815 and terminal adapter circuit 541. Rectifying unit 815 is coupled to pins 501 and 502, terminal adapter circuit 541 is coupled to filtering output terminals 511 and 512, and the ballast-compatible circuit 1510 in FIG. 58C is coupled between rectifying unit 815 and terminal adapter circuit 541. In this case, in the initial stage upon activation of the ballast, an AC driving signal as an external driving signal is input to the LED tube lamp, where the AC driving signal can only reach rectifying unit 815, but cannot reach other circuits such as terminal adapter circuit 541, other internal filter circuitry, and the LED lighting module. Moreover, parasitic capacitors associated with rectifying diodes 811 and 812 within rectifying unit 815 are quite small in capacitance and may be ignored. Accordingly, lamp driving circuit 505 in the initial stage isn't loaded with or effectively connected to the equivalent capacitor or inductor of the power supply module of the LED lamp, and the quality factor (Q) of lamp driving circuit 505 is therefore not adversely affected in this stage, resulting in a successful starting of the LED lamp by lamp driving circuit 505. For example, the first rectifying circuit 510 may comprise a rectifying unit 815 and a terminal adapter circuit 541, and the rectifying unit 815 is coupled to the terminal adapter circuit 541 and is capable of performing half-wave rectification. In this example, the terminal adapter circuit 541 is configured to transmit the external driving signal received via at least one of the first pin and the second pin.

In some embodiments, under the condition that terminal adapter circuit 541 doesn't include components such as capacitors or inductors, interchanging rectifying unit 815 and terminal adapter circuit 541 in position, meaning rectifying unit 815 is connected to filtering output terminals 511 and 512 and terminal adapter circuit 541 is connected to pins 501 and 502, doesn't affect or alter the function of ballast-compatible circuit 1510.

Further, as explained in FIGS. 50A-50D, when a rectifying circuit is connected to pins 503 and 504 instead of pins 501 and 502, this rectifying circuit may constitute the rectifying circuit 540. For example, the circuit arrangement with a ballast-compatible circuit 1510 in FIG. 58C may be alternatively included in rectifying circuit 540 instead of rectifying circuit 810, without affecting the function of ballast-compatible circuit 1510.

In some embodiments, as described above terminal adapter circuit 541 doesn't include components such as capacitors or inductors. Or when rectifying circuit 610 in FIG. 50A constitutes the rectifying circuit 510 or 540, parasitic capacitances in the rectifying circuit 510 or 540 are quite small and may be ignored. These conditions contribute to not affecting the quality factor of lamp driving circuit 505.

Figure 58D:
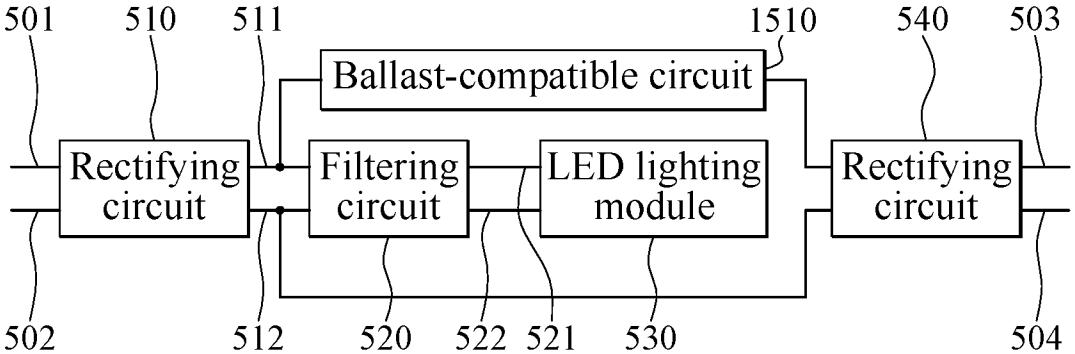
FIG. 58D is a block diagram of an LED lamp according to some embodiments.

FIG. 58D is a block diagram of an LED lamp according to some embodiments. Compared to the embodiment of FIG. 58A, ballast-compatible circuit 1510 in the embodiment of FIG. 58D is coupled between rectifying circuit 540 and filtering circuit 520. Since rectifying circuit 540 also doesn't include components such as capacitors or inductors, the function of ballast-compatible circuit 1510 in the embodiment of FIG. 58D will not be affected.

Figure 58E:
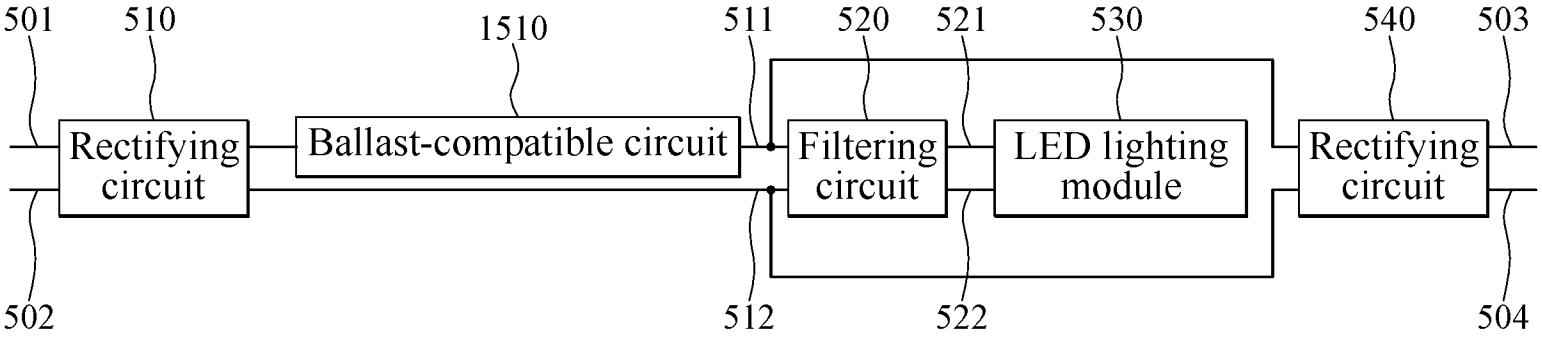
FIG. 58E is a block diagram of an LED lamp according to some embodiments.

FIG. 58E is a block diagram of an LED lamp according to some embodiments. Compared to the embodiment of FIG. 58A, ballast-compatible circuit 1510 in the embodiment of FIG. 58E is coupled between rectifying circuit 510 and filtering circuit 520. Similarly, since rectifying circuit 510 doesn't include components such as capacitors or inductors, the function of ballast-compatible circuit 1510 in the embodiment of FIG. 58E will not be affected. Still, under the configuration shown in FIG. 58E, the reception of a driving signal for driving an LED lamp (in this case a rectified driving signal) can be delayed. For example, in FIG. 58E, the reception of a driving signal at a filter circuit 520 may be delayed after the LED lamp is plugged in. The delay may be controlled by a ballast-compatible circuit.

Figure 58F:
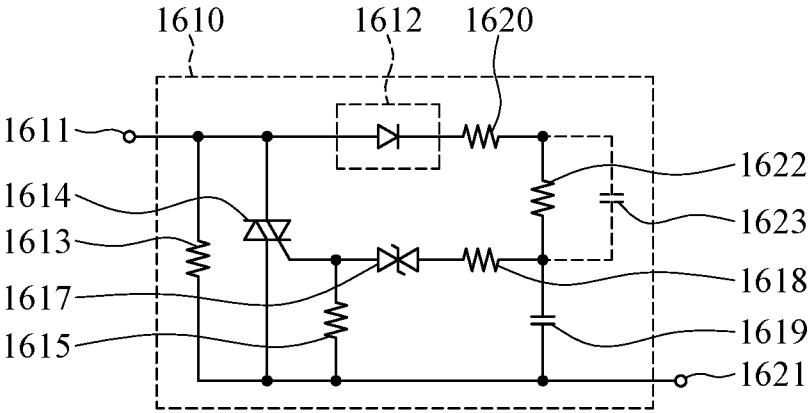
FIG. 58F is a schematic diagram of a ballast-compatible circuit according to some embodiments.

FIG. 58F is a schematic diagram of a ballast-compatible circuit according to some embodiments. Again a ballast-compatible circuit may also be referred to herein as a ballast interface circuit, as it serves as an interface between an electrical ballast and an LED lighting module of an LED lamp. Referring to FIG. 58F, a ballast-compatible circuit 1610 has an initial state in which an equivalent open-circuit is obtained at ballast-compatible circuit input and output terminals 1611 and 1621. Upon receiving an input signal at ballast-compatible circuit input terminal 1611, a delay will pass until a current conduction occurs through and between ballast-compatible circuit input and output terminals 1611 and 1621, transmitting the input signal to ballast-compatible circuit output terminal 1621.

Ballast-compatible circuit 1610 includes a diode 1612, first through fifth resistors 1613, 1615, 1618, 1620, and

1622, a second electronic switch (such as a bidirectional triode thyristor (TRIAC) 1614), a first electronic switch (such as a DIAC or symmetrical trigger diode 1617), a capacitor 1619, and ballast-compatible circuit input and output terminals 1611 and 1621. In some embodiments, the resistance of first resistor 1613 should be comparatively quite large so that when bidirectional triode thyristor 1614 is cutoff in an open-circuit state, an equivalent open-circuit is obtained at ballast-compatible circuit input and output terminals 1611 and 1621. Typical values of the resistance of first resistor 1613 may be in the range of about 330 kΩ to about 820 kΩ, and the resistance could take a value in a broad range of about 47 kΩ to about 1.5 MΩ. And in one embodiment, the value is 330KΩ.

Bidirectional triode thyristor 1614 is coupled between ballast-compatible circuit input and output terminals 1611 and 1621, and first resistor 1613 is also coupled between ballast-compatible circuit input and output terminals 1611 and 1621 and in parallel to bidirectional triode thyristor 1614. Diode 1612, fourth and fifth resistors 1620 and 1622, and capacitor 1619 are series-connected in sequence between ballast-compatible circuit input and output terminals 1611 and 1621, and are connected in parallel with bidirectional triode thyristor 1614. Diode 1612 has an anode connected to bidirectional triode thyristor 1614, and has a cathode connected to an end of fourth resistor 1620. Bidirectional triode thyristor 1614 has a control terminal connected to a terminal of symmetrical trigger diode 1617, which has another terminal connected to an end of third resistor 1618, which has another end connected to a node connecting capacitor 1619 and fifth resistor 1622. Second resistor 1615 is connected between the control terminal of bidirectional triode thyristor 1614 and a node connecting first resistor 1613 and capacitor 1619. In some embodiments, resistors 1615, 1618, and 1620 may be omitted. The different resistors and switches are referred to using labels first through fifth (or first and second), but may be referred to using other labels. For example, if only the fourth resistor 1620 and fifth resistor 1622 are being discussed, they may be referred to as a first and second resistor, respectfully. Similarly, the first switch 1617 may be referred to as a second switch, and the second switch 1614 may be referred to as a first switch. Also, the opposite ends or terminals of certain devices, such as the different resistors the capacitor 1619, switch 1617, or diode 1612, may be referred to as first and second ends, or first and second terminals, and may be described as opposite each other.

When an AC driving signal (such as a high-frequency high-voltage AC signal output by an electronic ballast) is initially input to ballast-compatible circuit input terminal 1611, bidirectional triode thyristor 1614 will be in an open-circuit state, preventing the AC driving signal from passing through, and the LED lamp is therefore also in an open-circuit state. In this state, the AC driving signal is charging capacitor 1619 through diode 1612 and resistors 1620 and 1622, gradually increasing the voltage of capacitor 1619. Upon continually charging for a period of time, the voltage of capacitor 1619 increases to be above the trigger voltage value of symmetrical trigger diode 1617 so that symmetrical trigger diode 1617 is turned on in a conducting state. Then the conducting symmetrical trigger diode 1617 will in turn trigger bidirectional triode thyristor 1614 on in a conducting state. In this situation, the conducting bidirectional triode thyristor 1614 electrically connects ballast-compatible circuit input and output terminals 1611 and 1621, allowing the AC driving signal to flow through ballast-compatible circuit input and output terminals 1611 and 1621, thus starting the operation of the power supply module of the LED lamp. In this case the energy stored by capacitor 1619 will maintain the conducting state of bidirectional triode thyristor 1614, to prevent the AC variation of the AC driving signal from causing bidirectional triode thyristor 1614 and therefore ballast-compatible circuit 1610 to be cutoff again, or to prevent the situation of bidirectional triode thyristor 1614 alternating or switching between its conducting and cutoff states. Therefore, when the external driving signal is initially input at the first pin and second pin, the second electronic switch will be in an open-circuit state, and the first capacitor will be charged so as to cause the first electronic switch to enter a conducting state to an extent that in turn triggers the second electronic switch into a conducting state, making the ballast-compatible circuit enter the conduction state.

When ballast-compatible circuit 1610 of this embodiment is applied to the circuit system in FIGS. 58C and 58D, since ballast-compatible circuit 1610 in operation receives a signal that has been rectified through the rectifying unit or the rectifying circuit, diode 1612 can be omitted. And in various embodiments, bidirectional triode thyristor 1614 may be replaced by, for example, a silicon controlled rectifier (SCR), which can reduce voltage drop in a conducting line, and the first electronic switch may comprise a symmetrical trigger diode 1617 or constitute e.g., a thyristor surge suppressor. In general, in hundreds of milliseconds upon activation of a lamp driving circuit 505 such as an electronic ballast, the output voltage of the ballast has risen above a certain voltage value as the output voltage hasn't been adversely affected by the sudden initial loading from the LED lamp. In particular, upon activation of each of some instant-start electronic ballasts, the output AC voltage of the ballast will be roughly maintained at a constant value below about 300 volts for a small period such as 0.01 seconds, and then rises. During this small period, if any load(s) is introduced in the lamp and then coupled to the output end of the ballast, this load addition will prevent the output AC voltage of the instant-start electronic ballast from smoothly rising to a sufficient level. This problem is especially likely to happen if the input voltage to the ballast is from the AC powerline of a voltage substantially equal to or below 120 volts. In some embodiments, a detection mechanism to detect whether lighting of a fluorescent lamp is achieved may be disposed in lamp driving circuits 505 such as an electronic ballast. In this detection mechanism, if a fluorescent lamp fails to be lit up for a defined period of time, an abnormal state of the fluorescent lamp is detected, causing the fluorescent lamp to enter a protection state. In certain embodiments, the delay provided by ballast-compatible circuit 1610 until conduction of ballast-compatible circuit 1610 and then the LED lamp may be larger than 0.01 seconds, and may be even in the range of about 0.1~3 seconds. For example, upon the external driving signal being initially input at the first pin and second pin, the ballast-compatible circuit will not enter a conduction state until a period of delay passes, wherein the period of delay is between about 10 milliseconds (ms) and 1 second. And preferably in some embodiments the period is between about 10 milliseconds (ms) and 300 ms.

In some embodiments, an additional or another capacitor 1623 may be coupled in parallel to fifth resistor 1622. Capacitor 1623 has an end coupled to a coupling node between an input/output terminal of the ballast-compatible circuit 1610 and the second electronic switch; has another end coupled to a coupling node between the first electronic switch and the first capacitor 1619; and is configured to reflect or bear instantaneous change in the voltage between an input terminal and an output terminal of the ballast-compatible circuit 1610. For example, capacitor 1623 operates to reflect or support instantaneous change in the voltage between ballast-compatible circuit input and output terminals 1611 and 1621, and will not affect the function of delayed conduction performed by ballast-compatible circuit 1610.

As disclosed herein, the LED tube lamp may comprise a light strip attached to an inner surface of the lamp tube and which comprises a bendable circuit sheet. And the LED lighting module may comprise an LED module, which comprises an LED component (e.g., an LED or group of LEDs) and is disposed on the bendable circuit sheet. The ballast-compatible circuit 1610 may be between a ballast of an external power supply and the LED lighting module and/or LED module of the LED tube lamp. The ballast-compatible circuit 1610 may be configured to receive a signal derived from the external driving signal. For example, the signal may be a filtered signal passed through a rectifying circuit and a filtering circuit.

Figure 58G:
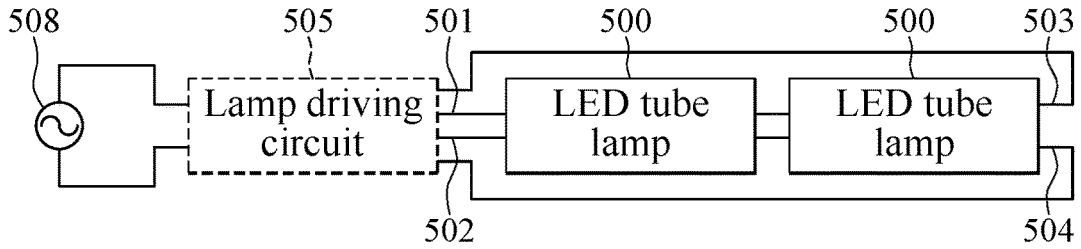
FIG. 58G is a block diagram of a power supply module in an LED lamp according to some embodiments.

FIG. 58G is a block diagram of a power supply module in an LED lamp according to some embodiments. Compared to the embodiment of FIG. 49D, lamp driving circuit 505 in the embodiment of FIG. 58G drives a plurality of LED tube lamps 500 connected in series, wherein a ballast-compatible circuit 1610 is disposed in each of the LED tube lamps 500. For the convenience of illustration, two series-connected LED tube lamps 500 are assumed for example and explained as follows.

Because the two ballast-compatible circuits 1610 respectively of the two LED tube lamps 500 can actually have different delays until conduction of the LED tube lamps 500, due to various factors such as errors occurring in production processes of some components, in some embodiments, the actual timing of conduction of each of the ballast-compatible circuits 1610 is different. Upon activation of a lamp driving circuit 505, the voltage of the AC driving signal provided by lamp driving circuit 505 will be shared by the two LED tube lamps 500 roughly equally. Subsequently when only one of the two LED tube lamps 500 first enters a conducting state, the voltage of the AC driving signal then will be borne mostly or entirely by the other LED tube lamp 500. This situation will cause the voltage across the ballast-compatible circuits 1610 in the other LED tube lamp 500 that's not conducting to suddenly increase or be doubled, meaning the voltage between ballast-compatible circuit input and output terminals 1611 and 1621 might even be suddenly doubled. In view of this, if capacitor 1623 is included, the voltage division effect between capacitors 1619 and 1623 will instantaneously increase the voltage of capacitor 1619 (see the explanation below), making symmetrical trigger diode 1617 triggering bidirectional triode thyristor 1614 into a conducting state, thus causing the two ballast-compatible circuits 1610 respectively of the two LED tube lamps 500 to become conducting almost at the same time. Therefore, by introducing capacitor 1623, the situation, where one of the two ballast-compatible circuits 1610 respectively of the two series-connected LED tube lamps 500 that is first conducting has its bidirectional triode thyristor 1614 then suddenly cutoff as having insufficient current passing through due to the discrepancy between the delays provided by the two ballast-compatible circuits 1610 until their respective conductions, can be avoided. Therefore, using each ballast-compatible circuit 1610 with capacitor 1623 further improves the compatibility of the series-connected LED tube lamps with each of lamp driving circuits 505 such as an electrical ballast.

The optional capacitor 1623 may be used in ballast-compatible circuit 1610 for or with each lamp tube 500 of a plurality of LED lamp tubes 500 connected in series illustrated in FIG. 58G, primarily for synchronizing entering of the plurality of LED lamp tubes into a conducting state (for the LED tube lamp comprising the series-connected LED lamp tubes to emit light) upon ballast-compatible circuit 1610 for each lamp tube 500 entering the conducting state. Within the delay period before ballast-compatible circuit 1610 for each lamp tube 500 enters the conducting state, the voltage across capacitor 1619 rises gradually due to electric charging by the RC series circuit comprising fifth resistor 1622 and capacitor 1619, with the impedance of capacitor 1623, when present, significantly larger than that of fifth resistor 1622. If capacitor 1623 is not present, when discrepant delay periods respectively of the series-connected lamp tubes 500 pass, the instantaneous high-frequency rise in the voltage across ballast-compatible circuit 1610 or each of some of the lamp tubes 500 and instantaneous high-frequency fall in the voltage across ballast-compatible circuit 1610 or each of the rest of the lamp tubes 500, due to inconsistent or nonsynchronous occasions/instants on or at which the plurality of lamp tubes 500 are each entering a conducting state upon ballast-compatible circuit 1610 entering the conducting state, are undesirable and will present shortcomings.

To address this problem, capacitor 1623 may be used. When capacitor 1623 is present and ballast-compatible circuit 1610 for each lamp tube 500 enters into the conducting state, the instantaneous high-frequency variation in the voltage causes the impedance of capacitor 1623 to be significantly lower than that of fifth resistor 1622, forming the voltage division circuit comprising capacitors 1619 and 1623 in place of the RC series circuit comprising fifth resistor 1622 and capacitor 1619. Therefore, the voltage division effect between capacitors 1619 and 1623 will then instantaneously increase the voltage across capacitor 1619, compared to the described gradual rise in the voltage across capacitor 1619 within the delay period before ballast-compatible circuit 1610 for each lamp tube 500 enters the conducting state.

In some embodiments, the value of total resistance of both fourth and fifth resistors 1620 and 1622 may typically be in the range of about 330 kΩ to about 820 kΩ, and the total resistance could take a value in a broad range of about 47 kΩ to about 1.5 MΩ. And in one embodiment, the actual total value is 330KΩ.

An exemplary range of the capacitance of capacitor 1623 may be about 10 pF to about 1 nF. In some embodiments, the range of the capacitance of capacitor 1623 may be about 10 pF to about 100 pF. For example, the capacitance of capacitor 1623 may be about 47 pF. Typical values of the capacitance of capacitor 1619 may be in the range of about 100 nF to about 470 nF, and the capacitance could take a value in a broad range of about 47 nF to about 1.5 μF. And in one embodiment, the actual value is 470 nF. As such, in some embodiments, a first capacitor 1619 and second capacitor 1623 are arranged in series between ballast-compatible circuit input and output terminals 1611 and 1621. In this case the capacitance of the first capacitor 1619 and the second capacitor 1623 may respectively be about 220 nF and about 50 pF (or 47 pF). And the capacitance ratio between the first capacitor 1619 and the second capacitor 1623 may be in some embodiments between about 47 and about 150000.

According to some embodiments, diode 1612 is used or configured to rectify the signal for charging capacitor 1619. Therefore, with reference to FIGS. 58C, 58D, and 58E, in the case when ballast-compatible circuit 1610 is arranged following a rectifying unit or circuit, diode 1612 may be omitted. Thus diode 1612 is depicted in a dotted line in FIG. 58F.

Figure 58H:
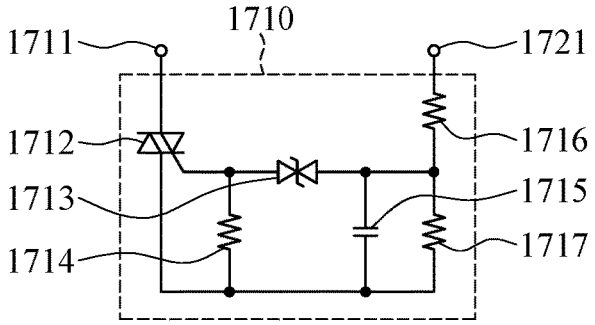
FIG. 58H is a schematic diagram of a ballast-compatible circuit according to some embodiments.

FIG. 58H is a schematic diagram of a ballast-compatible circuit according to some embodiments. Referring to FIG. 58H, a ballast-compatible circuit 1710 has an initial state in which an equivalent open-circuit is obtained at ballast-compatible circuit input and output terminals 1711 and 1721. Upon receiving an input signal at ballast-compatible circuit input terminal 1711, ballast-compatible circuit 1710 will be in a cutoff state when the level of the input external driving signal is below a defined value corresponding to a conduction delay of ballast-compatible circuit 1710; and ballast-compatible circuit 1710 will enter a conducting state upon the level of the input external driving signal reaching the defined value, thus transmitting the input signal to ballast-compatible circuit output terminal 1721. In some embodiments, the defined value is set to be larger than or equal to 400 volts.

Ballast-compatible circuit 1710 includes a second electronic switch (such as a bidirectional triode thyristor (TRIAC) 1712), a first electronic switch (such as a DIAC or symmetrical trigger diode 1713), first through third resistors 1714, 1716, and 1717, and a capacitor 1715. Bidirectional triode thyristor 1712 has a first terminal connected to ballast-compatible circuit input terminal 1711; a control terminal connected to a terminal of symmetrical trigger diode 1713 and an end of first resistor 1714; and a second terminal connected to another end of first resistor 1714. Capacitor 1715 has an end connected to another terminal of symmetrical trigger diode 1713, and has another end connected to the second terminal of bidirectional triode thyristor 1712. Third resistor 1717 is in parallel connection with capacitor 1715, and is therefore also connected to said another terminal of symmetrical trigger diode 1713 and the second terminal of bidirectional triode thyristor 1712. And second resistor 1716 has an end connected to the node connecting capacitor 1715 and symmetrical trigger diode 1713, and has another end connected to ballast-compatible circuit output terminal 1721. As mentioned above, the different ends and terminals of each component may be referred to as first and second ends or terminals, and the various labels, such as first, second, and third, are merely labels, and may be interchanged based on the components being described.

When an AC driving signal (such as a high-frequency high-voltage AC signal output by an electronic ballast) is initially input to ballast-compatible circuit input terminal 1711, bidirectional triode thyristor 1712 will be in an open-circuit state, preventing the AC driving signal from passing through, and the LED lamp is therefore also in an open-circuit state. The input of the AC driving signal causes a potential difference between ballast-compatible circuit input terminal 1711 and ballast-compatible circuit output terminal 1721. When the AC driving signal increases with time to eventually reach a sufficient amplitude (which may be a pre-defined level) after a period of time, the signal level at ballast-compatible circuit output terminal 1721 has a reflected voltage at the control terminal of bidirectional triode thyristor 1712 after passing through second resistor 1716, parallel-connected capacitor 1715 and third resistor 1717, and first resistor 1714, wherein the reflected voltage then triggers bidirectional triode thyristor 1712 into a conducting state. This conducting state makes ballast-compatible circuit 1710 entering a conducting state which causes the LED lamp to operate normally. Upon bidirectional triode thyristor 1712 conducting, a current flows through resistor 1716 and then charges capacitor 1715 to store a specific voltage on capacitor 1715. In this case, the energy stored by capacitor 1715 will maintain the conducting state of bidirectional triode thyristor 1712, to prevent the AC variation of the AC driving signal from causing bidirectional triode thyristor 1712 and therefore ballast-compatible circuit 1710 to be cutoff again, or to prevent the situation of bidirectional triode thyristor 1712 alternating or switching between its conducting and cutoff states.

In certain embodiments, bidirectional triode thyristor 1712 may have a triggering current magnitude of about 5 mA, symmetrical trigger diode 1713 may have a turn-on threshold voltage in the range of about 30 volts±6 volts, and the resistance of resistors 1716 and 1717 may be respectively about 100 kΩ and about 13 or 37.5 kΩ.

In various embodiments, when the external driving signal is initially input at the first pin and second pin, the second electronic switch 1712 will be in an open-circuit state, and then the external driving signal passes through a diode or the first rectifying circuit to produce a DC signal (or a pulsating DC signal), with the open-circuit state continuing until the DC signal reaches an amplitude causing the first electronic switch 1713 to enter a conducting state to an extent that in turn triggers the second electronic switch into a conducting state, making the ballast-compatible circuit 1710 enter the conduction state. Specifically, the diode may be in the first rectifying circuit, may be in the ballast-compatible circuit 1710, or may be separate from these two circuits, and the diode even may not belong to the LED tube lamp. In some embodiments, the rectified signal may comprise the DC signal.

And as shown in FIG. 58H, the DC signal may be produced after the external driving signal passes through the diode or the first rectifying circuit and then through a voltage division circuit (e.g. comprising second and third resistors 1716 and 1717). Various embodiments may also include different voltage division circuits within the knowledge of one of ordinary skill in the art, for producing the DC signal.

Further, in different embodiments, the first electronic switch in FIGS. 58F and 58H may comprise a symmetrical trigger diode or constitute a thyristor surge suppressor. And the second electronic switch in FIGS. 58F and 58H may comprise a bidirectional triode thyristor or a silicon controlled rectifier.

Figure 58I:
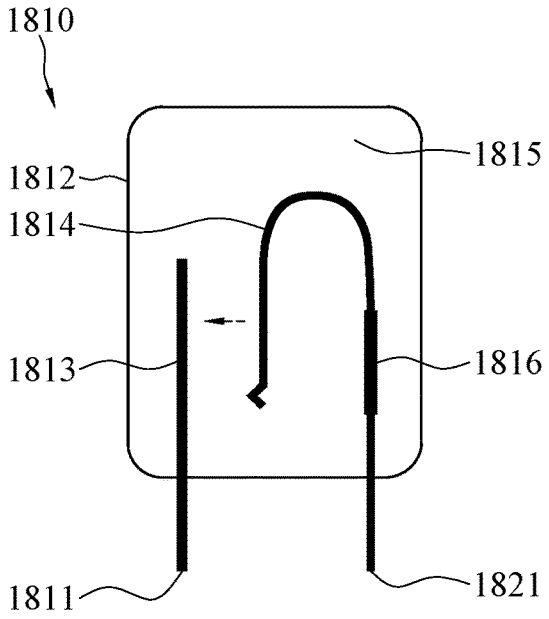
FIG. 58I illustrates a ballast-compatible circuit according to some embodiments.

FIG. 58I illustrates a ballast-compatible circuit according to some embodiments. Referring to FIG. 58I, a ballast-compatible circuit 1810 includes a housing 1812, a metallic electrode 1813, a bimetallic strip 1814, and a heating filament 1816. Metallic electrode 1813 and heating filament 1816 protrude from the housing 1812, so that they each have a portion inside the housing 1812 and a portion outside of the housing 1812. Metallic electrode 1813's outside portion has a ballast-compatible circuit input terminal 1811, and heating filament 1816's outside portion has a ballast-compatible circuit output terminal 1821. Housing 1812 is hermetic or tightly sealed and contains inertial gas 1815 such as helium gas. Bimetallic strip 1814 is inside housing 1812 and is physically and electrically connected to the portion of heating filament 1816 that is inside the housing 1812. And there is a spacing between bimetallic strip 1814 and metallic electrode 1813, so that ballast-compatible circuit input terminal 1811 and ballast-compatible circuit output terminal 1821 are not electrically connected in the initial state of ballast-compatible circuit 1810. Bimetallic strip 1814 may include two metallic strips with different temperature coefficients, wherein the metallic strip closer to metallic electrode 1813 has a smaller temperature coefficient, and the metallic strip more away from metallic electrode 1813 has a larger temperature coefficient.

When an AC driving signal (such as a high-frequency high-voltage AC signal output by an electronic ballast) is initially input at ballast-compatible circuit input terminal 1811 and ballast-compatible circuit output terminal 1821, a potential difference between metallic electrode 1813 and heating filament 1816 is formed. When the potential difference increases enough to cause electric arc or arc discharge through inertial gas 1815, meaning when the AC driving signal increases with time to eventually reach the defined level after a delay, then inertial gas 1815 is then heated to cause bimetallic strip 1814 to swell toward metallic electrode 1813 (as in the direction of the broken-line arrow in FIG. 58I), with this swelling eventually causing bimetallic strip 1814 to bear against metallic electrode 1813, forming the physical and electrical connections between them. In this situation, there is electrical conduction between ballast-compatible circuit input terminal 1811 and ballast-compatible circuit output terminal 1821. Then the AC driving signal flows through and thus heats heating filament 1816. In this heating process, heating filament 1816 allows a current to flow through when electrical conduction exists between metallic electrode 1813 and bimetallic strip 1814, causing the temperature of bimetallic strip 1814 to be above a defined conduction temperature. thus, since the respective temperature of the two metallic strips of bimetallic strip 1814 with different temperature coefficients are maintained above the defined conduction temperature, bimetallic strip 1814 will bend against or toward metallic electrode 1813, thus maintaining or supporting the physical joining or connection between bimetallic strip 1814 and metallic electrode 1813.

Therefore, upon receiving an input signal at ballast-compatible circuit input and output terminals 1811 and 1821, a delay will pass until an electrical/current conduction occurs through and between ballast-compatible circuit input and output terminals 1811 and 1821.

In an aspect of the present disclosure, an LED tube lamp comprises a ballast interface circuit coupled between the external connection terminals 501, 502, 503, and/or 504 and the LED lighting module 530, such as the ballast-compatible circuits 1510 described in FIGS. 58A-E. In embodiments of the LED tube lamp comprising the ballast interface circuit, the ballast interface circuit may comprise a detection circuit configured to determine whether the external driving signal received by the external connection terminal 501, 502, 503 or 504 is a high frequency or high voltage signal according to the frequency or voltage level of the rectified signal produced by the rectifying circuit 510 or 540. When the external driving signal is a high frequency or high voltage signal, the ballast interface circuit is configured to cause current conduction in the LED module 630 for emitting light.

In some embodiments, the external driving signal is initially input as a low voltage signal and after a delay of time the external driving signal changes into a high frequency or high voltage signal from the low voltage signal. In various embodiments, the external driving signal may be from or provided by an electrical ballast (e.g., an electronic ballast), an inductive ballast, an AC powerline, or a DC power source.

In some embodiments, the ballast interface circuit comprising the detection circuit may further comprise an electronic switch (such as switch 694 in FIG. 57J) coupled to the detection circuit. The detection circuit may comprise a voltage detection circuit (such as the voltage determination circuit 695 in FIG. 57J but coupled between output terminals 511 and 512) coupled to the electronic switch. The voltage detection circuit is configured to determine whether the external driving signal is a high frequency or high voltage signal according to the voltage level of the rectified signal, in order to control current conduction or cutoff of the electronic switch. The current conduction of the electronic switch causes current conduction in the LED module 630 and the cutoff of the electronic switch causes an open circuit in the LED module 630. In some embodiments, the voltage determination circuit 695 receives the rectified signal and generates the determined result signal S580 at the connection node of the symmetrical trigger diode 691 and the resistor 692 to control current conduction or cutoff of the electronic switch. When the external driving signal is a signal with high frequency or high voltage, the determined result signal S580 may be at a high voltage level causing current conduction of the electronic switch. When the external driving signal is a low frequency or low voltage signal, the determined result signal S580 may be at a low voltage level causing cutoff of the electronic switch.

In some embodiments, in additional to an electronic switch (such as switch 794 in FIG. 57K) coupled to the detection circuit, the detection circuit may comprise a frequency determination circuit (such as frequency determination circuit 795 in FIG. 57K) coupled to the electronic switch. The frequency determination circuit is configured to determine whether the external driving signal is a high frequency or high voltage signal according to the frequency of the rectified signal, in order to control the current conduction or the cutoff of the electronic switch. The current conduction of the electronic switch causes current conduction in the LED module 630 and the cutoff of the electronic switch causes an open circuit in the LED module 630. In some embodiments, the frequency determination circuit 795 receives the rectified signal and generates the determined result signal S580 at the connection node of the capacitor 791 and the resistor 792 to control current conduction or cutoff of the electronic switch. The operations performed by the frequency determination circuit 795 and its relevant conditions as to how to achieve its above function(s) were described above with reference to at least FIG. 57K.

Figure 58J:
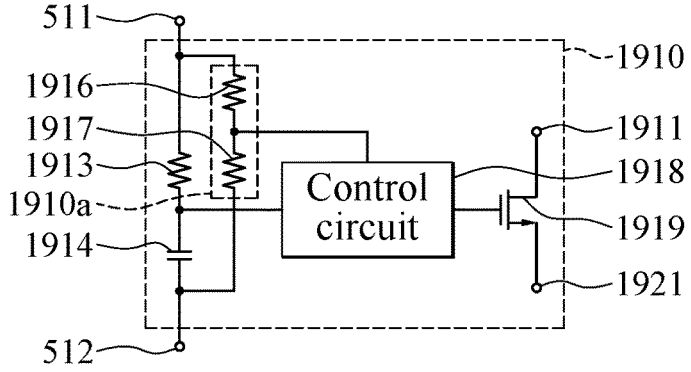
FIG. 58J is a schematic diagram of a ballast interface circuit according to some embodiments.

FIG. 58J is a schematic diagram of a ballast interface circuit according to some embodiments. Referring to FIG. 58J, the ballast interface circuit 1910 comprises the detection circuit which may comprise a control circuit 1918 and a switch 1919, for determining whether the external driving signal is a high frequency or high voltage signal according to the frequency or voltage level of the rectified external driving signal. The switch 1919 may comprise, or be referred to as, an electronic switch. Furthermore, the ballast interface circuit 1910 may comprise resistors 1913, 1916 and 1917, and a capacitor 1914. One end of the resistor 1913 is coupled to a first rectifying output terminal 511, the other end is coupled to one end of the capacitor 1914, and the other end of the capacitor 1914 is coupled to a second rectifying output terminal 512. A connection node of the resistor 1913 and the capacitor 1914 is coupled to the control circuit 1918 to provide power to the control circuit 1918 for operation. The resistors 1916 and 1917, which may be referred to as a circuit branch 1910*a*, are connected in series between the first rectifying output terminal 511 and the second rectifying output terminal 512. The circuit branch 1910*a* is coupled to the control circuit 1918, and is configured to detect the voltage level of the rectified signal at the rectifying output terminals 511 and 512 and then generate a detection signal indicative of an external AC signal based on a voltage level of a rectified signal to the control circuit 1918. Therefore circuit branch 1910*a* may also be referred to as a sampling branch or voltage detection circuit. The control circuit 1918 determines whether the external driving signal is a high frequency or high voltage signal according to the detection signal. A control end of the switch 1919 is coupled to the control circuit 1918, and thus the control circuit 1918 is configured to control current conduction or cutoff of the switch 1919 (i.e. the switch 1919 is turned on or off based on the control of the control circuit 1918). Two ends of the switch 1919 are coupled to ballast-compatible circuit terminals 1911 and 1921 and thus the current conduction of the switch 1919 can cause current conduction in the LED module 630 and the cutoff of the switch 1919 can cause an open circuit in the LED module 630.

When the control circuit 1918 determines that the voltage level of the detection signal, generated by the resistors 1916 and 1917, is lower than a high determination level (e.g., a predefined first threshold level), the control circuit 1918 cuts the switch 1919 off, the cutoff of the switch 1919 causes an open circuit in the LED module 630. When the electrical ballast has just been started to supply the LED tube lamp, the voltage level of the ballast's output AC signal is not high enough and so the voltage level of detection signal is lower than the high determination level, making the control circuit 1918 control the switch 1919 into a cutoff or open-circuit state. At this moment, the LED is open-circuited and stops emitting light. When the voltage level of the output AC signal rises to reach a sufficient amplitude (which is a defined level) in a time period, the voltage level of the detection signal is cyclically higher than the high determination level, the control circuit 1918 controls the switch 1919 to keep on a conduction state to cause current conduction in the LED module 630, and so the LED operates normally.

When an electronic ballast is applied, a level of an AC signal generated by the electronic ballast may range from about 200 to about 300 volts during the starting period (e.g., a time period shorter than 100 ms), and usually range from about 20 to about 30 ms and then the electronic ballast enters a normal state and the level of the AC signal is raised above the 300 volts. In some embodiments, a resistance of the resistor 1916 may range from about 200K to about 500K ohms; and in some embodiments from about 300K to about 400K ohms; a resistance of the resistor 1917 may range from about 0.5K to about 4K ohms, and in some embodiments, range from about 1.0K to 3K ohms; and the high determination level may range from 0.9 to 1.25 volts, and in some embodiments, be about 1.0 volts.

In some embodiments, the ballast-compatible circuit could be applicable to detect the inductive ballast being used to supply the LED tube lamp. A characteristic of the inductive ballast is its current or voltage periodically crosses zero value as the current or voltage signal proceeds with time. When the inductive ballast is applied, the level of the detection signal generated by the resistors 1916 and 1917 is lower than a low determination level (e.g., a predefined second threshold level) during the starting period powered by the commercial power, the control circuit 1918 controls the switch 1919 to keep on the conduction state and the LED tube lamp operates normally. In some embodiments, the low determination level is lower than 0.2 volts, and in some embodiments, lower than 0.1 volts.

For example, in some embodiments, during the starting period, if the detection signal is higher than the low determination level and lower than the high determination level (the high determination level is higher than the low determination level), the control circuit 1918 controls the switch 1919 to be cut off. On the other hand, when the detection signal is lower than the low determination level or higher than the high determination level, the control circuit 1918 controls the switch 1919 to be conducted continuously. Hence, the LED tube lamp using the ballast-compatible circuit can normally operate to emit light regardless of whether the electronic ballast or the inductive ballast is applied.

The resistors 1916 and 1917 are used to detect the level of the external AC signal, and in certain applications, a frequency detection circuit such as the frequency determination circuit 795 may be used to replace the voltage detection circuit of the resistors 1916 and 1917. The frequency detection circuit 795 can be coupled to the switch 1919 by being coupled to the control circuit 1918. By the control of the control circuit 1918, the frequency detection circuit can control current conduction or cutoff of the switch 1919; the current conduction of the switch 1919 causes current conduction in the LED module 630; and the cutoff of the switch 1919 causes an open circuit in the LED module 630. In general, the output signal of the electronic ballast may have a frequency higher than about 20K hz, and that of the inductive ballast may be lower than about 400 Hz. By setting an appropriate frequency value, the frequency detection circuit could properly determine whether an electronic ballast or an inductive ballast is applied, and so make the LED tube lamp operate normally to emit light under supplying by each kind of ballast.

According to an alternative embodiment to the embodiment of ballast interface circuit 1910 may use the control circuit 2018 of the mode determination circuit 2010, instead of the control circuit 1918 (and optionally the switch 1919), which mode determination circuit 2010 was disclosed in the U.S. application Ser. No. 15/211,813, filed on Jul. 15, 2016, which is herein incorporated by reference in its entirety into this present application. For example, the mode determination circuit 2010 can be an alternative embodiment to the ballast interface circuit 1910, and its disposition in the LED tube lamp of this disclosure may be between pins 501 and 502 (or 503 and 504) and the LED lighting module 530 or being coupled to (embodiment(s) of) the rectifying circuit 510 and/or 540.

In some embodiments, the detection circuit of the ballast interface circuit for determining whether the external driving signal is a high frequency or high voltage signal may comprise a thyristor, such as a thyristor surge protection device, which is configured to conduct current or be cutoff depending on the voltage level of the rectified external driving signal as produced by the rectified circuit 510 or 540. When the external driving signal is a high frequency or high voltage signal, the thyristor can or will conduct current after a delay of time upon the external driving signal being input to the LED tube lamp.

In some embodiments, the ballast interface circuit comprising the detection circuit may further comprise a switching circuit (such as shown in FIGS. 58K-N). After the delay of time, the current conduction of the thyristor of the detection circuit can trigger the switching circuit on to conduct current between the input terminal and the output terminal of the ballast interface circuit, in order to connect the supplied power to the LED lighting module 530, allowing the LED module 630 to emit light.

Figure 58K:
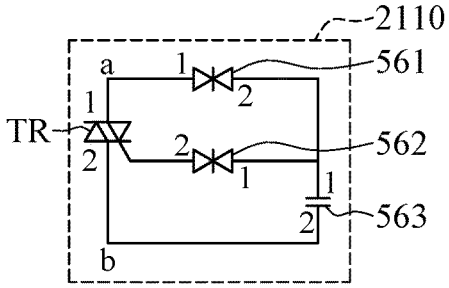
FIG. 58K is a schematic diagram of a ballast-compatible circuit according to some embodiments.

FIG. 58K is a schematic diagram of a ballast-compatible circuit according to some embodiments. The detection circuit of the ballast-compatible circuit 2110 includes a thyristor surge suppressor 561 as the thyristor surge protection device. The switching circuit of the ballast-compatible circuit 2110 includes a bidirectional triode thyristor TR connected between input and output terminals a and b of the ballast-compatible circuit 2110. Furthermore, the detection circuit of the ballast-compatible circuit 2110 may include another surge protection device such as thyristor surge suppressor 562, and a capacitor 563. One terminal of the thyristor surge suppressor 561 is coupled to an input terminal a of the ballast-compatible circuit 2110, and another terminal of the thyristor surge suppressor 561 is coupled to one terminal of the capacitor 563 and one terminal of the thyristor surge suppressor 562. Another terminal of the thyristor surge suppressor 562 is coupled to a control terminal of the bidirectional triode thyristor TR. Another terminal of the capacitor 563 is coupled to an output terminal b of the ballast-compatible circuit 2110.

When the external driving signal is a high frequency or high voltage signal, the voltage across the thyristor surge suppressor 561 can be higher than a threshold voltage, the thyristor surge suppressor 561 can be turned on to conduct current after the delay of time upon the external driving signal being input to the LED tube lamp, thus allowing the capacitor 563 to be charged. Then, the voltage across the thyristor surge suppressor 562 rises. When the voltage across the thyristor surge suppressor 562 is higher than a threshold voltage (e.g., a predefined threshold voltage) of the bidirectional triode thyristor TR, the bidirectional triode thyristor TR is turned on to conduct current between the input terminal a and the output terminal b of the ballast-compatible circuit 2110, thus allows the LED module 630 to emit light.

In some embodiments, the peak (off-state) forward or reverse voltage of the bidirectional triode thyristor TR may be in the range of about 600V-1300V, and may be in some embodiments preferably 600V. The maximum breakover voltage, or breakdown voltage, of the thyristor surge suppressor 561 may be in the range of about 200V-600V, and may be in some embodiments in the range of about 300-440V, and may be in some embodiments preferably 340V. The maximum breakover voltage, or breakdown voltage, of the thyristor surge suppressor 562 may be in the range of about 20V-100V, and may be in some embodiments in the range of about 30-70V, and may be in some embodiments preferably 68V. A capacitance value of the capacitor 563 may be in the range of about 2-50 nF, and may be in some embodiments preferably 10 nF. Moreover, maximum breakover voltage, or breakdown voltage, of the thyristor surge suppressor 561 is higher than that of the thyristor surge suppressor 562.

Figure 58L:
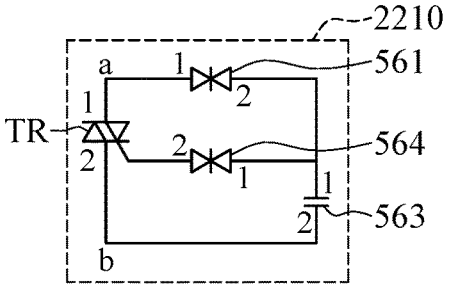
FIG. 58L is a schematic diagram of a ballast-compatible circuit according to some embodiments.

FIG. 58L is a schematic diagram of a ballast-compatible circuit according to some embodiments. Compared to the embodiment shown in FIG. 58K, FIG. 58L shows another embodiment of the ballast interface circuit, a ballast-compatible circuit 2210. Compared to the ballast-compatible circuit 2110 in FIG. 58K, the ballast-compatible circuit 2210 in FIG. 58L is different in that the ballast-compatible circuit 2210 includes a symmetrical trigger diode 564 which replaces the thyristor surge suppressor 562. For example, the detection circuit of the ballast-compatible circuit 2210 includes the thyristor surge suppressor 561, the symmetrical trigger diode 564 and the capacitor 563. One terminal of the thyristor surge suppressor 561 is coupled to an input terminal a of the ballast-compatible circuit 2210, and another terminal of the thyristor surge suppressor 561 is coupled to one terminal of the capacitor 563 and one terminal of the symmetrical trigger diode 564. Another terminal of the symmetrical trigger diode 564 is coupled to the control terminal of the bidirectional triode thyristor TR. Another terminal of the capacitor 563 is coupled to an output terminal b of the ballast-compatible circuit 2210.

In some embodiments, the peak (off-state) forward or reverse voltage of the bidirectional triode thyristor TR may be in the range of about 600V-1300V, and may be in some embodiments preferably 600V. The maximum breakover voltage, or breakdown voltage, of the thyristor surge suppressor 561 may be in the range of about 200V-600V, and may be in some embodiments in the range of about 300-440V, and may be in some embodiments preferably 340V. The withstand threshold or breakover voltage of the symmetrical trigger diode 564 may be in the range of about 20V-100V, and may be in some embodiments in the range of about 30-70V, and may be in some embodiments preferably 68V. A capacitance value of the capacitor 563 may be in the range of about 2-50 nF, and may be in some embodiments preferably 10 nF. Moreover, the maximum breakover voltage, or breakdown voltage, of the thyristor surge suppressor 561 is higher than a withstand threshold or breakover voltage of the symmetrical trigger diode 564.

Figure 58M:
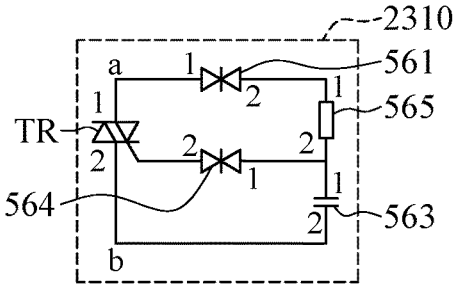
FIG. 58M is a schematic diagram of a ballast-compatible circuit according to some embodiments.

Furthermore, in some embodiments, the ballast-compatible circuit may include a current limiting circuit or element. FIG. 58M is a schematic diagram of a ballast-compatible circuit 2310 according to some embodiments. The current limiting circuit can limit a current in the ballast-compatible circuit. There is a difference between two ballast-compatible circuits 2210 and 2310 that the ballast-compatible circuit 2310 includes the current limiting circuit, such as a resistor 565. The resistor 565 is coupled between the thyristor surge suppressor 561 and the symmetrical trigger diode 564. The connection and operation of the remaining components of the ballast-compatible circuit 2310 can be understood by referring to the description of the previously described embodiment of FIG. 58L.

In some embodiments, the peak (off-state) forward or reverse voltage of the bidirectional triode thyristor TR may be in the range of about 600V-1300V, and may be in some embodiments preferably 600V. The maximum breakover voltage, or breakdown voltage, of the thyristor surge suppressor 561 may be in the range of about 200V-600V, and may be in some embodiments in the range of about 300-440V, and may be in some embodiments preferably 340V. The withstand threshold or breakover voltage of the symmetrical trigger diode 564 may be in the range of about 20V-100V, and may be in some embodiments preferably in the range of about 30-70V, and may be in some embodiments preferably 68V. A capacitance value of the capacitor 563 may be in the range of about 2-50 nF, and may be in some embodiments preferably 10 nF.

Figure 58N:
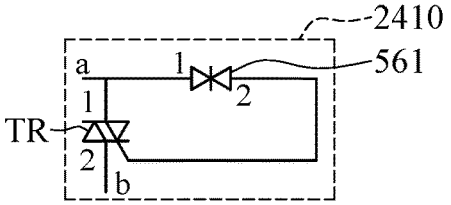
FIG. 58N is a schematic diagram of a ballast-compatible circuit according to some embodiments.

FIG. 58N is a schematic diagram of a ballast-compatible circuit according to some embodiments. The schematic diagram of FIG. 58N provides another example of the detection circuit. The detection circuit of the ballast-compatible circuit 2410 includes only the thyristor surge suppressor 561. One terminal of the thyristor surge suppressor 561 is coupled to an input terminal of the ballast-compatible circuit 2410 and a terminal electrode of the bidirectional triode thyristor TR, and another terminal of the thyristor surge suppressor 561 is coupled to the control terminal of the bidirectional triode thyristor TR. Another terminal electrode of the bidirectional triode thyristor TR is coupled to an output terminal b of the ballast-compatible circuit 2410. When the voltage across the thyristor surge suppressor 561 is higher than the defined value, the thyristor surge suppressor 561 is turned on to trigger the bidirectional triode thyristor TR on to conduct current between the input terminal and the output terminal of the ballast-compatible circuit 2410.

In some embodiments, the peak (off-state) forward or reverse voltage of the bidirectional triode thyristor TR may be in the range of about 600V-1300V, and may be in some embodiments preferably 600V. The maximum breakover voltage, or breakdown voltage, of the thyristor surge suppressor 561 may be in the range of about 20V-100V, and may be in some embodiments in the range of about 30-70V, and may be in some embodiments preferably 68V.

In some embodiment, a ballast-compatible circuit may include only a detection circuit. One terminal of the detection circuit is coupled to an input terminal of the ballast-compatible circuit, and another terminal of the detection circuit is coupled to an output terminal of the ballast-compatible circuit. When the voltage across the detection circuit is higher than a threshold voltage (e.g., a predefined threshold voltage), the detection circuit is turned on to conduct current between the input terminal and the output terminal of the ballast-compatible circuit.

Figure 58O:
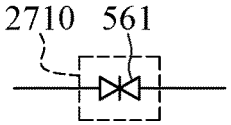
FIG. 58O is a schematic diagram of a ballast-compatible circuit according to some embodiments.

FIG. 58O is a schematic diagram of a ballast-compatible circuit according to some embodiments. The ballast-compatible circuit 2710 includes only the thyristor surge suppressor 561 as the detection circuit. When the voltage across the thyristor surge suppressor 561 is higher than the threshold voltage, the thyristor surge suppressor 561 is turned on to conduct current between the input terminal and the output terminal of the ballast-compatible circuit 2710.

In some embodiments, the maximum breakover voltage, or breakdown voltage, of the thyristor surge suppressor 561 may be in the range of about 20V-100V, and may be in some embodiments in the range of about 30-70V, and may be in some embodiments preferably 68V.

In summary, through the different topologies of the ballast-compatible circuits in FIGS. 58K-58O, the ballast-compatible circuit may use fewer components in a distinct topology, which may significantly improve the reliability of the LED tube lamp including the ballast-compatible circuit.

Figure 58P:
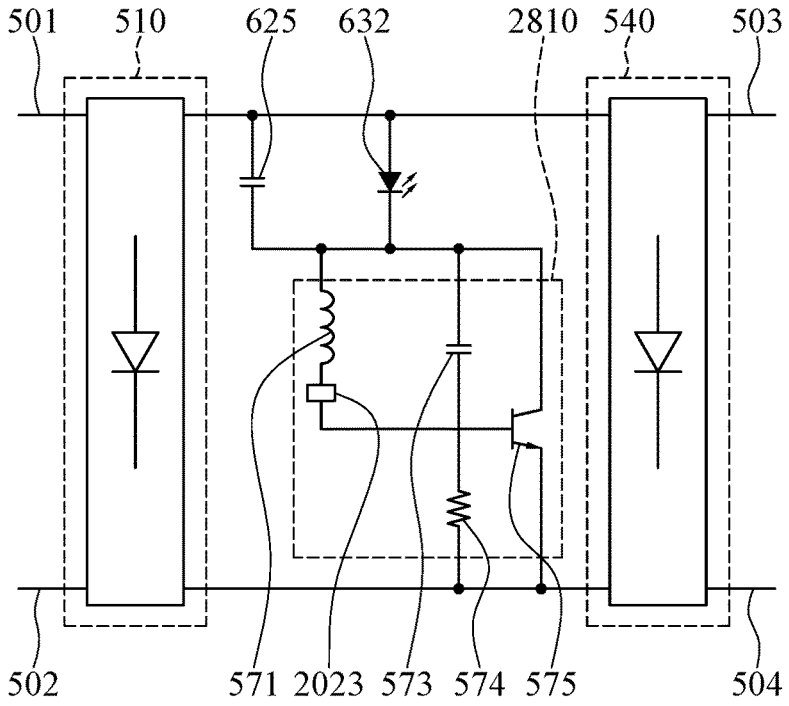
FIG. 58P is a schematic diagram of a ballast-compatible circuit being used in the LED tube lamp of the present disclosure according to some embodiments.

FIG. 58P is a schematic diagram of a ballast-compatible circuit 2810 according to some embodiments. As shown in FIG. 58P, the LED module 630 includes an LED unit 632. In this embodiment, the detection circuit of the ballast-compatible circuit 2810 includes a thyristor device 2023. The thyristor device 2023 may comprise or include e.g., a thyristor surge suppressor or a DIAC or even a MOSFET, and is coupled between the LED module 630 and the rectifying circuit 510, or between the LED module 630 and the rectifying circuit 540. The thyristor device 2023 receives the rectified signal from the rectifying circuit 510 or the rectifying circuit 540 and is configured to be turned on (to conduct current) or off according to the voltage level of the rectified signal. More specifically, the thyristor device 2023 is turned on when the voltage level of the rectified voltage is higher than a threshold voltage (e.g., a predefined threshold voltage) of the thyristor device 2023 after a delay of time upon the external driving signal being input to the LED tube lamp.

Thus, when an electrical ballast has been initially applied, the voltage level of the external driving signal is not high enough and so the voltage level of the rectified signal is lower than the turn-on or threshold voltage of the thyristor device 2023. At this moment, the LED module/unit is open-circuited and doesn't emit light. When the voltage level of the external driving signal rises to reach a sufficient amplitude (which is a defined level) in a time period, the voltage level of the rectified signal starts to be higher than the high determination level to turn on the thyristor device 2023, and so the rectified signal flows through the LED module 630, or is filtered by the filtering circuit 520 (comprising capacitor 625 in FIG. 58P) and then flows through the LED module 630, making the LED module emit light.

However, using the thyristor device 2023 may be subject to a problem that upon thyristor device 2023 being turned on, the current through it may not continually or constantly remain above its holding current because of the signal swing of the rectified external driving signal, and therefore thyristor device 2023 may be unfavorably or accidentally turned off (causing the LED lighting to be unstable or undesirably stopped) when its current falls below its holding current. In response to this problem, in some embodiments, the ballast-compatible circuit 2810 may further include a transistor 575, an inductor 571, a capacitor (or resistor) 573, and a resistor 574 to form a noise suppressing circuit mainly attributed to the inductor 571. A first terminal of the transistor 575 is coupled to the negative terminal of the LED module 630. The inductor 571 and the thyristor device 2023 are connected in series between the negative terminal of the LED module 630 and a control terminal of the transistor 575. A second terminal of the transistor 575 is coupled to the rectifying circuits 510 and 540. The resistor 574 is coupled between the control and second terminals of the transistor 575. The capacitor 573 is coupled between the control terminal of the transistor 575 and the first terminal of the transistor 575 to provide bias voltage to the transistor 575 for operation.

Figure 58Q:
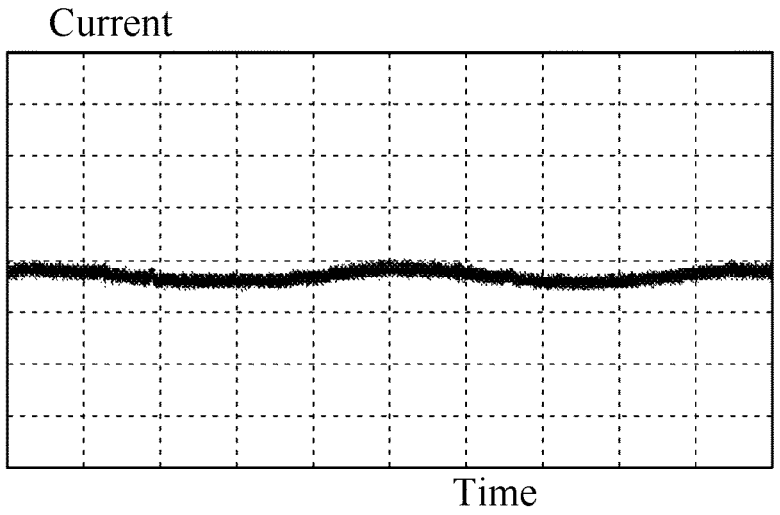
FIG. 58Q illustrates a waveform of a current flowing through a thyristor device and above its holding current value according to some embodiments.

In some embodiments, transistor 575, capacitor (or resistor) 573, and resistor 574 are used as an overcurrent protection mechanism for limiting, or preventing from exceeding a current rating, current flowing through inductor 571. When the thyristor device 2023 is turned on, a current flows through the inductor 571, and when the current flowing through the inductor 571 reaches a threshold of current (e.g., a predefined threshold current value), the overcurrent protection mechanism will be triggered, which is explained as follows. In general, the current from the LED unit 632 flows through the inductor 571 and resistor 574 thereby incurring a voltage drop across the resistor 574. When the current increases, the voltage drop will increase to reach a conducting voltage (e.g., 0.7 V) of the transistor 575 thereby turning on the transistor 575 to conduct current. Accordingly, when the transistor 575 operates in a conducting state, the conducting state of the transistor 575 diverts some current from flowing through the inductor 571, preventing an overcurrent flowing through inductor 571, and then the current flowing through the loop including the inductor 571, thyristor device 2023, and the transistor 575 can also maintain the conducting state of the thyristor device 2023, achieving the purpose of keeping the current flowing through the thyristor device 2023 above its holding current value, as shown in FIG. 58Q. In some embodiments, the transistor 575 may comprise a BJT, and the first terminal, the control terminal and the second terminal of the transistor 575 may be a collector, a base, and an emitter of the BJT, respectively. In other embodiments, the transistor 575 may comprise a MOSFET.

Therefore, exemplary ballast-compatible circuits such as described in FIGS. 58F, 58H-I, and 58K-O may be coupled in the LED tube lamp as described in FIGS. 58A-E, and an exemplary ballast-compatible circuit such as described in FIGS. 58J and 58P may be coupled in the LED tube lamp between pins 501 and 502 (or 503 and 504) and the LED lighting module 530 or coupled to (embodiment(s) of) rectifying circuit 510 and/or 540, wherein the ballast-compatible circuit will be in a cutoff state in a defined delay (e.g., 0.01 seconds) upon an external driving signal being input to the LED tube lamp, and will enter a conducting state after the delay. As such, the ballast-compatible circuit will be in a cutoff state when the level of the input external driving signal is below a defined value corresponding to a conduction delay of the ballast-compatible circuit; and the ballast-compatible circuit will enter a conducting state upon the level of the input external driving signal reaching the defined value. Accordingly, the compatibility of the LED tube lamp described herein with lamp driving circuits 505 such as an electrical ballast is further improved by using such a ballast-compatible circuit.

FIG. 59A is a block diagram of an LED tube lamp according to some embodiments. Compared to that shown in FIG. 49E, the present embodiment comprises the rectifying circuits 510 and 540, the filtering circuit 520, and the LED lighting module 530, and further comprises two filament-simulating circuits 1560. The filament-simulating circuits 1560 are respectively coupled between the pins 501 and 502 and coupled between the pins 503 and 504, for improving a compatibility with a lamp driving circuit having filament detection function, e.g.: programmed-start ballast. In general, each of the filament-simulating circuits 1560 may be and is typically implemented by a resistor and/or a capacitor coupled between pins 501 and 502 or between pin 503 and 504.

In an initial stage upon the lamp driving circuit having filament detection function being activated, the lamp driving circuit will determine whether the filaments of the lamp operate normally or are in an abnormal condition of short-circuit or open-circuit. When determining the abnormal condition of the filaments, the lamp driving circuit stops operating and enters a protection state. In order to avoid that the lamp driving circuit erroneously determines the LED tube lamp to be abnormal due to the LED tube lamp having no filament, the two filament-simulating circuits 1560 simulate the operation of actual filaments of a fluorescent tube to have the lamp driving circuit enter into a normal state to start the LED lamp normally.

FIG. 59B is a schematic diagram of a filament-simulating circuit according to some embodiments. The filament-simulating circuit comprises a capacitor 1663 and a resistor 1665 connected in parallel, and two ends of the capacitor 1663 and two ends of the resistor 1665 are respectively coupled to filament simulating terminals 1661 and 1662. Referring to FIG. 59A, the filament simulating terminals 1661 and 1662 of the two filament-simulating circuit 1660 are respectively coupled to the pins 501 and 502 and the pins 503 and 504. During the filament detection process, the lamp driving circuit outputs a detection signal to detect the state of the filaments. The detection signal passes the capacitor 1663 and the resistor 1665 and so the lamp driving circuit determines that the filaments of the LED lamp are normal. In some embodiments, using at least a resistor 1665 or a capacitor 1663 may be sufficient to achieve the purpose of simulating a filament.

In addition, a capacitance value of the capacitor 1663 is low and so a capacitive reactance (equivalent impedance) of the capacitor 1663 is far lower than an impedance of the resistor 1665 due to the lamp driving circuit outputting a high-frequency alternative current (AC) signal to drive LED lamp. Therefore, the filament-simulating circuit 1660 consumes fairly low power when the LED lamp operates normally, and so it almost does not affect the luminous efficiency of the LED lamp.

FIG. 59C is a schematic block diagram including a filament-simulating circuit according to some embodiments. In the present embodiment, the filament-simulating circuit 1660 replaces the terminal adapter circuit 541 of the rectifying circuit 810 shown in FIG. 50C, which is adopted as the rectifying circuit 510 or/and 540 in the LED lamp. For example, the filament-simulating circuit 1660 of the present embodiment has both of filament simulating and terminal adapting functions. Referring to FIG. 59A, the filament simulating terminals 1661 and 1662 of the filament-simulating circuit 1660 are respectively coupled to the pins 501 and 502 or/and pins 503 and 504. The half-wave node 819 of rectifying unit 815 in the rectifying circuit 810 is coupled to the filament simulating terminal 1662.

Figure 59F:
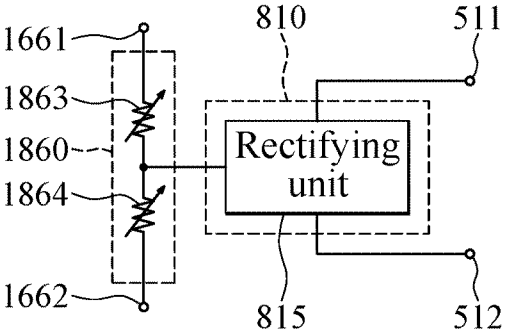
FIG. 59F is a schematic block diagram including a filament-simulating circuit according to some embodiments.
Figure 59E:
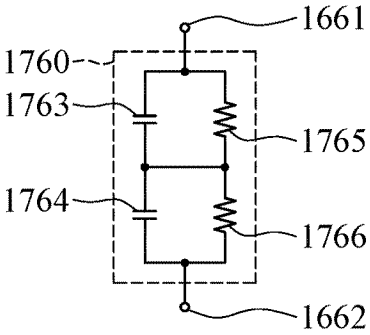
FIG. 59E is a schematic diagram of a filament-simulating circuit according to some embodiments.
Figure 59D:
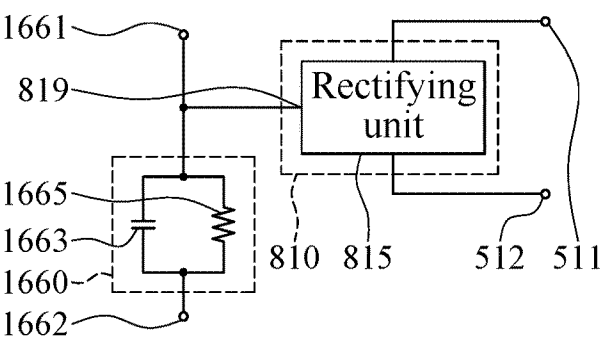
FIG. 59D is a schematic block diagram including a filament-simulating circuit according to some embodiments.

FIG. 59D is a schematic block diagram including a filament-simulating circuit according to some embodiments. Compared to that shown in FIG. 59C, the half-wave node is changed to be coupled to the filament simulating terminal 1661, and the filament-simulating circuit 1660 in the present embodiment still has both of filament simulating and terminal adapting functions.

FIG. 59E is a schematic diagram of a filament-simulating circuit according to some embodiments. A filament-simulating circuit 1760 comprises capacitors 1763 and 1764, and the resistors 1765 and 1766. The capacitors 1763 and 1764 are connected in series and coupled between the filament simulating terminals 1661 and 1662. The resistors 1765 and 1766 are connected in series and coupled between the filament simulating terminals 1661 and 1662. Furthermore, the connection node of capacitors 1763 and 1764 is coupled to that of the resistors 1765 and 1766. Referring to FIG. 59A, the filament simulating terminals 1661 and 1662 of the filament-simulating circuit 1760 are respectively coupled to the pins 501 and 502 and the pins 503 and 504. When the lamp driving circuit outputs the detection signal for detecting the state of the filament, the detection signal passes the capacitors 1763 and 1764 and the resistors 1765 and 1766 so that the lamp driving circuit determines that the filaments of the LED lamp are normal.

In some embodiments, in some embodiments, capacitance values of the capacitors 1763 and 1764 are low and so a capacitive reactance of the serially connected capacitors 1763 and 1764 is far lower than an impedance of the serially connected resistors 1765 and 1766 due to the lamp driving circuit outputting the high-frequency AC signal to drive LED lamp. Therefore, the filament-simulating circuit 1760 consumes fairly low power when the LED lamp operates normally, and so it almost does not affect the luminous efficiency of the LED lamp. Moreover, whether any one of the capacitor 1763 and the resistor 1765 is short circuited or open circuited, or any one of the capacitor 1764 and the resistor 1766 is short circuited or open circuited, the detection signal still passes through the filament-simulating circuit 1760 between the filament simulating terminals 1661 and 1662. Therefore, the filament-simulating circuit 1760 still operates normally when any one of the capacitor 1763 and the resistor 1765 is short circuited or is an open circuit or any one of the capacitor 1764 and the resistor 1766 is short circuited or is an open circuit, and so it has quite high fault tolerance.

FIG. 59F is a schematic block diagram including a filament-simulating circuit according to some embodiments. In the present embodiment, the filament-simulating circuit 1860 replaces the terminal adapter circuit 541 of the rectifying circuit 810 shown in FIG. 50C, which is adopted as the rectifying circuit 510 or/and 540 in the LED lamp. For example, the filament-simulating circuit 1860 of the present embodiment has both of filament simulating and terminal adapting functions. An impedance of the filament-simulating circuit 1860 has a negative temperature coefficient (NTC), i.e., the impedance at a higher temperature is lower than that at a lower temperature. In the present embodiment, the filament-simulating circuit 1860 comprises two NTC resistors 1863 and 1864 connected in series and coupled to the filament simulating terminals 1661 and 1662. Referring to FIG. 59A, the filament simulating terminals 1661 and 1662 are respectively coupled to the pins 501 and 502 or/and the pins 503 and 504. The half-wave node 819 of the rectifying unit 815 in the rectifying circuit 810 is coupled to a connection node of the NTC resistors 1863 and 1864.

When the lamp driving circuit outputs the detection signal for detecting the state of the filament, the detection signal passes the NTC resistors 1863 and 1864 so that the lamp driving circuit determines that the filaments of the LED lamp are normal. The impedance of the serially connected NTC resistors 1863 and 1864 is gradually decreased with the gradually increasing of temperature due to the detection signal or a preheat process. When the lamp driving circuit enters into the normal state to start the LED lamp normally, the impedance of the serially connected NTC resistors 1863 and 1864 is decreased to a relative low value and so the power consumption of the filament simulation circuit 1860 is lower.

An exemplary impedance of the filament-simulating circuit 1860 can be 10 ohms or more at room temperature (25 degrees Celsius) and may be decreased to a range of about 2-10 ohms when the lamp driving circuit enters into the normal state. It may be preferred that the impedance of the filament-simulating circuit 1860 is decreased to a range of about 3-6 ohms when the lamp driving circuit enters into the normal state.

As mentioned above, electronic components of the power supply module 5 or 250 may be disposed either on the light strip 2 or on a circuit board 253 (such as a printed circuit board) in the end cap(s) of one or two ends of the lamp tube. For improving benefits or advantages of embodiments of the power supply module or the general LED tube lamp, in some embodiments, capacitor(s) in the power supply module may be chip capacitor(s), such as multilayer ceramic chip capacitor(s), disposed either on the light strip 2 or on the short circuit board 253. However, such disposed chip capacitor(s) in use is likely to produce or incur distinct noise due to piezoelectric effects, which may adversely affect the comfort level of using the LED tube lamp by consumers. To address and reduce this problem, in the LED tube lamp of this disclosure, a hole or groove may be disposed (directly) below the chip capacitor by drilling or boring, to significantly reduce the noise by changing the vibration system formed under piezoelectric effects between the chip capacitor and the circuit board carrying the chip capacitor. In some embodiments, the hole or groove is formed in a conductive or wire layer in the light strip 2, or in the short circuit board 253 in the end cap(s), and (directly) below the chip capacitor.

Figure 63A:
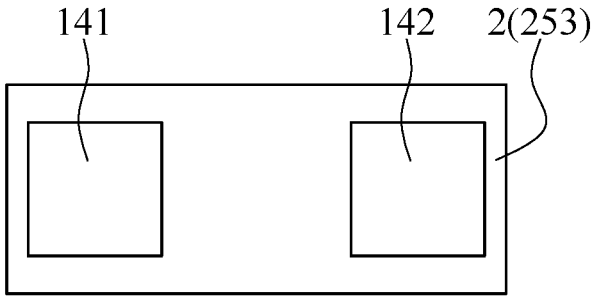
Figure 63B:
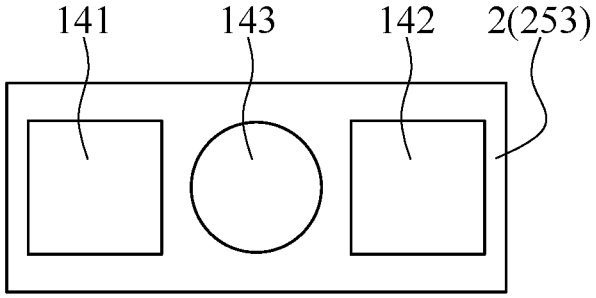
Figure 63C:
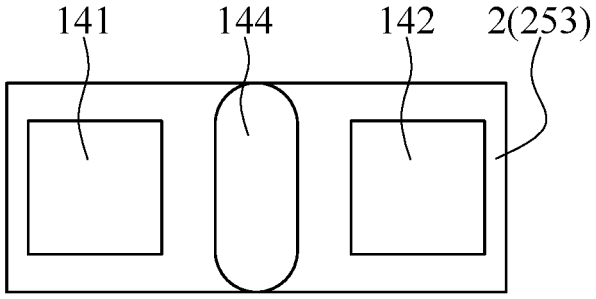

FIG. 63A is a plan view of a circuit substrate for disposing a chip capacitor in an LED tube lamp according to some embodiments, and FIGS. 63B and 63C are plan views of a circuit substrate for disposing a chip capacitor in an LED tube lamp according to different embodiments. Referring to FIGS. 63A-C, the circuit substrate belongs to the light strip 2 or the circuit board 253 for disposing the chip capacitor, wherein FIG. 63A doesn't show the hole or groove. In embodiments, the light strip 2 or the circuit board 253 may include two soldering points 141 and 142 and a chip capacitor of the LED tube lamp can be disposed on the light strip 2 or the circuit board 253 through the two soldering points 141 and 142. In some embodiments, the hole or groove 143 or 144 can be disposed below the chip capacitor, between the two soldering points 141 and 142, and in the light strip 2 or the circuit board 253. The soldering points 141 and 142 may be referred to as soldering pads. And the shape of the circumference of the hole or groove may be substantially close to, for example, a circle or round (in the case of the hole 143 shown in FIG. 63B), an oval or ellipse (in the case of the groove 144 shown in FIG. 63C), or a rectangle.

Figure 60A:
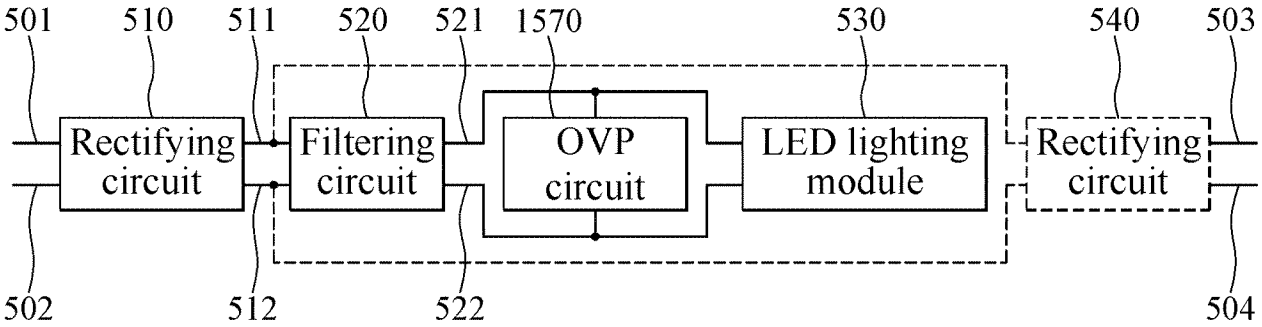
FIG. 60A is a block diagram of an LED tube lamp according to some embodiments.

FIG. 60A is a block diagram of an LED tube lamp according to some embodiments. Compared to that shown in FIG. 49D, the present embodiment comprises the rectifying circuits 510 and 540, the filtering circuit 520, and the LED lighting module 530, and further comprises an over voltage protection (OVP) circuit 1570. The OVP circuit 1570 is coupled to the filtering output terminals 521 and 522 for detecting the filtered signal. The OVP circuit 1570 clamps the level of the filtered signal when determining the level thereof higher than a defined OVP value. Hence, the OVP circuit 1570 protects the LED lighting module 530 from damage due to an OVP condition. The rectifying circuit 540 may be omitted and is therefore depicted by a dotted line.

Figure 60C:
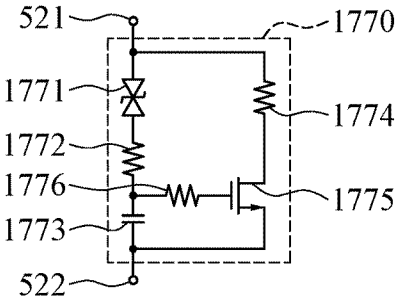
FIG. 60B is a schematic diagram of an OVP circuit according to an embodiment.
Figure 60B:
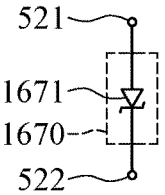

FIG. 60B is a schematic diagram of an overvoltage protection (OVP) circuit according to an embodiment. The OVP circuit 1670 comprises a voltage clamping diode 1671, such as a zener diode, coupled to the filtering output terminals 521 and 522. The voltage clamping diode 1671 is conducted to clamp a voltage difference at a breakdown voltage when the voltage difference of the filtering output terminals 521 and 522 (i.e., the level of the filtered signal) reaches the breakdown voltage. The breakdown voltage may be in a range of about 40 V to about 100 V. In some embodiments, the breakdown voltage may be in a range of about 55V to about 75V.

FIG. 60C is a schematic diagram of an overvoltage protection (OVP) circuit according to an embodiment. Referring to FIG. 60C, the over voltage protection circuit 1770 comprises a symmetrical trigger diode 1771, resistors 1772, 1774 and 1776, a capacitor 1733 and a switch 1775. The symmetrical trigger diode 1771, the resistor 1772 and the capacitor 1733 are connected in series between a first filtering output terminal 521 and a second filtering output terminal 522. One end of the symmetrical trigger diode 1771 is coupled to the first filtering output terminal 521, one end of the capacitor 1773 is coupled to the second filtering output terminal 522, and the resistor 1772 is coupled between the symmetrical trigger diode 1771 and the capacitor 1773. The resistor 1774 and the switch 1775 are connected in series between the first filtering output terminal 521 and the second filtering output terminal 522. One end of the resistor 1774 is coupled to the first filtering output terminal 521, and the other end of the resistor 1774 is coupled to the switch 1775. One end of the switch 1775 is coupled to the second filtering output terminal 522, and one control end of the switch 1775 is coupled to a connection node of the resistor 1772 and the capacitor 1773 through the resistor 1776, thus the switch 1775 can be turned on to conduct current or be cut off according to a voltage between the first filtering output terminal 521 and the second filtering output terminal 522 (i.e., the voltage level of the filtered signal). When the voltage level of the filtered signal is such that the voltage across symmetrical trigger diode 1771 is lower than its breakover voltage, the symmetrical trigger diode 1771 is turned off, and so a low voltage level at the connection node of the resistor 1772 and the capacitor 1773 causes the switch 1775 to be turned off. When the voltage level of the filtered signal is such that the voltage across symmetrical trigger diode 1771 reaches or is higher than its breakover voltage, the symmetrical trigger diode 1771 is turned on or conducted, and so a voltage of the capacitor 1773 is then raised to trigger the switch 1775 to be conducted to protect the LED lighting module 530.

In some embodiments, the breakover voltage of the symmetrical trigger diode 1771 ranges from about 400 to about 1300 volts, in some embodiments from about 450 to about 700 volts, and in further embodiments from about 500 to about 600 volts.

Referring to FIG. 37, in one embodiment, each of the LED light sources 202 may be provided with an LED lead frame 202*b* having a recess 202*a*, and an LED chip 18 disposed in the recess 202*a*. The recess 202*a* may be one or more than one in amount. The recess 202*a* may be filled with phosphor covering the LED chip 18 to convert emitted light therefrom into a desired light color. Compared with a conventional LED chip being a substantial square, the LED chip 18 in this embodiment may be preferably rectangular with the dimension of the length side to the width side at a ratio ranges generally from about 2:1 to about 10:1, in some embodiments from about 2.5:1 to about 5:1, and in some more desirable embodiments from about 3:1 to about 4.5:1. Moreover, the LED chip 18 is in some embodiments arranged with its length direction extending along the length direction of the lamp tube 1 to increase the average current density of the LED chip 18 and improve the overall illumination field shape of the lamp tube 1. The lamp tube 1 may have a number of LED light sources 202 arranged into one or more rows, and each row of the LED light sources 202 is arranged along the length direction (Y-direction) of the lamp tube 1.

Referring again to FIG. 37, the recess 202*a* is enclosed by two parallel first sidewalls 15 and two parallel second sidewalls 16 with the first sidewalls 15 being lower than the second sidewalls 16. The two first sidewalls 15 are arranged to be located along a length direction (Y-direction) of the lamp tube 1 and extend along the width direction (X-direction) of the lamp tube 1, and two second sidewalls 16 are arranged to be located along a width direction (X-direction) of the lamp tube 1 and extend along the length direction (Y-direction) of the lamp tube 1. The extending direction of the first sidewalls 15 may be substantially rather than exactly parallel to the width direction (X-direction) of the lamp tube 1, and the first sidewalls may have various outlines such as zigzag, curved, wavy, and the like. Similarly, the extending direction of the second sidewalls 16 may be substantially rather than exactly parallel to the length direction (Y-direction) of the lamp tube 1, and the second sidewalls may have various outlines such as zigzag, curved, wavy, and the like. In one row of the LED light sources 202, the arrangement of the first sidewalls 15 and the second sidewalls 16 for each LED light source 202 can be same or different.

Having the first sidewalls 15 being lower than the second sidewalls 16 and proper distance arrangement, the LED lead frame 202*b* allows dispersion of the light illumination to cross over the LED lead frame 202*b* without causing uncomfortable visual feeling to people observing the LED tube lamp along the Y-direction. In some embodiments, the first sidewalls 15 may not be lower than the second sidewalls, however, and in this case the rows of the LED light sources 202 are more closely arranged to reduce grainy effects. On the other hand, when a user of the LED tube lamp observes the lamp tube thereof along the X-direction, the second sidewalls 16 also can block user's line of sight from seeing the LED light sources 202, and which reduces unpleasing grainy effects.

Referring again to FIG. 37, each first sidewall 15 includes an inner surface 15*a* facing toward outside of the recess 202*a*. The inner surface 15*a* may be designed to be an inclined plane such that the light illumination easily crosses over the first sidewalls 15 and spreads out. The inclined plane of the inner surface 15*a* may be flat or cambered or combined shape. In some embodiments, when the inclined plane is flat, the slope of the inner surface 15*a* ranges from about 30 degrees to about 60 degrees. Thus, an included angle between the bottom surface of the recess 202*a* and the inner surface 15*a* may range from about 120 to about 150 degrees. In some embodiments, the slope of the inner surface 15*a* ranges from about 15 degrees to about 75 degrees, and the included angle between the bottom surface of the recess 202*a* and the inner surface 15*a* ranges from about 105 degrees to about 165 degrees.

There may be one row or several rows of the LED light sources 202 arranged in a length direction (Y-direction) of the lamp tube 1. In case of one row, in one embodiment, the second sidewalls 16 of the LED lead frames 202*b* of all of the LED light sources 202 located in the same row are disposed in same straight lines to respectively form two walls for blocking the user's line of sight seeing the LED light sources 202. In case of several rows, in some embodiments, only the LED lead frames 202*b* of the LED light sources 202 disposed in the outermost two rows are disposed in same straight lines to respectively form walls for blocking user's line of sight seeing the LED light sources 202. In case of several rows, it may be required only that the LED lead frames 202*b* of the LED light sources 202 disposed in the outermost two rows are disposed in same straight lines to respectively from walls for blocking user's line of sight seeing the LED light sources 202. The LED lead frames 202*b* of the LED light sources 202 disposed in the other rows can have different arrangements. For example, as far as the LED light sources 202 located in the middle row (third row) are concerned, the LED lead frames 202*b* thereof may be arranged such that: each LED lead frame 202*b* has the first sidewalls 15 arranged along the length direction (Y-direction) of the lamp tube 1 with the second sidewalls 16 arranged along in the width direction (X-direction) of the lamp tube 1; each LED lead frame 202*b* has the first sidewalls 15 arranged along the width direction (X-direction) of the lamp tube 1 with the second sidewalls 16 arranged along the length direction (Y-direction) of the lamp tube 1; or the LED lead frames 202*b* are arranged in a staggered manner. To reduce grainy effects caused by the LED light sources 202 when a user of the LED tube lamp observes the lamp tube thereof along the X-direction, it may be enough to have the second sidewalls 16 of the LED lead frames 202*b* of the LED light sources 202 located in the outmost rows to block user's line of sight from seeing the LED light sources 202. Different arrangements may be used for the second sidewalls 16 of the LED lead frames 202*b* of one or several of the LED light sources 202 located in the outmost two rows.

In summary, when a plurality of the LED light sources 202 are arranged in a row extending along the length direction of the lamp tube 1, the second sidewalls 16 of the LED lead frames 202*b* of all of the LED light sources 202 located in the same row may be disposed in same straight lines to respectively form walls for blocking user's line of sight seeing the LED light sources 202. When a plurality of the LED light sources 202 are arranged in a number of rows being located along the width direction of the lamp tube 1 and extending along the length direction of the lamp tube 1, the second sidewalls 16 of the LED lead frames 202*b* of all of the LED light sources 202 located in the outmost two rows may be disposed in straight lines to respectively form two walls for blocking user's line of sight seeing the LED light sources 202. The one or more than one rows located between the outmost rows may have the first sidewalls 15 and the second sidewalls 16 arranged in a way the same as or different from that for the outmost rows.

Figure 61A:
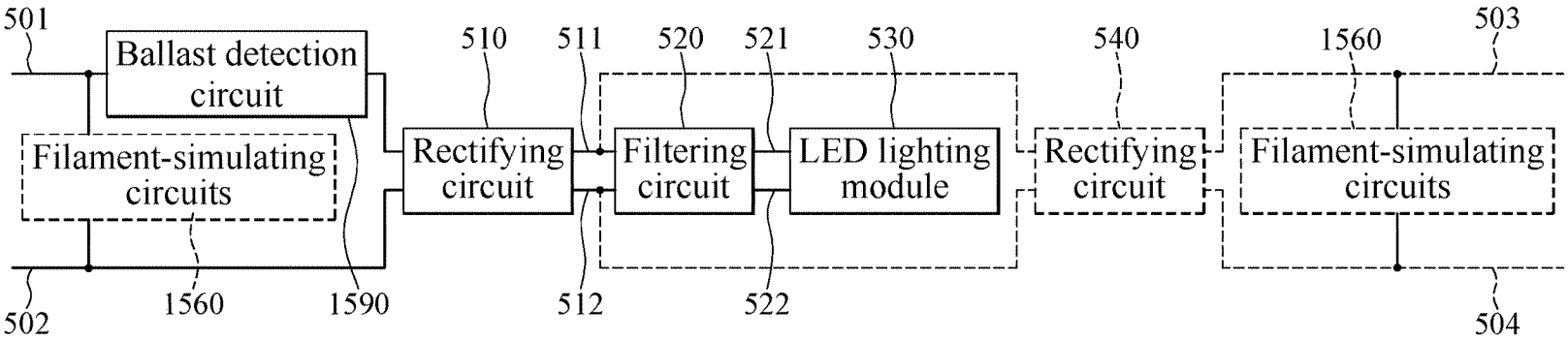

FIG. 61A is a block diagram of an LED tube lamp according to some embodiments. Compared to that shown in FIG. 59A, the present embodiment(s) comprises the rectifying circuits 510 and 540, the filtering circuit 520, the LED lighting module 530 and the two filament-simulating circuits 1560, and further comprises a ballast detection circuit 1590. The ballast detection circuit 1590 may be coupled to any one of the pins 501, 502, 503 and 504 and a corresponding rectifying circuit of the rectifying circuits 510 and 540. In the present embodiment, the ballast detection circuit 1590 is coupled between the pin 501 and the rectifying circuit 510.

The ballast detection circuit 1590 detects the AC driving signal or a signal input through the pins 501, 502, 503 and 504, and determines whether the input signal is provided by an electric ballast based on the detected result.

Figure 61B:
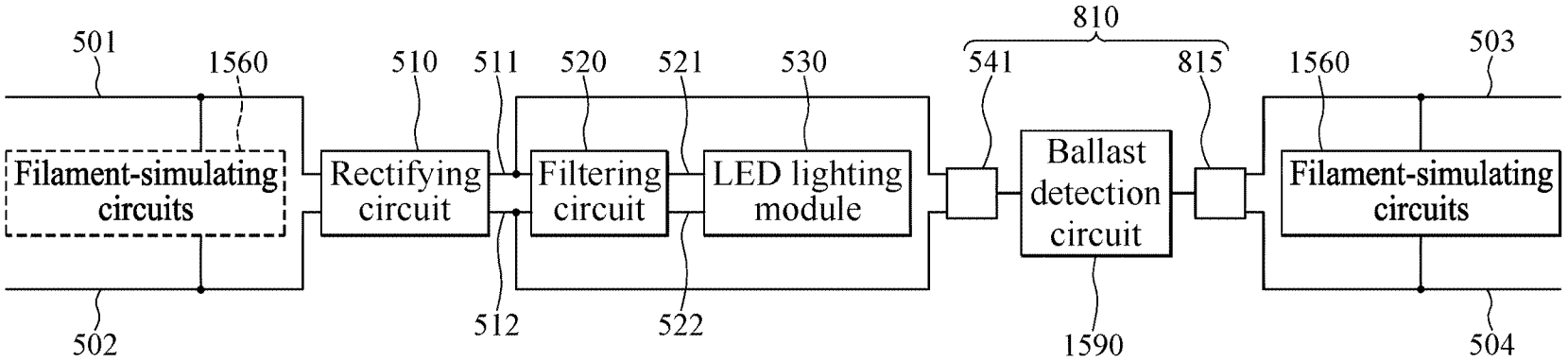

FIG. 61B is a block diagram of an LED tube lamp according to some embodiments. Compared to that shown in FIG. 61A, the rectifying circuit 810 shown in FIG. 50C replaces the rectifying circuit 540. The ballast detection circuit 1590 is coupled between the rectifying unit 815 and the terminal adapter circuit 541. One of the rectifying unit 815 and the terminal adapter circuit 541 is coupled to the pines 503 and 504, and the other one is coupled to the rectifying output terminal 511 and 512. In the present embodiment, the rectifying unit 815 is coupled to the pins 503 and 504, and the terminal adapter circuit 541 is coupled to the rectifying output terminal 511 and 512. Similarly, the ballast detection circuit 1590 detects the signal input through the pins 503 and 504 for determining the input signal whether provided by an electric ballast according to the frequency of the input signal.

In addition, the rectifying circuit 810 may replace the rectifying circuit 510 instead of the rectifying circuit 540, and the ballast detection circuit 1590 is coupled between the rectifying unit 815 and the terminal adapter circuit 541 in the rectifying circuit 510.

In an aspect of the present disclosure, the ballast detection circuit 1590 may comprise a detection circuit configured for determining whether the external driving signal is a high frequency signal according to the frequency of the external driving signal. When the external driving signal is a high frequency signal, the ballast detection circuit 1590 allows transmission of the external driving signal to the LED lighting module 530 through the detection circuit or a circuit external to or outside the ballast detection circuit 1590; and when the external driving signal is a low frequency signal the detection circuit allows transmission of the external driving signal to the LED lighting module 530 by bypassing the detection circuit or the external circuit.

In various embodiments, the external driving signal may be from or provided by an electrical ballast (e.g., an electronic ballast), an inductive ballast, an AC powerline, or a DC power source.

Figure 61D:
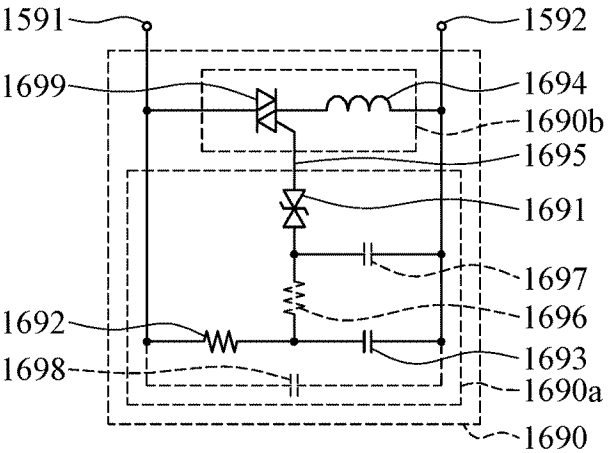
Figure 61C:
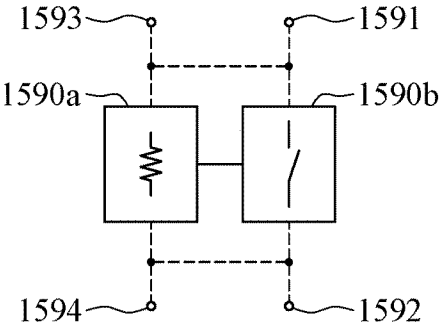

FIG. 61C is a block diagram of a ballast detection circuit according to some embodiments. In these embodiments, the ballast detection circuit 1590 comprises a detection circuit 1590*a* as the detection circuit configured for determining whether the external driving signal is a high frequency signal, and a switch circuit 1590*b*. The switch circuit 1590*b* is coupled to switch terminals 1591 and 1592. The switch terminals 1591 and 1592 can also be referred to as an input and an output terminals of the ballast detection circuit 1590. The detection circuit 1590*a* is coupled to the detection terminals 1593 and 1594 for detecting a signal transmitted through the detection terminals 1593 and 1594. Alternatively, the switch terminals 1591 and 1592 serves as the detection terminals and the detection terminals 1593 and 1594 are omitted. For example, in certain embodiments, the switch circuit 1590*b* and the detection circuit 1590*a* are commonly coupled to the switch terminals 1591 and 1592, and the detection circuit 1590*a* detects a signal transmitted through the switch terminals 1591 and 1592. Hence, the detection terminals 1593 and 1594 are depicted by dotted lines.

The switch circuit 1590*b* is connected to the detection circuit 1590*a* and is controlled by the detection circuit 1590*a*. When the external driving signal is a high frequency signal, the switch circuit 1590*b* is cutoff to allow transmission of the external driving signal through a circuit connected in parallel with the switch circuit 1590*b*, for example the detection circuit 1590*a*, or the external circuit outside the ballast detection circuit 1590, such as a circuit including capacitors 743 and 745 coupled in series between pins 501 and 503 shown in FIG. 51B. And when the external driving signal is a low frequency signal, the switch circuit 1590*b* is turned on to conduct current for transmission of the external driving signal bypassing the circuit connected in parallel with the switch circuit 1590*b*, or the external circuit.

When the LED lighting module 530 comprises the driving circuit 1530 and the LED module 630 as described in FIG. 57A, the switch circuit 1590*b* may be replaced by the mode switching circuit 580. That is, the ballast detection circuit 1590 may comprise the mode switching circuit 580 and the detection circuit 1590*a*. In these embodiments, the detection circuit 1590*a* may be configured to produce a control signal, according to the frequency of the external driving signal, to control the mode switching circuit 580 on whether to perform a first mode or a second mode of lighting operation. For example, when the mode switching circuit 580 performs the first mode of lighting operation, the driving circuit 1530 receives (a filtered version of) the rectified external driving signal and drives the LED module 630. And when the mode switching circuit 580 performs the second mode of lighting operation, transmission of the rectified external driving signal bypasses at least some components of the driving circuit 1530 in order to drive the LED module 630.

In some embodiments, the detection circuit 1590*a* of the ballast detection circuit 1590 may comprise a frequency determination circuit configured to control current conduction or cutoff of the switch circuit 1590*b* of the ballast detection circuit 1590 according to the frequency of the external driving signal. Such ballast detection circuit 1590 may be configured such that when the external driving signal is a high frequency signal, the switch circuit 1590*b* is cutoff, and when the external driving signal is a low frequency signal the switch circuit 1590*b* conducts current. As an example, FIG. 61D is a schematic diagram of a ballast detection circuit according to some embodiments. Referring to FIG. 61D, the ballast detection circuit 1690 comprises a detection circuit 1690*a* as the frequency determination circuit, and a switch circuit 1690*b* connected to the detection circuit 1690*a*, and is coupled between the switch terminals 1591 and 1592.

In FIG. 61D, the frequency determination circuit 1690*a* may include a capacitor 1698 coupled between the input and the output terminals 1591 and 1592 of the ballast detection circuit 1590. When the external driving signal is a high frequency signal, a low voltage produced by the capacitor 1698 causes the switch circuit 1690*b* to be cutoff. And when the external driving signal is a low frequency or DC signal, a high voltage produced by the capacitor 1698 causes the switch circuit 1690*b* to conduct current between the switch terminals 1591 and 1592.

More specifically, the detection circuit 1690*a* comprises a symmetrical trigger diode 1691, resistors 1692 and 1696 and capacitors 1693, 1697 and 1698. The switch circuit 1690*b* comprises a TRIAC 1699 and an inductor 1694.

The capacitor 1698 is coupled between the switch terminals 1591 and 1592 for generating a detection voltage in response to a signal (based on the received external driving signal) transmitted through the switch terminals 1591 and 1592. When the signal is a high frequency signal, the capacitive reactance of the capacitor 1698 is fairly low and so the detection voltage generated thereby is quite high. The resistor 1692 and the capacitor 1693 are connected in series and coupled between two ends of the capacitor 1698. The serially connected resistor 1692 and the capacitor 1693 are used to filter the detection signal generated by the capacitor 1698 and generate a filtered detection signal at a connection node thereof. The filter function of the resistor 1692 and the capacitor 1693 is used to filter high frequency noise in the detection signal for preventing the switch circuit 1690*b* from misoperation due to the high frequency noise. The resistor 1696 and the capacitor 1697 are connected in series and coupled between two ends of the capacitor 1693, and transmit the filtered detection signal to one end of the symmetrical trigger diode 1691. The serially connected resistor 1696 and capacitor 1697 performs second filtering of the filtered detection signal to enhance the filter effect of the detection circuit 1690*a*. Based on requirement for filtering level of different application, the capacitor 1697 may be omitted and the end of the symmetrical trigger diode 1691 is coupled to the connection node of the resistor 1692 and the capacitor 1693 through the resistor 1696. Alternatively, both of the resistor 1696 and the capacitor 1697 are omitted and the end of the symmetrical trigger diode 1691 is directly coupled to the connection node of the resistor 1692 and the capacitor 1693. Therefore, the resistor 1696 and the capacitor 1697 are depicted by dotted lines. The other end of the symmetrical trigger diode 1691 is coupled to a control end of the TRIAC 1699 of the switch circuit 1690*b*. The symmetrical trigger diode 1691 determines whether to generate a control signal 1695 to trigger the TRIAC 1699 on according to a level of a received signal. A first end of the TRIAC 1699 is coupled to the switch terminal 1591 and a second end thereof is coupled to the switch terminal through the inductor 1694. The inductor 1694 is used to protect the TRIAC 1699 from damage due to a situation where the signal transmitted into the switch terminals 1591 and 1592 is over a maximum rate of rise of Commutation Voltage, a peak repetitive forward (off-state) voltage or a maximum rate of change of current.

When the switch terminals 1591 and 1592 receive a low frequency signal or a DC signal, the detection signal generated by the capacitor 1698 is high enough to make the symmetrical trigger diode 1691 generate the control signal 1695 to trigger the TRIAC 1699 on to conduct current between the switch terminals 1591 and 1592. At this time, the switch terminals 1591 and 1592 are shorted to bypass the circuit(s) connected in parallel with the switch circuit 1690*b*, such as a circuit coupled between the switch terminals 1591 and 1592, the detection circuit 1690*a* and the capacitor 1698.

In some embodiments, when the switch terminals 1591 and 1592 receive a high frequency AC signal, the detection signal generated by the capacitor 1698 is not high enough to make the symmetrical trigger diode 1691 generate the control signal 1695 to trigger the TRIAC 1699 on. At this time, the TRIAC 1699 is cut off and so the high frequency AC signal is mainly transmitted through external circuit or the detection circuit 1690*a*.

Hence, the ballast detection circuit 1690 can determine whether the input signal is a high frequency AC signal provided by an electric ballast. If yes, the high frequency AC signal is transmitted through the external circuit or the detection circuit 1690*a*; if no, the input signal is transmitted through the switch circuit 1690*b*, bypassing the external circuit and the detection circuit 1690*a*.

In some embodiments, the capacitor 1698 may be replaced by external capacitor(s), such as at least one capacitor in the terminal adapter circuits shown in FIG. 51A-C. Therefore, the capacitor 1698 may be omitted and be therefore depicted by a dotted line.

Figure 61E:
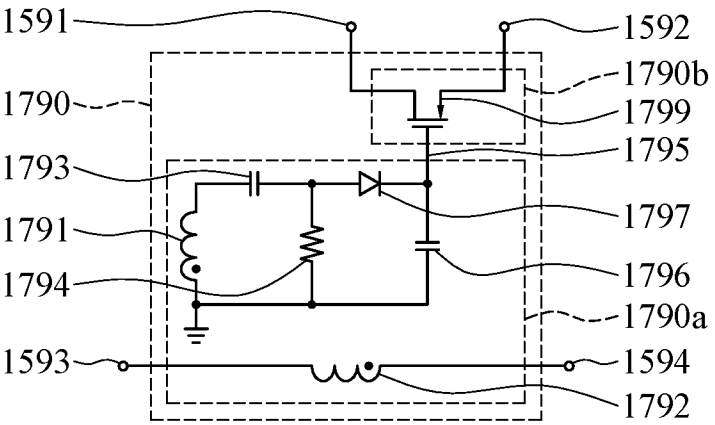

As another example, FIG. 61E is a schematic diagram of a ballast detection circuit according to some embodiments. Referring to FIG. 61E, the ballast detection circuit 1790 comprises a detection circuit 1790*a* as the frequency determination circuit, and a switch circuit 1790*b* connected to the detection circuit 1790*a*. The switch circuit 1790*b* is coupled between the switch or input terminals 1591 and 1592. The detection circuit 1790*a* is coupled between the detection terminals 1593 and 1594. In FIG. 61E, the frequency determination circuit 1790*a* may include two inductors 1791 and 1792 with or capable of mutual induction, which may be referred to as a first and a second inductors respectively. The inductor 1792 is coupled to the at least two of the external connection terminals 501, 502, 503, 504, and is configured to induce a detection voltage in the inductor 1791 by mutual induction based on a current flowing through the inductor 1792 upon the external driving signal being input to the LED tube lamp. When the external driving signal is a high frequency signal, a high level detection voltage produced by the inductor 1791 causes the switch circuit 1790*b* to be cutoff. And when the external driving signal is a low frequency or DC signal, a low detection voltage produced by the inductor 1791 causes the switch circuit 1790*b* to conduct current.

More specifically, the detection circuit 1790*a* comprises inductors 1791 and 1792, capacitor 1793 and 1796, a resistor 1794 and a diode 1797. The switch circuit 1790*b* comprises a switch 1799. In the present embodiment, the switch 1799 is a P-type Depletion Mode MOSFET, which is cut off when the gate voltage is higher than a threshold voltage and conducted when the gate voltage is lower than the threshold voltage.

The inductor 1792 is coupled between the detection terminals 1593 and 1594 and induces the detection voltage in the inductor 1791 based on a current signal flowing through the detection terminals 1593 and 1594. The level of the detection voltage is varied with the frequency of the current signal, and may be increased with the increasing of that frequency and reduced with the decreasing of that frequency.

In some embodiments, when the signal is a high frequency signal, the inductive reactance of the inductor 1792 is quite high and so the inductor 1791 induces the detection voltage with a quite high level. When the signal is a low frequency signal or a DC signal, the inductive reactance of the inductor 1792 is quite low and so the inductor 1791 induces the detection voltage with a quite high level. One end of the inductor 1791 is grounded. The serially connected capacitor 1793 and resistor 1794 is connected in parallel with the inductor 1791. The capacitor 1793 and resistor 1794 receive the detection voltage generated by the inductor 1791 and filter a high frequency component of the detection voltage to generate a filtered detection voltage. The filtered detection voltage charges the capacitor 1796 through the diode 1797 to generate a control signal 1795. Due to the diode 1797 providing a one-way charge for the capacitor 1796, the level of control signal generated by the capacitor 1796 is the maximum value of the detection voltage. The capacitor 1796 is coupled to the control end of the switch 1799. First and second ends of the switch 1799 are respectively coupled to the switch terminals 1591 and 1592.

When the signal received by the detection terminal 1593 and 1594 is a low frequency signal or a DC signal, the control signal 1795 generated by the capacitor 1796 is lower than the threshold voltage of the switch 1799 and so the switch 1799 are conducted. At this time, the switch terminals 1591 and 1592 are shorted to bypass the external circuit(s) connected in parallel with the switch circuit 1790*b*, such as the least one capacitor in the terminal adapter circuits show in FIG. 51A-c.

When the signal received by the detection terminal 1593 and 1594 is a high frequency signal, the control signal 1795 generated by the capacitor 1796 is higher than the threshold voltage of the switch 1799 and so the switch 1799 are cut off. At this time, the high frequency signal is transmitted by the external circuit(s).

Hence, the ballast detection circuit 1790 can determine whether the input signal is a high frequency AC signal provided by an electric ballast. If yes, the high frequency AC signal is transmitted through the external circuit(s); if no, the input signal is transmitted through the switch circuit 1790*b*, bypassing the external circuit.

Next, exemplary embodiments of the conduction (bypass) and cut off (not bypass) operations of the switch circuit in the ballast detection circuit of an LED lamp will be illustrated. For example, the switch terminals 1591 and 1592 are coupled to a capacitor connected in series with the LED lamp, e.g., a signal for driving the LED lamp also flows through the capacitor. The capacitor may be disposed inside the LED lamp to be connected in series with internal circuit(s) or outside the LED lamp to be connected in series with the LED lamp. Referring to FIG. 49A, 49B, or 49D, the AC power supply 508 provides a low voltage and low frequency AC driving signal as an external driving signal to drive the LED tube lamp 500 while the lamp driving circuit 505 does not exist. At this moment, the switch circuit of the ballast detection circuit is conducted, and so the alternative driving signal is provided to directly drive the internal circuits of the LED tube lamp 500. When the lamp driving circuit 505 exists, the lamp driving circuit 505 provides a high voltage and high frequency AC driving signal as an external driving signal to drive the LED tube lamp 500. At this moment, the switch circuit of the ballast detection circuit is cut off, and so the capacitor is connected in series with an equivalent capacitor of the internal circuit(s) of the LED tube lamp for forming a capacitive voltage divider network. Thereby, a division voltage applied in the internal circuit(s) of the LED tube lamp is lower than the high voltage and high frequency AC driving signal, e.g.: the division voltage is in a range of 100-270V, and so no over voltage causes the internal circuit(s) damage. Alternatively, the switch terminals 1591 and 1592 is coupled to the capacitor(s) of the terminal adapter circuit shown in FIG. 51A to FIG. 51C to have the signal flowing through the half-wave node as well as the capacitor(s), e.g., the capacitor 642 in FIG. 51A, or the capacitor 842 in FIG. 51C. When the high voltage and high frequency AC signal generated by the lamp driving circuit 505 is input, the switch circuit is cut off and so the capacitive voltage divider is performed; and when the low frequency AC signal of the commercial power or the direct current of battery is input, the switch circuit bypasses the capacitor(s).

In some embodiments, the switch circuit may have plural switch unit to have two or more switch terminal for being connected in parallel with plural capacitors, (e.g., the capacitors 645 and 645 in FIG. 51A, the capacitors 643, 645 and 646 in FIG. 51A, the capacitors 743 and 744 or/and the capacitors 745 and 746 in FIG. 50B, the capacitors 843 and 844 in FIG. 51C, the capacitors 845 and 846 in FIG. 51C, the capacitors 842, 843 and 844 in FIG. 51C, the capacitors 842, 845 and 846 in FIG. 51C, and the capacitors 842, 843, 844, 845 and 846 in FIG. 51C) for bypassing the plural capacitor.

As mentioned above, the ballast detection circuit of the present disclosure can be used in conjunction with the mode switching circuits shown in FIG. 57A-57I. The switch circuit of the ballast detection circuit is replaced with the mode switching circuit. The detection circuit of the ballast detection circuit is coupled to one of the pins 501, 502, 503 and 504 for detecting the signal input into the LED lamp through the pins 501, 502, 503 and 504. The detection circuit generates a control signal to control the mode switching circuit being at the first mode or the second mode according to whether the signal is a high frequency, low frequency or DC signal, i.e., the frequency of the signal.

For example, when the signal is a high frequency signal and higher than a defined mode switch frequency, such as the signal provided by the lamp driving circuit 505, the control signal generated by the detection circuit makes the mode switching circuit be at the second mode for directly inputting the filtered signal into the LED module. When the signal is a low frequency signal or a direct signal and lower than the defined mode switch frequency, such as the signal provided by the commercial power or the battery, the control signal generated by the detection circuit makes the mode switching circuit be at the first mode for directly inputting the filtered signal into the driving circuit.

As still another example, the detection circuit 1590*a* of the ballast detection circuit 1590 may comprise the frequency determination circuit 795 comprising resistor 792 and capacitor 791 connected in series shown in FIG. 57K, as the frequency determination circuit configured to control current conduction or cutoff of a switch circuit 1590*b* of the ballast detection circuit 1590 according to the frequency of the external driving signal. One terminal of the capacitor 791 can be coupled to the detection terminal 1593 (and optionally the switch terminal 1591), one terminal of the resistor 792 can be coupled to the detection terminal 1594 (and optionally the switch terminal 1592), and the other terminals of capacitor 791 and resistor 792 are connected together as a connection node. The frequency determination circuit 795 can be configured to generate a determination result at the connection node, according to the frequency of the external driving signal or a signal received at the detection terminals 1593 and 1594, to control current conduction or cutoff of the switch circuit 1590*b*. In addition, the determined result signal S580 generated at the connection node between capacitor 791 and resistor 792 can correspond to the control signal 1695 or 1795.

In some embodiments using the frequency determination circuit 795, the switch circuit 1590*b* is configured to be turned on to conduct current, or be cut off, according to a voltage level of the determined result signal S580, which level is determined according to the frequency of the external driving signal or a signal received at the detection terminals 1593 and 1594. For example, the higher the frequency of the external driving signal, the higher the voltage level of the determined result signal S580 (due to a lower total impedance between detection terminals 1593 and 1594), and the lower the frequency of the external driving signal, the lower the voltage level of the determined result signal S580 (due to a higher total impedance between detection terminals 1593 and 1594).

Hence, when the external driving signal is a high frequency signal (e.g., more than 20 kHz) or high voltage signal, the determined result signal S580 may be at a high voltage level to cause the switch circuit 1590*b* to be cut off, allowing transmission of the external driving signal to the LED lighting module 530 through the detection circuit or a circuit external to the ballast detection circuit 1590. And when the external driving signal is a low frequency signal, the determined result signal S580 may be at a low voltage level to turn on the switch circuit 1590*b*, allowing transmission of the external driving signal to the LED lighting module 530 by bypassing a circuit connected in parallel with the switch circuit 1590*b*, the detection circuit, or the external circuit.

Figure 62:
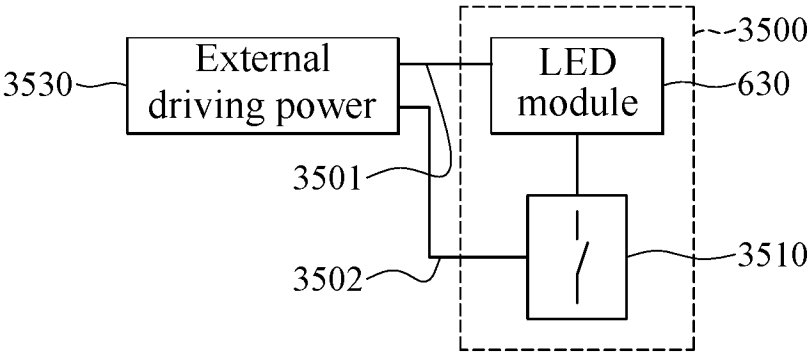

FIG. 62 is a block diagram of a power supply module in an LED tube lamp according to some embodiments. Compared to the above-mentioned embodiments, the circuits for driving the LED module is installed outside of the LED tube lamp. For example, the LED tube lamp 3500 is driven to emit light by an external driving power 3530 through external driving terminals 3501 and 3502. The LED tube lamp 3500 comprises the LED module 630 and a current control circuit 3510, and does not comprise the rectifying circuit, filtering circuit and the driving circuit. In the present embodiment, the external driving terminals 3501 and 3502 serve as the pins 501 and 502 shown in FIG. 49A and FIG. 49B.

The external driving power 3530 may be directly connected with the commercial power or the ballast for receiving power and converting into an external driving signal to input into the LED tube lamp 3500 through the external driving terminals 3501 and 3502. The external driving signal may be a DC signal, and may preferably be a stable DC current signal. Under a normal condition, the current control circuit 3510 conducts to have a current flowing through and driving the LED module 630 to emit light. The current control circuit 3510 may further detect the current of the LED module 630 for performing a steady current or voltage control, and have a function of ripple filter. Under an abnormal condition, the current control circuit 3510 is cut off to stop inputting the power of the external driving power 3530 into the LED module 630 and enters into a protection state.

When the current control circuit 3510 determines that the current of the LED module 630 is lower than a defined current or a minimum current of a defined current range, the current control circuit 3510 is completely conducted, i.e., the impedance of the current control circuit 3510 comes down a minimum value.

When the current control circuit 3510 determines that the current of the LED module 630 is higher than a defined current or a maximum current of a defined current range, the current control circuit 3510 is cutoff to stop inputting power into the LED tube lamp 3500. The maximum current of a defined current range is in some embodiments set at a value about 30% higher than a rated current of the LED module 630. Thereby, the current control circuit 3510 can keep the brightness of the LED lamp as much as possible when a driving capability of the external driving power 3530 is reduced. Furthermore, the current control circuit 3510 can prevent the LED module 630 from over current when the driving capability of the external driving power 3530 is abnormally increased. Hence, the current control circuit 3510 has a function of over-current protection.

In some embodiments, the external driving power 3530 may be a DC voltage signal. Under a normal condition, the current control circuit 3510 stabilizes the current of the LED module 630 or controls the current linearly, e.g., the current of the LED module 630 is varied linearly with a level of the DC voltage signal. For controlling the current of the LED module at a current value or linearly, a voltage cross the current control circuit 3510 is increased with the level of the DC voltage signal provided by the external driving power 3530 and a power consumption thereof is also increased. The current control circuit 3510 may have a temperature detector. When the level of the DC voltage signal provided by the external driving power 3530 is over a high threshold, the current control circuit 3510 enters into a state of over temperature protection to stop inputting power of the external driving power 3530 into the LED tube lamp 3500. For example, when the temperature detector detects the temperature of the current control circuit 3510 at 120° C., the current control circuit 3510 enters into the state of over temperature protection. Thereby, the current control circuit 3510 has both over temperature and over voltage protections.

The LED tube lamps according to various different embodiments are described as above. With respect to an entire LED tube lamp, the features including "having the structure-strengthened end region", "adopting the bendable circuit sheet as the LED light strip", "coating the adhesive film on the inner surface of the lamp tube", "coating the diffusion film on the inner surface of the lamp tube", "covering the diffusion film in form of a sheet above the LED light sources", "coating the reflective film on the inner surface of the lamp tube", "the end cap including the thermal conductive member", "the end cap including the magnetic metal member", "the LED light source being provided with the lead frame", and "utilizing the circuit board assembly to connect the LED light strip and the power supply" may be applied in practice singly or integrally such that only one of the features is practiced or a number of the features are simultaneously practiced.

Furthermore, any of the features "having the structure-strengthened end region", "adopting the bendable circuit sheet as the LED light strip", "coating the adhesive film on the inner surface of the lamp tube", "coating the diffusion film on the inner surface of the lamp tube", "covering the diffusion film in form of a sheet above the LED light sources", "coating the reflective film on the inner surface of the lamp tube", "the end cap including the thermal conductive member", "the end cap including the magnetic metal member", "the LED light source being provided with the lead frame", "utilizing the circuit board assembly (including a long circuit sheet and a short circuit board) to connect the LED light strip and the power supply", "a rectifying circuit", "a filtering circuit", "a driving circuit", "an anti-flickering circuit", "a protection circuit", "a mode switching circuit", "an overvoltage protection circuit", "a ballast detection circuit", "a ballast-compatible circuit", and "a filament-simulating circuit" may include any related technical points and their variations and any combination thereof as described in the abovementioned embodiments.

As an example, the feature "having the structure-strengthened end region" may include "the lamp tube includes a main body region, a plurality of rear end regions, and a transition region connecting the main body region and the rear end regions, wherein the two ends of the transition region are arc-shaped in a cross-section view along the axial direction of the lamp tube; the rear end regions are respectively sleeved with end caps; the outer diameter of at least one of the rear end regions is less than the outer diameter of the main body region; the end caps have same outer diameters as that of the main body region."

As an example, the feature "adopting the bendable circuit sheet as the LED light strip" may include "the connection between the bendable circuit sheet and the power supply is by way of wire bonding or soldering bonding; the bendable circuit sheet includes a wiring layer and a dielectric layer arranged in a stacked manner; the bendable circuit sheet has a circuit protective layer made of ink to reflect light and has widened part along the circumferential direction of the lamp tube to function as a reflective film."

As an example, the feature "coating the diffusion film on the inner surface of the lamp tube" may include "the composition of the diffusion film includes calcium carbonate, halogen calcium phosphate and aluminum oxide, or any combination thereof," and may further include "thickener and a ceramic activated carbon;" The diffusion film may be a sheet covering the LED light source.

As an example, the feature "coating the reflective film on the inner surface of the lamp tube" may include "the LED light sources are disposed above the reflective film, within an opening in the reflective film or beside the reflective film."

As an example, the feature "the end cap including the thermal conductive member" may include "the end cap includes an electrically insulating tube, the hot melt adhesive is partially or completely filled in the accommodation space between the inner surface of the thermal conductive member and the outer surface of the lamp tube." The feature "the end cap including the magnetic metal member" may include "the magnetic metal member is circular or non-circular, has openings or indentation/embossment to reduce the contact area between the inner peripheral surface of the electrically insulating tube and the outer surface of the magnetic metal member; has supporting portions and protruding portions to support the magnetic metal member or reduce the contact area between the electrically insulating tube and the magnetic metal member."

As an example, the feature "the LED light source being provided with the lead frame" may include "the lead frame has a recess for receive an LED chip, the recess is enclosed by first sidewalls and second sidewalls with the first sidewalls being lower than the second sidewalls, wherein the first sidewalls are arranged to locate along a length direction of the lamp tube while the second sidewalls are arranged to locate along a width direction of the lamp tube."

As an example, the feature "utilizing the circuit board assembly to connect the LED light strip and the power supply" may include "the circuit board assembly has a long circuit sheet and a short circuit board that are adhered to each other with the short circuit board being adjacent to the side edge of the long circuit sheet; the short circuit board is provided with a power supply module to form the power supply; the short circuit board is stiffer than the long circuit sheet."

The above-mentioned features can be accomplished in any combination to improve the LED tube lamp, and the above embodiments are described by way of example only. The present disclosure is not herein limited, and many variations are possible without departing from the spirit of the present disclosure and the scope as defined in the appended claims.

What is claimed is:

1. A light-emitting diode (LED) tube lamp, comprising:

a lamp tube;

at least two external connection terminals for the lamp tube, for receiving an external driving signal;

a rectifying circuit for rectifying the external driving signal to produce a rectified signal;

an LED lighting module comprising an LED module, for emitting light; and a ballast interface circuit coupled between the external connection terminals and the LED lighting module, and comprising a detection circuit configured to determine whether the external driving signal is a high frequency or high voltage signal according to the frequency or voltage level of the rectified signal, wherein the ballast interface circuit is configured such that when the external driving signal is determined to be a high frequency or high voltage signal, the ballast interface circuit causes current conduction in the LED module for emitting light; the ballast interface circuit further comprises an electronic switch coupled to the detection circuit, and the detection circuit comprises a voltage detection circuit coupled to the electronic switch; and the voltage detection circuit is configured to determine whether the external driving signal is a high frequency or high voltage signal according to the voltage level of the rectified signal, in order to control current conduction or cutoff of the electronic switch, wherein the current conduction causes current conduction in the LED module and the cutoff causes an open circuit for the LED module.

2. A light-emitting diode (LED) tube lamp, comprising:

a lamp tube;

at least two external connection terminals for the lamp tube, for receiving an external driving signal;

a rectifying circuit for rectifying the external driving signal to produce a rectified signal; an LED lighting module comprising an LED module, for emitting light; and a ballast interface circuit coupled between the external connection terminals and the LED lighting module, and comprising a detection circuit configured to determine whether the external driving signal is a high frequency or high voltage signal according to the frequency or voltage level of the rectified signal, wherein the ballast interface circuit is configured such that when the external driving signal is determined to be a high frequency or high voltage signal, the ballast interface circuit causes current conduction in the LED module for emitting light;

wherein the ballast interface circuit further comprises an electronic switch coupled to the detection circuit, and the detection circuit comprises a frequency determination circuit coupled to the electronic switch; and wherein the frequency determination circuit is configured to determine whether the external driving signal is a high frequency or high voltage signal according to the frequency of the rectified signal, in order to control current conduction or cutoff of the electronic switch, wherein the current conduction causes current conduction in the LED module and the cutoff causes an open circuit for the LED module.

3. A light-emitting diode (LED) tube lamp, comprising:

a lamp tube;

at least two external connection terminals for the lamp tube, for receiving an external driving signal;

a rectifying circuit for rectifying the external driving signal to produce a rectified signal; an LED lighting module comprising an LED module, for emitting light; and a ballast interface circuit coupled between the external connection terminals and the LED lighting module, and comprising a detection circuit configured to determine whether the external driving signal is a high frequency or high voltage signal according to the frequency or voltage level of the rectified signal, wherein the ballast interface circuit is configured such that when the external driving signal is determined to be a high frequency or high voltage signal, the ballast interface circuit causes current conduction in the LED module for emitting light;

wherein the ballast interface circuit further comprises a circuit branch coupled to the detection circuit, and the detection circuit comprises a control circuit and an electronic switch; and wherein the circuit branch is configured to detect the voltage level of the rectified signal and then generate a detection signal; and the control circuit is configured to determine whether the external driving signal is a high frequency or high voltage signal according to the detection signal, and to control current conduction or cutoff of the electronic switch, wherein the current conduction causes current conduction in the LED module and the cutoff causes an open circuit for the LED module.

4. A light-emitting diode (LED) tube lamp, comprising:

a lamp tube;

at least two external connection terminals for the lamp tube, for receiving an external driving signal;

a rectifying circuit for rectifying the external driving signal to produce a rectified signal;

an LED lighting module comprising an LED module, for emitting light; and a ballast interface circuit coupled between the external connection terminals and the LED lighting module, and comprising a detection circuit configured to determine whether the external driving signal is a high frequency or high voltage signal according to the frequency or voltage level of the rectified signal, wherein the ballast interface circuit is configured such that when the external driving signal is determined to be a high frequency or high voltage signal, the ballast interface circuit causes current conduction in the LED module for emitting light;

wherein the detection circuit comprises a thyristor, which is configured to conduct current or be cutoff depending on the voltage level of the rectified signal; and wherein when the external driving signal is a high frequency or high voltage signal, the thyristor conducts current after a predefined delay of time upon the external driving signal being input to the LED tube lamp.

5. A light-emitting diode (LED) tube lamp, comprising:

a lamp tube;

at least two external connection terminals for the lamp tube, for receiving an external driving signal;

a rectifying circuit for rectifying the external driving signal to produce a rectified signal; an LED lighting module comprising an LED module, for emitting light; and a ballast interface circuit coupled between the external connection terminals and the LED lighting module, and comprising a detection circuit configured to determine whether the external driving signal is a high frequency or high voltage signal according to the frequency or voltage level of the rectified signal, wherein the ballast interface circuit is configured such that when the external driving signal is determined to be a high frequency or high voltage signal, the ballast interface circuit causes current conduction in the LED module for emitting light;

wherein the detection circuit determines that the external driving signal is a high frequency or high voltage signal when determining that the voltage level of the rectified signal is higher than a predefined first threshold level;

wherein the ballast interface circuit causes an open circuit for the LED module when the detection circuit determines that the voltage level of the rectified signal is higher than a predefined second threshold level but lower than the predefined first threshold level, wherein the predefined first threshold level is higher than the predefined second threshold level; and wherein the ballast interface circuit causes current conduction in the LED module when the detection circuit determines that the voltage level of the rectified signal is lower than the predefined second threshold level.

6. A light-emitting diode (LED) tube lamp, comprising:

a lamp tube;

at least two external connection terminals for the lamp tube, for receiving an external driving signal;

a rectifying circuit for rectifying the external driving signal to produce a rectified signal;

an LED lighting module comprising an LED module, for emitting light; and a ballast interface circuit coupled between the external connection terminals and the LED lighting module, and comprising a detection circuit configured to determine whether the external driving signal is a high frequency or high voltage signal according to the frequency or voltage level of the rectified signal, wherein the ballast interface circuit is configured such that when the external driving signal is determined to be a high frequency or high voltage signal, the ballast interface circuit causes current conduction in the LED module for emitting light;

wherein the detection circuit comprises a thyristor device coupled between the rectifying circuit and the LED module; and wherein when the external driving signal is determined to be a high frequency or high voltage signal, the thyristor device is configured to conduct current after a predefined delay of time upon the external driving signal being input to the LED tube lamp.

7. A light-emitting diode (LED) tube lamp, comprising:

a lamp tube;

at least two external connection terminals for the lamp tube, for receiving an external driving signal;

a rectifying circuit for rectifying the external driving signal to produce a rectified signal; an LED lighting module comprising an LED module, for emitting light;

a ballast interface circuit coupled between the external connection terminals and the LED lighting module, and comprising a detection circuit configured to determine whether the external driving signal is a high frequency or high voltage signal according to the frequency or voltage level of the rectified signal, wherein the ballast interface circuit is configured such that when the external driving signal is determined to be a high frequency or high voltage signal, the ballast interface circuit causes current conduction in the LED module for emitting light;

a filtering circuit; and an over voltage protection circuit, wherein the filtering circuit is coupled to the rectifying circuit to filter the rectified signal to produce a filtered signal, and two output terminals of the filtering circuit are respectively coupled to an anode and a cathode of the LED module; and wherein the over voltage protection circuit comprises a resistor and a switch connected in series between the two output terminals of the filtering circuit, wherein the switch is configured to conduct current or be cutoff according to a voltage level of the filtered signal.

8. An LED tube lamp, comprising:

a lamp tube;

at least two external connection terminals for the lamp tube, for receiving an external driving signal;

a rectifying circuit for rectifying the external driving signal to produce a rectified signal;

an LED lighting module comprising an LED module, for emitting light; and a ballast detection circuit coupled to the rectifying circuit and comprising a detection circuit configured to determine whether the external driving signal is a high frequency signal according to the frequency of the external driving signal, wherein the ballast detection circuit is configured such that when the external driving signal is determined to be a high frequency signal, the ballast detection circuit allows transmission of the external driving signal to the LED lighting module through the detection circuit or a circuit external to the ballast detection circuit; and when the external driving signal is determined to be a low frequency signal the ballast detection circuit allows transmission of the external driving signal to the LED lighting module by bypassing the detection circuit; the ballast detection circuit further comprises a switch circuit connected to the detection circuit and controlled by the detection circuit; and wherein, when the external driving signal is determined to be a high frequency signal, the switch circuit is configured to be cutoff to allow transmission of the external driving signal through a circuit connected in parallel with the switch circuit, or through the external circuit; and when the external driving signal is determined to be a low frequency signal, the switch circuit is configured to conduct current for transmission of the external driving signal bypassing the circuit connected in parallel with the switch circuit.

9. An LED tube lamp, comprising:

a lamp tube;

at least two external connection terminals for the lamp tube, for receiving an external driving signal;

a rectifying circuit for rectifying the external driving signal to produce a rectified signal; an LED lighting module comprising an LED module, for emitting light; and a ballast detection circuit coupled to the rectifying circuit and comprising a detection circuit configured to determine whether the external driving signal is a high frequency signal according to the frequency of the external driving signal, wherein the ballast detection circuit is configured such that when the external driving signal is determined to be a high frequency signal, the ballast detection circuit allows transmission of the external driving signal to the LED lighting module through the detection circuit or a circuit external to the ballast detection circuit; and when the external driving signal is determined to be a low frequency signal the ballast detection circuit allows transmission of the external driving signal to the LED lighting module by bypassing the detection circuit or the external circuit;

wherein the LED lighting module further comprises a driving circuit for driving the LED module, the ballast detection circuit further comprises a mode switching circuit, and the detection circuit is configured to produce a control signal, according to the frequency of the external driving signal, to control the mode switching circuit on whether to perform a first mode or a second mode of lighting operation; when the mode switching circuit performs the first mode of lighting operation, the driving circuit receives the rectified signal and drives the LED module; and when the mode switching circuit performs the second mode of lighting operation, transmission of the rectified signal bypasses at least some components of the driving circuit in order to drive the LED module.

10. An LED tube lamp, comprising:

a lamp tube;

at least two external connection terminals for the lamp tube, for receiving an external driving signal;

a rectifying circuit for rectifying the external driving signal to produce a rectified signal;

an LED lighting module comprising an LED module, for emitting light; and a ballast detection circuit coupled to the rectifying circuit and comprising a detection circuit configured to determine whether the external driving signal is a high frequency signal according to the frequency of the external driving signal, wherein the ballast detection circuit is configured such that when the external driving signal is determined to be in a first frequency range, the ballast detection circuit allows transmission of the external driving signal to the LED lighting module through the detection circuit or a circuit external to the ballast detection circuit; and when the external driving signal is determined to be in a second frequency range the ballast detection circuit allows transmission of the external driving signal to the LED lighting module by bypassing the detection circuit or the external circuit;

wherein the detection circuit comprises a frequency determination circuit, the ballast detection circuit further comprises a switch circuit connected to the detection circuit, and the frequency determination circuit is configured to control current conduction or cutoff of the switch circuit according to the frequency of the external driving signal; and when the external driving signal is determined to be in a first frequency range, the switch circuit is cutoff, and when the external driving signal is determined to be in a second frequency range, the switch circuit conducts current.

11. An LED tube lamp, comprising:

a lamp tube;

at least two external connection terminals for the lamp tube, for receiving an external driving signal;

a rectifying circuit for rectifying the external driving signal to produce a rectified signal; an LED lighting module comprising an LED module, for emitting light;

a ballast detection circuit coupled to the rectifying circuit and comprising a detection circuit configured to determine whether the external driving signal is a high frequency signal according to the frequency of the external driving signal, wherein the ballast detection circuit is configured such that when the external driving signal is determined to be a high frequency signal, the ballast detection circuit allows transmission of the external driving signal to the LED lighting module through the detection circuit or a circuit external to the ballast detection circuit; and when the external driving signal is determined to be a low frequency signal the ballast detection circuit allows transmission of the external driving signal to the LED lighting module by bypassing the detection circuit or the external circuit; and a light strip and a circuit board, wherein the light strip is disposed in the lamp tube, the circuit board is contained in an end cap at an end of the lamp tube, and the light strip or the circuit board includes two soldering points; a chip capacitor of the LED tube lamp is disposed on the light strip or the circuit board and is connected to the two soldering points; and a hole or groove is disposed below the chip capacitor, between the two soldering points, and in the light strip or the circuit board.

12. An LED tube lamp, comprising:

a lamp tube;

at least two external connection terminals, for receiving an external driving signal from outside the LED tube lamp;

a rectifying circuit for rectifying the external driving signal to produce a rectified signal; an LED lighting module comprising a driving circuit and an LED module for emitting light, the driving circuit for driving the LED module;

a mode determination circuit coupled to the driving circuit and configured to determine whether the external driving signal is a high frequency or high voltage signal according to the frequency or voltage level of the rectified signal, wherein the mode determination circuit is configured such that when the external driving signal is determined to be a high frequency or high voltage signal, the mode determination circuit allows transmission of the rectified signal to the LED module by bypassing at least some components of the driving circuit; and when the external driving signal is determined to be a low frequency or low voltage signal, the mode determination circuit allows the driving circuit to receive the rectified signal and drive the LED module; and a mode switching circuit coupled to the mode determination circuit and the driving circuit, and the mode determination circuit comprises a voltage determination circuit configured to control, according to the voltage level of the external driving signal, the mode switching circuit on whether to perform a first mode of lighting operation or a second mode of lighting operation;

wherein, when the mode switching circuit performs the first mode of lighting operation, the driving circuit receives the rectified signal and drives the LED module; and when the mode switching circuit performs the second mode of lighting operation, transmission of the rectified signal bypasses at least some components of the driving circuit in order to drive the LED module; and wherein the voltage determination circuit comprises a symmetrical trigger diode coupled to a resistor, and the symmetrical trigger diode is configured to receive the rectified signal to generate a determination result signal at a connection node between the symmetrical trigger diode and the resistor.

13. An LED tube lamp, comprising:

a lamp tube;

at least two external connection terminals, for receiving an external driving signal from outside the LED tube lamp;

a rectifying circuit for rectifying the external driving signal to produce a rectified signal; an LED lighting module comprising a driving circuit and an LED module for emitting light, the driving circuit for driving the LED module;

a mode determination circuit coupled to the driving circuit and configured to determine whether the external driving signal is a high frequency or high voltage signal according to the frequency or voltage level of the rectified signal, wherein the mode determination circuit is configured such that when the external driving signal is determined to be a high frequency or high voltage signal, the mode determination circuit allows transmission of the rectified signal to the LED module by bypassing at least some components of the driving circuit; and when the external driving signal is determined to be a low frequency or low voltage signal, the mode determination circuit allows the driving circuit to receive the rectified signal and drive the LED module; and a light strip and a circuit board, wherein the light strip is disposed in the lamp tube, the circuit board is contained in an end cap at an end of the lamp tube, and the light strip or the circuit board includes two soldering points; a chip capacitor of the LED tube lamp is disposed on the light strip or the circuit board and is connected to the two soldering points; and a hole or groove is disposed below the chip capacitor, between the two soldering points, and in the light strip or the circuit board.

14. The LED tube lamp of claim 6, wherein the external driving signal is initially input as a low voltage signal, and after a delay of time the external driving signal changes into a high frequency or high voltage signal from the low voltage signal.

15. The LED tube lamp of claim 5, wherein when the external driving signal is from an inductive ballast, the voltage level of the rectified signal is lower than the predefined second threshold level.

16. The LED tube lamp of claim 6, further comprising a current-limiting element coupled between at least one of the external connection terminals disposed at one end of the lamp tube and at least one of the external connection terminals disposed at the other end of the lamp tube, and coupled to the rectifying circuit and configured to receive the external driving signal.

17. The LED tube lamp of claim 6, wherein the ballast interface circuit further comprises a transistor, an inductor, and a resistor; the inductor is coupled between a first terminal of the thyristor device, and the LED module; the transistor has a collector connected to the LED module and the inductor, an emitter connected to the rectifying circuit, and a base connected to a second terminal of the thyristor device and the resistor; and upon the thyristor device being turned on a current flowing through the inductor and the transistor maintains the conduction state of the thyristor device.

18. The LED tube lamp of claim 6, further comprising a light strip and a circuit board, wherein the light strip is disposed in the lamp tube, the circuit board is contained in an end cap at an end of the lamp tube, and the light strip or the circuit board includes two soldering points; and wherein, a chip capacitor of the LED tube lamp is disposed on the light strip or the circuit board and is connected to the two soldering points; and a hole or groove is disposed below the chip capacitor, between the two soldering points, and in the light strip or the circuit board.

19. The LED tube lamp of claim 6, wherein the external driving signal is from an electronic ballast, an inductive ballast, an AC powerline, or a DC power source.

20. The LED tube lamp of claim 10, wherein the frequency determination circuit comprises a capacitor coupled between an input and an output terminal of the ballast detection circuit; when the external driving signal is determined to be in the first frequency range, a low voltage produced by the capacitor causes the switch circuit to be cutoff; and when the external driving signal is determined to be in the second frequency range, a high voltage produced by the capacitor causes the switch circuit to conduct current.

21. The LED tube lamp of claim 10, wherein the frequency determination circuit comprises a first inductor and a second inductor; the first inductor is coupled to the at least two external connection terminals, and is configured to induce a detection voltage in the second inductor by mutual induction based on a current through the first inductor upon the external driving signal being input to the LED tube lamp; when the external driving signal is determined to be in the first frequency range, a high level detection voltage produced by the second inductor causes the switch circuit to be cutoff; and when the external driving signal is determined to be in the second frequency range, a low detection voltage produced by the second inductor causes the switch circuit to conduct current.

22. The LED tube lamp of claim 8, further comprising a current-limiting element coupled between at least one of the external connection terminals disposed at one end of the lamp tube and at least one of the external connection terminals disposed at the other end of the lamp tube, and coupled to the rectifying circuit and configured to receive the external driving signal.

23. The LED tube lamp of claim 8, wherein the external driving signal is from an electronic ballast, an inductive ballast, an AC powerline, or a DC power source.

24. The LED tube lamp of claim 8, wherein the high frequency signal has a frequency in a range between about 20 kHz and about 50 kHz.

25. The LED tube lamp of claim 12, further comprising a current-limiting element coupled between at least one of the external connection terminals disposed at one end of the lamp tube and at least one of the external connection terminals disposed at the other end of the lamp tube, and coupled to the rectifying circuit and configured to receive the external driving signal.

26. The LED tube lamp of claim 12, wherein the external driving signal is from an electronic ballast, an inductive ballast, an AC powerline, or a DC power source.

27. The LED tube lamp of claim 12, wherein the high frequency signal has a frequency in a range between about 20 kHz and about 50 kHz.

28. The LED tube lamp of claim 9, further comprising a filtering circuit coupled to the rectifying circuit to filter the rectified signal to produce a filtered signal, and coupled to the LED lighting module, wherein the driving circuit is coupled to the ballast detection circuit and the LED module; the driving circuit includes a controller, a switching circuit, and an energy storage circuit coupled to the switching circuit; and the controller is configured to determine when to turn the switching circuit on or off according to a detection signal.

29. The LED tube lamp according to claim 28, wherein when the external driving signal is a low frequency or DC signal, the detection circuit is configured to cause the mode switching circuit to perform the first mode of lighting operation for inputting the filtered signal into the driving circuit, allowing the controller to turn on the switching circuit to supply current to the LED module for emitting light.

30. The LED tube lamp according to claim 28, wherein when the external driving signal is a high frequency signal, the detection circuit is configured to cause the mode switching circuit to perform the second mode of lighting operation for directly inputting the filtered signal into the LED module for emitting light.

31. The LED tube lamp according to claim 28, further comprising a capacitive filter coupled between the driving circuit and the LED module, to stabilize a voltage on the LED module; wherein the capacitive filter is coupled to the energy storage circuit and the mode switching circuit.

32. The LED tube lamp of claim 8, wherein the low frequency signal comprises a DC signal.

33. The LED tube lamp of claim 10, wherein the second frequency range includes a DC frequency.

34. The LED tube lamp of claim 4, wherein the external driving signal is from an electronic ballast, an inductive ballast, an AC powerline, or a DC power source.

35. The LED tube lamp of claim 10, wherein the external driving signal is from an electronic ballast, an inductive ballast, an AC powerline, or a DC power source.

36. The LED tube lamp of claim 1, wherein the LED module comprises an LED unit, and the LED tube lamp further comprises an inductor connected in series with the LED unit and configured to suppress electrical noise on the LED unit.

37. The LED tube lamp of claim 4, wherein the LED module comprises an LED unit, and the LED tube lamp further comprises an inductor connected in series with the LED unit and configured to suppress electrical noise on the LED unit.

38. The LED tube lamp of claim 6, wherein the LED module comprises an LED unit, and the LED tube lamp further comprises an inductor connected in series with the LED unit and configured to suppress electrical noise on the LED unit.

39. The LED tube lamp of claim 4, wherein the LED module is disposed on a light strip of the LED tube lamp; the light strip comprises a first conductive layer, a dielectric layer, and a second conductive layer or a circuit protective layer; and the dielectric layer is disposed between the first conductive layer, and the second conductive layer or the circuit protective layer.

40. The LED tube lamp of claim 6, wherein the LED module is disposed on a light strip of the LED tube lamp; the light strip comprises a first conductive layer, a dielectric layer, and a second conductive layer or a circuit protective layer; and the dielectric layer is disposed between the first conductive layer, and the second conductive layer or the circuit protective layer.

41. The LED tube lamp of claim 8, wherein the LED module is disposed on a light strip of the LED tube lamp; the light strip comprises a first conductive layer, a dielectric layer, and a second conductive layer or a circuit protective layer; and the dielectric layer is disposed between the first conductive layer, and the second conductive layer or the circuit protective layer.

42. The LED tube lamp of claim 10, wherein the LED module is disposed on a light strip of the LED tube lamp; the light strip comprises a first conductive layer, a dielectric layer, and a second conductive layer or a circuit protective layer; and the dielectric layer is disposed between the first conductive layer, and the second conductive layer or the circuit protective layer.

* * * * *